US011685578B2

(12) United States Patent
Harris

(10) Patent No.: US 11,685,578 B2
(45) Date of Patent: Jun. 27, 2023

(54) CONTAINER LID

(71) Applicant: Joel Harris, Toronto (CA)

(72) Inventor: Joel Harris, Toronto (CA)

( * ) Notice: Subject to any disclaimer, the term of this patent is extended or adjusted under 35 U.S.C. 154(b) by 0 days.

(21) Appl. No.: 17/376,055

(22) Filed: Jul. 14, 2021

(65) Prior Publication Data

US 2023/0018909 A1 Jan. 19, 2023

(51) Int. Cl.
*B65D 51/18* (2006.01)
*B65D 43/02* (2006.01)

(52) U.S. Cl.
CPC ..... *B65D 51/18* (2013.01); *B65D 43/0212* (2013.01); *B65D 2251/0021* (2013.01); *B65D 2251/0081* (2013.01); *B65D 2543/00046* (2013.01); *B65D 2543/00092* (2013.01); *B65D 2543/00231* (2013.01); *B65D 2543/00296* (2013.01); *B65D 2543/00527* (2013.01); *B65D 2543/00537* (2013.01); *B65D 2543/00638* (2013.01); *B65D 2543/00685* (2013.01)

(58) Field of Classification Search
CPC ..... B65D 51/18; B65D 43/0212; B65D 2251/0021; B65D 2251/0081; B65D 2543/00046; B65D 2543/00092; B65D 2543/00231; B65D 2543/00296; B65D 2543/00527; B65D 2543/00537; B65D 2543/00638; B65D 2543/00685
USPC ..... 220/254.3
See application file for complete search history.

(56) References Cited

U.S. PATENT DOCUMENTS 1,002,333 A * 9/1911 Stollberg ..... B65D 25/54 220/592.2
1,448,316 A * 3/1923 Shackitt ..... B65F 1/1607 220/640
3,090,542 A 5/1963 Miller
3,417,897 A 12/1968 Johnson
3,710,419 A 1/1973 De Groft
3,994,411 A 11/1976 Elfelt et al.
4,206,854 A 6/1980 Takami
4,322,015 A 3/1982 Bailey
4,602,557 A 7/1986 Yip
4,717,050 A * 1/1988 Wright ..... B65D 47/0885 220/259.2

(Continued)

FOREIGN PATENT DOCUMENTS

AT 518459 A1 * 10/2017 ..... B65D 19/44
JP 2004155467 A 11/2002

*Primary Examiner* — Jennifer Robertson
*Assistant Examiner* — Eric C Baldrighi

(57) ABSTRACT

A two part container lid for a container including a separately moulded brim mount part with a hatch opening in a top portion, reversibly clamped onto an rolled rim of the container and a separately moulded hatch cover part, sized and shaped to reversibly fit over the hatch opening. The hatch cover part is coupled to the top wall of the brim mount part by a detachable hinge thus pivoting the hatch cover part over the hatch opening between a fully closed position and a fully opened position and any intermediate position therein, thereby providing access to the beverage within the container without removing the two part container lid from the container. Detaching the hatch cover part from the brim mount part converts the two part container lid into a hybrid lid covering partially covering the container while permitting access to the contents within the container through the hatch opening.

16 Claims, 60 Drawing Sheets

(56) References Cited

U.S. PATENT DOCUMENTS

| | | | |
|---|---|---|---|
| 4,738,373 | A | 4/1988 | DeParales |
| 5,076,460 | A | 12/1991 | Hussell |
| 5,398,843 | A | 3/1995 | Warden et al. |
| 5,745,952 | A | 5/1998 | Baragar et al. |
| 6,095,033 | A | 8/2000 | Melton |
| 6,202,542 | B1 | 3/2001 | Melton |
| 6,889,859 | B1 | 5/2005 | Leon |
| 6,955,289 | B2 | 10/2005 | Green |
| 7,175,042 | B2 | 2/2007 | Durdon |
| 7,185,781 | B2 | 3/2007 | Pitts |
| 7,246,716 | B2 | 7/2007 | Durdon |
| 8,074,564 | B2 | 12/2011 | Kowlessar |
| 8,336,732 | B1 | 12/2012 | Tobias |
| 8,701,930 | B2 | 4/2014 | Mithal et al. |
| 8,794,479 | B2 | 8/2014 | Lin |
| 9,327,881 | B1 | 5/2016 | Saranga |
| 9,409,685 | B2 | 8/2016 | Luis |
| 9,538,873 | B2 | 1/2017 | Gardeski |
| 9,725,214 | B2 | 8/2017 | Crosby |
| 10,604,308 | B2 | 3/2020 | Harris |
| 10,710,779 | B2 | 7/2020 | Harris |
| 2005/0092749 | A1 | 3/2005 | Durdon |
| 2005/0145638 | A1 | 7/2005 | Van Handel et al. |
| 2006/0144340 | A1 | 7/2006 | Burge et al. |
| 2007/0068948 | A1 | 3/2007 | Friedman |
| 2010/0295328 | A1 | 11/2010 | Fiorino |
| 2012/0201941 | A1 | 8/2012 | Lavoie |
| 2012/0298667 | A1 | 11/2012 | Anthony |
| 2013/0256307 | A1 | 10/2013 | Hewitt |
| 2015/0053090 | A1 | 2/2015 | Berger |
| 2015/0069064 | A1 | 3/2015 | Johnson |
| 2015/0144628 | A1 | 5/2015 | Piper |
| 2015/0289693 | A1 | 10/2015 | Losee |
| 2015/0360829 | A1 | 12/2015 | Davis et al. |
| 2016/0229597 | A1 | 8/2016 | Polt |
| 2017/0112312 | A1 | 4/2017 | Gardeski |
| 2017/0253398 | A1 | 9/2017 | Shapiro |
| 2018/0290799 | A1 | 10/2018 | Sedwick et al. |
| 2019/0308779 | A1* | 10/2019 | Harris ..... A47G 19/2272 |

* cited by examiner

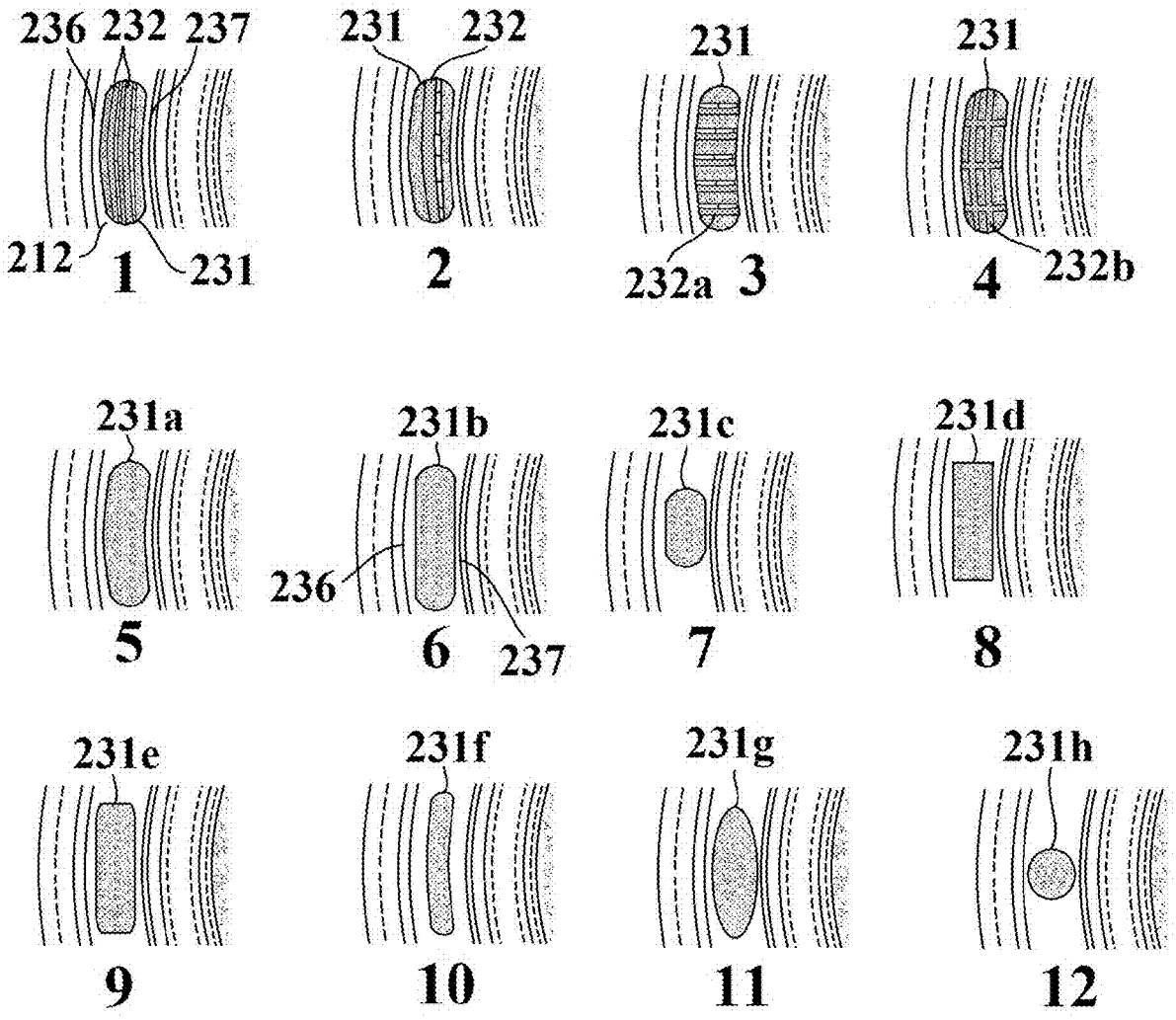
FIG. 6A1-12

CONTAINER LID

FEDERALLY SPONSORED RESEARCH

N/A

U.S. CL.: D07/392.1

D07 Equipment for preparing or serving food or drink not elsewhere specified

387 . . . element or attachment

391 . . . Utensil cover 392.1 . . . For china, glassware or serving vessel

B65D43/164 Non-removable lids or covers hinged for upward or downward movement, the container and the lid being made separately and connected by interfitting hinge elements integrally with the container and the lid formed respectively;

B65D2251/1025 Integral locking elements penetrating in an opening, e.g. a flap through a slit, a hook in an opening;

B65D2251/1033 Protuberances and cavities provided on a horizontal flange respectively of the container or base and the closure, and penetrating one into the other, e.g. of the press-button type;

Y10T16/5357 Resiliently biassed retaining means.

NOTICE OF COPYRIGHT

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, as long as proper credit is listed, otherwise the author reserves all (copyright or mask work) rights whatsoever.

BACKGROUND

The following is a tabulation of some prior art that presently appears relevant:

U.S. patents

| Cite No. | U.S. Pat. No. | Kind Code | Issue Date | Patentee |
|---|---|---|---|---|
| 1 | 10,710,779 | B2 | Jul. 14, 2020 | Harris |
| 2 | 10,604,308 | B2 | Mar. 31, 2020 | Harris |
| 3 | 9,725,214 | B2 | Aug. 8, 2017 | Crosby |
| 4 | 9,538,873 | B2 | Jan. 10, 2017 | Gardeski |
| 5 | 9,409,685 | B2 | Aug. 9, 2016 | Luis |
| 6 | 9,327,881 | B1 | May 3, 2016 | Saranga |
| 7 | 8,794,479 | B2 | Aug. 5, 2014 | Lin |
| 8 | 8,701,930 | B2 | Apr. 22, 2014 | Mithal et al. |
| 9 | 8,336,732 | B1 | Dec. 25, 2012 | Tobias |
| 10 | 8,074,564 | B2 | Dec. 13, 2011 | Kowlessar |
| 11 | 7,246,716 | B2 | Jul. 24, 2007 | Durdon |
| 12 | 7,175,042 | B2 | Feb. 13, 2007 | Durdon (DA) |
| 13 | 7,185,781 | B2 | Mar. 6, 2007 | Pitts |
| 14 | 6,955,289 | B2 | Oct. 18, 2005 | Green |
| 15 | 6,889,859 | B1 | May 10, 2005 | Leon |
| 16 | 6,202,542 | B1 | Mar. 20, 2001 | Melton |
| 17 | 6,095,033 | A | Aug. 1, 2000 | Melton |
| 18 | 5,745,952 | | May 5, 1998 | Baragar et al. |
| 19 | 5,076,460 | | Dec. 31, 1991 | Hussell |
| 20 | 5,398,843 | | Mar. 21, 1995 | Warden et al. |
| 21 | 4,738,373 | | Apr. 19, 1988 | DeParales |
| 22 | 4,602,557 | | Jul. 29, 1986 | Yip |
| 23 | 4,322,015 | | Mar. 30, 1982 | Bailey |
| 24 | 4,206,854 | | Jun. 10, 1980 | Takami |
| 25 | 3,994,411 | A | Nov. 11, 1976 | Elfelt et al. |
| 26 | 3,710,419 | | Jan. 16, 1973 | De Groft |

-continued

U.S. patents

| Cite No. | U.S. Pat. No. | Kind Code | Issue Date | Patentee |
|---|---|---|---|---|
| 27 | 3,417,897 | | Dec. 24, 1968 | Johnson |
| 28 | 3,090,542 | | May 21, 1963 | Miller |

U.S. patent application Publications

| Cite No. | Publication Nr. | Kind Code | Publ. Date | Applicant |
|---|---|---|---|---|
| 1 | 2018/0290799 | A1 | Oct. 11, 2018 | Sedgwick et al. |
| 2 | 2017/0253398 | A1 | Sep. 7, 2017 | Shapiro |
| 3 | 2017/0112312 | A1 | Apr. 27, 2017 | Gardeski |
| 4 | 2016/0229597 | A1 | Aug. 11, 2016 | Polt |
| 5 | 2015/0360829 | A1 | Dec. 17, 2015 | Davis et al. |
| 6 | 2015/0289693 | A1 | Oct. 15, 2015 | Losee |
| 7 | 2015/0144628 | A1 | May 28, 2015 | Piper |
| 8 | 2015/0069064 | A1 | Mar. 12, 2015 | Johnson |
| 9 | 2015/0053090 | A1 | Feb. 26, 2015 | Berger |
| 10 | 2013/0256307 | A1 | Oct. 3, 2013 | Hewitt |
| 12 | 20120298667 | A1 | Nov. 29, 2012 | Anthony |
| 13 | 2012/0201941 | A1 | Aug. 9, 2012 | Lavoie |
| 14 | 2010/0295328 | A1 | Nov. 25, 2010 | Fiorino |
| 15 | 2007/0068948 | A1 | Mar. 29, 2007 | Friedman |
| 16 | 2006O144340 | A1 | Jul. 6, 2006 | Burge et al. |
| 17 | 2005/0145638 | A1 | Jul. 7, 2005 | Van Handel et al. |
| 18 | 2005/0092749 | A1 | Mar. 5, 2005 | Durdon |

Foreign Patent Documents

| Cite No. | Publication Nr. | Kind Code | Publ. Date | Applicant |
|---|---|---|---|---|
| 1 | GB2407562 | A | Apr. 5, 2005 | Durdon |
| 2 | CDN3037920 | A1 | Mar. 35, 2019 | Harris |
| 3 | DE202012012222 | U | Dec. 20, 2012 | Aleksey Zhukov |
| 4 | JP2004155467 | A | Nov. 07, 2002 | Miyazaki ET AL. |

Non-Patent Citations

| | |
|---|---|
| 1 | Krakauer, Lawrence J., "The word biscotti in Italian is the plural of biscotto . . . " - https://ljkrakauer.com/LJK/essays/biscottibis.htm., Jun. 17, 2010. |
| 2 | Korey and Lenzi, G https://www.theflorentine.net/2015/09/10/cantucci-vin-santo/) |
| 3 | https://stefangourmet.com/2012/08/12/cantuccini-with-vin-santo-biscotti-di-prato/ |
| 4 | Wikipedia "dunking (biscuit)" - https://en.wikipedia.org/wiki/Dunking (biscuit) |
| 5 | https://blackbearcoffee.com |
| 6 | Brown, F. et al. under the category "Burns," titled: "Calculating the optimum temperature for serving hot beverages," (https://www.ncbi.nlm.nih.gov/pubmed/18226454) |

Grab-and-go food outlets serve a variety of beverages and foods each morning and throughout the day to be consumed by an on-the-go mobile base of millions, if not billions of people. Often, along with these beverage purchases, customers will also buy an accompanying bakers' confection. Bakers' confections are sweet foods that feature flour as a main ingredient and are baked or fried. One confection option, conspicuous by its absence in this array of grab-and go foods, is the biscotto ("The word biscotti in Italian is the plural of biscotto. North Americans seem to assume that "biscotti" is singular, and so they speak of one biscotti, two biscottis. Courtesy Lawrence J. Cracker—https://ljkrakauer.com/LJK/essays/biscottibis.htm. Jun. 17, 2010). The phrase "grab-and-go" refers to grabbing something, a drink, a pre-packaged food, a rapidly prepared food item from a fast food outlet, and then being on your way. At this stage, following the "grab-and-go" purchase, the customer may consume said purchase while "on-the-go", this phrase means to be moving about, in a car, on public transit, on foot, always on the go.

Though modern biscotti (the generic name in Italy) are associated with the Tuscan region, this popular Italian cookie traces its origins to Roman times. During the Roman Empire, biscotti, from the Latin 'bis', meaning twice, and 'coctum', meaning baked, were created to sustain the Roman League soldiers during long marches into battle. The unleavened wafers, flavoured with almonds which at the time were plentiful, were baked once to cook them and again to completely draw out the moisture, resulting in a hard, dry texture making them durable for travel and nourishment on long journeys with a shelf-life so long that the philosopher Pliny the Elder once reportedly boasted that they would be edible for centuries. When the Roman Empire collapsed, the cookies disappeared until the Renaissance (Courtesy Alexandra Korey and Gabriella Ienzi https://www.theflorentine.net/2015/09/10/cantucci-vin-santo/). The biscotti re-emergence began in Tuscany, where the cookies, mostly known as cantucci or cantuccini, were officially called biscotti di Prato. Biscotti di Prato are named after the city of Prato (near Florence) because the oldest records of cantuccini are kept there, and were reintroduced by a pastry baker of Prato, winning prizes with them in the 19th century. The word "cantuccini" refers to the shape of the biscotti and means "little angles" (Courtesy https://stefangourmet.com/2012/08/12/cantuccini-with-vin-santo-biscotti-di-prato/). The Roman biscotti were more about convenience food for travellers rather than a pleasurable treat for leisurely diners. The biscotto, historically, might be considered the first recorded example of fast food specifically designed for travellers, on-the-go, eventually evolving to be paired with a local sweet wine, turning the "emergency-fuel snack" into a dessert to be savoured and enjoyed, consumed by dipping into a drink, traditionally a Vin Santo.

The biscotto is a hard biscuit with its own unique shape that has become an iconic brand of this confection. Biscotti are shaped as a stick of varying lengths, curved on one side and flat on the other, tapering at opposite ends to a sharp angle. Biscotti also have a branded iconic consistency and mode of consumption, respectively, they are hard and dry to taste and difficult to bite and ingest without some form of beverage for dunking and softening purposes.

Biscotti have evolved from the unleavened, twice-baked, oblong-shaped, dry, pallid, crunchy, fingers; dry staples for nourishment, to flavourings only limited by the imagination of the baker and the palates of the customer. The original almond recipe from Tuscany has expanded to anisette-, amarettos- and lemon-flavoured dough and to other spices; to biscotti with raisins and other dried fruits, including biscotti studded with chocolate morsels and with other varieties of nuts. The aforementioned ingredients and varying size described for biscotti do not preclude the availability of other recipes or dimensions not described herein. Biscotti are not the only bakers' confection available with a hard consistency requiring softening through dunking into a beverage to be consumed while simultaneously enhancing the beverage consumption experience, and which have also become conspicuous by their absence in the array of grab-and go foods available for purchase.

Eating a biscotto offers the customer a way to satisfy their hunger with a nutritious treat which is enhanced through dunking into a favourite beverage. The fact that traditional biscotto recipes don't use any butter, oil or margarine makes this treat a healthier choice compared with other available bakers' confections which are deep fried and prepared with richer ingredients. A beverage, with a bakers' confection, has become a very important ritual for many starting their daily grind. However, the concept of dunking any type of confection into a beverage filled sealed disposable container was never realized as a grab-and-go option for the on-the-go beverage customer because there was no viable means to safely access the beverage without first prying a clamped disposable lid from the upper end rolled rim of the container and risk potential spills and/or injuries in the process. Consequently bakers' confections, such as biscotti, prepared with healthy ingredients and requiring dunking into a beverage to soften for consumption, and generating a unique taste experience, have gradually disappeared as a confection option at grab-and-go food outlets. Dunking any type of bakers' confection into a beverage within a sealed disposable container is not a common practice at grab-and-go fast food outlets, and certainly not practised while on-the-go. Reference throughout this patent application is made to the upper end rolled rim of a disposable container as many disposable lids are designed to reversibly clamp to the rolled rim of disposable containers. The disposable lid/disposable container rolled rim interface offers a strong, non-permanent clamping interface between the lid and container allowing for the lid to be reversibly removed while offering a snug seal against spills seeping through the interface or for the lid to accidentally disengage from the rolled rim of the container. This widely accepted lid/container interface does not preclude other upper end container rim designs and corresponding disposable lid annular skirt configurations from being adopted or utilized to reversibly clamp a disposable lid to the upper end of a disposable container and eliminate leaking through this interface while the lid remains clamped to the rim of the container. The symbol for a forward slash, "/" is used throughout this patent application as a short form to represent "and" as defined under Thesaurus.com.

Dunking a bakers' confection into a beverage is not a new practice. Many varieties of confections, which do not require softening to be more easily ingested, have been dunked into a beverage. Cookies, such as "Oreos*," have repeatedly been shown in the media as being dunked into a glass of milk, yet can be easily ingested without dunking into a liquid to soften. The restaurant holding company, Dunkin' Brands Group Inc. which owns "Dunkin' Donuts*" is named for the very purpose of dunking a donut into coffee, another example of a confection which does not necessarily require softening with a liquid for ingestion. According to Wikipedia, dunking means to dunk or to dip a biscuit or some other food; to submerge it into a beverage, especially tea, coffee, or milk. Dunking releases more flavours from the confections by dissolving the ingredients, while also softening their texture. 'Evelyn, in the movie "The Best Exotic Marigold Hotel," poetically describes dunking as "lowering the biscuit into the tea and letting it soak in there and trying to calculate the exact moment before the biscuit dissolves, when you whip it up into your mouth and enjoy the blissful union of biscuits and tea combined."'(Wikipedia "dunking (biscuit)"-https://en.wikipedia.org/wiki/Dunking (biscuit)). Some bakers' confections are specifically designed to be dunked into a beverage for the purposes of softening for ingestion, introducing a more enjoyable taste experience, infusing the confection with beverage and conversely infusion the beverage with the flavours of the confection, making these types of confections a more attractive option to accompany a beverage purchase.

Bakers' confections requiring softening through dunking or immersion in a beverage for the purposes of easier consumption have been readily available prior to, during, and following the introduction and expansion of disposable beverage containers and lids in the grab-and-go fast food industry. Bakers' confections such as biscotti are not some obscure confection but one that has been offered, albeit less and less, at fast food establishments offering grab-and-go beverages and which continue to be widely available at bakeries and grocery stores. Biscotti may still be enjoyed with a beverage served in the traditional cup and saucer arrangement, leisurely consumed while seated at a table on a patio or with a glass of wine at the end of a fine meal in a restaurant. In these scenarios the customer leisurely alternates between dunking this confection into their beverage to soften and mix with the beverage before being consumed between sips of the beverage, without the potential risk of spills and injury arising when removing a tightly clamped disposable lid from a disposable beverage container. Despite this widely available and popular confection, together with the biscotto's classic history as a fast food staple for the traveller, bakers' confections, such as biscotti and other related hard baked biscuits, have not successfully made the transition into today's grab-and-go, on-the-go beverage fast food life style.

The fast food beverage grab-and-go take-out industry's proliferation has seen biscotti and similar bakers' confections become conspicuous by their absence as an available accompanying confection when ordering a grab-and-go beverage. This has highlighted the broader absence of dunking a bakers' confection into a grab-and-go beverage designed to be consumed through a disposable lid sealed to the rolled rim of a disposable beverage container while on-the-go. Dunking a confection into a grab-and go beverage is not a viable option with disposable lids clamped to the rolled rims of beverage filled disposable containers in the present grab-and-go beverage culture.

One possible explanation for the absence of dunking a bakers' confection into a grab-and-go beverage purchase, and for the scarcity of bakers' confections such as biscotti from fast food menus, is that these traditional Italian "chip-your-tooth" biscuits must be softened by dunking into a drink in order to be enjoyably consumed. In many, but not all instances, grab-and-go fast food outlets provide beverages to customers with condiments added followed by pre-attaching a disposable lid to the rolled rim of a disposable beverage container before serving to the customer. Conversely, the beverage may be served to the customer without the lid attached, allowing the customer to customize their beverage and then optionally attach a lid. The disposable lid is designed to securely clamp to the rolled rim of a disposable beverage container ensuring a tight seal, keeping the beverage contents hot or cold during consumption and reducing possible spilling or leaking of the beverage from the container. The secure fixing of a lid to a disposable beverage container by the barista and/or server before delivery to the customer protects the customer against accidental spills and possible injury while also offering the fast food outlet some liability protection against accidents to their customers and staff. The very design of the disposable lid to clamp in a snug sealing manner to the rolled rim of a disposable beverage container suggests that the disposable lid is not meant to be repeatedly detached and reattached to the disposable container. Despite this generally accepted practice and lid design, occasionally a customer will attempt to disengage a disposable lid from the rolled rim of a disposable beverage container for any number of reasons, including, but not limited to, adding more condiments, expediting cooling of the beverage, dunking a confection, scooping a whipped topping from the beverage surface, introducing an organic decoction material or an infusion pouch, or just to better gather in the full aroma of the beverage. When a customer attempts to disengage the clamped disposable lid from the rolled rim of a disposable container, spills may result, possibly propelling the contained beverage in different directions potentially injuring the customer, not to mention any persons in the vicinity. When attempting to disengage the disposable lid, the customer's attention may be distracted in any number of directions, escalating the potential for accidents. Introducing a confection requiring dunking to be more enjoyably ingested adds more risk between the customer and disposable beverage container/lid configuration. Once the customer has successfully navigated the safe detaching of the lid from the beverage container and performed changes to their beverage, such as adding further condiments, and/or dunking a confection, the customer may reattach the lid to the rolled rim of the container, again risking spills and possible injury. The necessity of removing and reattaching a lid in order to consume a baker's confection, such as a biscotto, which requires dunking, is in conflict with the grab-and-go and on-the-go philosophies facilitating expediting the respective beverage purchase and beverage consumption while saving time in the process, and introduces real risks of spills and possible injury.

The concept behind grab-and-go fast food establishments is to expedite the customer's purchase and receipt of their beverage filled disposable container with an attached disposable lid and then for the customer to optionally sip the beverage safely through an aperture in the lid while on-the-go. If a confection adjoins this beverage purchase, also to be consumed while on-the-go, it is unlikely a biscotto will be selected because the disposable beverage container/lid configuration has not been designed to alternate between dunking and sipping while the disposable lid remains clamped to the container's rolled rim. The fast food outlet likely would not want to encourage the customer to risk spills and accidents through the removal of a clamped lid from a disposable container for the purposes of dunking a confection, and risk subsequent possible liability to their business. The dual functionality of dunking a confection and sipping a beverage through the same disposable lid introduces processes which are at odds with the grab-and-go and on-the-go lifestyle supported by the fast food industry. The grab-and-go beverage served in a disposable container sealed with a disposable lid clamped to the rolled rim of the beverage container does not promote the option of dunking a confection into a beverage while on-the-go, subsequently resulting in a declining demand for confections such as biscotti while other baked confections, not requiring dunking to soften for ingestion, are selected. It is not unusual to see a customer holding a bakers' confection, other than a biscotto, in one hand and a sealed disposable beverage filled container in the opposing hand, alternating between eating the confection and sipping from their sealed grab-and-go disposable beverage container, while on-the-go.

Once a disposable lid is removed from a disposable beverage container, for whatever reason, the portable nature of the on-the-go beverage is diminished and the convenience and safety offered by the snug fitting lid has been compromised. Customers on-the-go have no practical way to safely dunk a baked confection into a sealed disposable beverage container, but still have the option of sipping their beverage while on-the-go. The customer, in most instances, cannot enjoyably eat a hard baked confection, such as a biscotto, without first dunking it into their beverage to soften, nor perform dunking of any confection without exposing themselves to the risks discussed above arising when prying the disposable lid from the rolled rim of a disposable beverage container, while on-the-go. This helps to explain why bakers' confections, such as biscotti, are in less demand and dunking a confection in general is not an option for grab-and-go, on-the-go beverage purchasers, denying the customer a more enhanced beverage/confection experience and, in the case of biscotti, a healthier bakers' confection alternative for consumption.

This lack of access to the contents within a disposable beverage container without first removing the disposable lid from the disposable beverage container is not restricted to grab-and-go beverages and the dunking of accompanying bakers' confections, but may also be extended to larger disposable food containers offered for grab-and-go food purchases. Disposable food container/lid configurations also do not offer access to the food within disposable food containers without first risking unclamping the disposable lid from the rolled rim of a disposable food container to perform actions on the food contents within the disposable food container including, but not limited to, retrieving the contents with a utensil for consumption, cooling the contents within, dunking or adding an accompanying side food into the contents, such as crackers for example, adding condiments such as grated cheeses, spices, and sour cream for example. In any of these examples the disposable lid must first be removed from the disposable container to access the food within once again introducing the same risks of accidents and injuries due to the spilling of contents initially raised when removing a secured disposable lid from a disposable beverage container.

There are currently no disposable beverage container/lid configuration options offered at grab-and-go fast food outlets which allow access to the beverage within a disposable container for the purposes of dunking a bakers' confection while alternatively sipping the beverage, with the lid remaining secured to the container rolled rim. Presently, the customer's only option for dunking a confection into their beverage is to decline having the barista and/or server affix the disposable lid prior to delivering the beverage, or, for the customer to remove the disposable lid from the rolled rim of the disposable container after receipt of the sealed disposable beverage filled container and risk possible accidents and injuries in the process.

To enable a customer the option of sipping a beverage and dunking a confection, enjoying the experience of consuming a beverage infused confection while on-the-go, requires a disposable lid facilitating repeated dunking of a confection, without the necessity of first removing the lid from the rolled rim of a container to access the beverage within the disposable container while also offering the option of sipping the beverage through the lid, thereby allowing the lid to remain secured to the rolled rim of a container and continue to offer some protection against spills and possible injury. This new invention allows customers to continue consuming a beverage while on-the-go, sipping it through an aperture around the perimeter in the top of the disposable lid with the added benefit of safely dunking a confection, through a resealable hatch opening in the top wall of the lid, into a beverage without the necessity and associated risks of first removing the lid from the rolled rim of the disposable beverage filled container. This is accomplished through a reclosable hatch cover part connected to the top wall of a brim mount part by a detachable hinge, thus forming a new two part container lid, wherein said hatch cover part pivots between a fully closed position, reversibly sealing the hatch opening, and a fully opened position, providing unobstructed entry to the hatch opening and access to the beverage within the container, and an intermediate opened position between fully closed and fully opened positions. This new disposable two part container lid enhances the beverage/confection experience while on-the-go, elevating hard baked confections, such as biscotti, as a viable option among grab-and-go fast food confections, and expanding all available bakers' confections the option of being dunked through the resealable hatch opening into a favourite beverage without the risk of detaching the lid from the rolled rim of the container. This proposed invention also has the potential of reducing the number of steps a barista and/or server follows when preparing a beverage for a customer. The re-sealable hatch opening in the top portion of the brim mount part of this new disposable two part container lid allows the barista and/or server to optionally omit the addition of condiments, expediting delivery of the beverage to the customer and increasing customer throughput. The addition of condiments is transferred to the customer and may be safely introduced by pivoting the hatch cover part to a fully opened position to expose the hatch opening, without the necessity and risk of removing the disposable lid from the rolled rim of the disposable container. The pivoting hatch cover part over the reclosable hatch opening in the top of the disposable two part container lid also allows the barista and/or server the option of pre-attaching a disposable lid to an empty disposable beverage container and then pouring the beverage through the hatch opening when the hatch cover part is pivoted to the fully opened position, thereby eliminating the necessity and potential risks of attaching a disposable lid to the rolled rim of a beverage filled disposable container and incurring possible accidents.

This new proposed invention also addresses the inherent medical risks associated with the consumption of a hot beverage by offering an expedited means of cooling a hot beverage to a personal consumption temperature through the broad venting of steam and heat through the disposable two part container lid hatch opening when the hatch cover part is pivoted to a fully opened position. Beverage heat management is a contributing factor in the coffee preparation process to attain optimum brewing of the coffee beans. While medical research has found that hot beverage products such as coffees and tea have not been proven as cancerous, the International Agency for Research on Cancer (IARC) has classified drinking very hot beverages as a probable carcinogen and a major risk factor for esophageal cancer.

According to Black Bear Coffee (blackbearcoffee.com), "The brewing temperature of the water used in the initial preparation of coffee is very important. It should be between 195° F. (91° C.) and 205° F. (96° C.). The closer to 205° F. (96° C.) the better. Boiling water (212° F.-100° C.) should never be used, as it will burn the coffee. Water that is less than 195° F. (91° C.) will not extract coffee properly." In the fast food industry hot beverages must be served at a temperature which is high enough to maximize the taste sensation of the product served to the customer. The research by Brown, F. et al. under the category "Burns," titled: "Calculating the optimum temperature for serving hot beverages," (https://www.ncbi.nlm.nih.gov/pubmed/18226454), reports that hot beverages such as tea, hot chocolate, and coffee are frequently served at temperatures between 160° F. (71.1° C.) and 185° F. (85° C.). Very hot beverages refer to drinks hotter than 149° F. (65° C.). Brief exposures to liquids in this temperature range can cause significant scald burns. The preferred drinking temperature of coffee is specified in the literature as 140+/−15° F. (60+/−8.3° C.) with an optimal drinking temperature of approximately 136° F. (57.8° C.). Serving temperatures below 131° F. (55° C.) results in a drink which begins to feel lukewarm. In order for the fast food industry to serve coffee at that perfect temperature, the hot beverage is usually transferred after brewing to a container where a temperature of 140° F. (60° C.) is achievable. That being said, the problem is that there are many fast food outlets using a variety of beverage preparation equipment for grab-and-go hot beverages, subject to varying preparation temperatures.

This new invention offers benefits to both the fast food industry and the customer towards achieving a personalized consumption temperature for their hot beverage. If the beverage seems too hot when served, the customer may pivot the hatch cover part to a fully opened position, exposing the hatch opening, expediting cooling and reducing the risk of scolding to the mouth. The fast food establishment may optionally mitigate their risks around the serving of a hot beverage through this new invention, whereby the customer would have further control through the pivoting hatch cover part towards expediting cooling of the beverage through the exposed hatch opening, offering a means to address the warning "Caution: Contents Hot" label embossed on most disposable drink lids. A further benefit to the expedited cooling of the beverage by the customer is that the customer has the option of selecting less liquid condiments to cool their beverage, without further diluting the beverage flavour, allowing for a more robust taste experience. This new invention offers an option to reduce the presently recommended serving temperature of a hot beverage to achieve the combined result of reducing the scald burn hazard and improving customer satisfaction, at the customer's discretion, while on-the-go. part This proposed invention may be optionally classified as a strawless lid as it offers drinking access ports die-cut into the perimeter top wall of the brim mount. However, the introduction of a reclosable hatch opening also offers the customer the option of introducing a straw into the hatch opening created when the hatch cover part is pivoted to a fully opened position. The option of introducing a straw through the hatch opening might be considered during the consumption of cold beverages utilizing this same container/lid configuration.

This new disposable two part container lid for use on disposable beverage containers may also be adopted for use with disposable food containers employed in grab-and-go outlets serving foods by increasing the lid diameter to fit wider diameter disposable food containers, thereby taking advantage of the pivoting hatch cover part to provide access to the hatch opening to retrieve food from within the disposable food container with a utensil without the necessity and risk of first removing the disposable lid from the disposable food container.

The existing grab-and-go food options sold in disposable food containers and meant to be taken to another location for consumption do not offer the option of leaving the lid clamped to the rolled rim of the container and drinking through a die-cut drinking access port as is the case with grab-and-go disposable beverage container/lid configurations. Grab-and-go disposable food containers require the customer to remove the disposable lid to access the contents, thereby inviting the same risk of accidents such as spills and possible injury arising when a customer optionally removes a disposable lid from a disposable beverage filled container.

Through a minor variation in the disposable beverage lid diameter, while retaining the pivoting hatch cover part over the reclosable hatch opening in the top wall of two part container lid, this new invention can be adopted as a suitable disposable lid for use with disposable food containers. As described for disposable beverage containers, this new two part container lid offers the same benefit of leaving a lid fixed to the rolled rim of the container while allowing the customer to access the food within through the hatch opening once the hatch cover part is pivoted to the fully opened position, thereby simultaneously eliminating the risks of spills and injuries associated with removing a lid to access the food within the container.

Dunking a bakers' confection through the hatch opening in the top wall of the disposable two part container lid designed for disposable beverage containers may be suitably adopted for grab-and-go disposable food containers whereby the dunking of a bakers' confection has been replaced with another accompanying food, such as crackers, which might be optionally dunked into the food or added to the food within the container through the hatch opening. The hatch opening in this new invention also facilitates the insertion of a utensil for the retrieval of food within the disposable container without removing the disposable lid from the rolled rim of the disposable container and further having to contend with the separated lid to manage and subsequently discard once removed from the disposable food container. In both applications of this new invention for disposable beverage and food containers, the hatch opening in the top wall of the respective two part container lids allows for the container to be optionally filled with a beverage or food, through the respective hatch openings and to subsequently access that respective beverage or food for purposes including, but not limited too, repeated dunking of a confection or other related adjoining food into, and retrieval therefrom, the respective beverage, adding a condiment or condiments to the beverage, introducing a utensil into the beverage for the purposes of stirring the condiment or condiments within the beverage and retrieving the respective beverage for consumption with a utensil, adding a topping to the surface of the respective beverage and retrieving the topping from the surface of the respective beverage with a utensil, introducing a straw into the respective beverage, venting an aroma from the beverage through the respective hatch opening, cooling the beverage by venting heat and steam from the beverage through the hatch opening, introducing an infusion pouch through the hatch opening into the respective beverage for the purposes of infusing the respective beverage therein, wherein these actions are performed through the respective hatch opening with the hatch cover part pivoted to an intermediate or partially opened or fully opened position and without the necessity of disengaging the respective disposable beverage or food lid from the rolled rim of the respective disposable container.

This new invention introduces a paradigm shift in the consumption of grab-and-go beverages and foods designed to be consumed from a disposable container while on-the-go eliminating the risks associated with removing a disposable lid from the disposable container to access the contents within the respective disposable container.

Disposable beverage and food container lids are designed to offer several functional requirements including a reasonably secure seal to the rolled rim of a disposable container to prevent the lid from being detached resulting in beverage or food within the respective containers from leaking or spilling out. The disposable lid must also be secured to a disposable container to keep the beverage or food hot or cold depending on the contents. While the lid must be secured to the rolled rim of the container, in the case of food containers, it must also be easy to remove without risk of accident, suggesting a conflict of purposes. By adopting a variation in size of the above described new invention for a disposable lid for grab-and-go beverages, the first two requirements of disposable food container lids can be achieved, that is preventing leaks and retaining the temperature of the contents within, while the last requirement, the need to remove the disposable lid to access the contents has been eliminated along with the aforementioned associated risks incurred when such detaching of a lid from a food container may arise. This new invention offers grab-and-go fast food outlets a new, safer and expeditious option of beverage and food delivery by optionally first attaching all disposable two part container lids to disposable containers and then filling the respective containers with food or beverage through the hatch opening, following the pivoting of the hatch cover part to a fully opened position after the lid is attached as opposed to first filling the respective container with beverage or food and then risking accidents when clamping the lid to the filled disposable container, before serving to the customer. The option to pre-attach a disposable lid before filling the disposable container does not eliminate a preparation step as a disposable lid may be attached at some point by the barista and/or server or by the customer, if the beverage or food container is served to the customer without a lid already attached. However, by taking advantage of a suitably sized hatch opening offered by this new two part container lids for the purposes of filling a disposable container with beverage or food and then optionally fully closing or leaving the pivoting hatch cover part fully open, introduces several benefits to the fast food industry. One notable benefit is that the barista and/or server does not have to risk spills and accidents attaching a disposable lid to a beverage or food filled disposable container. The barista and/or server does not have to grip a disposable container holding a hot beverage or food when attaching a disposable lid as the disposable two part container lids has been previously attached to an empty disposable container at ambient temperatures. The container retains it structural integrity longer because the hot beverage or food is added to a completed container/lid configuration through the hatch opening, rather than adding the food to an unlidded container and allowing the container to rest until a disposable lid is attached, resulting in the heat from the contents to affect the structure of the disposable container which may impact on attaching a disposable lid and grasping the container as the lid is attached.

Disposable paper containers are made from "cup board", or other similar material, comprised of a special multi-layer paper with a waterproofing barrier coating of plastic or wax to prevent liquid from leaking out or soaking through. Hot beverages and foods within a disposable paper container bring a beverage into contact with the container rim, wall and bottom, while also transferring heat and steam to the container wall, bottom and rolled rim, weakening its structural integrity and potentially leading to deformation and a loss of container shape, if not immediately covered with a lid and served to the customer in a timely manner. The initial clamping of a lid to the rolled rim of a container, freshly filled with a hot beverage or food, results in a secured sealed interface, however, with time, heat, water and steam may weaken the rolled rim, making it difficult for the customer to easily remove and reattach the lid without risk of spills and injury. The impact of heat, liquid and steam on the container rolled rim/lid interface are reduced with this new invention. This new disposable two part container lid may be optionally initially clamped to the rolled rim of an empty disposable beverage or food container. The beverage or food may then be added through the hatch opening and the hatch opening reversibly sealed with the pivoting hatch cover part and immediately served without delay to the customer. Access to the contents within the container is provided through the hatch opening eliminating the need to remove the lid from the rolled rim of the container, thereby reducing the impact of heat, water and steam imparted to weaken the container rolled rim/lid interface and the general integrity of the container, and reducing the risk of spills and injury associated with attaching or removing a lid, to and from the rolled rim of a container. Another benefit of pre-attaching this new two part container lid to an empty disposable container is a saving in time as the completed container/lid configuration allows for the expedited safe filling of the container through the hatch opening, eliminating the patience and care expended to safely attach a disposable lid to a hot steaming beverage or hot food filled disposable container, supporting the fast food industry's goal of expediting the preparation and delivery of product to the customer. A further saving in preparation and delivery time is attributed to the option of passing all customization of the beverage or food to the customer who may add condiments and toppings through the hatch opening at their leisure, thereby removing several steps performed by the barista and/or server. Another optional benefit to both the customer and the fast food outlet is that beverage refills may be provided directly to the original container through the hatch opening, saving time and costs associated with replacing the lid and/or container for refill requests.

This new invention also expands on the fast food on-the-go life style by eliminating the need to manage both a disposable lid and a disposable container, as there is no longer a need to remove the lid from the rolled rim of the disposable container to access the contents within. With this new disposable two part container lid no longer required to be removed, the customer has more options for drinking and eating from their on-the-go disposable beverage or food container. The customer no longer needs a stable, flat surface to rest a disposable container for removing the lid. The two part container lid remains attached to the disposable container freeing up the opposing hand to perform additional actions on the beverage or food once the hatch cover part is pivoted to a fully opened position, while the disposable two part container lid remains clamped to the disposable container offering protection against spilling and accidents. The customer can stand while dunking an accompanying food, eating or drinking with more confidence as they better manage their disposable drink or food container, with the attached hatch cover part pivoted to a fully opened position, no longer having to remove the lid to access the contents within the container and necessitating a supporting surface to manage both the container, detached lid and accompanying food. The fast food outlet may expedite their service delivery with all drinks and food served with the disposable two part container lid attached, ensuring a more safe delivery of their product to the customer, optionally served without the barista and/or server adding condiments, leaving this to the discretion of the customer. The customer need not hold up the line trying to remove the disposable lid at the service counter or at a condiment station. Once the customer pivots the hatch cover part to the fully opened position their free hand may easily and quickly add condiments to their beverage or food through the hatch opening without the need to use the free hand to manage an unclamped disposable lid or the necessity of a supporting surface to help manage the container, the detached lid and any accompanying condiments or foods, while retrieving food or beverage from within the container or dunking a food into a beverage or food within the container.

The conspicuous absence of bakers' confections such as biscotti highlights the broader absence of dunking in general among grab-and-go beverages served with disposable container/lid configurations not designed for the lid to be easily and safely removed from the rolled rim of a container for dunking or adding condiments, cooling a beverage or food, or selectively eating a topping before sipping a beverage or eating a food. While the absence of biscotti offered as bakers' confections at fast food outlets initiated the research into this new invention, it also highlighted the broader absence of the option of dunking in the grab-and-go and on-the-go beverage and food communities around the world, reminders of a bygone time and the missed opportunity to enjoy dunking while still adhering to, and practising, the grab-and-go, on-the-go beverage and food lifestyle. While the driving force for this new patent application was initiated by the absence of access to bakers' confections such as biscotti, and a means to dunk them to soften for ingestion, it opened the broader absence of a means of dunking any bakers' confection or adjoining food while on-the-go, introducing many associated benefits offered by this new disposable two part container lid through the pivoting of a hatch cover part between a fully opened and a fully closed position, and any intermediate opened position therein, for accessing a hatch opening in the top of the disposable two part container lid, which extends beyond dunking.

Disadvantages of the Prior Art

This new invention comprises a disposable two part container lid consisting of two separately moulded units, a separately moulded hatch cover part removably attached to the top of a separately moulded brim mount part via a detachable hinge, pivoting the hatch cover part between fully closed and fully opened positions over a hatch opening in the top wall of the brim mount part, removably attachable to the rolled rim of a disposable container. This is a different lid design compared with the lids described in U.S. Pat. No. 10,604,308 (Harris, Mar. 31, 2020) and 10,710,779 (Harris, Jul. 14, 2020) wherein the hatch cover and brim mount member are moulded together as a single unit forming a disposable lid with the hatch cover member pivoting about a recessed u-shaped hinge between a fully closed and a fully opened position over a hatch opening in the top wall of the disposable lid and wherein the hatch cover member is not removably attachable to the top wall of the brim mount member as is the configuration for the detachable hinge comprising this new invention.

One advantage of this new invention over U.S. Pat. Nos. 10,604,308 and 10,710,779 is that unlike the recessed u-shaped hinge, contiguously connecting the hatch cover member to the top of the brim mount member, there is no contiguous physical connection between the detachable hinge, as they represent separately moulded units, and therefore undergo less stress and wear under repeated pivoting of the hatch cover parts between fully opened and fully closed positions compared with the recessed u-shaped hinge which begins to show wear along the axial length of the hinge line between the top of the lid and the hatch cover member. This wear, after a few pivots of the hatch cover member between opened and closed positions, leads to a breakdown of the plastic along this narrow axial hinge line, eventually leading to tearing of the plastic along the hinge line and detachment of the hatch cover member from the top of the brim mount. The detachable hinge parts of this new invention are not subject to the same type of wear and tear applied to the narrow axial hinge line along the recessed u-shaped hinge upon repeated pivoting of the hatch cover members between opened and closed positions and therefore forms a more resilient connection between the hatch cover part and the top of the brim mount part compared with the hatch cover member joined to the top wall of the lid by the recessed u-shaped hinge configuration in U.S. Pat. Nos. 10,604,308 and 10,710,779. Consequently, the more resilient nature of the detachable hinge configuration allows this new two part container lid to be optionally re-used when complimentary refills are available and not disposed after one use, offering a more cost effective use of a disposable lid for the fast food outlet and reducing the recycling footprint.

Another advantage of this new invention over U.S. Pat. Nos. 10,604,308 and 10,710,779 is that the thinly extruded polymers used to create disposable container lids possess an inherent memory DNA which impact the recessed u-shaped hinge preventing the hatch cover member from remaining in a fully closed or fully opened position as the memory in the plastic forming the u-shaped hinge will pivot back to its prior position. In this new invention inherent retention memory in the plastic is not a factor affecting the opening and closing of the hatch cover part. The detachable hinge form a non-permanent frictional interface between their respective contact walls enabling the hatch cover part to be pivoted and retained at intermediate opened positions between fully opened and fully closed positions in a hands-free manner. The detachable hinge allows the customer to introduce personal preferences to their beverage, including, but not limited to, articulating the hatch cover part to a fully opened position, or any intermediate opened therein, respectively expediting cooling or moderating the cooling of a hot beverage. Due to the memory DNA in U.S. Pat. Nos. 10,604,308 and 10,710,779, the hatch cover member is not retained at preferred intermediate opened positions for a preferential cooling rate without the potential of pivoting back to its last pivoted position and without retaining the pivoted hatch cover member at such selected intermediate opened positions with some assistance of the opposite hand or with the addition of optional posts in the top and/or bottom portion of the hatch cover member which are received into cavities in the top portion of the brim mount member to retain the hatch cover member in the fully opened or fully closed positions. The effects of memory DNA of the plastic also contributes to wear along the recessed u-shaped hinge line in U.S. Pat. Nos. 10,604,308 and 10,710,779 where the hatch cover member returns to its original starting position, forcing the customer to pivot the hatch cover member back to the desired position, further adding wear along the axial hinge line of the u-shaped hinge. The increased contribution to wear along the narrow axial hinge line due to memory DNA in the plastic are eliminated with this new two part container lid configured with a detachable hinge between the hatch cover part and the top wall of the brim mount part compared with the u-shaped hinge describe in U.S. Pat. Nos. 10,604,308 and 10,710,779

Another advantage offered by the frictional interface between the detachable hinge components in this new patent over U.S. Pat. Nos. 10,604,308 and 10,710,779 is that there is no longer any memory DNA to contend with as the hatch cover part is retained in an unassisted fully opened position, thereby allowing the barista and/or server to slowly and carefully add beverage through the hatch opening of the disposable two part container lid, pre-attached to the disposable container rolled rim, without worry that memory DNA in the plastic will randomly close the hatch cover part over the hatch opening while barista and/or server are the process of pouring beverage into the container through the hatch opening. The barista and/or server may safely fill the disposable beverage container through the hatch opening of the pre-attached two part container lid instead of filling the container with beverage and then clamping the lid to the rolled rim of a beverage filled container, thereby reducing the risk of spills and accidents associated with clamping a lid to a freshly filled disposable container holding a hot beverage. Toppings, such as whipped cream, for specialty beverages, may also be added through the hatch opening with the hatch cover part remaining fully opened when served to the customer due to the detachable hinge, without risk of inherent memory DNA properties in the plastic causing the hatch cover part to prematurely close compressing the vertical peak and shape of the whipped topping and potentially submerging it from a position resting on the beverage surface plane to a submerged position dissolving within the beverage before this value added beverage is delivered and the added topping can be separately consumed. This optional beverage preparation process still ensures the disposable beverage container is served to the customer with the lid secured to the rolled rim of the container for safety, reducing spills and splashes, while offering a means of providing an attractively prepared product.

The hatch opening and pivoting hatch cover part about a detachable hinge offers the customer options to personalize their beverage purchase should they wish to add further condiments or toppings usually offered at a grab-and-go food outlets or to expedite cooling of their beverage, as mentioned, without the risk of the hatch cover part closing prematurely. The introduction of a detachable hinge offers more functionality and resilience while eliminating the nuisance of memory in the plastic, overcoming the inherent characteristics of the earlier recessed u-shaped hinge configuration described in U.S. Pat. Nos. 10,604,308 and 10,710,779, thereby enabling the hatch cover part to be articulated and retained in a fully closed or a fully opened position or any intermediate position in between, in a hands-free manner, without premature random closing and opening of the hatch cover member due to memory DNA of the plastic, thereby enhancing both the beverage and beverage/confection experience.

SUMMARY OF THE INVENTION

This invention was developed to provide a means to access a beverage within a sealed disposable container for the purposes including, but not limited to, dunking a bakers' confection into the beverage, adding condiments, adding toppings such as whipped cream to the surface of the beverage, retrieving such toppings with a utensil, inserting a straw, expediting cooling of a hot beverage within the disposable container through the venting of heat and steam, venting aroma, stirring the contents within the container, and introducing an organic decoction material or an infusion pouch while the disposable two part container lid remains clamped to the rolled rim of the disposable container thereby avoiding the necessity of removing the disposable lid from the disposable container rolled rim and incurring the risk of accidental spillage and injury when prying a clamped disposable lid from the rolled rim of a disposable container.

This new invention introduces a new type of disposable two part container lid designed for a disposable container whereby the two part container lid comprises a separately moulded hatch cover part removably attached to the top of a separately moulded brim mount part via detachable hinge, pivoting the hatch cover part between fully closed and fully opened positions over a hatch opening in the top wall of a brim mount part releasably mounted to the rolled rim of a container. The hatch opening in the top wall of the brim mount part of the two part container lid provides direct access to the beverage within the disposable container and is of sufficient diameter to accommodate dunking a variety of bakers' confections of varying dimensions through the hatch opening into the beverage within the disposable container.

The brim mount part further comprises a circumscribing lower annular skirt with a perimeter bottom flange with a free edge to guide the brim mount part onto the rolled rim of a disposable container securely engaging and reversibly clamping an interior sealing curvature on the interior wall of the annular skirt to the rolled rim of a disposable container, sealing the container against spills and the risk that the lid may become inadvertently detached from the disposable container. The top portion of the brim mount part is comprised of a elevated raised and planar region configured as a raised ring-shaped crown portion further comprising a first outside wall depends at an upward angle from a lower annular skirt, where the first outside wall is contiguous to an outer perimeter edge of a planar top transition surface which terminates at an inside perimeter edge wherein a second outside wall is disposed at a downward angle therein, terminating at a trough base forming one side of a trough. A first drinking access port is centrally die-cut through the planar top transition surface of the ring-shaped crown portion along a central line across the top portion of the brim mount part and disposed at a rear end of the brim mount part, and a diametrically opposite second drinking access port may be added, die-cut through the planar top transition surface and disposed at a front end of the brim mount part with the first drinking access port and the second drinking access port interposed between the outside and the inside perimeter edges peripheral to the planar top transitional surface, through which a beverage within the disposable container is dispensed when drinking from the first or the second drinking access ports.

In one preferred embodiment of the present invention a retaining rib, formed in the shape of an archway with a first outside wall and a second outside wall of equal height joined at their respective upper ends by an arch, is disposed concentrically within the second outside wall of the ring-shaped crown portion with a segment of the retaining rib removed adjacent the first drinking access port, thus an annular retaining rib therein, thereby creating two symmetrically opposing severed ends, each end sealed off with a end wall. Centrally positioned on each end wall is a partially spherical protrusion of equal diameter in an opposing configuration separated by a first gap between the opposing end walls, together the partially spherical protrusion forming the male hinge part of a detachable hinge. A planar transition panel is formed within the first gap, contiguous to the base of the two opposing end walls and also to the base of the second outside wall of the ring-shaped crown portion, depending inwardly with an optional gentle downward slope merging and blending into an annular interior rim circumscribing the perimeter base of the retaining rib second outside wall. A further preferred embodiment of the brim mount part is the optional formation of an anti-splash/spill apron comprised of a ring-shaped wall of optional variable height downwardly disposed from the top perimeter edge of annular interior rim circumscribing a first recessed lowered and planar region in the top portion of the brim mount part forming a hatch opening. The anti-splash/spill apron serves to dampen side-to-side wave-action created by the least amount of minimal movement to the container and which is imparted to the beverage within the disposable container resulting in surface sloshing of the beverage, whereby the anti-splash/spill apron dampens splashing from the surface of the beverage from moving upwards through the hatch opening.

In still an another preferred embodiment of this new invention a sump is created in the form of a u-shaped or v-shaped trough configured between the second outside wall of the ring-shaped crown portion and the retaining rib first outside wall, wherein the base of the trough is formed with an optional downward slant towards the first gap. This sump functions as a means to return liquid spillage splashed upwards through the hatch opening and over the retaining rib, and/or splashed upwards through the first and/or second drinking access ports and cascading down the second outside wall of the ring-shaped crown portion and/or the retaining rib first outside wall, to collect in the trough, wherein the trough directs the collected liquid spillage along its base to the first gap where opposing spillways convey the liquid spillage onto the planar transition panel where it continues to travel over the perimeter edge of annular interior rim and down the anti-splash/spill apron ring-shaped wall through the hatch opening back into the disposable container.

The hatch cover part of this new disposable two part container lid comprises a clamping rib, constructed in the form of an archway with a first wall upwardly disposed from a free edge to an arch and a second wall, of equal height to the first wall, downwardly disposed on the opposite side of the arch terminating contiguous to a perimeter edge circumscribing a recessed top wall of the hatch cover part forming a second recessed lowered and planar region. The interior of the clamping rib forms a locking channel wherein the width between the surface on the inside of the walls is dimensioned to be equal to, or slightly less than the outside width between the surface of the outside of the walls to allow for reversible frictionally clamping fitment mating of the locking channel over the retaining rib in a releasable, non-permanent manner. The hatch cover part describes semi-circular shaped gripping tab with a curvilinear perimeter front edge, joined to the top of the arch of the clamping rib, depends outwardly with a front edge curved extent beyond the perimeter of the first outside wall of the clamping rib.

In one preferred embodiment of the present invention a portion of the clamping rib is severed and a segment of the clamping rib removed, diametrically opposite the gripping tab and adjacent to the first drinking access port and the segment removed from the retaining rib, thereby creating two opposing symmetrically positioned opens ends with free edges on opposing sides of the clamping rib defining a second gap therein with a portion of the perimeter edge exposed without a segment of the clamping rib removed from the recessed top wall therein, thereby further defining the circumscribed clamping rib as partially annular around the top wall of the hatch cover part and wherein the arc length of the second gap is greater than the arc length of the first gap. A cylindrical housing, equal in length to the first gap between the end walls of the retaining rib of the brim mount part, is comprised of a rectangular base upwardly disposed from the top wall of the hatch cover part with a cylinder of equal length to the rectangular base, upwardly disposed from a top surface of the rectangular base and aligned along the length therein, the cylindrical housing positioned along a central line across the top wall of the hatch cover part within the second gap with the rectangular base partially overlapping the perimeter edge of the top wall. The cylinder portion further comprises two opposing cylinder end walls, each with a partially spherical indentation configured as centrally positioned recessed dished depressions with radii substantially equal to the radii of the partially spherical protrusion on the end walls of the retaining rib, wherein the cylindrical housing forms the female hinge part of the detachable hinge. Two opposing exposed perimeter extents of the recessed top wall of the hatch cover part, with equal arc lengths, are symmetrically positioned between opposing rectangular base end walls and the opposing open ends of the clamping rib, wherein equal severed portions of clamping rib have been removed leaving the two symmetrically perimeter extents of the recessed top wall.

Container lids formed from polystyrene plastics typically have wall thicknesses in the range of 0.4 mm offering the necessary flexibility to be easily clamped to the rolled rim of a container and a surface smoothness promoting suitability when two polystyrene surfaces are in intimate contact and moving against each other. This allows for the hatch cover part cylindrical housing, with a marginally shorter axial length than the axial length of the first gap between the end walls of the retaining rib, to be slidably press snap fitted into the first gap between the retaining rib end walls while at the same time the first gap is flexed outwards on either side, increasing the dimensional length of the first gap allowing the opposing partially spherical protrusions to be positioned in concentric alignment with, and to seat within, the partially spherical indentation, and for the partially spherical indentation to enshroud the partially spherical protrusions, thereby joining the hatch cover part in a non-permanent relatable manner to the top wall of the brim mount part and completing the formation of the detachable hinge. Alternatively the hatch cover part may be flexed to decrease the dimensional length of the cylindrical housing to allow the cylindrical housing to be inserted into the first gap of the brim mount part, wherein the partially spherical indentation snap over and enshroud the partially spherical protrusions. The detachable hinge snaps together or apart when sufficient force is applied to elastically flex either the dimensional length of the first gap or the dimensional length of the cylindrical housing. The flexible nature of polystyrene lids are routinely demonstrated by their ability to snugly clamp to the rolled rim of a container and their smooth surface characteristics allows for lids to be easily stacked and subsequently removed as needed. The detachable hinge configuration may be reversed with the partially spherical indentations recessed within the opposing end walls of the retaining rib and extending from the opposing cylinder end walls. Other materials offering characteristic advantages as those described for polystyrene may also be considered in the manufacturing of this new two part container lid.

The snug fitment of the partially spherical protrusions within the partially spherical indentations keeps these two hinge parts in intimate contact constraining lateral play between the respective parts and preventing the cylinder from shifting, thereby keeping a tight seal between the hatch cover part and the brim mount parts when the hatch cover part is in the fully closed position over the hatch opening. The detachable hinge provides sufficient holding power allowing the female hinge part to pivot about the male hinge part when the hatch cover part is pivoted between fully closed and fully opened positions over the hatch opening, or any intermediate position between fully closed and fully opened positions, while the snug interface of the opposing walls of the detachable hinge parts allows the hatch cover part to be pivoted and retained at other intermediate opened positions between a fully closed and fully opened position, in a hands-free manner, while constraining the hatch cover part to the brim mount part of the detachable hinge. In various preferred embodiments the hatch cover part may be able to pivot about the detachable hinge along a pivoting hinge axis parallel to the top portion of the brim mount part, wherein the top portion having a multitude of axes, one of which is parallel, between a fully closed position to a fully opened position approximating an angle approaching up to 180 degrees, thereby reaching its fully opened position providing unobstructed access to the hatch opening.

In a preferred embodiment of the present invention, the width between the inside walls forming the locking channel portion of the clamping rib is equal to, or slightly narrower than the width between the outside walls of the retaining rib thereby allowing for the locking channel to be releasably mated in a non-permanent manner through frictional fitment onto the retaining rib, releasably locking the hatch cover part in the fully closed position. This brings the hatch cover part into a coplanar relationship with the hatch opening when the hatch cover part is in the fully closed position over the hatch opening also configuring the recessed top wall of the hatch cover part as a second recessed lowered and planar region due to the coplanar relationship with the hatch opening, initially described as a first recessed raised and planar region. When the hatch cover part is in the fully closed position, annular interior rim, disposed inwardly from the base of the retaining rib second outside wall, provides a supporting surface contact area for the perimeter base of the underside bottom surface of the hatch cover part recessed top wall preventing the hatch cover part from being pressed beyond the plane of the hatch opening and possibly becoming wedged in the hatch opening thereby hampering the continued consumption of beverage and utilizing the hatch cover part to open and close access to the beverage through the hatch opening.

In still another preferred embodiment of the present invention the hatch cover part discloses a gripping tab joined to the apex of an arch at the top of the clamping rib and disposed horizontally beyond the outside perimeter edge of the ring-shaped crown portion but within the perimeter of the free edge of the bottom flange when the hatch cover part is in the fully closed position over the hatch opening. The bottom surface of the arcuate gripping tab is in intimate contact with the planar top transition surface of the ring-shaped crown portion concealing the second drinking access port when the hatch cover part is in the fully closed position. The gripping tab extends marginally beyond the first outside wall of the ring-shaped crown portion providing a front edge which may be gripped to raise and pivot the hatch cover part from a fully closed to a fully opened position and back again.

In still another further preferred embodiment of the present invention, the hatch cover part recessed top wall provides nominal vertical recessed depth within the circumscribing clamping rib to accommodate the customer's nose and top lip when drinking from the first drinking access port and tilting the head backwards to promote delivery of beverage through the first drinking access port, when the hatch cover part is in the fully closed position. When the hatch cover part is pivoted to the fully opened position, the hatch opening provides sufficient surface area and vertical recessed depth to accommodate the customer's nose and top lip when drinking from the second drinking access port and tilting the head backwards to promote beverage delivery.

Fully opening and fully closing the hatch cover part may be accomplished when the front edge, and the top and bottom surfaces of the gripping tab are gripped between the thumb and index finger and pulled upwards to gently release the frictional fitment between locking channel and retaining rib, thus pivoting hatch cover part between to a fully opened position or a multitude of intermediate opened positions therein. Alternatively, a finger or thumb of either hand may apply upward pressure to the bottom surface of the gripping tab to lift the gripping tab upwards thereby releasing the frictional fitment between locking channel and retaining rib. When the hatch cover part is pivoted to its fully opened position it first releasably disengages the locking channel from frictional fitment over the retaining rib. As the hatch cover part is pivoted to its fully opened position, the respective opposing two symmetrically positioned segments of equal length forming the symmetrically exposed extent of the perimeter of the recessed top wall between the opposing open ends of the clamping rib and the rectangular base end walls are brought into intimate contact with the planar top transition surface of the ring-shaped crown portion. At the same time the symmetrical free edges of the clamping rib second outside wall circumscribing the recessed top wall of the hatch cover part are brought into intimate contact with the first outside wall of the ring-shaped crown portion such that this contact releasably frictionally wedges the symmetrically terminated free edges of the clamping rib second outside wall symmetrically against the ring-shaped crown portion first outside wall assisting in holding the hatch cover part in the fully opened position. The symmetrically opposing free edges at the open ends of clamping rib first outside wall are not in contact with the first outside wall of the ring-shaped crown portion.

In another preferred embodiment of this new invention, the snug interface between the walls of the male and female hinge parts benefit the customer offering the option of allowing the hatch cover part to be pivoted in increments and retained at different positions partially exposing the hatch opening to control the rate of cooling of a hot beverage within the container while being pivoted between fully closed and fully opened positions or to optionally pivot the hatch cover part in a single continuous movement to either the fully opened or fully closed positions. Although designed for the detachable hinge halves to fit snugly, the smooth surface nature of the plastic moderates the friction allowing for movement between the interface of the respective surfaces of the partially spherical protrusions and partially spherical indentations, together with the snug contact between the retaining rib end walls and the cylinder end walls, permitting an unimpeded and controlled pivoting of the hatch cover part, and to retain the hatch cover part at a preferential intermediate opened position in a hands-free manner, thereby freeing the opposing hand to access the contents within the disposable container through the hatch opening with the hatch cover part held in position while the other hand grips the container outside wall. This enables the customer the ability to control exposing the hatch opening for partially cooling of a hot beverage or to pivot the hatch cover part to its fully opened position offering the broadest unobstructed access to the hatch opening for more expedited cooling or to facilitate other functions such as dunking a confection, adding toppings to the surface of the beverage, introducing utensils to retrieve toppings or stir the beverage, adding condiments, submerging and retrieving an infusion pouch, through the hatch opening without removing the lid from the rolled rim of the container and risking spills and/or injuries. Controlling the rate of cooling of a hot beverage, customizing the temperature at which a hot beverage is consumed and limits the addition of a cooling agent, thus retaining the original flavour and aroma therein through the duration of consumption of a hot beverage. Utilizing the pivoting hatch cover part to expedite beverage cooling of a hot beverage through the realisable hatch opening addresses the medical community's concerns about repeated consumption of hot beverages increasing the chances of developing cancer of the esophagus. Very hot beverages refer to drinks hotter than 65° C., which translates to about 149° F. The realisable hatch opening configuration allows for the top of the two part container lid to be fully opened expediting cooling of the beverage through a broad hatch opening to attain a personally comfortable drinking temperature, controlling and reducing scolding to the mouth and at the same time optionally using less liquid condiments to cool, and consequently dilute, the beverage, allowing for a more robust taste experience.

This new two part container lid configuration provides access to the first or second drinking access ports when the hatch cover part is respectively in the fully closed or fully opened position, and both drinking access ports when the hatch cover part is pivoted to a partially opened intermediate position. The drinking access ports, together with the exposed hatch opening, provide routes for upward splashing from the beverage surface to escape leading to spills and possibly injury. In another preferred embodiment of this new invention upwards splashing from a beverage surface due to wave-action at the beverage surface from agitation of the container is mitigated through the introduction of an anti-splash/spill apron circumscribed around the hatch opening with a downwardly disposed ring-shaped wall absorbing side-to-side sloshing of the beverage at the beverage surface thereby reducing upward splashing through the hatch opening and also through the die-cut drinking access ports.

In still another preferred embodiment of the present invention the problem of splashes and spills exiting through either, or both drinking access ports, may be further reduced through the introduction of an optional single louver or multiple louvers configured in one direction in a parallel configuration with a vertical angle and disposed integrated to the inside walls of the first and second drinking access ports, or arranged in a grate pattern integrated to the inside walls of the first and second drinking access ports. Louvers are an arrangement of parallel, horizontal or vertical blades, slats, laths made of wood, glass or other material designed to regulate airflow or light penetration respectively such as the angled louvers on room air vent covers or on window blinds. Louvers may be optionally introduced and positioned across the length and/or width of the drinking access ports, vertically angled at approximately 45° in one direction towards the beverage surface with the opposing ends of the louvers joined to the inside perimeter of the drinking access ports, die-cut at the same time as the drinking access ports.

Spills and splashes arising from the beverage surface when the container is agitated are deflected back into the container when they make contact with the underside angled louvers across the drinking access ports which act as an interference pattern, reducing the volume of beverage which might exit through the drinking access ports. Conversely, while obstructing random splashes of beverage upwards through the drinking ports the spacing between the louvers allows for the slow, controlled delivery of beverage to the customer upon tilting the container for the purposes of drinking through the drinking access ports. The louvers configure a passive interference pattern slowing beverage delivery, reducing the volume of hot or cold beverages delivered to the customer through the drinking access ports, adding a further element of safety when consuming grab-and-go on-the-go hot or cold beverages. Increasing or decreasing the dimensions of the drinking ports and or the number and dimensions of the louvers retained within the drinking access ports, will respectively increase or decrease beverage flow while continuing to restrict splashing upwards through the drinking access ports. The louvers may optionally be arranged in other interference patters within the drinking access ports such as a set of intersecting parallel louvers or a series of parallel louvers across the width of the drinking access ports. Whether one or more louvers positioned longitudinally across the drinking access ports or arranged as an intersecting set of parallel louvers, this interference pattern deflects upwardly splashed beverage back downwards into the container while allowing beverage to move through the interference configuration when the customer is drinking from the first or second drinking access ports.

Once the realisable hatch cover part is pivoted to its fully opened position there is unobstructed access to the beverage through the hatch opening. The hatch opening has a sufficiently large enough surface area to accommodate a plurality of bakers' confections of different shape, composition and dimensions, such that these confections may be safely dunked, easily immersed to varying depths through the hatch opening into a hot or cold beverage, obviating the necessity, disadvantages, risks and time-consuming practice of prying a disposable lid from the disposable container rolled rim to access the beverage within. When this new two part container lid is increased in diameter for placement over a food container, the hatch opening has a sufficiently large enough surface area to accommodate a plurality of accompanying foods of different shape, composition and dimensions for the purposes of dunking or breaking up and placing on top of, or into, the food contents within the disposable container, easily immersed to varying depths through the hatch opening into the food within the container. This broad, opened access offered by the hatch opening for food containers also provides unobstructed access to different foods, where respective utensils can easily reach the bottom of the container through the hatch opening and conveniently and smoothly retrieve the food within for consumption.

As discussed above, aside from dunking a confection and expediting cooling through the hatch opening, the customer might also utilize the hatch opening to add condiments or an infusion pouch, scoop out toppings such as whipped cream or more effectively stir the beverage, while the two part container lid remains clamped to the rolled rim of the container and access is provided through this hatch opening. Another advantage of this new invention and its variation for use with food containers is the option for the Barista and/or server to first secure the disposable beverage container two part container lid or food container lid, respectively, to the rolled rim of the disposable beverage container or food container and then pivot the respective hatch cover part to it fully open position to add beverage, or food, to the respective containers through the hatch opening, thereby avoiding the risk of spills and accidents arising when clamping a lid to the rolled rim of a beverage filled disposable container or food filled disposable container. This new invention allows toppings, such as whipped cream for specialty beverages or grated cheese added to the top of a grab-and-go pasta dish, to be added through the hatch opening with the hatch cover part remaining in the fully opened position when the respective container is served to the customer, thereby avoiding flattening the topping when a lid is clamped to the container rim, compressing the respective topping through the beverage surface or food surface, as well as toppings adhering to the underside bottom surface of the lid, diminishing the topping's appearance and value as a separate added feature to the beverage or food upon delivery. This optional beverage or food preparation process offered by this new invention ensures the disposable container is served to the customer with the two part container lid secured to the container rim against spills and splashing while also reducing accidents during the beverage or food preparation process, which may arise when clamping a respective lid to a beverage or food filled disposable container. This new invention allows the Barista and/or server the option to first pre-attach the respective two part container lid and then fill the respective beverage or food container through the hatch opening, thereby expediting both grab-and-go beverage and food delivery to the customer by saving the Barista and/or server time by not having to carefully attach the respective lids to the respective filled containers and further offers the Barista and/or server the option of serving the beverage or food container with unobstructed access to the hatch opening, thereby allowing the customer to add further condiments or to cool the contents within the container upon receipt of their grab-and-go beverage or food purchase or for the customer to pivot the hatch cover part to the fully closed position over the hatch opening.

The hatch opening and respective hatch cover part may be any shape and size, however, a circular shape conforms with standard lids and containers for accessing a beverage, but this does not preclude a square shaped hatch opening and hatch cover part from being adopted. In this new invention the hatch cover part and gripping tab have been configured to allow the two part container lid to be stacked for access and space accommodations. The hatch cover part the clamping rib and retaining rib dimensions may be adjusted to be narrower, thereby nominally increasing the area of the hatch opening while still allowing for mated frictional fitment of the respective locking channel onto the retaining rib when the hatch cover part is in the fully closed position.

A further preferred embodiment of the present invention is the optional addition of a string entry slit ruptured along one perimeter edge of the gripping tab leading to an optionally added string guide hole. A string, attached to an infusion pouch such as a tea bag, may be introduced through the string entry slit and then pulled further into the string guide hole where the string can be freely moved up and down. The string entry slit and string guide hole offer one method to manage the lowering of an infusion pouch into a beverage or pulling an infusion pouch upwards from the beverage to retrieve the pouch through the hatch opening while control of the string is maintained and does not slip into the beverage container. The string entry slit is scored through the top and bottom surfaces of the gripping tab from one side of the perimeter edge of the gripping tab which can optionally be used to wedge the string into the slit to hold the infusion pouch at a preferred height in the beverage. Additionally, a second notch, string retaining slot, may be die-cut, rupturing the opposing perimeter edge of the gripping tab directly opposite the string guide hole. This allows the customer to loop the tea bag string into the entry slit and then continue to loop the remaining string into the opposing slot, and then continue to wrap the string around the top and bottom surfaces of the gripping tab for the purposes of holding the string and the infusion pouch at a preferred height within the beverage filled container. In a further related preferred embodiment of the present invention, the hatch cover part, once pivoted to its fully opened position is inverted, providing a surface for resting a retrieved infusion pouch on the underside bottom surface of the recessed top wall of the hatch cover part allowing the slope of the hatch cover part resting on the planar top transition surface of the ring-shaped crown portion to drain infused residual beverage through gravity down the sloped underside bottom surface of the recessed top wall, returning the residual beverage through the hatch opening into the container.

Another preferred embodiment of this new invention is the ability to increase or decrease the diameter of the brim mount and hatch cover parts thereby allowing this new two part container lid to be suitably adopted to a variety of dimensioned container rolled rim diameters without affecting changes in the design elements and preferred embodiments described above beyond maintaining corresponding size changes in dimensions affecting all corresponding parts. The option to change the respective diameter of the two part container lid parts introduces other applications for this new invention for use on smaller diameter containers when serving less commonly encountered grab-and-go, on-the-go specialty drinks such as espresso shots. Accessing an espresso shot for further customization would benefit from this new two part container lid with access to the beverage contents through the hatch opening in the top portion of this new two part container lid. A more common encounter at grab-and-go fast food outlets are disposable containers with large diameter upper end openings, compared with disposable beverage containers, and designed for take-out hot and cold prepared foods. Increasing or decreasing the diameter of this new two part container lid would continue to embrace the preferred embodiments and benefits described above and identified as improvements and which can continue to be realized for use on wider and narrower diameter disposable containers. A change in the dimensions of the brim mount and hatch cover parts comprising this new two part container lid does not introduce a new species but rather represents a variation of the same species while maintaining the preferred embodiments described above.

Adopting this new invention for use on disposable food containers introduces many benefits to the broader field of grab-and-go products offered beyond that of beverages. Disposable food container/lid configurations are designed for the lid to be removed from the rolled rim of a disposable food container in order to access the food within through the upper end opening of the container. The requirement of removing a disposable food container lid to access the food within invites the same risks described above associated with the removal of a lid from a disposable beverage filled container. Adopting a variation of the present invention by way of increasing the lid diameter for use on grab-and-go disposable food containers allows the customer to access the contents within a food container through the hatch opening once the hatch cover part is pivoted to the fully opened position, without the necessity of first removing the lid to access the contents within the container, thereby reducing and/or eliminating the risks of spills and injuries which may arise when the customer attempts to pry a disposable lid from the rolled rim of a disposable food container. The same advantages offered by the articulating hatch cover part are easily realized when this variation in lid diameter is applied to use on grab-and-go disposable food containers. The hatch cover part can be partially pivoted to any intermediate position between fully closed and fully opened positions respectively, to retain food temperature or expedite cooling of the contents. The anti-splash/spill apron is still a preferred embodiment in this variation of this new invention acting to dampen side-to-side wave-action causing surface sloshing of the food contents within which may lead to upward splashing of foods through the hatch opening. The increased diameter of the hatch opening supports the use of this variation of this new invention for disposable food containers because it facilitates the use of utensils to easily access and retrieve food through the hatch opening, reaching the full depth of the container. This new two part container lid allows disposable food containers to be optionally held in one hand while using a utensil in the other, no longer requiring a support surface such as a table or counter top, to rest the container and the detached disposable lid. The pivoted hatch cover part provides unobstructed access to a broad hatch opening promoting easy maneuverability of a utensil and access to retrieve the food within the disposable container. This new invention keeps the two part container lid attached to the disposable food container while still providing access to the food within, resulting in one item to manage and discard thereby avoiding a potential mess around the meal when a lid is removed from a disposable container of hot food for example, wherein residue moisture and/or food adhering to the underside bottom surface of the disconnected lid may be accidentally transferred to the counter or table top surface and the customer. When the hatch cover part of this new two part container lid is pivoted to the fully opened position to access the contents through the hatch opening, any moisture or food adhering to the underside bottom surface of the hatch cover part from food contents within the disposable container may cascade down the sloped underside bottom surface by way of gravity back through the hatch opening into the container or remain adhering to the underside bottom surface of the hatch cover part, remote from the customer. In either scenario the attached hatch cover part pivoted to the fully opened position isolates any adhering food to the underside bottom surface of the hatch cover part, thereby reducing possible contact of the hatch cover part with the customer and with areas around the customer, increasing the hygiene around the consumption of a fast food meal, which might not otherwise be achieved with a detached disposable lid. Retaining the disposable lid to the disposable container in this new invention, while allowing access to remove food from the disposable container, eliminates the clutter of removed disposable lids occupying counter tops and taking up limited space to place dishes to receive food removed from the disposable containers. Although many disposable container/lid configurations are circular this invention may be adopted for any shape of container with a corresponding lid design where a realisable hatch opening allows access to the contents within the container without removing the lid from the rolled rim of the container. Take out food purchases may be served in rectangular shaped disposable containers with clear rectangular lids, reversibly sealing the disposable lid to the disposable container and which this new invention can be adopted where a realisable hatch opening in the top wall of the disposable rectangular lid can be accessed through a pivoting hatch cover part to remove prepared foods to be plated for serving without the necessity to remove the disposable lids to pile up and clutter the plating area. This new invention employed with these take out food container allows the customer to remove food from the container through the realisable hatch opening for serving and then to conveniently and expeditiously close the hatch cover part to retain the heat or cold of the remaining food within the container for subsequent servings.

A preferred embodiment of this new two part container lid for disposable beverage containers utilizes the inverted underside bottom surface of the hatch cover part as an optional supporting surface to drain an infusion pouch retrieved from the beverage and rested on the underside bottom surface of the recessed top wall of the hatch cover part when the hatch cover part is pivoted to its fully opened position. This same preferred embodiment can be suitably adopted when a variation of this new two part container lid is used with disposable food containers where the hatch cover part is fully opened offering the inverted underside bottom surface of the hatch cover part recessed top wall as a resting place for any accompanying foods joining the main food purchase such as crackers which might be dunked through the hatch opening into a soup, for example, within the container. This convenient optional underside bottom surface of the hatch cover part for use as a support avoids the customer using less hygienic surfaces such as table tops, benches, or the customer's lap, to rest accompanying foods such as rolls, crackers, and the like for eating with the main course or adding into the main course, as well as offering a clean support resting surface for condiments, utensils and napkins.

A preferred embodiment of this variation on this new two part container lid when adopted for use as a disposable lid for disposable food containers is the removal of the ring-shaped crown portion as the opposing drinking access ports die-cut into the planar top transition surface are not required for lids used on disposable food containers. Foods, even soups, are not typically consumed through a drinking access port. Therefore when a variation of this new two part container lid is adopted for use on a disposable food container, this variation removes the ring-shaped crown portion resulting in a further increase in the already expanded diameter of the hatch opening in the brim mount part top wall portion and the corresponding increase in the diameter of the retaining rib around the perimeter of the hatch opening, without impacting the detachable hinge between the hatch cover part and the brim mount part, wherein the hatch cover part the clamping rib undergoes a corresponding increase in diameter to fittingly mate with the corresponding increased diameter of the retaining rib to properly cover part the hatch opening when the hatch cover part is pivoted to the fully closed position.

In a further preferred embodiment of this variation on the present invention resulting from the removal of the raised ring-shaped crown portion also results in reducing the length of the segments of the exposed extent of the perimeter of the recessed top wall of the hatch cover part between the open ends of the clamping rib and the rectangular base end walls of the cylindrical housing where portions of the clamping rib have been severed and removed. The wider arc length of symmetrical segments were necessary to allow the hatch cover part to be pivoted to a substantially horizontal fully opened position when used on the smaller diameter disposable beverage containers in order to accommodate the planar top transition surface of the ring-shaped crown portion. In this variation on this new two part container lid there is no raised ring-shaped crown portion to be accommodated when the hatch cover part is pivoted to its fully opened position and therefore the arc length of the exposed perimeter segments around the extent of the recessed top wall of the hatch cover part are shorter with only a small portion of the clamping rib severed and removed leaving a narrow gap between the symmetrical open ends of the clamping rib and the end walls of the rectangular base of the cylindrical housing. This also results in the clamping rib open ends terminating intimately closer to the rectangular base end walls thereby providing increased mating between the locking channel and the retaining rib when the hatch cover part is in the fully closed position providing a better seal between the hatch cover part and the hatch opening.

Another preferred embodiment of this new invention is that this new disposable two part container lid may be manufactured in both a flat style configuration and a raised, dome style configuration of varying height above the flat version, to clamp to beverage and food disposable containers. Varying the first outside wall height of the brim mount part with or without a ring-shaped crown portion allows this new invention to be used as a flat-style lid or to raise the first outside wall to be manufactured at varying heights, including, but not limited to a dome style configuration, while the other preferred embodiments are unchanged. This is a minor variation in one dimension and does not represent the introduction of a new species, and is consistent with varying the diameter of this new invention for use on different diameter disposable drinking containers and food containers. The dome style lid variation adopted for disposable food containers allows for food to be placed higher in the container, above the plane of the upper end opening of the container and to add toppings to the food, without the risk of compressing the food or the toppings when a dome lid is clamped to the rolled rim of a disposable food container with the hatch cover part in the fully closed position or when food and toppings are introduced through the hatch opening of a pre-attached disposable two part container lid with the hatch cover part in the fully opened position and then to optionally close the hatch cover part. Similarly, varying the height of the first outside wall during manufacturing allows for this new two part container lid to be used on drink containers with added toppings to the surface plane of the beverage without these added toppings becoming compressed into the beverage when a dome lid of suitable height is clamped to the rolled rim of the beverage container.

This new invention introduces a disposable container two part container lid with many novel features which the foregoing and numerous other objects, features and advantages of one or more aspects of this new invention will become readily apparent upon consideration of the drawings and reading the detailed description and claims set forth herein.

BRIEF DESCRIPTION OF DRAWINGS

The following figures depict the contours and contrasts of all surfaces and hidden elements configuring the part shapes and relationships constructed in accordance with the principles of the invention. The drawings are for the purposes of illustration only and not limitation, disclosing the preferred embodiments of the invention in which:

FIGS. 6A1-12 are partial top plan views on a larger scale showing alternative configurations for drinking access ports in FIG. 6.

FIG. 10 is a top plan view representing the dome lid and flat lid configurations in FIG. 8A and FIG. 9A, respectively.

FIG. 12 is a perspective top view of the dome lid configuration, mounted to the rolled rim of a beverage container, compressed for ease of illustration, with the hatch cover part in a partially opened position.

FIG. 21F-1 is a partial perspective view on a larger scale of a portion of the dome lid configuration in FIG. 21F.

FIG. 21F-2 is perspective top view of the dome brim mount part mounted to the rolled rim of a beverage container with the disconnected inverted hatch cover part resting on a surface adjacent to the beverage container wherein a customer is dunking a confection through the hatch opening into a beverage within the container.

FIG. 21F-3 is a perspective top view of the dome brim mount part mounted to the rolled rim of a beverage container with the inverted disconnected hatch cover part resting on a surface adjacent the beverage container wherein a portion of a confection is resting on the underside bottom surface of the hatch cover part.

DETAILED DESCRIPTION OF DRAWINGS

Figure 1A:
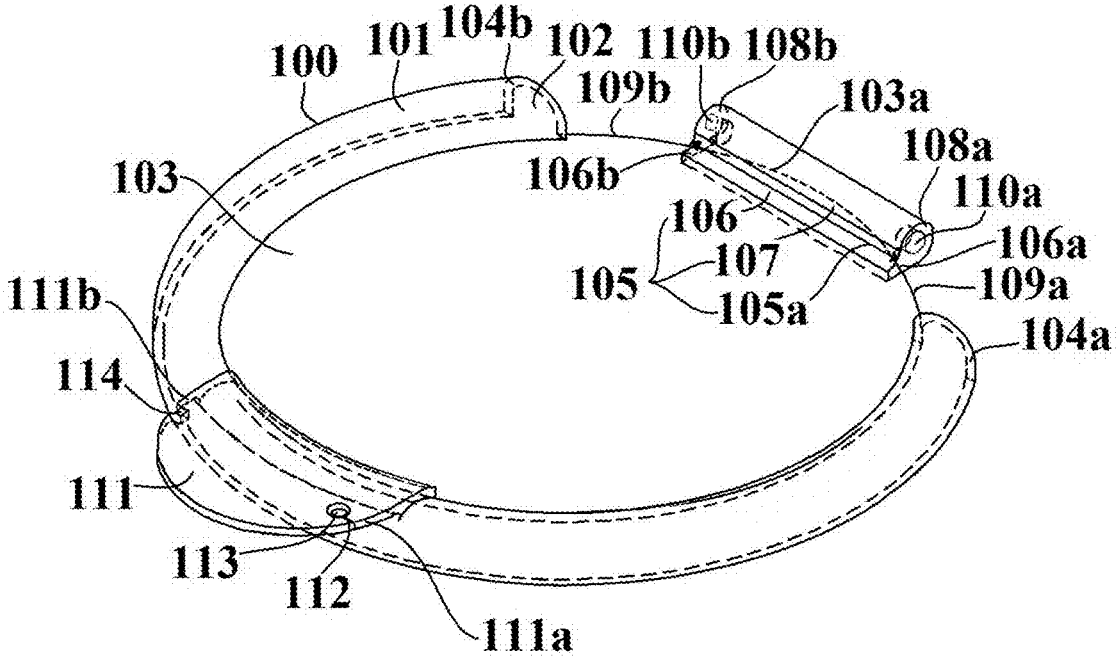
FIG. 1A is a perspective top view of the hatch cover part.

The invention will hereafter be described with reference to the accompanying drawings, wherein like reference numerals denote like elements, and it will be understood that the foregoing description is of preferred exemplary embodiments and advantages thereof and that the invention is not limited to the specific forms shown. Other variations may be made in the design and arrangement of the elements without departing from the scope of the invention as expressed in the appended claims. The novel features which are believed to be characteristic of the present invention, as to its structure, organization, use and method of operation, together with further objectives will be better understood from the following discussion.

Referring to FIG. 1A, a first preferred embodiment in keeping with the principles of the present invention, illustrates a perspective top view of hatch cover part 100 with a raised outer clamping rib 101 (partially shown with phantom lines), with locking channel 102 (phantom lines) therein, substantially, but not completely, enclosing the perimeter of a second recessed lowered and planar region top wall 103 of hatch cover part 100. Two opposing truncations sever clamping rib 101 creating two symmetrically opposing open ends 104*a* and 104*b*. A cylindrical housing 105, disposed from recessed top wall 103, is centrally positioned between open ends 104*a* and 104*b* with a cylindrical housing length 105*a* (solid line with double-headed arrows) which may vary in dimensional length at time of manufacture. Cylindrical housing 105 further comprises a rectangular base 106 (phantom lines) joined to recessed top wall 103 configured partially extending outwardly over recessed top wall perimeter edge 103*a* (solid and phantom lines) and a cylinder 107 of equal length disposed upwards resting blended on top of rectangular base 106. Cylinder 107 is configured with two opposing cylinder end walls 108*a* and 108*b*. Two symmetrically opposing equidistant segments 109*a* and 109*b* are disposed around recessed top wall perimeter edge 103*a* (solid and phantom lines) interposed between open ends 104*a* and 104*b* and rectangular base end walls 106*a* and 106*b*, wherein equal sections clamping rib 101 are severed and removed.

In a preferred embodiment of hatch cover part 100, cylindrical housing 105 represents the female hinge part of a detachable hinge with retaining means to confine partially spherical protrusions within opposing recesses of partially spherical indentation 110*a* and 110*b* (phantom and solid lines), depending inwards from opposing cylinder end walls 108*a* and 108*b*.

A further preferred embodiment of hatch cover part 100 is gripping tab 111, disposed outwardly from the top of clamping rib 101, positioned diametrically opposite cylindrical housing 105. Gripping tab 111 may optionally include a string entry slit 112, scored through gripping tab 111, inwardly dependent from a first side perimeter edge 111*a* of gripping tab 111. String entry slit 112 may then optionally open into an annular string guide hole 113 die-cut through gripping tab 111. On the diametrically opposite second side perimeter edge 111*b* (solid and phantom lines) of gripping tab 111, an optional string retaining slot 114 may be added, formed inwardly therefrom die-cut through gripping tab 111. The position of string entry slit 112, string guide hole 113, and string retaining slot 114 are not confined to these locations on gripping tab 111 and may be reversed, as well, the length of string entry slit 112 and diameter of string guide hole 113, may respectively vary in size.

Figure 1B:
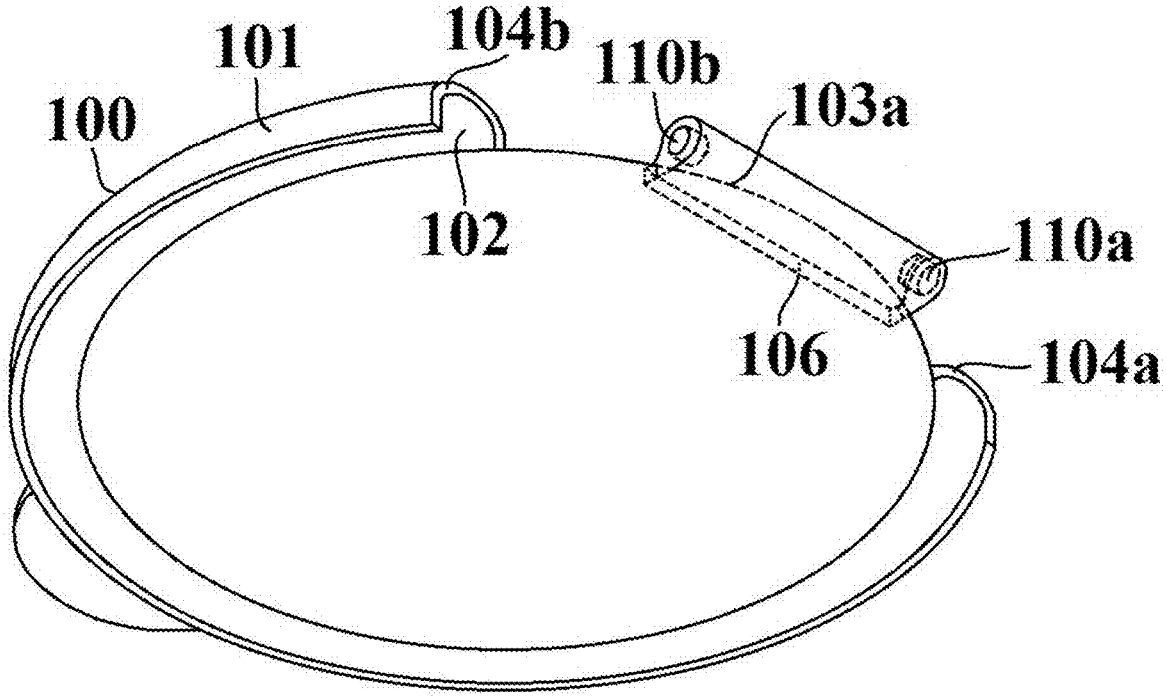
FIG. 1B is a perspective bottom view of the hatch cover part in FIG. 1A.

FIG. 1B is a perspective bottom view of hatch cover part 100 in FIG. 1A showing locking channel 102 formed within clamping rib 101. Partially spherical indentation 110*a* and 110*b* (solid and phantom lines) and open ends 104*a* and 104*b* are also shown. Rectangular base 106 is shown blended in part to recessed top wall perimeter edge 103*a* (solid and phantom lines).

Figure 2:
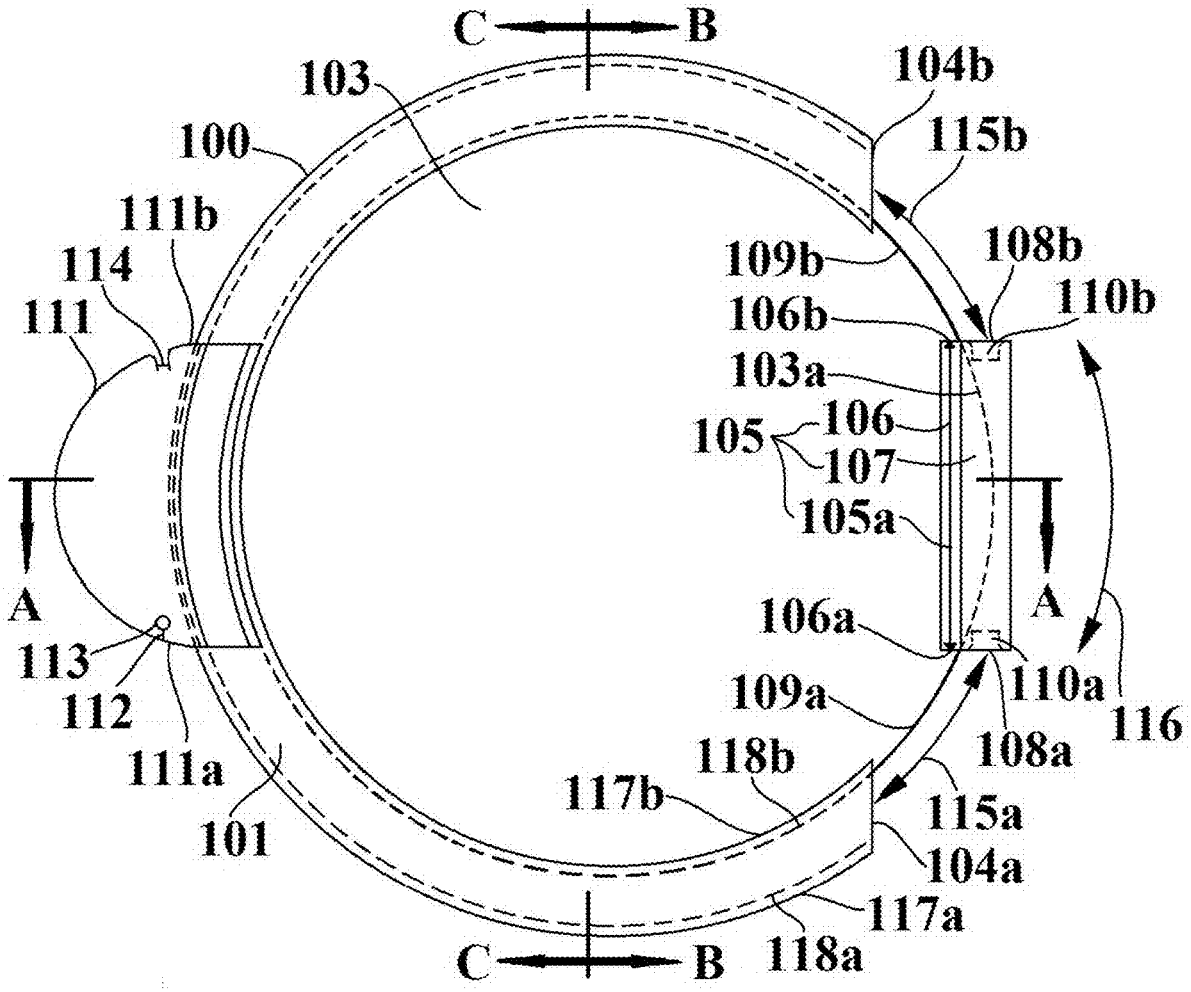
FIG. 2 is a top plan view of the hatch cover part in FIG. 1A.

FIG. 2 is a top plan view of hatch cover part 100 in FIG. 1A showing cylindrical housing 105, rectangular base 106, cylinder 107 and cylindrical housing length 105*a* (solid line with double-headed arrows) disposed at one end of recessed top wall 103 with partially spherical indentation 110*a* and 110*b* (phantom lines) inwardly dependent from cylinder end walls 108*a* and 108*b*. Cylindrical housing 105 extends over recessed top wall perimeter edge 103*a* (solid and phantom lines). The two symmetrically opposing equidistant segments 109*a* and 109*b* are defined by segment arc lengths 115*a* and 115*b* (curved line with double-headed opposing arrows), respectively drawn between open ends 104*a* and 104*b* and rectangular base end walls 106*a* and 106*b*. The space occupied by cylindrical housing 105 is further defined by a single cylinder arc length 116 (curved line with double-headed opposing arrows). The length of segment arc lengths 115*a* and 115*b* and cylinder arc length 116 may vary accordingly with the size of hatch cover part 100 and its respective parts and other variations on dimensions introduced at the time of manufacturing. Open ends 104*a* and 104*b* terminate clamping rib first outside wall 117*a* and second outside 117*b* and locking channel first inside wall 118*a* (phantom lines) and second inside wall 118*b* (phantom lines). Gripping tab 111 is disposed diametrically opposite cylindrical housing 105, extending outwardly from the top of clamping rib 101. This plan view illustrates the spatial arrangement of scored string entry slit 112, disposed from a first side perimeter edge 111*a*, string guide hole 113, and string retaining slot 114 disposed from opposite second side perimeter edge 111*b* of gripping tab 111.

Figure 3A:
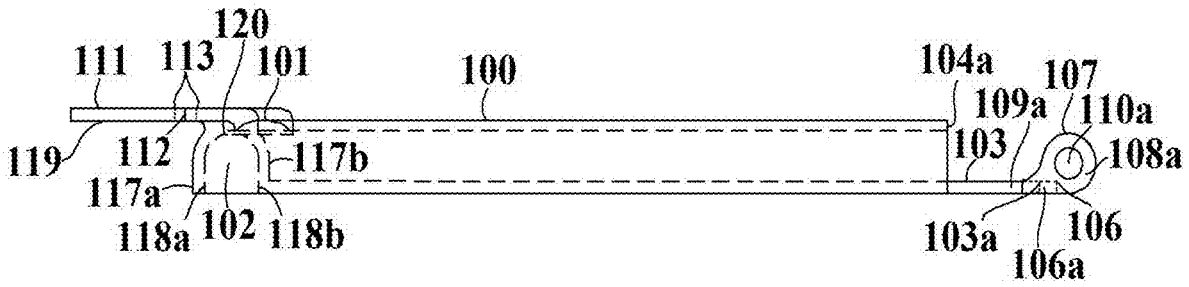
FIG. 3A is a side view in section of the hatch cover part taken substantially along line A-A in FIG. 2.

FIG. 3A is a side view in section of hatch cover part 100 taken substantially along line A-A in FIG. 2. Gripping tab 111 bottom surface 119 is joined to clamping rib arch 120 at the top of clamping rib 101. Clamping rib 101 is defined by first outside wall 117*a* and second outside wall 117*b*, and locking channel 102 is defined by first inside wall 118*a* and second inside wall 118*b*. Open ends 104*a* and 104*b* (104*b* not shown), are separated from rectangular base end walls 106*a* and 106*b* (106*b* not shown), by segments 109*a* and

109*b* (109*b* not shown). Rectangular base 106 is blended to recessed top wall 103 and extends over recessed top wall perimeter edge 103*a* and is interposed between the bottom of cylinder 107 and recessed top wall 103. Cylinder 107 is further defined by partially spherical indentation 110*a* and 110*b* (110*b* not shown), centrally positioned on, and inwardly dependent from, cylinder end walls 108*a* and 108*b* (108*b* not shown). String entry slit 112 is defined by a single solid vertical line and string guide hole 113 by two parallel vertical phantom lines, one on either side of string entry slit 112.

Figure 3B:
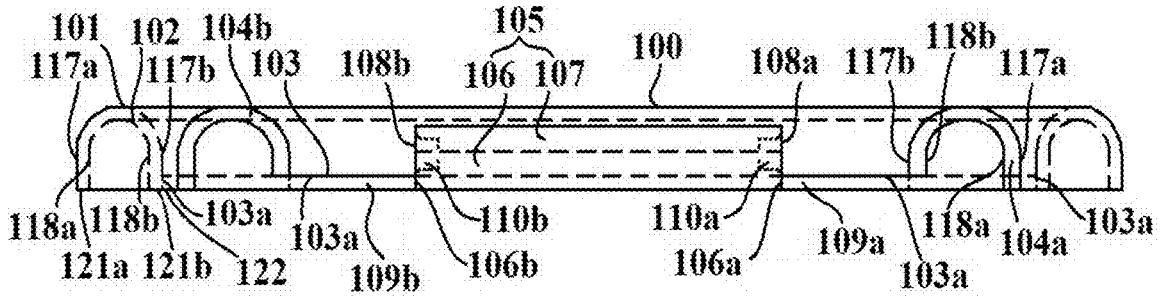
FIG. 3B is a side view in section of the hatch cover part taken substantially along line B-B in FIG. 2.

FIG. 3B is a side view in section of hatch cover part 100 taken substantially along line B-B in FIG. 2. Clamping rib 101 are shown in section (with phantom and solid lines) to the extreme right and left in FIG. 3B defining their respective formation around recessed top wall perimeter edge 103*a* (phantom lines) and are further comprised of clamping rib first outside wall 117*a*/locking channel first inside wall 118*a* and clamping rib first outside wall/locking channel first inside wall base 121*a*, and clamping rib second outside wall 117*b*/locking channel second inside wall 118*b* and clamping rib second outside wall/locking channel second inside wall base 121*b*. Clamping rib second outside wall 117*b*/locking channel second inside wall 118*b* base 121*b* is contiguous to, and blends into underside bottom surface 122 of recessed top wall 103 of hatch cover part 100. A second sectional view of clamping rib 101/locking channel 102 is shown with open ends 104*a* and 104*b* defining the symmetrical severing location of clamping rib 101/locking channel 102 with clamping rib first outside wall 117*a*/locking channel first inside wall 118*a* and clamping rib second outside wall 117*b*/locking channel second inside wall 118*b* defined once again. Each open end 104*a* and 104*b* is separated from the respective rectangular base end walls 106*a* and 106*b* by equidistant segments 109*a* and 109*b* around an exposed recessed top wall perimeter edge 103*a* (solid lines), interposed between clamping rib second outside wall 117*b*/locking channel second inside wall 118*b* and rectangular base end walls 106*a* and 106*b*. Cylinder end walls 108*a* and 108*b* are further defined by inwardly disposed partially spherical indentation 110*a* and 110*b* (phantom lines). Parallel horizontal phantom lines extending from the opposing cylinder end walls 108*a* and 108*b* across the length of cylindrical housing 105 identify interposed rectangular base 106 between recessed top wall 103 and the bottom of cylinder 107.

Figure 3C:
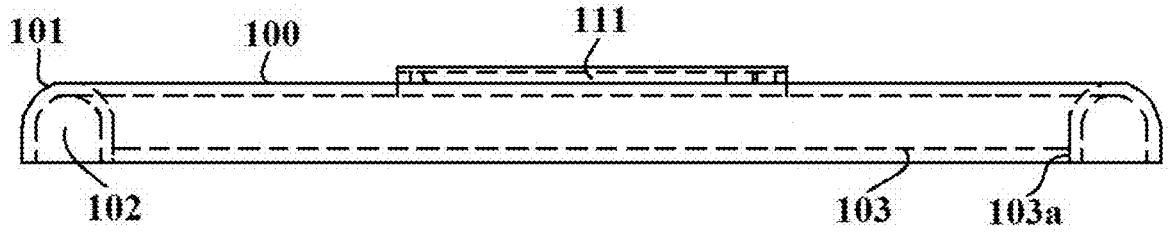
FIG. 3C is a side view in section of the hatch cover part taken substantially along line C-C in FIG. 2.

FIG. 3C is a side view in section of hatch cover part 100 taken substantially along line C-C in FIG. 2. Clamping rib 101/locking channel 102 are shown around recessed top wall perimeter edge 103*a* (phantom lines). Gripping tab 111 joined to the top of clamping rib 101.

Figure 4A:
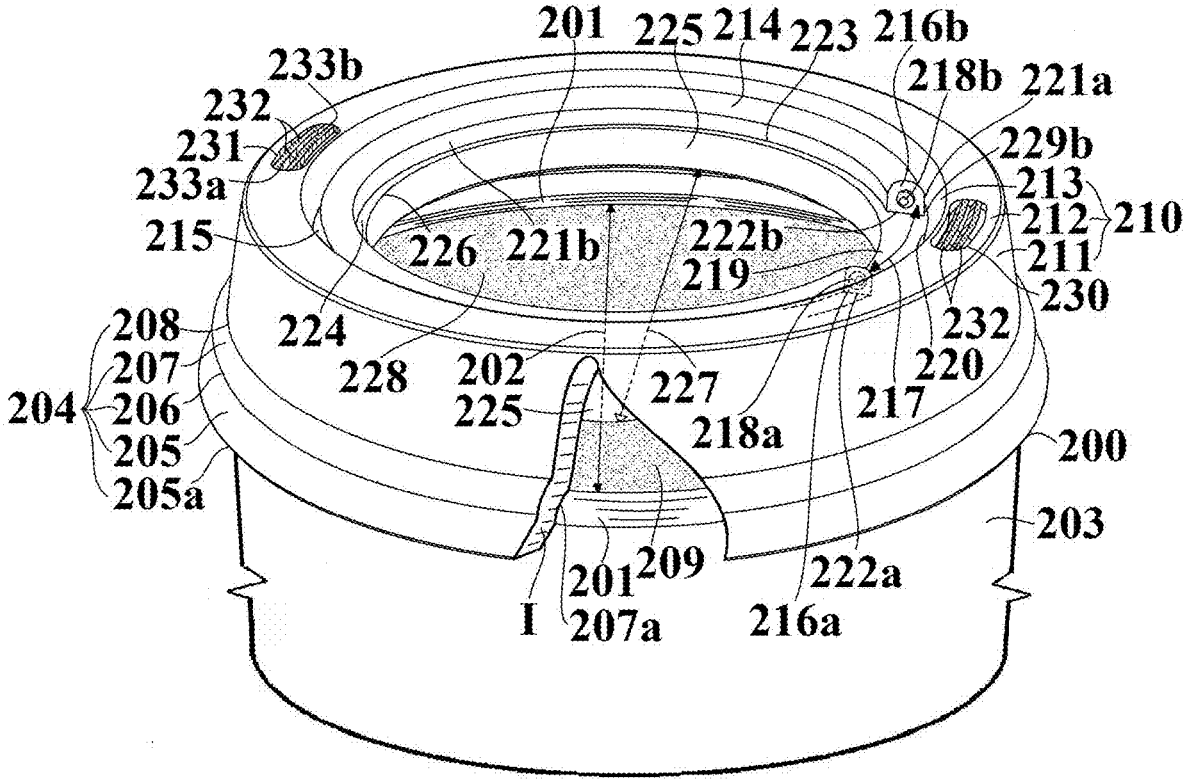
FIG. 4A is a perspective top view of the dome brim mount part mounted to the rolled rim of a beverage container compressed for ease of illustration.

FIG. 4A is a perspective top view of dome brim mount part 200 sized to fit over, and reversibly, securely seal to an upper end peripheral rolled rim 201 around the upper end opening 202 (solid and phantom lines with double-headed opposing arrows) of disposable beverage container 203 (compressed for ease of illustration), made in a suitable manner.

Dome brim mount part 200 comprises an annular configuration to conform to the shape and size of upper end opening 202 of disposable beverage container 203. The base of dome brim mount part 200 is defined by an annular skirt 204 comprised of a perimeter continuous bottom flange 205 with an outside perimeter free edge 205*a*. A lower furrow 206 is contiguous between the top of bottom flange 205 and the bottom of a clamping curvature 207 outwardly disposed radially therefrom an upper end of annular skirt 204 with an interior sealing curvature 207*a* therein (see cut-away I). A second upper furrow 208 is formed at the top of clamping curvature 207 and interior sealing curvature 207*a*, thereby sandwiching clamping curvature 207/interior sealing curvature 207*a* between lower furrow 206 and upper furrow 208, wherein interior sealing curvature 207*a* is radially directed in a reversible non-permanent frictionally mated fitment over rolled rim 201 thereby retaining container lid attached to container 203, thus preventing leakage of beverage 209 from container 203 as shown in cut-away I. A furrow by definition is roughly triangular in cross section that rounds off an interior angle between two surfaces. Bottom flange 205 and outside perimeter free edge 205*a* serve as a pilot guide diameter portions to assist in mounting interior sealing curvature 207*a* onto rolled rim 201. Cut-away I, in the annular skirt 204, illustrates bottom flange 205 and interior sealing grove 207*a* cooperatively working as rim-engaging means adapted to clamp interior sealing grove 207*a* to rolled rim 201, reversibly engaging dome brim mount part 200 onto rolled rim 201 in a mutually reversible non-permanent relatable locking relationship. Interior sealing curvature 207*a* clamps dome brim mount part 200 safely and reliably to rolled rim 201 without the risk that dome brim mount part 200 may become inadvertently detached from disposable beverage container 203, thereby reducing pop-off incidents and providing a more secure lid fit, thereby reducing leakage and dribble of beverage 209 at the interface between dome brim mount part 200 and rolled rim 201.

Another preferred embodiment in keeping with the principles of the present invention is an elevated raised and planar region forming a substantially ring-shaped crown portion 210 comprised of a first outside wall 211, upwardly dependent from upper furrow 208 to planar top transition surface 212. Planar top transition surface 212 (also see FIG. 4B) is inwardly dependent from the top of first outside wall 211, terminating at the top of a second outside wall 213 (also see FIG. 4B), which depends downwardly therefrom.

Figure 4B:
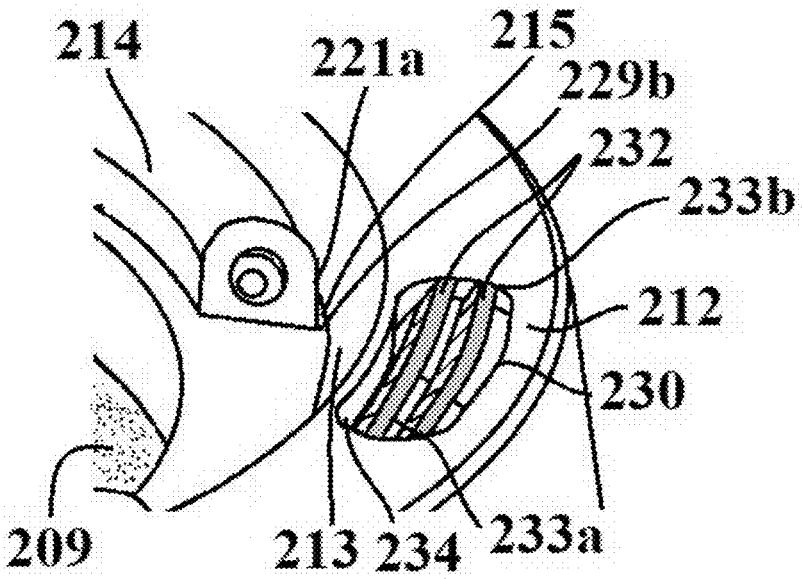
FIG. 4B is a partial perspective view on a larger scale of a portion of the dome brim mount part in FIG. 4A.

In a further preferred embodiment a retaining rib 214 (also see FIG. 4B) is formed concentrically within the inside perimeter of second outside wall 213, separated from second outside wall 213 by u-shaped trough 215 (also see FIG. 4B). Retaining rib 214 is symmetrically severed forming opposing end walls 216*a* (phantom lines) and 216*b* (also see FIG. 4B) separated by first gap 217 (solid line with double-headed opposing arrows, also see FIG. 6) which is equal in length or marginally less in length than the cylindrical housing length 105*a* in FIG. 2. Two opposing partially spherical protrusions 218*a* (phantom lines) and 218*b* (also see FIG. 4B), centrally separately and extending horizontally respectfully therefrom end walls 216*a* (phantom lines) and 216*b*, represent the male hinge part of a detachable hinge. An interposed planar transition panel 219 (also see FIG. 4B) is contoured to second outside wall bottom furrow 220 (also see FIGS. 4B and 7A) at the base of second outside wall 213, and is horizontally inwardly disposed therefrom, with an optional low angled downward slope, extending past retaining rib first outside wall 221*a* (also see FIG. 4B) and joined to the base of opposing end wall furrows 222*a* (phantom lines) and 222*b* (also see FIG. 4B), respectively, at the base of end walls 216*a* (phantom lines) and 216*b*. Planar transition panel 219 continues to extend beyond retaining rib second outside wall 221*b* (also see FIG. 4B) and retaining rib 214 second outside wall bottom furrow 223 (also see FIG. 4B and FIG. 7A) at the base of retaining rib second outside wall 221*b* and blends into annular interior rim 224 (also see FIG. 4B) which encircles the inside perimeter of retaining rib second outside wall 221*b*. Retaining rib second outside wall bottom furrow 223 separates retaining rib second outside wall 221*b* from annular interior rim 224.

In a further preferred embodiment of dome brim mount part 200, an anti-splash/spill apron 225 ring-shaped wall (also see FIG. 4B) may be optionally formed, downwardly dependent from annular interior rim perimeter edge 226 (also see FIG. 4B) circumscribing annular interior rim 224, whereby annular interior rim 224 and optional anti-splash/spill apron 225 define a first recessed lowered and planar region of hatch opening 227 (solid and phantom lines with double-headed opposing arrows). Anti-splash/spill apron 225 is comprised of a circumscribing ring-shaped wall (also see anti-splash/spill apron 225 through recessed hatch opening 227 above rolled rim 201) partitioning a top portion of beverage 209 therein disposed at an upper end of container 203 and an area configured above beverage surface plane 228, as shown in cut-away I (also see FIG. 7A) of beverage 209 in upper end opening 202 of container 203, into an interior space within said anti-splash/spill apron 225 and an exterior space above the top portion of beverage 209 between ring-shaped outside wall of anti-splash/spill apron 225 and an inside wall surface of said container 203 and an area configured above beverage surface plane 228 and below a planar top transition under surface 235 (also see FIG. 4C) of ring-shaped crown portion 210, and also above rolled rim 201 observed through recessed hatch opening 227 diametrically opposite cut-away I. Anti-splash/spill apron 225 forms a partially peripheral barrier above beverage surface plane 228 to disrupt and dampen side-to-side wave-action at beverage surface plane 228 from the sloshing of beverage 209, necessarily caused by handling of container 203 and even nominal movement of beverage 209 filled disposable container 203 arising during transport of disposable container 203 thereby reducing splashing upwards through recessed hatch opening 227 when hatch part 100 (also see FIGS. 8A, 12 and 16A) is pivoted to the fully closed or fully opened position, or any intermediate position in between, and/or also from beverage 209 splashing upwards through diametrically opposing first 230 (also see FIG. 4A) and/or optionally added second 231 (also see FIG. 4A) drinking access ports die-cut through planar top transition surface 212.

In still another preferred embodiment of the present invention u-shaped trough 215 conveys beverage 209 splashed upwards through recessed hatch opening 227, over retaining rib 214, and/or through first 230 and second 231 drinking access ports, cascading down second outside wall 213 and retaining rib first outside wall 221*a* to collect in u-shaped trough 215. U-shaped trough 215 terminates at the opposing end walls 216*a* (phantom lines) and 216*b* providing dual spillways 229*a* (229*a* not visible in FIG. 4A) and 229*b* (also see FIG. 4B), symmetrically disposed on opposite sides adjacent opposing end walls 216*a* (phantom lines) and 216*b* between the end of retaining rib first outside wall 221*a* and second outside wall 213 of ring-shaped crown portion 210, delivering collected beverage 209 onto planar transition panel 219, and further delivering liquid spillage over annular interior rim 224, down anti-splash/spill apron 225 ring-shaped wall and through recessed hatch opening 227 back into disposable beverage container 203.

In yet another preferred embodiment of dome brim mount part 200 a first drinking access port 230 is centrally die-cut through into the planar top transition surface 212 of the ring-shaped crown portion 210 along a central line across the top portion of the brim mount part 200 and adjacent the first gap 217 between the end walls 216*a* and 216*b*, and a second drinking access port 231 is optionally die-cut through planar top transition surface 212 diametrically opposite first drinking access port 230. Both drinking access ports may vary in shape from circular to oblong and oval or parabolic with varying marginally different surface area dimensions and will be further discussed under FIGS. 6A1-12.

The first drinking access port 230 and the second drinking access port 231 die-cut in planar top transition surface 212 of ring-shaped crown portion 210 may allow upwardly splashed beverage 209 to escape through the drinking access ports onto the top of brim mount part 200 and potentially onto the customer when the container is agitated. In a preferred embodiment in keeping with the principles of the present invention a single louver or multiple louvers 232 (shaded, also see FIG. 4B) may be optionally configured at a vertical angle within the first 230 and second 231 drinking access ports to dampen beverage 209 from splashing upwards through the drinking access ports. Louvers 232 may be die-cut at the same time as the first 230 and second 231 drinking access ports are die-cut into the planar top transition surface 212. The louver opposing ends 233*a* and 233*b* (see FIG. 4B) are integrated into the drinking access port inside wall 234 (see FIG. 4B) across the length or the width of the drinking access ports depending on the shape of drinking access port adopted (see FIGS. 6A1-12). Louvers 232 may also be arranged as an intersecting parallel set of louvers 232 configuring a grate interference pattern (see FIG. 6A-4) or as a set of parallel louvers 232 across the width of drinking access ports to dampen upward splashing of beverage 209 (see FIG. 6A-3) through the respective drinking access ports. Additionally louvers 232 may block suspended organic infusion substances from passing through the drinking access ports during beverage 209 consumption. The optional introduction of louvers 232 across the drinking access ports offers an alternative to splash sticks designed to be temporarily inserted into drinking access ports in the ring-shaped crown portion of disposable lids clamped to disposable containers to stop beverage from splashing upwards through the drinking access port. While louvers 232 do not plug the entire drinking access port in this new invention in the same way as splash sticks, louvers 232 offer some mitigation to restrict splashing through the drinking access ports in a more passive configuration. Louvers 232 dampen splashing without the introduction of another accessory joining the beverage purchase which must be manipulated and managed along with the disposable beverage container, disposable beverage container lid, utensils and condiments.

The louver 232 preferred embodiment was adopted as they mimic the angled louvers of room air vent covers. These vents direct air into a room while restricting reverse air flow partially due to the angle of the louvers. In the same manner as air flow is restricted, spills and splashes rising upwards from beverage surface plane 228 through sudden movements of disposable beverage container 203 may also be deflected back into disposable beverage container 203 when the splashed beverage makes contact with the louvers 232 across the first 230 and second 231 drinking access ports, respectively; thereby reducing the volume of beverage 209 which might escape and potentially make contact with the customer and other surface areas. However, while obstructing spills and splashes of beverage 209 upwards through the drinking access ports, the spacing between louvers 232 may also allow for the slow, controlled delivery of beverage 209 to the customer upon tilting disposable beverage container 203 for the purposes of drinking through the first drinking access port 230 or second drinking access port 231. Louvers 232 offer a dampening effect, slowing beverage delivery, and reducing the volume of a hot or cold beverage 209 delivered to the customer through the drinking access ports, adding a further element of safety when consuming hot grab-and-go beverages while on-the-go. Optionally, the length and/or width dimensions of the first 230 and second 231 drinking access ports may be marginally increased or decreased with the corresponding dimensions of the louvers 232 adjusted accordingly, thereby respectively, increasing or decreasing beverage 209 flow while continuing to restrict splashing upwards through the drinking access ports. Additionally the shape of the respective drinking access port may also change together with the number and positioning of louvers 232 as further discussed and shown under FIG. 6A1-12.

Figure 13:
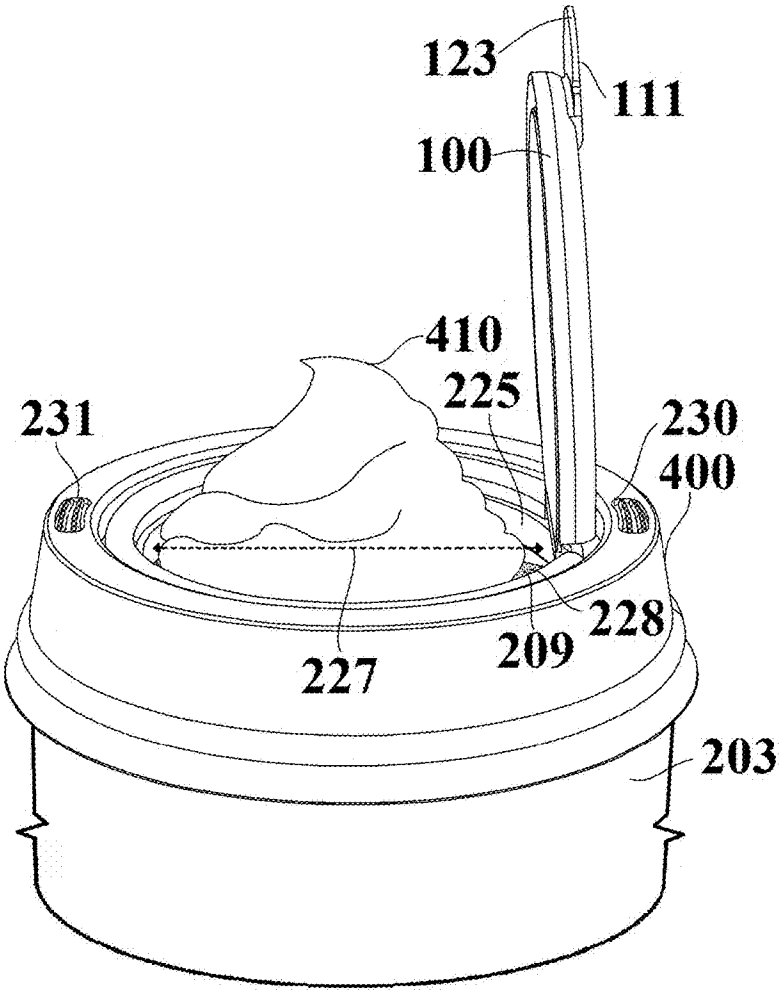
FIG. 13 is a perspective top view of the dome lid configuration, mounted to the rolled rim of a beverage container, compressed for ease of illustration, with the hatch cover part opened to approximately a 90° angle showing a whipped topping resting on the beverage surface plane.

The broad hatch opening allows toppings such as whipped cream to be added to beverage surface plane 228 with a desired width and height within recessed hatch opening 227 offering desired value to the customer in both appearance and for consumption purposes (also see FIG. 13). Recessed hatch opening 227 may be marginally increased in diameter by narrowing the width and increasing the length of the respective first 230 and second 231 drinking access ports, retaining suitable beverage delivery, which would allow for a narrowing of the width between the first 211 and second 213 outside walls of ring-shaped crown portion 210 and the width between the first 221*a* and second 221*b* outside walls of retaining rib 214, subsequently increasing their respective circumferences and also the corresponding diameter of the anti-splash/spill apron 225 and therefore increasing the circumference and surface area of the recessed hatch opening 227 to receive a broader variety of different sized confections to be optionally and conveniently dunked and retrieved within a time that allows beverage 209 to infuse the confection for a more enjoyable beverage/confection experience without the confecting breaking apart and remaining in beverage 209.

FIG. 4B is a partial perspective top view on a larger scale of a portion of dome brim mount part 200 in FIG. 4A showing louvers 232 (shaded) opposing ends 233*a* and 233*b* integrated into drinking access port inside wall 234 longitudinally across the length of the first 230 and second 231 (231 not shown in FIG. 4B). Louvers 232 are contoured to match the shape and dimension of the first 230 and second 231 (231 not shown in FIG. 4B) drinking access ports. Louvers 232 are shown with a vertical angled configuration and may be optionally designed with the same thickness as the drinking access port inside wall 234 (see FIG. 7B), or configured with a marginally increased vertical dimension, with the top of the louver 232 flush with planar top transition surface 212 but extending marginally below planar top transition undersurface 235 (see FIG. 7C) increasing the barrier to upward splashing of beverage 209 through the drinking access port while still allowing beverage 209 to pass through when the customer is drinking from either the first 230 or second 231 drinking access ports. Beverage 209 flow might be dampened due to louvers 232 such that a slower volume delivery may have benefits when first consuming a hot beverage. The angle and thickness of louvers 232 combine to reduce splashing of beverage 209 through the first 230 and second 231 (231 not shown FIG. 4B) drinking access ports while still allowing beverage 209 to pass through. U-shaped trough 215 is shown between second outside wall 213 and retaining rib 214 first outside wall 221*a* with spillway 229*b*.

Figure 4C:
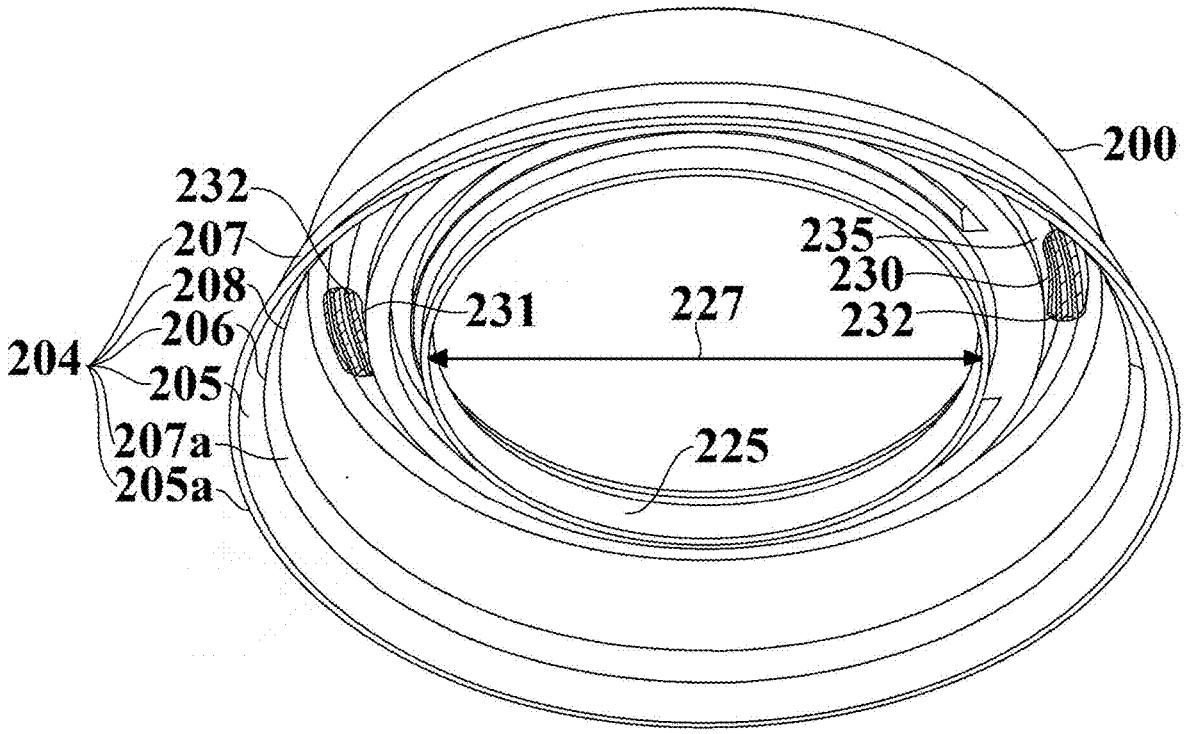
FIG. 4C is a perspective bottom view of the dome brim mount part in FIG. 4A.

FIG. 4C is a perspective bottom view of dome brim mount part 200 in FIG. 4A showing anti-splash/spill apron 225 encircling recessed hatch opening 227 (solid line with double-headed opposing arrows). The planar top transition undersurface 235 is viewed from the underside showing louvers 232 on the reverse side of the first 230 and second 231 drinking access ports. Annular skirt 204 is viewed from the inside showing bottom flange 205 and outside perimeter free edge 205*a* with interior sealing curvature 207*a* interposed between lower furrow 206 and upper furrow 208 and opposite outside clamping curvature 207 (see FIG. 4A).

Figure 4D:
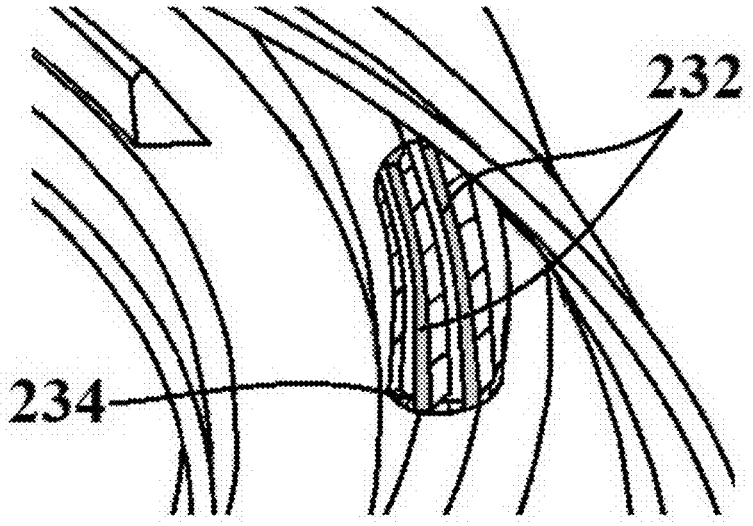
FIG. 4D is a partial perspective view on a larger scale of a portion of the dome brim mount part in FIG. 4C.

FIG. 4D is a partial perspective bottom view on a larger scale of a portion of dome brim mount part 200 in FIG. 4C again showing louvers 232 integrated to drinking access port inside wall 234 as previously discussed under FIG. 4B. This enlarged view further illustrates the angled slant of louvers 232 to deflect upwardly splashed beverage 209 back into disposable beverage container 203 (FIG. 4A). Louvers 232 are configured at an angle (see FIGS. 7B and 7C) to deflect upwardly splashed beverage 209. This does not preclude configuring louvers 232 vertically at 90° (see FIG. 7D) or any other angle which might allow for maximum deflection of splashed beverage 209 while also permitting beverage 209 flow past louvers 232 when consuming beverage 209 and drinking from first 230 or second 231 drinking access ports.

Figure 5A:
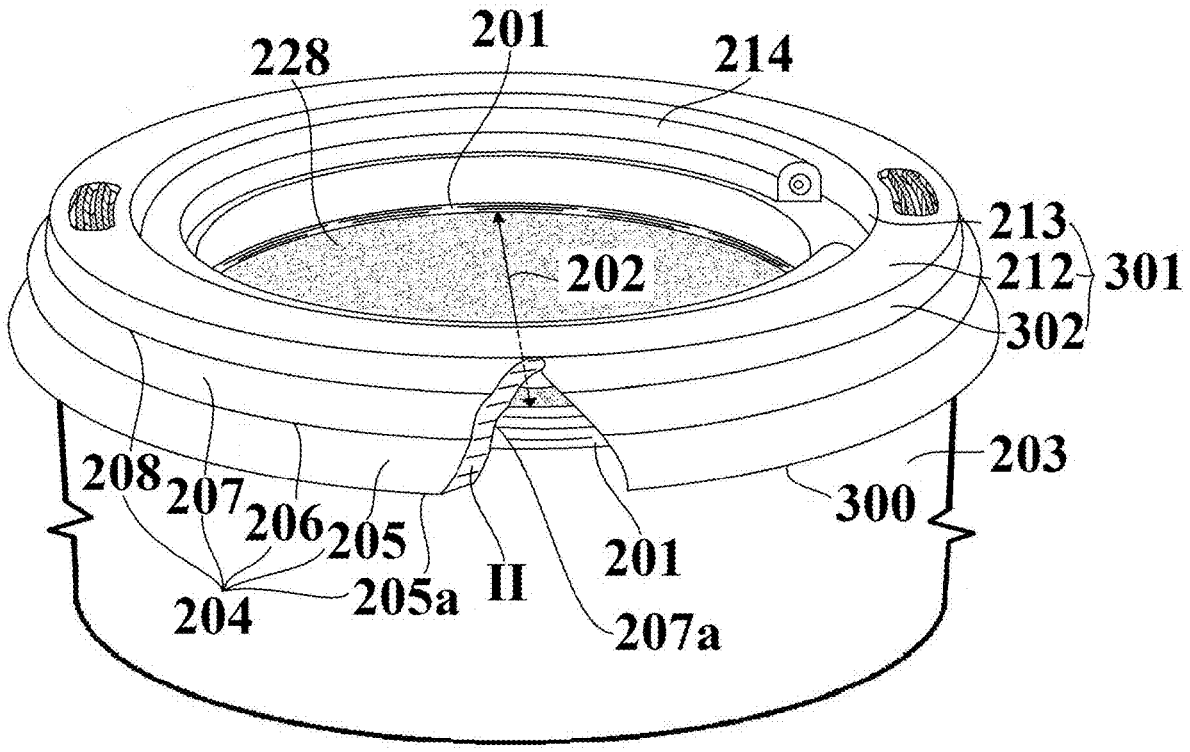
FIG. 5A is a perspective top view of the flat brim mount part, mounted to the rolled rim of a beverage container compressed for ease of illustration.

FIG. 5A shows a perspective top view of flat brim mount part 300 where first outside wall 211 in FIG. 4A is compressed vertically to form compressed ring-shaped crown portion 301 comprised of compressed first outside wall 302 and retains planar top transition surface 212 and second outside wall 213 seen in FIG. 4A. The formation of flat brim mount part 300 results in changing one dimension, first outside wall 211 height in FIG. 4A, while the physical characteristics and relationships of all other parts described in FIG. 4A remain unchanged in FIG. 5A. The annular skirt 204 has not been affected with the formation of compressed first outside wall 302. Cut-away II shows annular skirt 204, comprised of a perimeter bottom flange 205 and outside perimeter free edge 205*a* with clamping curvature 207 and interior sealing curvature 207*a*, interposed between lower furrow 206 and upper furrow 208. Similarly bottom flange 205 and outside perimeter free edge 205*a* serves as pilot guide diameter portions to assist in mounting interior sealing curvature 207*a* onto rolled rim 201 in cut-away II reversibly clamping interior sealing curvature 207*a* onto rolled rim 201 engaging flat brim mount part 300 to rolled rim 201 of disposable beverage container 203 (compressed for ease of illustration) in a reversible non-permanent relatable locking relationship as shown in FIG. 4A. The height of second outside wall 213 has not changed and therefore the relative height of compressed ring-shaped crown portion 301 has not changed compared with the height of retaining rib 214 as shown in FIG. 4A. However, the physical relationship between flat brim mount part 300 and disposable beverage container 203 has been affected resulting in lowering compressed ring-shaped crown portion 301 and retaining rib 214 closer to the upper end opening 202 (solid and phantom lines with double-headed opposing arrows) of disposable beverage container 203 and subsequently beverage surface plane 228.

Figure 5B:
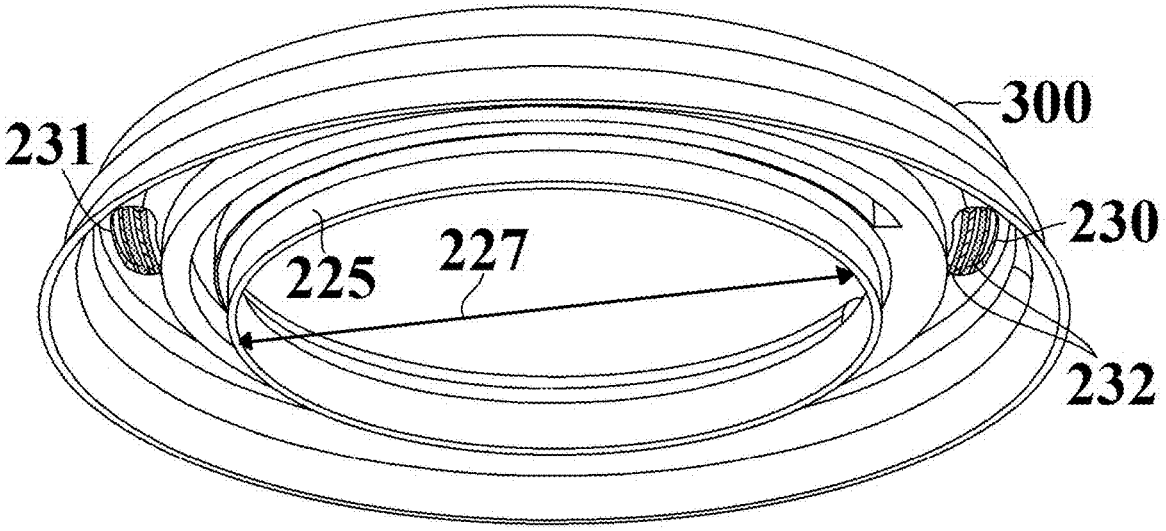
FIG. 5B is a perspective bottom view of the flat brim mount part in FIG. 5A.

FIG. 5B is a perspective bottom view of flat brim mount part 300 in FIG. 5A showing anti-splash/spill apron 225 encircling recessed hatch opening 227 (solid line with double-headed opposing arrows). Louvers 232, originally shown in FIG. 4C are not affected by flat brim mount part 300 and retain their function of helping to deflect beverage 209 (see FIG. 4A) back into disposable beverage container 203 when splashed upwards contacting the first 230 and/or second 231 drinking access ports.

Figure 6:
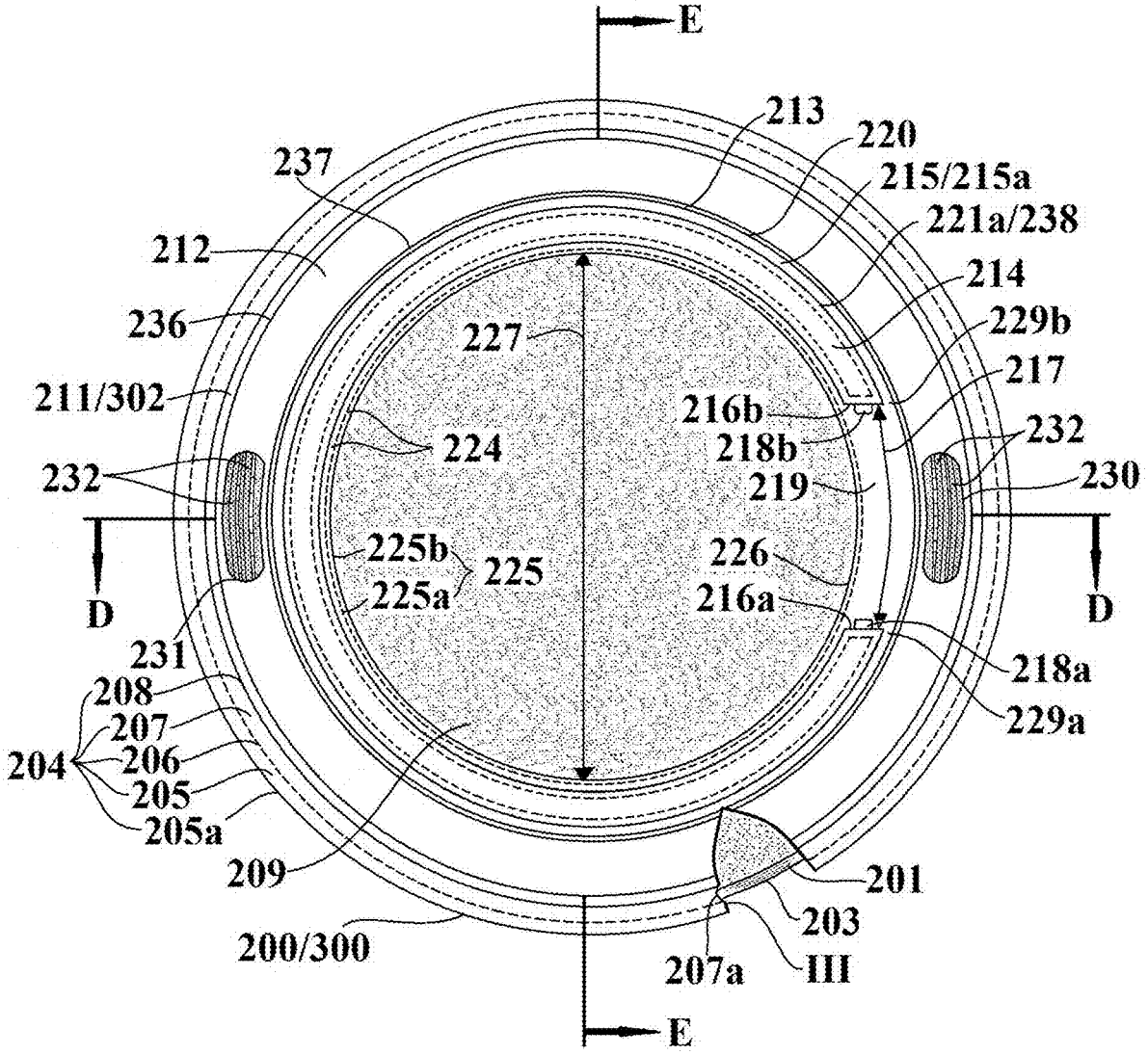
FIG. 6 is a top plan view representing both the dome and flat brim mount part in FIGS. 4A and 5A, respectively.

FIG. 6 is a top plan view representing dome brim mount part 200 in FIG. 4A and flat brim mount part 300 in FIG. 5A showing several preferred embodiments of the present invention. First outside wall 211 and compressed first outside wall 302, respectively, are not distinguishable in this plan view. Cut-away III discloses outside perimeter free edge 205*a* working in cooperation with bottom flange 205 to assist in clamping and reversibly mating interior sealing curvature 207*a* to rolled rim 201 of disposable beverage container 203. Clamping curvature 207 is interposed between lower furrow 206 (phantom lines) and upper furrow 208, completing annular skirt 204. First outside wall 211 and compressed first outside wall 302, respectively in dome brim mount part 200 and flat brim mount part 300, are interposed between upper furrow 208 and planar top transition surface outside perimeter edge 236. Opposing first 230 and second 231 drinking access ports with parallel louvers 232 therein are centrally die-cut into planar top transition surface 212 between a planar top transition surface outside perimeter edge 236 and a planar top transition surface inside perimeter edge 237. Substantially annular u-shaped trough 215 is further comprised of u-shaped trough base 215*a* (not distinguishable in FIG. 6, see FIG. 7A) which may be configured with an optional sloping bottom surface towards dual spillways 229*a* and 229*b*, both u-shaped trough 215 and u-shaped trough base 215*a* are respectively configured between second outside wall 213 and second outside wall bottom furrow 220, and retaining rib first outside wall 221*a* and retaining rib first outside wall bottom furrow 238 (also not distinguishable in FIG. 6, see FIG. 7A), terminating on opposing sides of end walls 216*a* and 216*b*, respectively (also see FIG. 7A). U-shaped trough 215 collects any splashed liquid spillage rising upwards through recessed hatch opening 227 (solid line with double-headed opposing arrows) and travelling over retaining rib 214 (solid and phantom lines) and/or splashed liquid spillage escaping through first 230 or second 231 drinking access ports and moving down second outside wall 213. The collected beverage 209 is conveyed along u-shaped trough 215 and u-shaped trough base 215*a*, which combine to act as a sump means to convey beverage 209, as it seeks its own level along trough base 215*a* to spill out through an open end, symmetrically positioned at opposing ends of trough base 215*a*, defined as dual spillways 229*a* and 229*b*, into a spillway of space whereby the Earth's gravitation force directs beverage 209 onto a planar transition panel 219, wherein planar transition panel 219 is formed below detachable hinge and is contiguous on each side to end walls 216*a* and 216*b* of retaining rib 214 and base of second outside wall 213 of ring-shaped crown portion 210 and disposed outwardly therefrom extending through first gap 217 between end walls 216*a* and 216*b* of retaining rib 214 terminating contiguous to outside perimeter edge 236 of annular interior rim 224, and where planar transition panel 219 which acts as a further spillway delivering beverage 209 liquid spillage over annular interior rim 224 (phantom lines represents anti-splash/spill apron 225 inside wall 225*a* below annular interior rim 224), down anti-splash/spill apron outside wall 225*b* (solid lines) and through recessed hatch opening 227 (solid line with double-headed opposing arrows) back into disposable beverage container 203.

Opposing partially spherical protrusions 218*a* and 218*b*, representing the male hinge part of a detachable hinge, extend horizontally outwards, respectively, from their centrally positioned locations on end walls 216*a* and 216*b*. Planar transition panel 219 extends from second outside wall bottom furrow 220 to annular interior rim perimeter edge 226 (not distinguishable from anti-splash/spill apron outside wall 225*b* in FIG. 6). The length of the first gap 217 (curved solid line with double-headed arrows) between opposing end walls 216*a* and 216*b* is equal to, or marginally wider than the cylindrical housing length 105*a* of cylindrical housing 105 (see FIGS. 1A and 2) such that cylindrical housing 105 can be snap fitted into first gap 217 when first gap 217 is flexed on either side, increasing the dimensional length of the first gap 217 allowing cylindrical housing 105 (see FIGS. 1A and 2) to be slidably press snap fitted into first gap 217 and then releasing the flexing of first gap 217 allowing opposing partially spherical protrusions 218*a* and 218*b* to seat within the respective partially spherical indentation 110*a* and 110*b* (see FIGS. 1A and 2), and for the partially spherical indentation 110*a* and 110*b* to mate over and enshroud the partially spherical protrusions 218*a* and 218*b*, thereby joining hatch cover part 100 in a non-permanent relatable manner to the top wall portion of dome brim mount part 200 or flat brim part 300 completing the formation of the detachable hinge, further described under FIG. 8A and FIG. 9A.

FIG. 6 also shows the first 230 and second 231 drinking access ports with the optional arrangement of two louvers 232 integrated across their longitudinal dimension. The shape of these drinking access ports may be described as oblong, racetrack-shaped with gentle curved longitudinal walls contoured to the annular shape of the planar top transition surface outside perimeter edge 236 and planar top transition surface inside perimeter edge 237. This design does not preclude adopting other drinking access port configurations as shown in FIGS. 6A1-12 with, and without, optional louvers 232 arranged in different interference patterns.

Figure 21B:
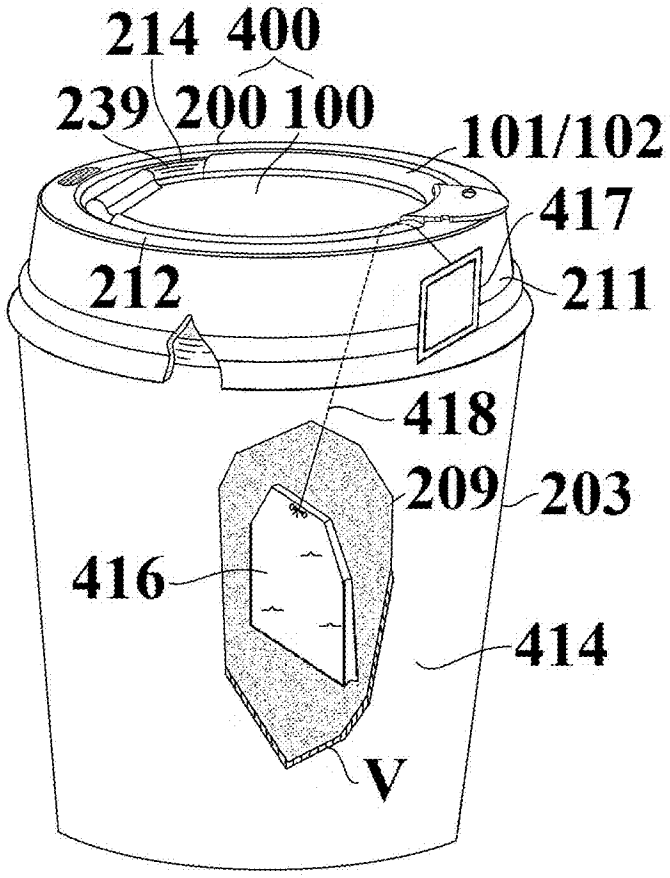
FIG. 21B is a perspective top view of the dome lid configuration, mounted to the rolled rim of a beverage container with the hatch cover part in the fully closed position with an infusion pouch suspended in the beverage within the container.

FIG. 6A1-12 discloses different optional top view configurations for drinking access ports with, and without, integrated louvers 232 forming anti-splash/spill interference patterns. FIG. 6A-1 shows the second drinking access port 231 in FIG. 6 as described above and is used to illustrate other optional configurations which might be adopted preferred embodiments for the present invention. The second drinking access port 231 includes two louvers 232 and is die-cut through planar top transition surface 212 between planar top transition surface outside perimeter edge 236 and planar top transition surface inside perimeter edge 237. FIG. 6A-2 shows the second drinking access port 231 with a single, wider louver 232 longitudinally configured across the second drinking access port 231. FIG. 6A-3 shows several parallel louvers 232*a* configured in an interference pattern across the width of the second drinking access port 231. FIG. 6A-4 shows intersecting parallel louvers 232*b* at 90° forming an interference grate pattern within the second drinking access port 231. FIG. 6A-5 shows the second drinking access port 231*a* without integrated louvers 232. FIG. 6A-6 shows the second drinking access port 231*b* with an oblong, racetrack-shape without gentle curved longitudinal walls contoured to planar top transition surface outside perimeter edge 236 and planar top transition surface inside perimeter edge 237 as shown in FIG. 6A-1. FIG. 6A-7 shows the second drinking access port 231*c* with a shortened oblong, racetrack-shaped configuration. FIG. 6A-8 shows a rectangular-shaped drinking access port 231*d* and FIG. 6A-9 shows a rectangular-shaped drinking access port 231*e* with rounded corners. FIG. 6A-10 shows an oblong-shaped curved drinking access port 231*f* with a narrower width between the longitudinal walls compared with second drinking access port 231 in FIG. 6A-1. FIG. 6A-11 shows an oval-shaped drinking access port 231*g* and FIG. 6A-12 shows a circular-shaped drinking access port 231*h*. These examples do not preclude other configured drinking access port designs from be adopted, and may also include louvers 232 and louver patterns (232*a*, and 232*b*) described above.

Figure 7A:
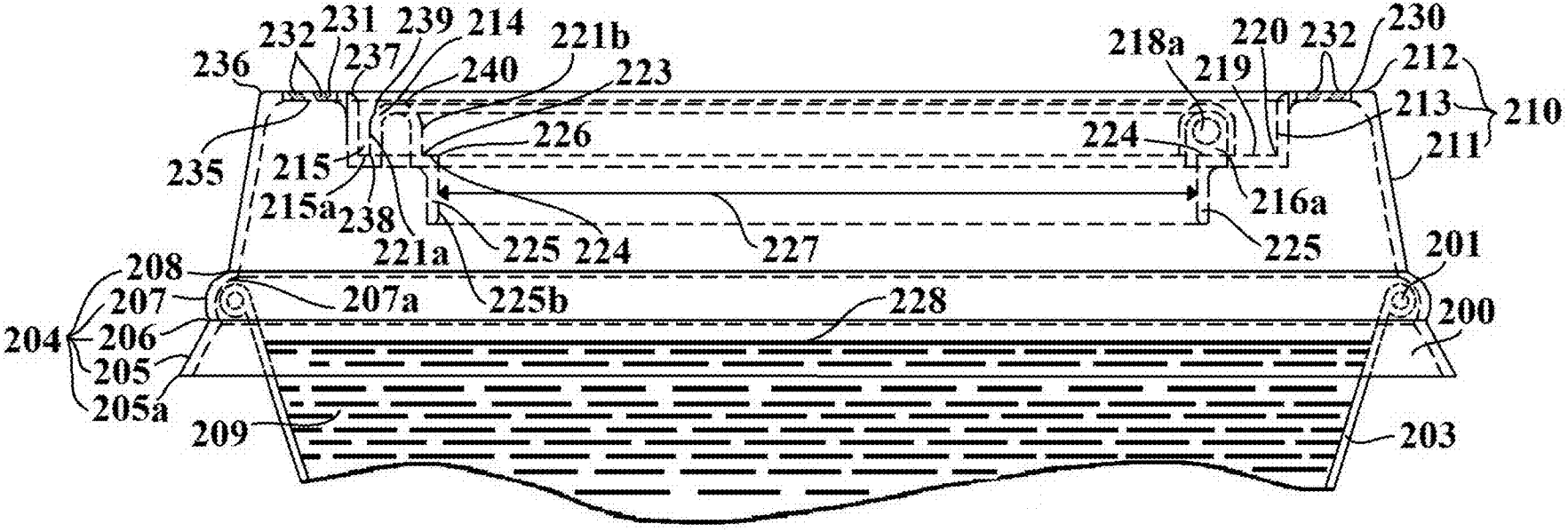
FIG. 7A is a side view in section of the dome brim mount part taken substantially along line D-D in FIG. 6.

FIG. 7A is a side view in section of the dome brim mount part 200 taken substantially along line D-D in FIG. 6 mounted to the rolled rim 201 of a disposable beverage container 203, compressed for ease of illustration. Annular skirt 204 is comprised of bottom flange 205 (phantom and solid lines) and outside perimeter free edge 205*a*, which serves as a pilot guide diameter portions for assisting in frictional fitment of interior sealing curvature 207*a* (phantom and solid lines) opposite clamping curvature 207, positioned between lower furrow 206 and upper furrow 208, wherein interior sealing curvature 207*a* is shaped to frictionally clamp around rolled rim 201 (phantom lines) of disposable beverage container 203, thereby preventing leakage of beverage 209 at the interface between dome brim mount part 200 and rolled rim 201. Ring-shaped crown portion 210 is comprised of first outside wall 211, upwardly dependent from upper furrow 208 to planar top transition surface outside perimeter edge 236. Planar top transition surface 212 is inwardly dependent from planar top transition surface outside perimeter edge 236 and terminating at planar top transition surface inside perimeter edge 237 at the top of second outside wall 213 (phantom lines). First 230 and second 231 drinking access ports are die-cut into planar top transition surface 212 between the planar top transition surface outside perimeter edge 236 and planar top transition surface inside perimeter edge 237. Second outside wall 213 (phantom lines) is downwardly dependent from planar top transition surface inside perimeter edge 237 to second outside wall bottom furrow 220. Opposite second outside wall 213 is retaining rib 214 comprised of retaining rib first outside wall 221*a*, which is upwardly dependent from retaining rib first outside wall bottom furrow 238 to retaining rib arch 239 with retaining rib apex 240 at the top of retaining rib arch 239. Retaining rib apex 240 is at a similar height to that of planar top transition surface 212. Downwardly dependent from the opposite side of retaining rib arch 239 is retaining rib second outside wall 221*b* terminating at retaining rib second outside wall bottom furrow 223. Annular interior rim 224 depends horizontally outward from retaining rib second outside wall bottom furrow 223. Depending downward from annular interior rim perimeter edge 226 is anti-splash/spill apron 225 with anti-splash/spill apron outside wall 225*b* circumscribing recessed hatch opening 227 (solid line with double-headed arrows) which acts to reduce upward splashing from beverage surface plane 228 arising below planar top transition under surface 235. Annular interior rim 224 and anti-splash/spill apron 225 are also shown on the right side of FIG. 7A, thereby forming a perimeter to define recessed hatch opening 227 within anti-splash/spill apron 225. U-shaped trough 215 is formed between ring-shaped crown portion second outside wall 213 and retaining rib first outside wall 221*a*. U-shaped trough base 215*a* is respectively formed between ring-shaped crown portion second outside wall 213 bottom furrow 220 and retaining rib first outside wall 221*a* bottom furrow 238.

On the right side of FIG. 7A, one side of end wall 216*a* supports centrally positioned partially spherical protrusions 218*a* (partially spherical protrusions 218*b* not shown in FIG. 7A) representing the male hinge part of the detachable hinge. Planar transition panel 219 is inwardly disposed from second outside wall bottom furrow 220, passing end wall 216*a* and extending to blend with annular interior rim 224.

In a preferred embodiment louvers 232, slanted at an angle, have been optionally introduced to first 230 and second 231 drinking access ports, for the purposes of restricting splashing upwards through drinking access ports. Upwardly splashed beverage 209 from the beverage surface plane 228 hits the louvers 232 and is redirected back into disposable beverage container 203. Depending on the size of the drinking access ports, the number, length and width of louvers 232 may vary accordingly (see FIGS. 6A1-12) to increase or decrease the amount of beverage 209 deflected back into disposable beverage container 203 and also the flow rate of beverage communicated through the first 230 and second 231 drinking access ports to the customer.

The rolled rim 201 profile at the upper end of disposable beverage container 203 is referred too throughout this patent application, however, this does not preclude other disposable container rim configurations and profiles which do not configure a rolled rim 201 design from forming a clamped interface between dome 200 and flat 300 brim mount part with corresponding clamping profiles to annular skirt 204. Disposable plastic containers designed with a rib/channel interface between the container portion and the lid portion may also be suitable configured with a repeatable hatch opening and a pivoting hatch cover part about a detachable hinge providing access to the contents within the container without removing the lid from the container rim.

Figure 7D:
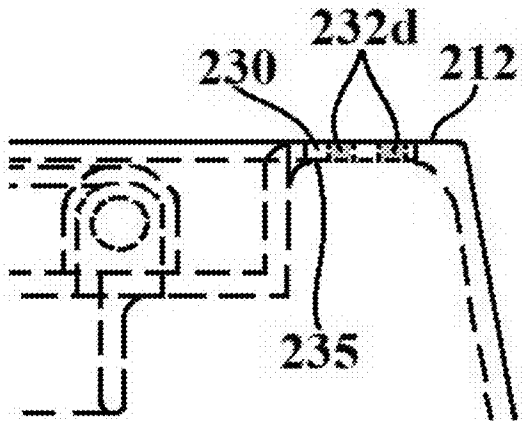
FIG. 7D is a partial side view in section on a larger scale of a portion of the dome brim mount part in FIG. 7A.
Figure 7C:
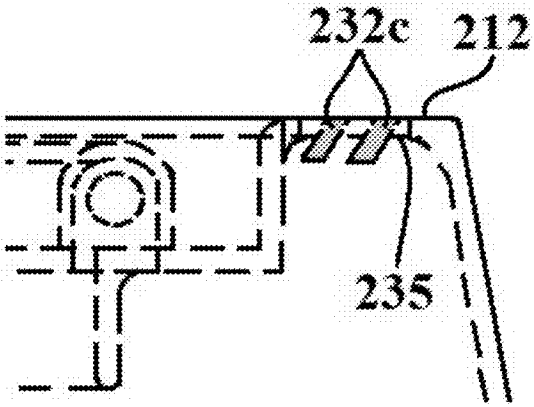
FIG. 7C is a partial side view in section on a larger scale of a portion of the dome brim mount part in FIG. 7A.
Figure 7B:
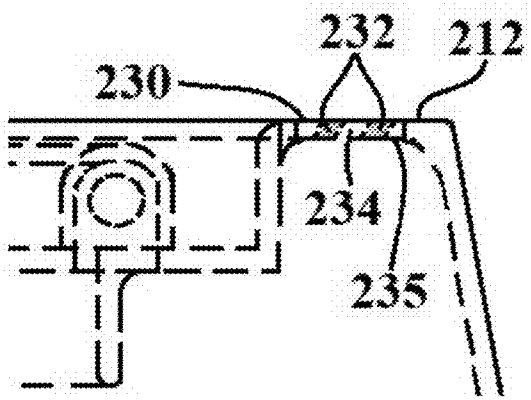
FIG. 7B is a partial side view in section on a larger scale of a portion of the dome brim mount part in FIG. 7A.

FIG. 7B is a side view in section on a larger scale of a portion of dome brim part 200 in FIG. 7A showing the first drinking access port 230 with optionally introduced angled louvers 232 (shaded) integrated longitudinally to drinking access port inside wall 234 and flush with planar top transition surface 212 and flush with planar top transition undersurface 235.

FIG. 7C is a side view in section on a larger scale of a portion of dome brim mount part 200 in FIG. 7A showing a variation of louver 232 (shaded, in FIG. 7A), flush with planar top transition surface 212 while extending below planar top transition undersurface 235, thereby forming extended slanted louvers 232*c* with a marginally increased vertical length, providing increased deflection of splashing from the beverage surface plane 228 (see FIG. 7A).

FIG. 7D is a side view in section on a larger scale of a portion of dome brim mount part 200 in FIG. 7A showing a variation of louver 232 (shaded, in FIG. 7A) configured vertically and not at an angle across the first drinking access port 230 forming vertical louvers 232*d* flush with planar top transition surface 212 and flush with planar top transition undersurface 235.

Figure 7E:
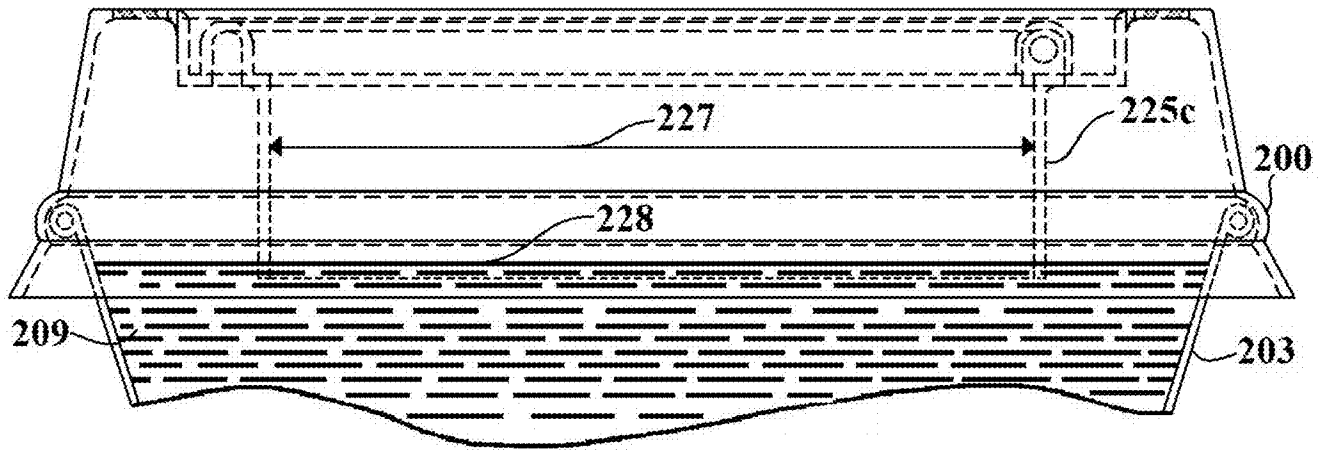
FIG. 7E is a side view in section of the dome brim mount part, mounted to the rolled rim of a beverage container, compressed for ease of illustration, taken substantially along line D-D in FIG. 6 showing an extended anti-splash/spill apron compared with a shorter anti-splash spill apron in FIG. 7A.

FIG. 7E is a side view in section of dome brim mount part 200 taken substantially along line D-D in FIG. 6, showing a variation of the anti-splash/spill apron 225 described in FIG. 7A. The vertical height of anti-splash/spill apron 225 (phantom lines) has been extended forming new extended anti-splash/spill apron 225*c* (phantom lines) which may make optional contact with, and/or submerge below, beverage surface plane 228, depending on the height of beverage 209 in disposable beverage container 203 (compressed for ease of illustration). Extended anti-splash/spill apron 225*c* (phantom lines) increases the effective dampening of wave-action created by minimal movement of the container 203, resulting in side-to-side sloshing of beverage 209, thereby restricting sloshing of beverage 209 from moving into the enclosed recessed hatch opening 227 (solid line with double-headed arrows) and possibly splashing upwards when transporting beverage 209 filled disposable container 203 with hatch cover part 100 in the fully closed or fully opened position. The extended anti-splash/spill apron 225*c* (phantom lines) also limits the volume of beverage 209 and the rate at which the beverage 209 is delivered to the first 230 or second 231 drinking access ports when the container 203 is tilted for drinking. This may have an impact on reducing burns to the mouth when from hot contents which reaches the drinking access ports too quickly or in larger volumes.

Figure 7F:
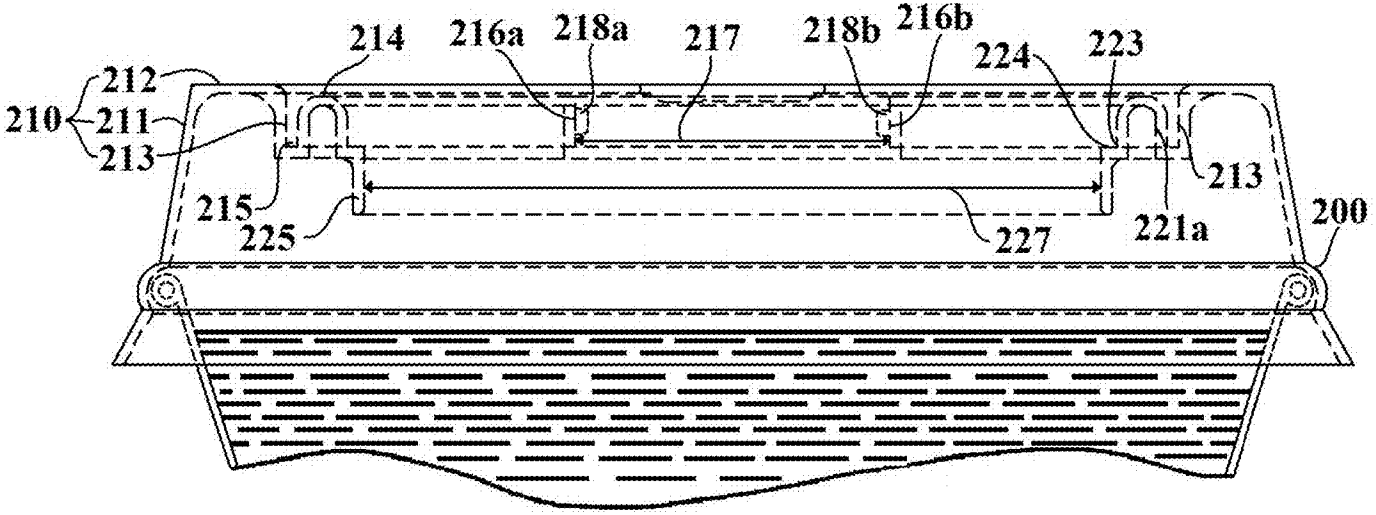
FIG. 7F is a side view in section of the dome brim mount part, mounted to the rolled rim of a beverage container, compressed for ease of illustration, taken substantially along line E-E in FIG. 6.

FIG. 7F is a side view in section of dome brim mount part 200 taken substantially along line E-E in FIG. 6 showing another perspective of the symmetry of retaining rib 214, ring-shaped crown portion 210 (phantom and solid lines), first outside wall 211, planar top transition surface 212, second outside wall 213, u-shaped trough 215 (phantom lines), annular interior rim 224 (phantom lines), anti-splash/spill apron 225 (phantom lines), and partially spherical protrusions 218*a* and 218*b* respectively centrally positioned on end walls 216*a* and 216*b* and extend horizontally outwards therefrom. Again we see how annular interior rim 224 and anti-splash/spill apron 225 blend to circumscribe recessed hatch opening 227 (solid line with double-headed arrows).

Annular interior rim 224 depends horizontally outward from retaining rib second outside wall bottom furrow 223. Retaining rib 214 is severed at two symmetrical terminations forming opposing end walls 216*a* and 216*b* thereby providing a first gap 217 (solid line with double headed-arrows) within to receive cylindrical housing 105 (See FIG. 1A and FIG. 2) when hatch part 100 is combined with dome brim mount part 200 as was previously discussed in FIG. 6 and will be further described under FIG. 8A.

The moulding process uses thin thermoplastics which may allow for a more intimate contact between second outside wall 213 and retaining rib first outside wall 221*a*, resulting in a narrower u-shaped trough 215 approaching a v-shaped channel profile. The width of u-shaped trough 215 must be wide enough to allow for clamping rib first outside wall 117*a*/locking channel first inside wall 118*a* of hatch cover part 100 (see FIGS. 2 and 3A) to frictionally fit between second outside wall 213 and retaining rib first outside wall 221*a* to achieve relatable intimate frictional fitment of clamping rib 101/locking channel 102 mated to retaining rib 214 when hatch cover part 100 has been configured to dome brim mount part 200 and flat brim mount part 300, respectively, and pivoted to the fully closed position, as will be further illustrated and discussed under FIGS. 8A, 9A and 11C.

Figure 7G:
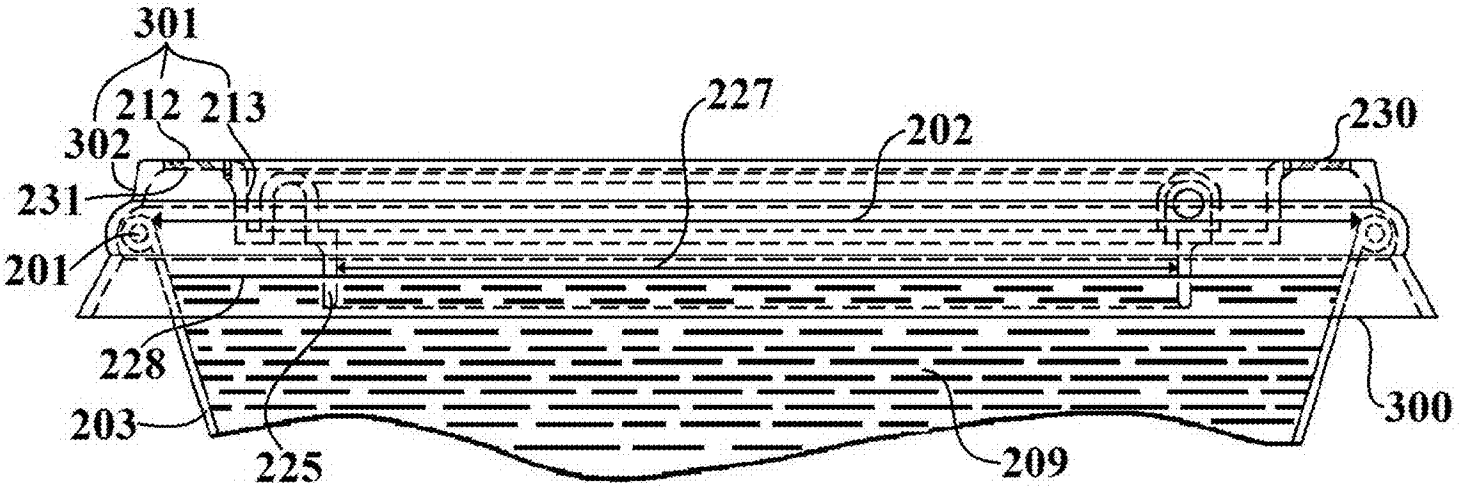
FIG. 7G is a side view in section of the flat brim mount part, mounted to the rolled rim of a beverage container, compressed for ease of illustration, taken substantially along line D-D in FIG. 6.

FIG. 7G is a side view in section of flat brim mount part 300 taken substantially along line D-D in FIG. 6 mounted to the rolled rim 201 of a disposable beverage container 203, compressed for ease of illustration. All the preferred embodiments and parts described in FIG. 7A are captured in FIG. 7G with one difference regarding the height of ring-shaped crown portion 210. In FIG. 7G ring-shaped crown portion 210 has been compressed to form compressed ring-shaped crown portion 301 comprised of compressed first outside wall 302, while retaining planar top transition surface 212 and second outside wall 213 which remain unchanged from FIG. 7A. A preferred embodiment of flat brim mount part 300 is that less material may be used in manufacturing resulting in lower costs and increasing the number of units being stacked and stored in the same space compared with dome brim mount part 200. In still another preferred embodiment compressed ring-shaped crown portion 301 is brought into a more intimate relationship with beverage surface plane 228 thereby reducing the vertical distance between recessed hatch opening 227 (solid line with double-headed arrows) and beverage surface plane 228. Another benefit of flat brim mount part 300 is the shorter vertical distance created when dunking a confection through recessed hatch opening 227 before it makes contact with beverage 209 for subsequent dunking compared with the longer distance the confection must travel when dunked through dome brim mount part 200, thereby allowing the customer increased management of the depth of dunking a confection and the portion of the confection to be infused with beverage 209.

Figure 7H:
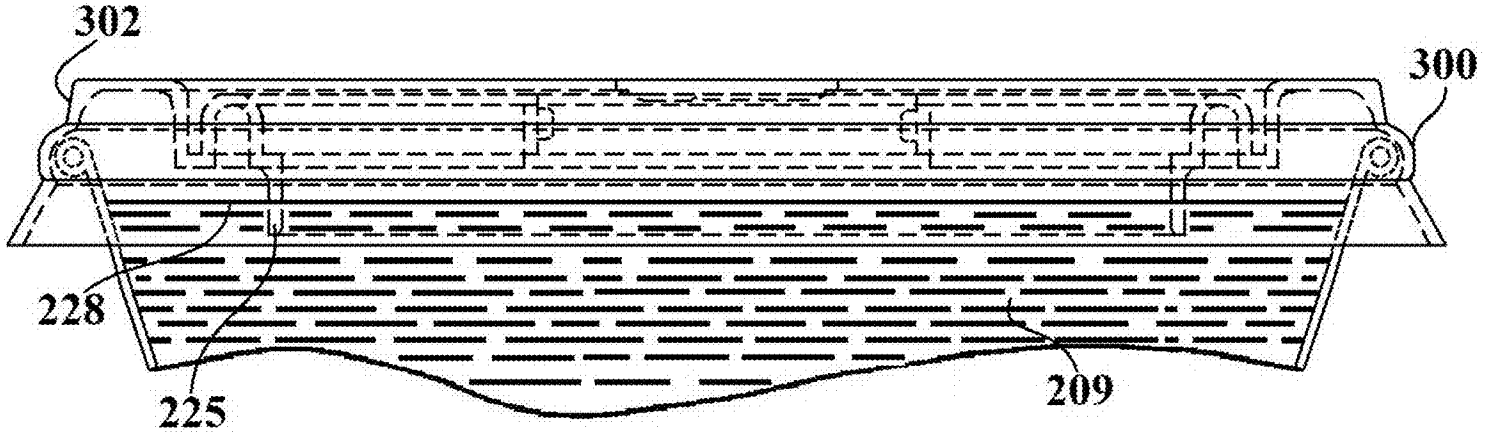
FIG. 7H is a side view in section of the flat brim mount part, mounted to the rolled rim of a beverage container, compressed for ease of illustration, taken substantially along line E-E in FIG. 6.

Another preferred embodiment of flat brim mount part 300 is the lowering of anti-splash/spill apron 225 into closer proximity with beverage surface plane 228 whereby anti-splash/spill apron 225 may become submerged below beverage surface plane 228 as shown in FIGS. 7G and 7H, with no change in the vertical height dimension of anti-splash/spill apron 225 seen for dome brim mount part 200 in FIG. 7A. The submerging of anti-splash/spill apron 225 below beverage surface plane 228 increases its effectiveness in dampening wave-action leading to side-to-side sloshing of beverage 209 resulting from sudden or random movements to disposable beverage container 203 by preventing beverage 209 from using the full surface area of the upper end opening 202 (solid line with double-headed arrows) of the disposable beverage container 203 to build side-to-side momentum subsequently leading to spilling or splashing upwards through the interface between flat brim mount part 300 and rolled rim 201, through recessed hatch opening 227, and also through the first 230 and/or second 231 drinking access ports.

FIG. 7H is a side view in section of flat brim mount part 300 of the present invention taken substantially along line E-E in FIG. 6. All the preferred embodiments and parts described in FIG. 7F are captured in FIG. 7H, again with the exception of compressed first outside wall 302 which forms part of compressed ring-shaped crown portion 301 (see FIG. 7G) and also wherein a portion of anti-splash/spill apron 225 may become submerged into beverage 209 as it is brought into closer proximity to beverage surface plane 228, which is not the case in FIG. 7F.

Figure 8A:
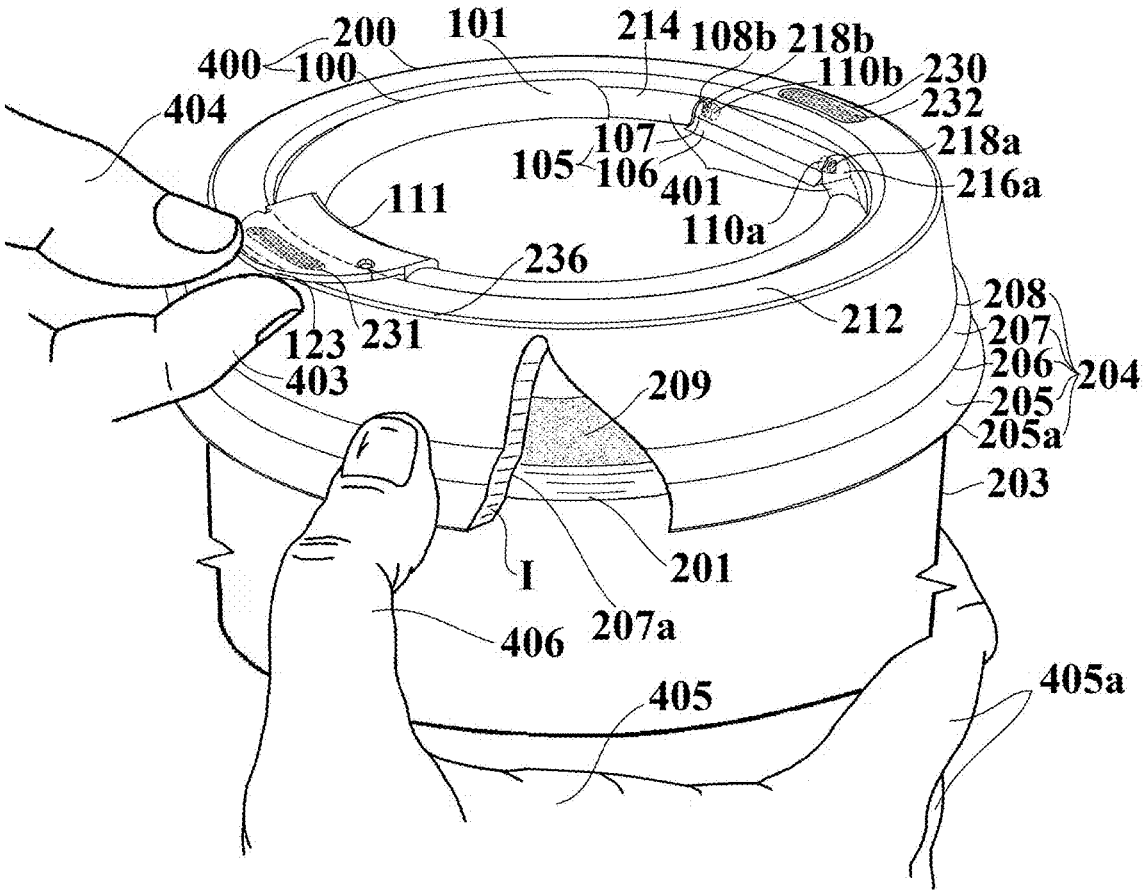
FIG. 8A is a perspective top view of the hatch cover part (see FIG. 1A) in the fully closed position attached to the dome brim mount part (see FIG. 4A), thereby forming the dome lid configuration, mounted to the rolled rim of a beverage container, compressed for ease of illustration.

FIG. 8A is a perspective top view of dome lid 400 comprising a separately moulded hatch cover part 100 in the fully closed position, removably attached to the top of a separately moulded dome brim mount part 200, wherein interior sealing curvature 207*a* is mounted to upper end rolled rim 201 of disposable beverage container 203 (compressed for ease of illustration). Cut-away I shows bottom flange 205 and outside perimeter free edge 205*a* as rim-engaging means assisting in clamping interior sealing curvature 207*a* onto rolled rim 201, thereby reversibly engaging dome brim mount part 200 onto rolled rim 201 in a mutually reversible non-permanent relatable locking relationship as first discussed in detail under FIG. 4A.

Figure 16A:
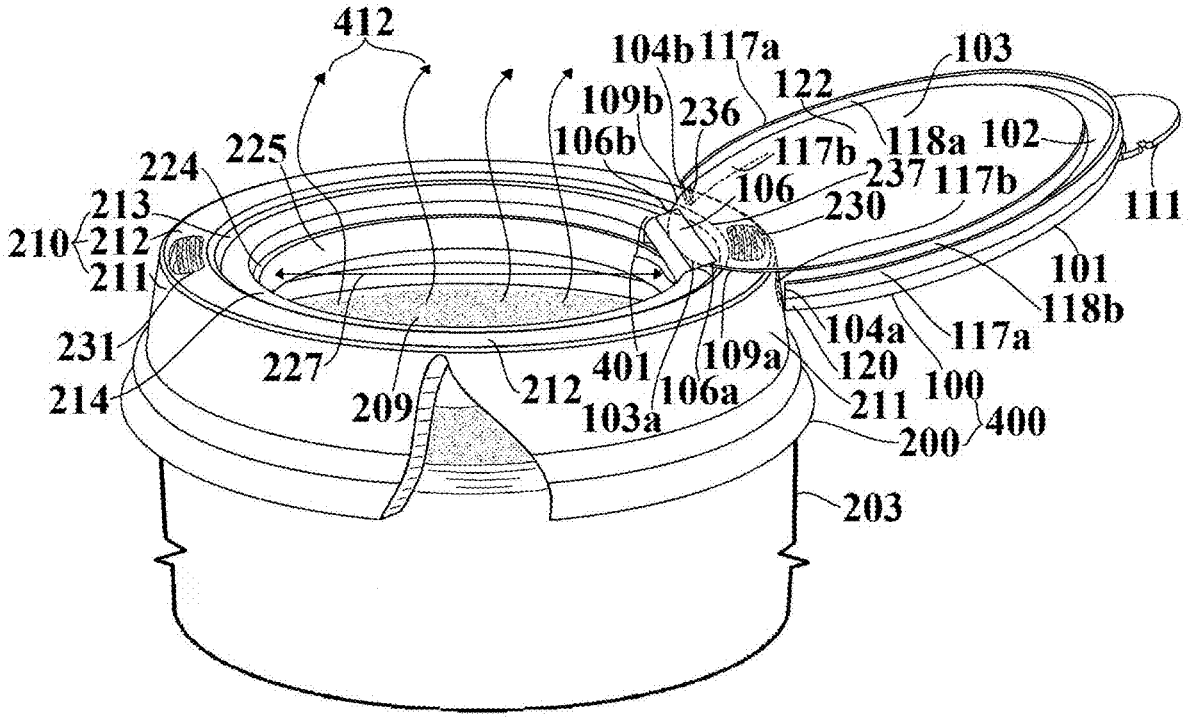
FIG. 16A is a perspective top view of the dome lid configuration, mounted to the rolled rim of a beverage container, compressed for ease of illustration, with the hatch cover part pivoted to the fully opened position.

Container lids which are preferably formed from thermoplastic resins such as polystyrene plastics or high density polyethylene or other materials typically have wall thicknesses in the range of 0.4 mm and demonstrate resilient flexibility, pliability and memory characteristics. The memory properties of polystyrene together with its pliability and flexibility characteristics work cooperatively when clamping dome lid 400 to the rolled rim 201 of disposable beverage container 203. The bottom flange 205 outside perimeter free edge 205*a* guides dome brim mount part 200 onto rolled rim 201 of disposable beverage container 203. To demonstrate one method utilizing bottom flange 205 and outside perimeter free edge 205*a* to guide dome 200 or flat 300 brim mount part onto rolled rim 201 of disposable beverage container 203 refer to FIG. 16D. In FIG. 16D bottom flange 205, outside perimeter free edge 205*a* and clamping curvature/interior sealing curvature 207/207*a* (see also FIG. 8A), positioned between lower furrow 206 and upper furrow 208, are in an unstressed condition optionally configured with index finger 403 and thumb 404 of one hand exerting downward finger pressure to planar top transition surface 212, clamping rib 101 and clamping rib arch 120 when hatch cover part 100 is in the fully closed position while the opposing thumb 406 assists in guiding outside perimeter free edge 205*a* onto rolled rim 201 and opposing hand 405 and remaining fingers 405*a* grip and steady disposable beverage container 203 (also see FIG. 8A for opposing hand 405, thumb 406 and remaining fingers 405*a*). The downward finger pressure exerted by index finger 403 and thumb 404 (in FIG. 16D) flexes outside perimeter free edge 205*a* of bottom flange 205 outwards, guiding and urging interior sealing curvature 207*a* to slide over rolled rim 201 in a reversible frictional clamping fitment mating with rolled rim 201 of container 203 wherein bottom flange 205, outside perimeter free edge 205*a* and interior sealing curvature 207*a* work in combination as rim-engaging means adapted to clamp interior sealing curvature 207*a* to upper end rolled rim 201 of container 203 in a mutually relatable semi-locking relationship providing a tight seal between rolled rim 201 of container 203 and dome brim mount part 200. Once interior sealing curvature 207*a* is mated onto rolled rim 201, downward finger pressing force is released and the memory characteristics of the polystyrene returns bringing bottom flange 205 and interior sealing curvature 207*a* back towards their original moulded pre-flexed unstressed position thereby creating a snug clamping fit of interior sealing curvature 207*a* onto rolled rim 201, designed to non-permanently retain dome 200 or flat 300 brim mount parts to rolled rim 201 of container 203 and not be easily unclamped from rolled rim 201, thereby preventing leaking of beverage 209 from an interface between rolled rim 201 and annular skirt 204.

In another preferred embodiment of the present invention relating to thermoplastic resins is the beneficial characteristics of their smooth surfaces, promoting suitability when two parts are in intimate contact and moving against each other. The smooth nature of the respective part surfaces together with the inherent flexibility, pliability and memory characteristics of thin thermoplastics forming hatch cover part 100 and dome brim mount part 200, respective halves of dome lid 400, allows for hatch cover part 100 to be connected to the top of dome brim part 200 via detachable hinge when manufacturing and assembling hatch cover part 100 to the top portion of dome 200 or flat 300 brim mount part. In one method to assemble the hatch cover part 100 to dome 200 or flat 300 brim mount part forming the detachable hinge, the opposing partially spherical protrusions 218*a* and 218*b*, the male hinge part extending from either side of end walls 216*a* and 216*b* (216*b* not visible in FIG. 8A, see FIG. 8B), are flexed outwards, without being fractured, to increase the dimension of the first gap 217 (refer to FIG. 6 and FIG. 8B) between end walls 216*a* and 216*b* (216*b* not visible in FIG. 8A) and the space between partially spherical protrusions 218*a* and 218*b*, enlarging the dimensional length of the first gap 217 thereby permitting cylindrical housing 105 (see FIGS. 1A and 2, also FIG. 8B) to be slidably inserted into first gap 217. Once opposing partially spherical indentation 110*a* and 110*b* (also see FIGS. 1A and 2, and also FIG. 8B) forming dished recessed female hinge part on opposing cylinder end walls 108*a* (108*a* not visible in FIG. 8A) and 108*b* (also see FIGS. 1A and 2) of cylinder 107, and opposing partially spherical protrusions 218*a* and 218*b*, are brought into a concentric alignment, the flexing of opposing partially spherical protrusions 218*a* and 218*b* is released, returning first gap 217 to its original, pre-flexed dimension. This allows opposing partially spherical protrusions 218*a* and 218*b* to seat within the respective partially spherical indentation 110*a* and 110*b*, and for the partially spherical indentation 110*a* and 110*b* to mate over and enshroud the partially spherical protrusions 218*a* and 218*b*, thereby joining hatch cover part 100 in a non-permanent relatable manner to the top wall portion of dome brim mount part 200 (or to flat brim mount part 300 see FIG. 9A) completing the formation of detachable hinge 401. The detachable hinge snaps together or apart when sufficient force is applied to elastically flex the dimensional length of the first gap 217, forcing the partially spherical protrusions 218*a* and 218*b* apart so that they pass over the outside rims of the partially spherical indentation 110*a* and 110*b*. In another optional method of attaching hatch cover part 100 to the top of dome 200 or flat 300 brim mount part during manufacture and assembly involves hatch cover part 100 being flexed to reduce the dimensional cylindrical housing length 105*a* of cylindrical housing 105 allowing cylinder 107 to be inserted into first gap 217 and bring partially spherical indentation 110*a* and 110*b* into concentric alignment with partially spherical protrusions 218*a* and 218*b*, at which time the flexing of hatch cover part 100 is released allowing cylindrical housing 105 to return to its original pre-flexed dimensional length wherein partially spherical indentation 110*a* and 110*b* enshroud and mate over partially spherical protrusions 218*a* and 218*b*. This method of attaching hatch cover part 100 to the top portion of either dome 200 or flat 300 brim mount part may as well be accomplished with dome 200 or flat 300 (see FIG. 9A) brim mount part clamped to the rolled rim 201 of container 203. FIGS. 21F and 21F-1 illustrate this latter method for engagement and disengagement of hatch cover part 100, respectively, to, and from, dome brim mount part 200 while dome brim mount part 200 is attached to rolled rim 201.

In a further preferred embodiment related to the formation of the detachable hinge 401 the opposing partially spherical protrusions 218*a* and 218*b* have at least one axis of rotational symmetry and opposing partially spherical indentation 110*a* and 110*b* have at least one axis of rotational symmetry, such that the centres of partially spherical protrusions 218*a* and 218*b* are concentric with the centres of partially spherical indentation 110*a* and 110*b* and wherein partially spherical indentation 110*a* and 110*b* are configured with radii substantially equal to the radii of the respective partially spherical protrusions 218*a* and 218*b*, such that partially spherical indentation 110*a* and 110*b* are adapted to receive partially spherical protrusions 218*a* and 218*b* and wherein partially spherical indentation 110*a* and 110*b* enshroud partially spherical protrusions 218*a* and 218*b* in a snug, intimate mated relationship, reversible, non-permanent fashion. This mated relationship between the respective hinge parts provides sufficient holding power permitting free rotational motion of hatch cover part 100 female hinge part about dome brim part 200 male hinge part between fully closed and fully opened positions, and any intermediate opened position, of which there are a multitude of intermediate opened positions therein, of which one intermediate opened position is selected, while constraining lateral movement and supporting retention of hatch cover part 100 to the top portion of dome brim mount part 200 or flat brim mount part 300 (also see FIG. 8B and FIG. 9A). This snug interface provides retaining means to confine male hinge part partially spherical protrusions 218*a* and 218*b* within female hinge part partially spherical indentations 110*a* and 110*b* constraining hatch cover part 100 to dome brim mount part 200 and flat brim mount part 300 top portion thereby snap fitting the two halves of the detachable hinge together in a non-permanent fashion forming a constrained partially spherical protrusion and partially spherical indentation 401 (see FIG. 8B) and completing the attachment of the hatch cover part 100 to dome brim mount part 200 and flat brim mount parts 300 (FIG. 9A) thereby creating dome lid 400 (and flat lid 500, respectively, see FIG. 9A). The cylindrical housing length 105*a* (see FIG. 8B) of cylindrical housing 105 is equal to, or slightly less than the linear dimension of first gap 217 between end walls 216*a* and 216*b*, thereby creating a snug fit when the two hinge parts are snap fitted together (see FIG. 8B). This detachable hinge configuration may be reversed with partially spherical indentation 110*a* and 110*b* recessed within the opposing end walls 216*a* and 216*b* and partially spherical protrusions 218*a* and 218*b* extending from opposing cylinder end walls 108*a* and 108*b* of cylinder 107.

In still another preferred embodiment of the present invention each partially spherical protrusion and partially spherical indentation of the detachable hinge 401 is moulded as a complete unit such that dome lid 400 (and flat lid 500, see FIG. 9A) comprises just two mouldings. Hatch cover part 100 represents one moulded half comprising cylindrical housing 105, further comprised of rectangular base 106 and cylinder 107, with cylinder end walls 108*a* (108*a* not visible in FIG. 8A) and 108*b* with their respective partially spherical indentation 110*a* and 110*b* recessed therein. Dome 200 or flat 300 brim mount part represent the second moulded half comprising retaining rib end walls 216*a* and 216*b* (216*b* not visible in FIG. 8A, see FIG. 8B) with their respective partially spherical protrusions 218*a* and 218*b* extending therefrom, when gently snap fitted into each other to form detachable hinge 401. The respective moulded halves may be optionally gently disengaged with sufficient force due to the flexible and smooth surface properties of the thermoplastics. Although dome lid 400 (and flat lid 500, see FIG. 9A) is comprised of two separate units, once joined the two part container lid becomes a single unit with the ability to open hatch cover part 100 exposing recessed hatch opening 227 (see FIG. 4C) to access the beverage 209 within disposable beverage container 203 without the necessity of first removing dome lid 400 (or flat lid 500) from rolled rim 201. This further converts the conventional disposable beverage container/lid configuration from two detachable parts attached to each other to a single unit wherein the two part container lid remains clamped to rolled rim 201 of container 203, while still permitting access to disposable container 203 to add beverage 209 and subsequently to add condiments to beverage 209, to dunk a confection, or to perform other aforementioned actions on beverage 209. Consequently, as this new invention removes the necessity to remove the lid from rolled rim 201 of container 203 to access beverage 209 within, there is no longer two separate units to manage; a disposable beverage container 203 and a disposable lid, when the lid is optionally pried from the rolled rim 201 of disposable container 203. With this new invention there is a single unit to discard following beverage consumption as the new two part container lid remains attached to the container throughout the beverage purchase, delivery and subsequent consumption.

Another preferred embodiment of the present invention are the optional louvers 232 (also see FIG. 8B) integrated to drinking access port inside wall 234 (see FIG. 8B) across the length of both the first 230 and second 231 (phantom lines) drinking access ports (also see FIGS. 4B and 4D) to reduce upwards splashing of beverage 209 through the drinking access ports.

A further preferred embodiment of the present invention is gripping tab 111, joined to the top of clamping rib 101, whereby gripping tab bottom surface 119 (see FIG. 8D) is in intimate contact with planar top transition surface 212, concealing the second drinking access port 231 (phantom lines). The curvilinear perimeter front edge 123 of gripping tab 111 extends marginally beyond the planar top transition surface outside perimeter edge 236 and first outside wall 302 which forms part of compressed ring-shaped crown portion 301, thus providing a curvilinear perimeter front edge 123 for optional finger gripping to lift hatch cover part 100 and disengage clamping rib 101/locking channel 102 (locking channel 102 not visible in FIG. 8A) from retaining rib 214. The size gripping tab 111 may be reduced or increased accordingly for the purposes of gripping to lift hatch cover part 100 while still remaining within the outside perimeter free edge 205*a* on bottom flange 205, thereby allowing stacking of dome lids 400 (see FIG. 22A).

Figure 12:
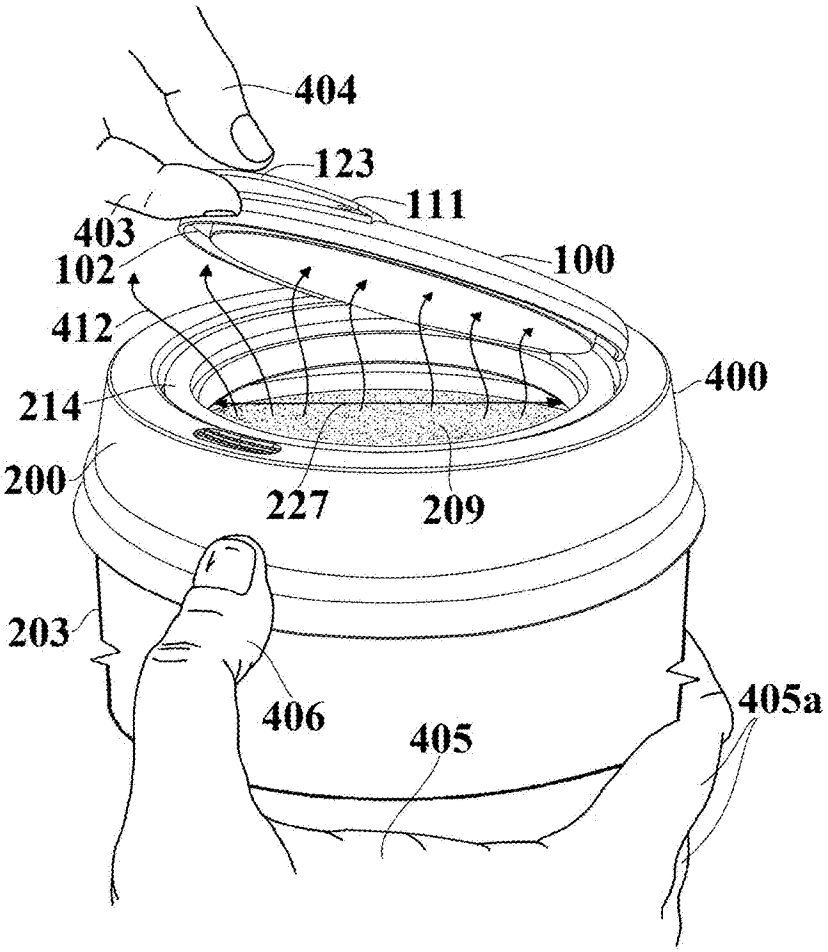
Figure 17A:
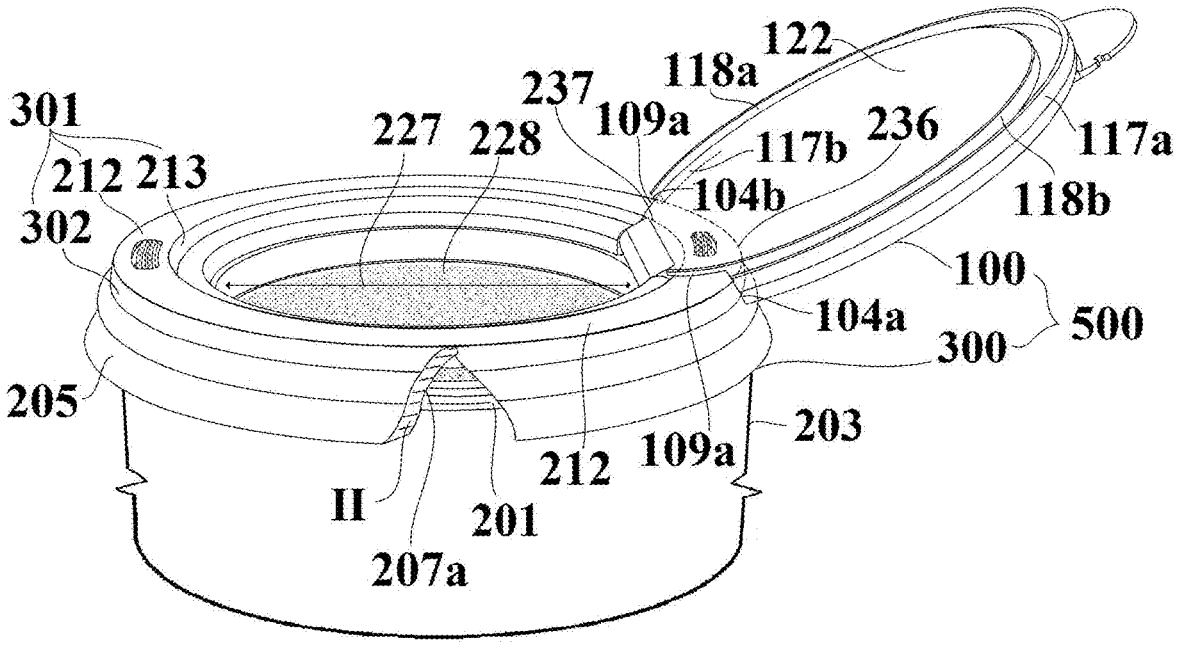
FIG. 17A is a perspective top view of the flat lid configuration, mounted to the rolled rim of a beverage container, compressed for ease of illustration, with the hatch cover part in the fully opened position.

In various preferred embodiments of the present invention FIG. 8A shows hatch cover part 100 in the fully closed position with the curvilinear perimeter front edge 123 of gripping tab 111 optionally gripped between index finger 403 and thumb 404 of one hand initiating the lifting and pivoting of hatch cover part 100 to a partially opened position as shown in FIG. 12, and subsequently to a fully opened position shown in FIG. 16A and FIG. 17A. Alternatively, index finger 403 and thumb 404 may grip curvilinear perimeter front edge 123 of gripping tab 111 in FIG. 8A also illustrating the pivoting of fully opened hatch cover part 100 back to the fully closed position as shown in FIGS. 12, 13, 16A, and 17A. While gripping tab 111 is lifting hatch cover part 100 upwards to a fully opened position, or downwards to a fully closed position, opposing thumb 406 may be extended to apply downward pressure to annular skirt 204 on dome brim mount part 200 (or flat brim mount part 300) while opposing hand 405 and remaining fingers 405*a* may be wrapped around disposable beverage container 203. This positioning of opposing hand 405 and remaining fingers 405*a* together with opposing thumb 406 steadies disposable beverage container 203 as index finger 403 and thumb 404 engage and grip curvilinear perimeter front edge 123 of gripping tab 111, pulling gripping tab 111 upwards, thereby prying locking channel 102 free and disengaging it from frictional mated fitment to retaining rib 214 (as shown in FIG. 12). This arrangement of hands and fingers gripping disposable beverage container 203, dome lid 400 and gripping tab 111, may change with handedness and repositioning of fingers and thumbs. Alternatively other optional finger and hand configurations may be adopted which accomplish the opening and closing of hatch cover part 100 which do not involve gripping tab 111 curvilinear perimeter front edge 123. This may include placing a digit of either hand under gripping tab 111 in contact with gripping tab bottom surface 119 when hatch cover part 100 is in the fully closed position and lifting hatch cover part 100 upwards without gripping curvilinear perimeter front edge 123, while opposing hand 405 grips container 203, and, similarly, placing a digit of either hand under the inverted top surface 127 (see FIG. 21D) of gripping tab 111 when hatch cover part 100 is in the fully opened position or partially opened position, to pivot hatch cover part 100 from a fully opened position to a fully closed position or any intermediate opened position in between while opposing hand 405 grips container 203.

Figure 8B:
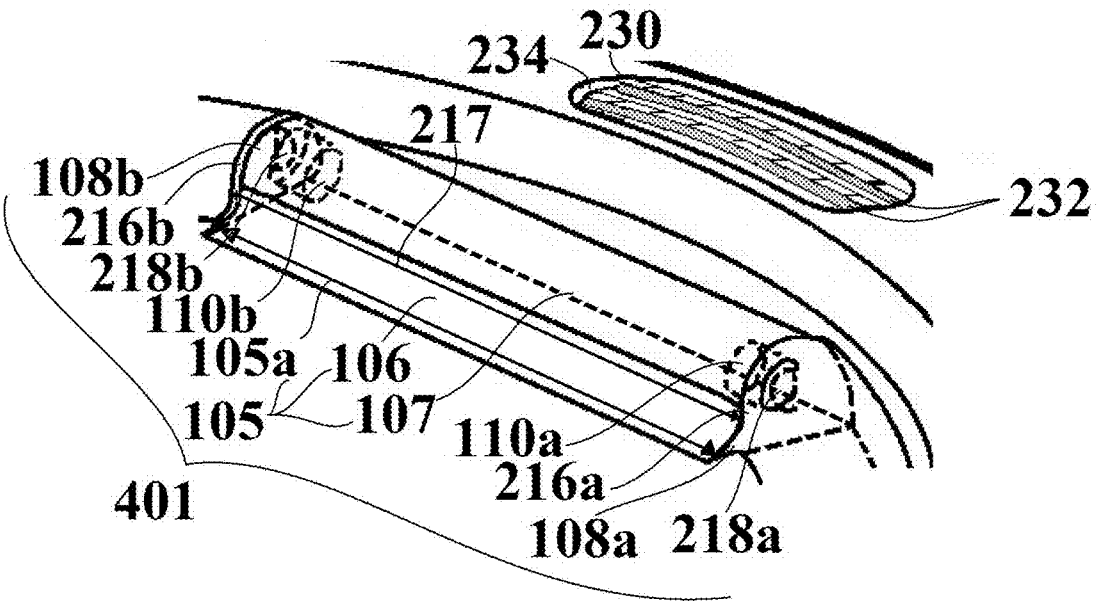
FIG. 8B is a partial perspective view on a larger scale of a portion of the dome lid in FIG. 8A.

FIG. 8B is a partial perspective view on a larger scale of a portion of dome lid 400 in FIG. 8A showing cylindrical housing 105, comprised of rectangular base 106 and cylinder 107, with a cylindrical housing length 105*a* (solid line with double-headed arrows) equal to, or of marginally less dimensional length compared with the dimensional length of first gap 217 (solid line with double-headed arrows, also see to FIG. 6) between end walls 216*a* and 216*b*, thereby allowing for cylinder 107 to be slidably inserted into first gap 217 between end walls 216*a* and 216*b* and cylinder end walls 108*a* and 108*b*, thus creating a snug fit when cylinder 107 partially spherical indentation 110*a* and 110*b* (phantom lines) are snap fitted over respective partially spherical protrusions 218*a* and 218*b* (phantom lines) forming a constrained detachable hinge 401, completing the attachment of the hatch cover part 100 to dome brim mount part 200 and creating dome lid 400. Optional louvers 232 are integrated to drinking access port inside wall 234 across the length of both the first 230 and second 231 (not shown in FIG. 8B) drinking access ports to reduce upward splashing of beverage 209 through the drinking access ports.

Figure 8C:
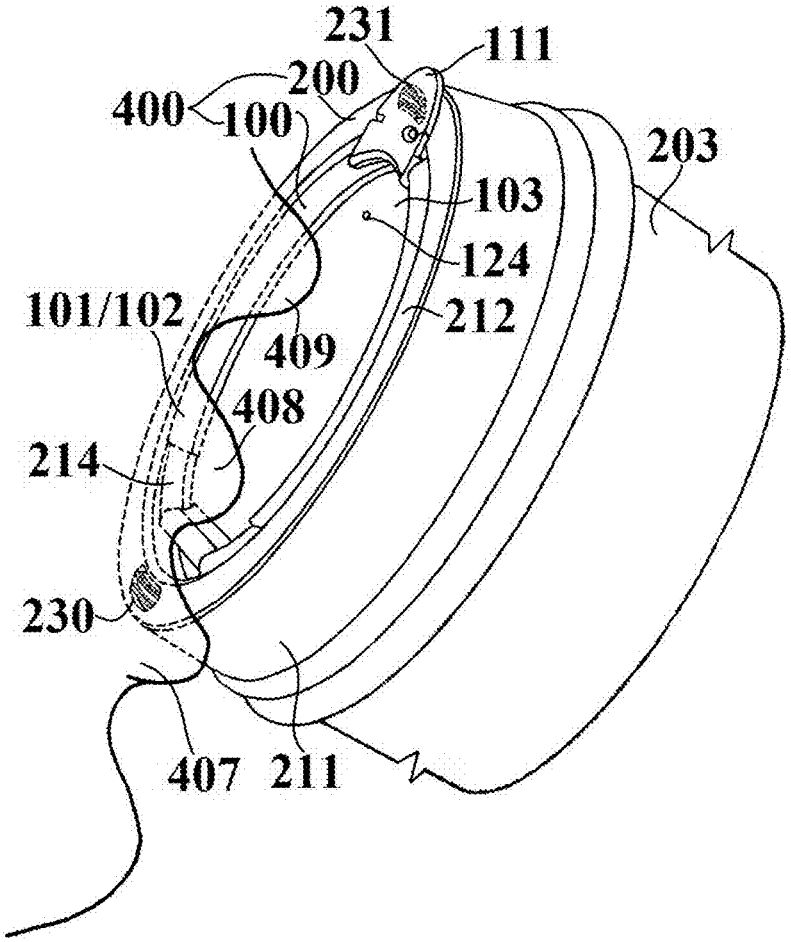
FIG. 8C is a perspective top view of the dome lid configuration in FIG. 8A with the hatch cover part in the fully closed position wherein a customer is drinking from the first drinking access port.

FIG. 8C is a perspective top view of the dome lid configuration in FIG. 8A with hatch cover part 100 in the fully closed position wherein a customer is drinking from the first drinking access port 230. FIG. 8C shows another preferred embodiment of dome lid 400 where planar top transition surface 212 represents an elevated raised and planar region and recessed top wall 103 of hatch cover part 100 represents a second recessed lowered and planar region co-planar with recessed hatch opening 227 (see FIG. 11A). Recessed top wall 103 is sufficiently recessed below planar top transition surface 212 to accommodate the customer's lips and nose, where bottom lip 407 and top lip 408 form a good seal around the first drinking access port 230 (phantom lines) with the bottom lip 407 in contact with first outside wall 211 and planar top transition surface 212 and the customer's top lip 408 and nose 409 are accommodated by recessed top wall 103 as the customer tilts disposable beverage container 203 (compressed for ease of illustration) at an increased angle promoting delivery of beverage 209 (see FIG. 8A) through the first drinking access port 230, tilting further as the volume of beverage 209 decreases in disposable beverage container 203, thereby showing the relationship between the customer's bottom lip 407, top lip 408, and nose 409 when drinking from dome lid 400.

In a further preferred embodiment of the present invention a vent hole 124 may be die-cut through recessed top wall 103 for the purposes of allowing air flow into disposable beverage container 203 for air pressure equalization within disposable beverage container 203 when hatch cover part 100 is in the fully closed position and a customer is drinking from the first drinking access port 230, thereby allowing beverage 209 to flow out in an even stream. In the absence of vent hole 124, or other openings to allow air into disposable beverage container 203, a vacuum is created forcing the customer to suck on the drinking aperture to promote beverage 209 flow. Vent hole 124 is presented as an optional consideration in this new invention as this new two part container lid is a two part configuration comprising a hatch cover part 100 and a brim mount part 200 wherein the interface between the frictional fitment of clamping rib 101/locking channel 102 (phantom and solid lines, locking channel 102 not visible in FIG. 8C) of hatch cover part 100 in the fully closed position onto retaining rib 214 (phantom and solid lines) of dome brim mount part 200 is not air tight, providing some access for air to pass through this interface into disposable beverage container 203. Similarly, when hatch cover part 100 is in the fully closed position gripping tab 111 covers the second drinking access port 231 (phantom lines), and this interface is also not air tight, allowing further air to be drawn in through the secondary drinking access port 231 into the upper end opening 202 (see FIG. 4A) of the disposable beverage container 203. Both these access interface areas provide routes for air to seep into disposable beverage container 203, offering pressure equalizing points within disposable beverage container 203, similar to vent hole 124, promoting a more usual, even and smoother flow of beverage 209 through the first drinking access port 230 when the customer tilts disposable beverage container 203 rather than requiring a sucking action on the part of the customer to receive beverage 209. Optionally, however, the pivoting of hatch part 100 to a fully opened position provides the best equalization of pressure and control of beverage consumption through the second drinking access port 231 as shown in FIG. 16C. The diameter of vent hold 124 is relatively small when compared with the described interfaces which permit air to access disposable beverage container 203 when hatch cover part 100 is in the fully closed position and for this reason vent hole 124 is introduced as an optional preferred embodiment and one less step to be included in the manufacturing process, however, it may still be optionally included as a further means of equalization of pressure within sealed disposable beverage container 203 when drinking through the first 230 drinking access port.

Figure 11A:
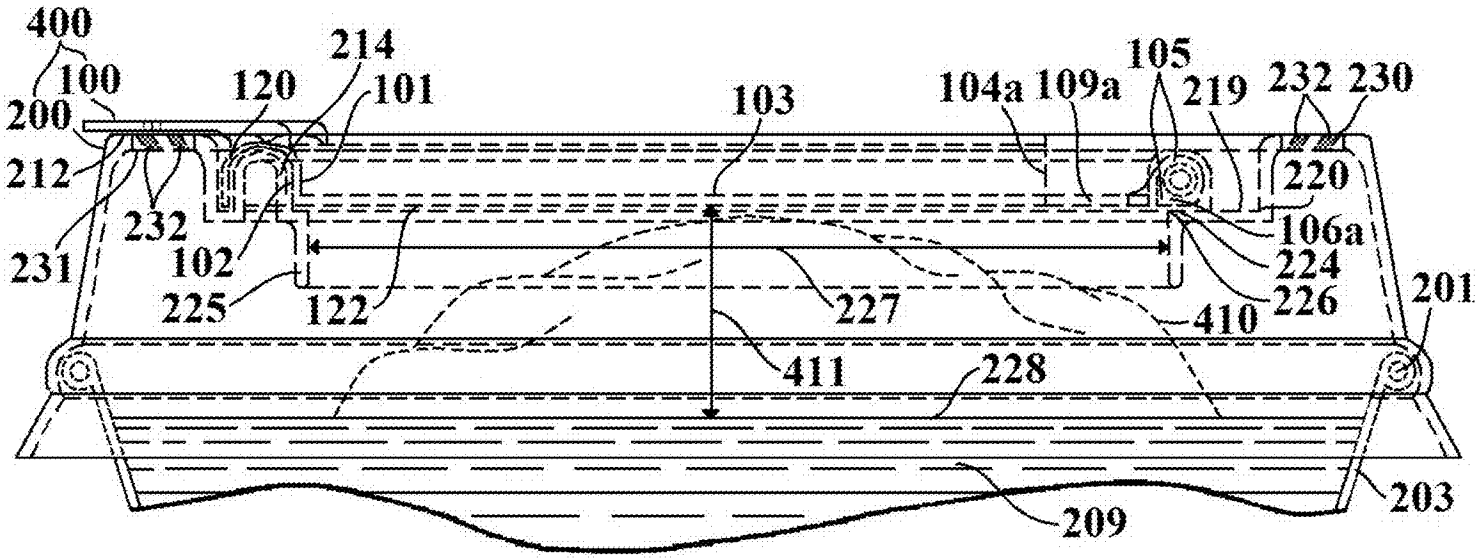
FIG. 11A is a side view in section of the dome lid configuration, mounted to the rolled rim of a beverage container, compressed for ease of illustration, with the hatch cover part in the fully closed position taken substantially along line F-F in FIG. 10.

Although recessed top wall 103 is recessed to accommodate the customer's bottom lip 407, top lip 408, and nose 409, recessed top wall 103 is still sufficiently elevated above beverage surface plane 228 (see FIG. 7A), providing vertical space to accommodate the vertical peak of whipped toppings 410 added to beverage surface plane 228 without the flattening of these toppings when dome lid 400 is fitted to rolled rim 201 and when hatch cover part 100 is in the fully closed position (see FIG. 11A).

Figure 8D:
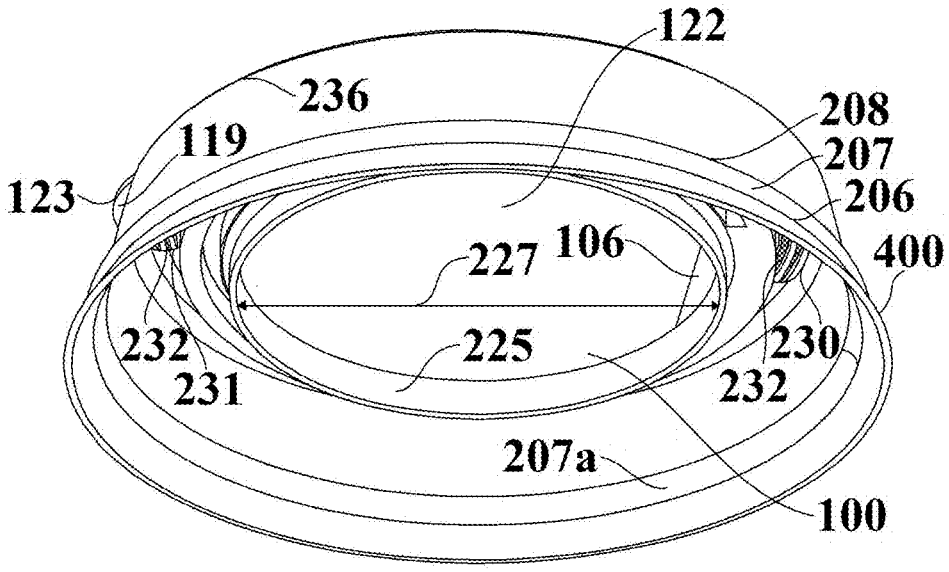
FIG. 8D is a perspective bottom view of the dome lid configuration in FIG. 8A.

FIG. 8D is a perspective bottom view of dome lid 400 in FIG. 8A with hatch cover part 100 in the fully closed position showing anti-splash/spill apron 225 encircling recessed hatch opening 227 (solid line with double-headed arrows). A portion of the bottom of rectangular base 106 is shown blended to recessed top wall 103 (103 not visible in FIG. 8D) and recessed top wall underside bottom surface 122 (also see FIG. 11A). There are also partial views of the first 230 and second 231 drinking access ports with louvers 232 and gripping tab bottom surface 119 with curvilinear perimeter front edge 123 extending marginally beyond the planar top transition surface outside perimeter edge 236. Interior sealing curvature 207*a* is shown on the reverse side of clamping curvature 207 which is sandwiched between lower furrow 206 and upper furrow 208.

Figure 9A:
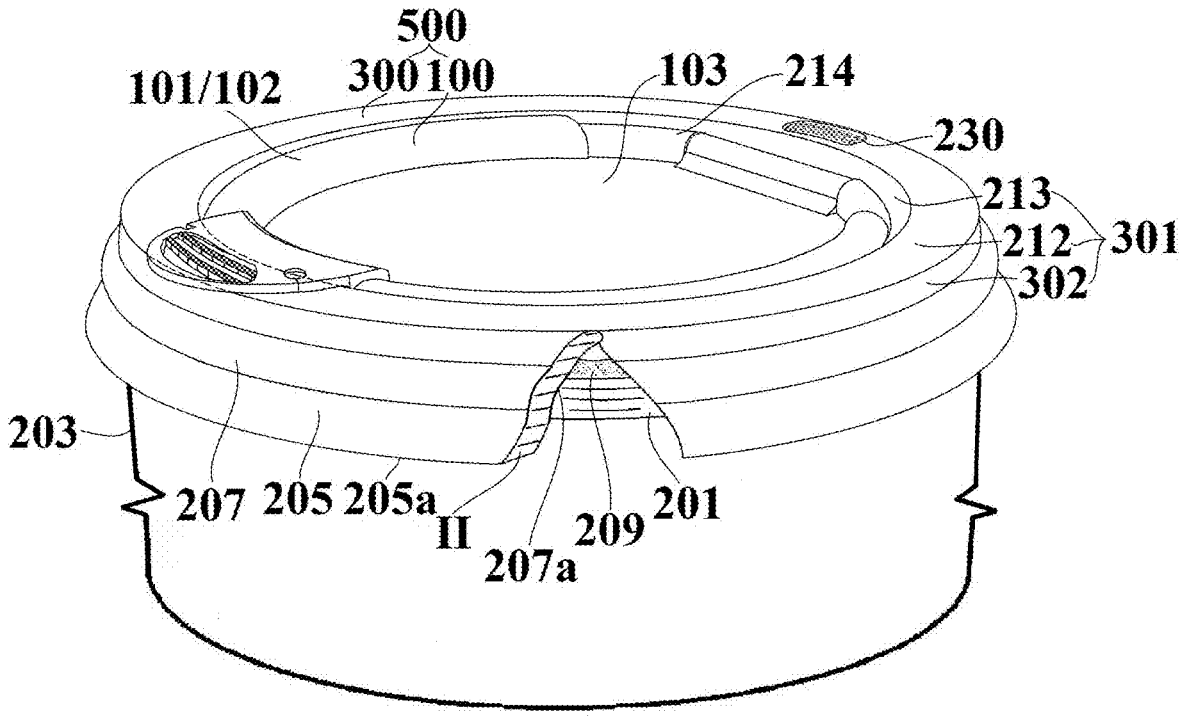
FIG. 9A is a perspective top view of the hatch cover part (see FIG. 1A) in the fully closed position attached to the flat brim mount part (see FIG. 5A) mounted to the rolled rim of a beverage container, compressed for ease of illustration.

FIG. 9A is a perspective top view of flat lid 500 comprised of flat brim mount part 300 and hatch cover part 100 in the fully closed position. Flat lid 500 includes all of the preferred embodiments and parts described for dome lid 400 in FIG. 8A except for ring-shaped crown portion 210 which has been compressed to form compressed ring-shaped crown portion 301, where second outside wall 213 and planar top transition surface 212 remain unchanged, while the height of first outside wall 211 has been compressed to form compressed first outside wall 302. Although compressed first outside wall 302 has resulted in compressing dome lid 400 to form flat lid 500, the relative heights of second outside wall 213, and therefore the height of planar top transition surface 212, compared with the height of clamping rib 101/locking channel 102 clamped to retaining rib 214 when hatch cover part 100 is in the fully closed position, remain unchanged with the same relative heights as shown in FIG. 8A.

In another preferred embodiment, compressed first outside wall 302 does not change the relationship between planar top transition surface 212, a elevated raised and planar region, and recessed top wall 103, a second recessed lowered and planar region, where recessed top wall 103 remains sufficiently recessed below planar top transition surface 212, thereby accommodating the customer's top lip 408 and nose 409 when tilting disposable beverage container 203 (compressed for ease of illustration) during beverage 209 consumption through the first drinking access port 230, as shown in FIG. 8C, when hatch cover part 100 is in the fully closed position. In a further preferred embodiment of flat lid 500, flat brim mount part 300 and recessed top wall 103 of hatch cover part 100 are brought into closer proximity to beverage surface plane 228 (see FIG. 11G).

Flat lid 500 shows cut-away II, once again demonstrating how bottom flange 205 and outside perimeter free edge 205*a* with clamping curvature 207 sealing curvature 207*a* cooperatively work as rim-engaging means adapted to reversibly engage interior sealing grove 207*a* to rolled rim 201 in a mutually reversible non-permanent relatable locking relationship first described in FIGS. 5A and 8A.

The positioning of the fingers and hands described in FIG. 8A, where the index finger 403 and thumb 404 grip curvilinear perimeter front edge 123 of gripping tab 111, together with positioning of the opposing hand 405 and remaining fingers 405*a* wrapped around disposable beverage container 203 and opposing thumb 406 extended to apply downward pressure to annular skirt 204 on dome lid 400 in FIG. 8A, may be suitably optionally positioned on flat lid 500 in a similar fashion for the purposes of pivoting hatch cover part 100 between a fully opened and a fully closed position and any intermediate opened position therein.

Figure 11C:
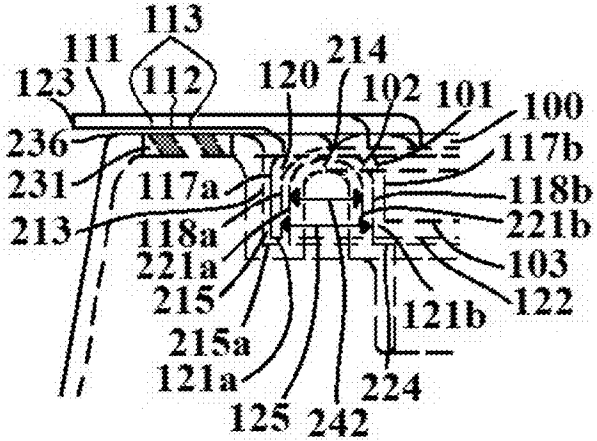
FIG. 11C is a partial side view in section on a larger scale of a portion of the dome lid configuration in FIG. 11A.
Figure 11B:
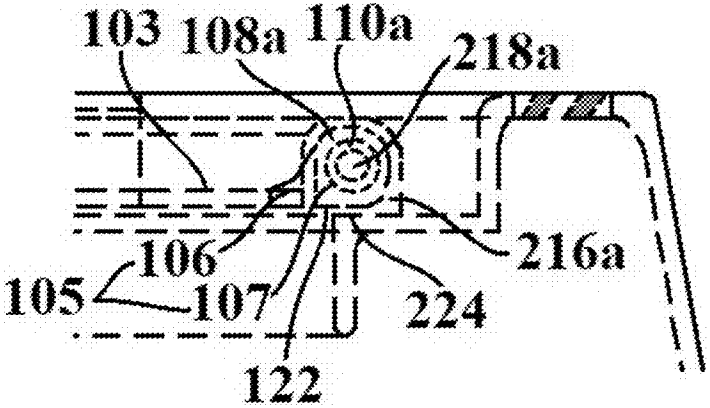
FIG. 11B is a partial side view in section on a larger scale of a portion of the dome lid configuration in FIG. 11A.
Figure 11D:
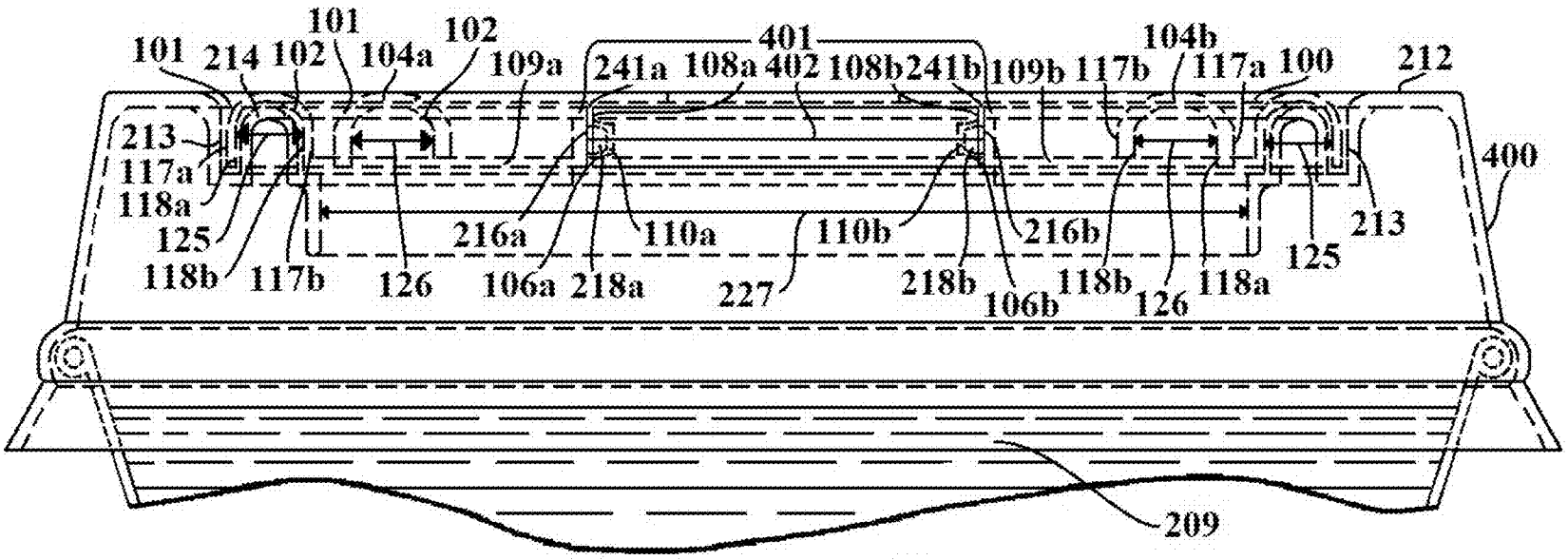
FIG. 11D is a side view in section of the dome lid configuration, mounted to the rolled rim of a beverage container, compressed for ease of illustration, with the hatch cover part in the fully closed position taken substantially along line G-G in FIG. 10.
Figure 11F:
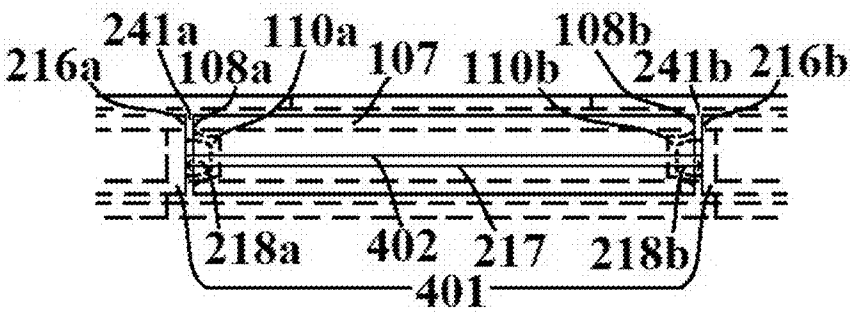
FIG. 11F is a partial side view in section on a larger scale of a portion of the dome lid configuration in FIG. 11D.
Figure 11E:
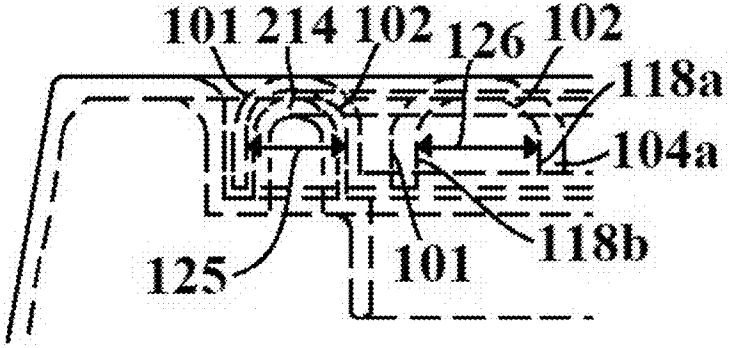
FIG. 11E is a partial side view in section on a larger scale of a portion of the dome lid configuration in FIG. 11D.
Figure 11G:
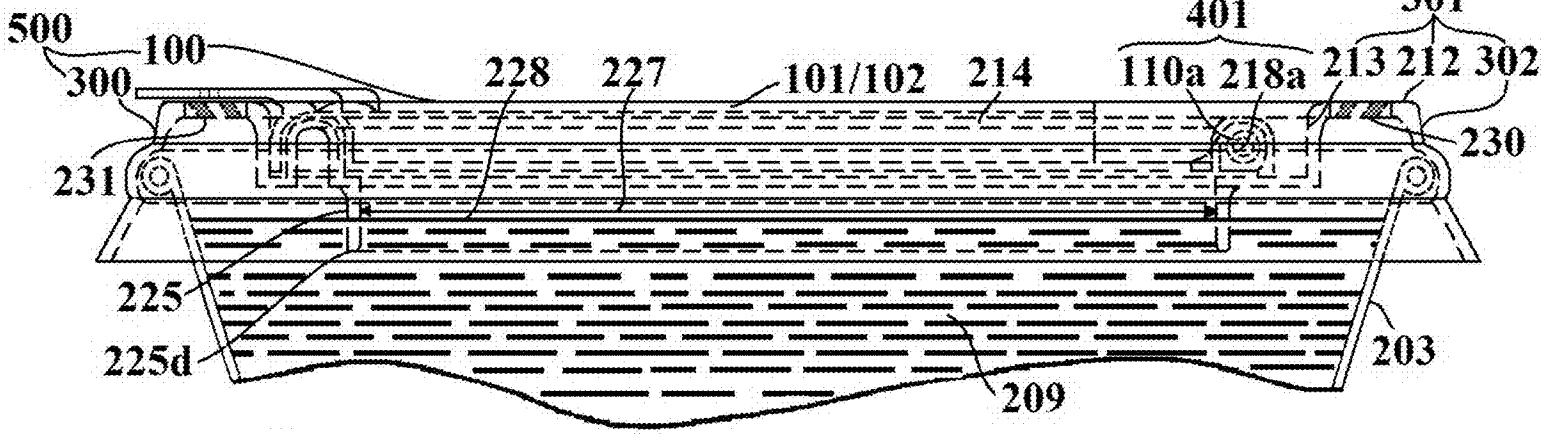
FIG. 11G is a side view in section of the flat lid configuration, mounted to the rolled rim of a beverage container, compressed for ease of illustration, with the hatch cover part in the fully closed position taken substantially along line F-F in FIG. 10.

The option of a flat lid 500 may be preferred by customers who request their grab-and-go beverages without toppings, thereby eliminating the need for the dome style lid 400 to protect added toppings from being flattened and pushed down into, and through, beverage surface plane 228 (see FIG. 11G). The flat lid 500 option offers customers a more streamlined container/lid configuration while still providing the same preferred embodiments and functionality described for dome lid 400 (FIG. 8A), albeit with a reduced vertical profile, while retaining the preferred embodiment of an articulating hatch cover part 100, exposing recessed hatch opening 227 (see FIG. 5B) to access beverage 209 without the necessity and risk of removing the entire flat lid 500 from the rolled rim 201 of disposable beverage container 203. The reduced height of flat lid 500 configuration, while allowing more lids to be stacked in the same available space compared with dome lid 400 configuration, offers the added benefit of less vertical height when two or more container 203/flat lid 500 configurations are stacked one on top of the other compared with the same arrangement for two or more container 203/dome lid 400 configurations, wherein the container 203/flat lid 500 configuration will take up less vertical space when stacked and packed for delivery compared with stacking and packing container 203/dome lid 400 configurations for delivery in the same available space.

The heights of first outside wall 211 for dome brim mount part 200 and compressed first outside wall 302 for flat brim mount part 300, shown respectively in FIGS. 4A and 8A, and 5A and 9A, may vary in their relative heights from that shown whereby dome brim mount part 200 may be further increased in height to accommodate whipped toppings 410 of increased vertical height without deformation when hatch cover part 100 is pivoted to the fully closed position over a whipped topping 410 (see FIG. 11A). Conversely, flat brim mount part 300 may be manufactured with an incremental vertical height increase which still remains less than the compared vertical height for dome brim mount part 200, thereby allowing a marginally increased height between the recessed top wall underside bottom surface 122 of hatch cover part 100 and the beverage surface plane 228, thereby accommodating some limited height of whipped toppings 410 (see FIG. 11A) added to beverage surface plane 228 while still offering some savings on material costs and an increase in stacking volumes for storage purposes. While there is the ability to increase or decrease the respective vertical heights of dome lid 400 and flat lid 500, such changes must be tempered against any loss in functionality and preferred embodiments in keeping with the principles of this new invention.

Although this new invention focuses on disposable container/lid configurations designed where the lid is clamped to the rolled rim 201 of a disposable container 203, this invention may be suitably adopted for use with reusable container/lid configurations used as grab-and-go beverage containers which are optionally accepted at fast food outlets offering a discount incentive when customers "bring-your-own-container" to be filled with beverage by the Barista and/or server. There will continue to be an interest in dunking a confection which may be accommodated by such reusable containers, allowing the Barista and/or server to fill a container with beverage through the hatch opening when the hatch cover part is pivoted to the fully opened position without the necessity of removing the lid from the top of the container, and also allowing the customer the option of leaving the hatch cover part in a fully opened position for the purposes of dunking a confection or performing other operations on the beverage without the necessity of first removing the lid from the container after being served their beverage.

Figure 9B:
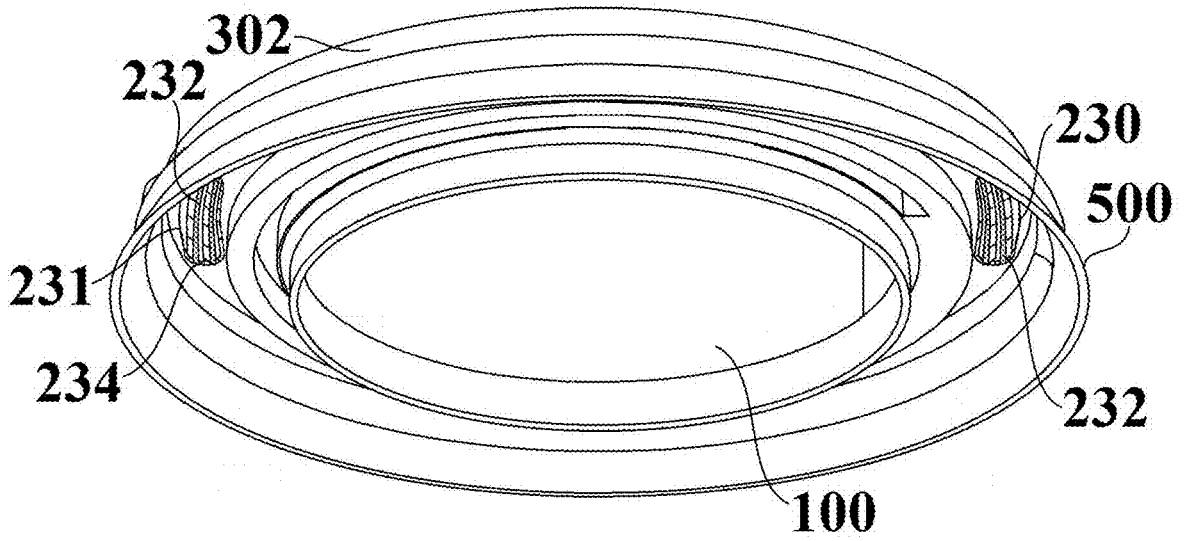
FIG. 9B is a perspective bottom view of the flat lid configuration in FIG. 9A.

FIG. 9B is a perspective bottom view of flat lid 500 in FIG. 9A with hatch cover part 100 in the fully closed position showing the same elements observed from a bottom view as described under FIG. 8B with the exception of compressed first outside wall 302, thereby exposing more of the underside of the first 230 and second 231 drinking access ports and louvers 232 joined to drinking access port inside walls 234.

Figure 10:
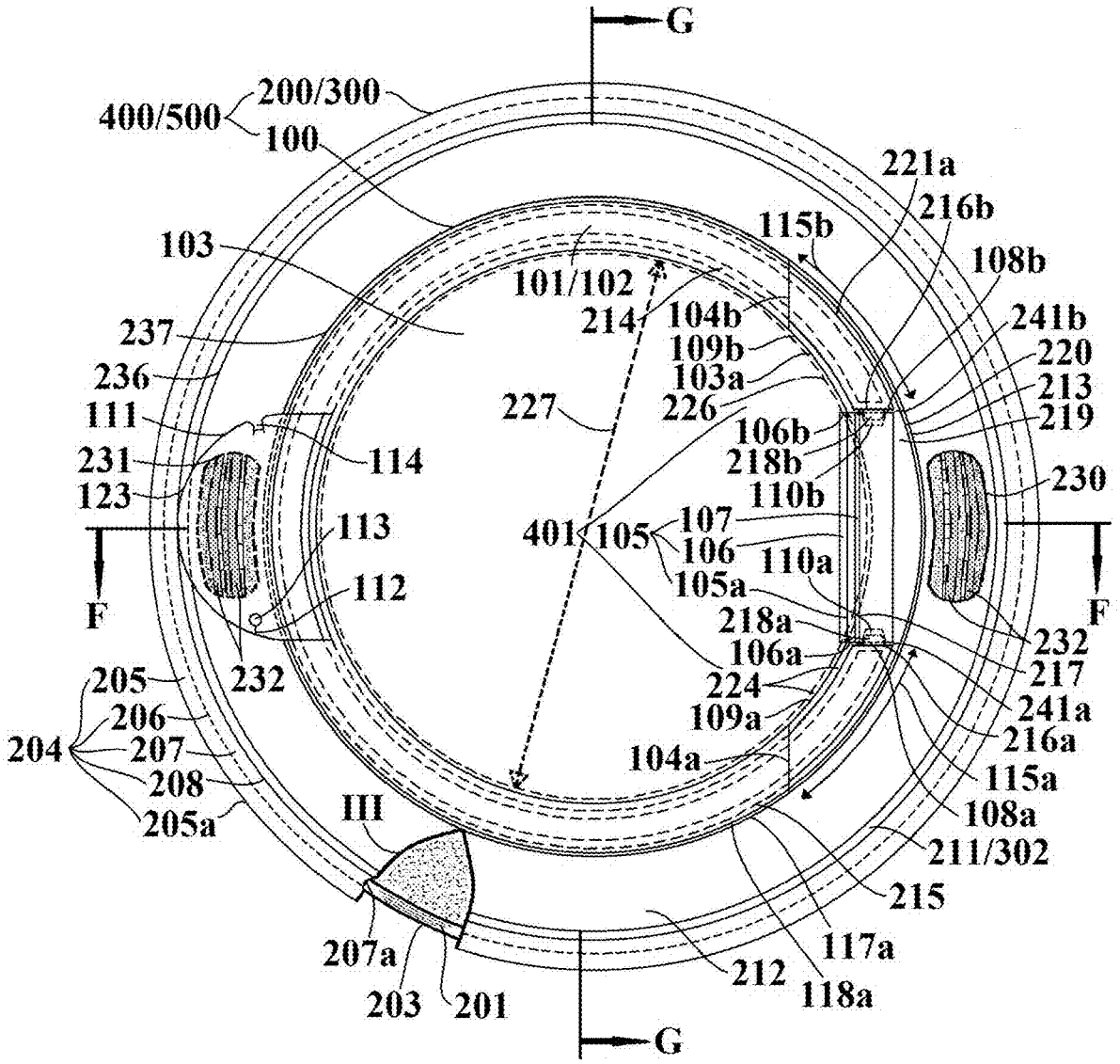

FIG. 10 is a top plan view representing dome lid 400 in FIG. 8A and flat lid 500 in FIG. 9A showing several preferred embodiments of the present invention. First outside wall 211 and compressed first outside wall 302, respectively, of dome brim 200 and flat 300 brim mount part, are not distinguishable in this plan view. Cut-away III discloses annular skirt 204 where outside perimeter free edge 205*a* and bottom flange 205 work in combination as rim engaging means to slide interior sealing curvature 207*a* over rolled rim 201 into a frictional mated clamping fitment to disposable beverage container 203 as previously discussed under FIG. 6. Clamping curvature 207/interior sealing curvature 207*a* are interposed between lower furrow 206 (phantom lines) and upper furrow 208. Opposing first 230 and second 231 (phantom lines) drinking access ports are centrally die-cut into planar top transition surface 212 between planar top transition surface outside perimeter edge 236 and planar top transition surface inside perimeter edge 237 with louvers 232 contoured longitudinally therein across the first 230 and second 231 (phantom lines) drinking access ports.

Figure 10A:
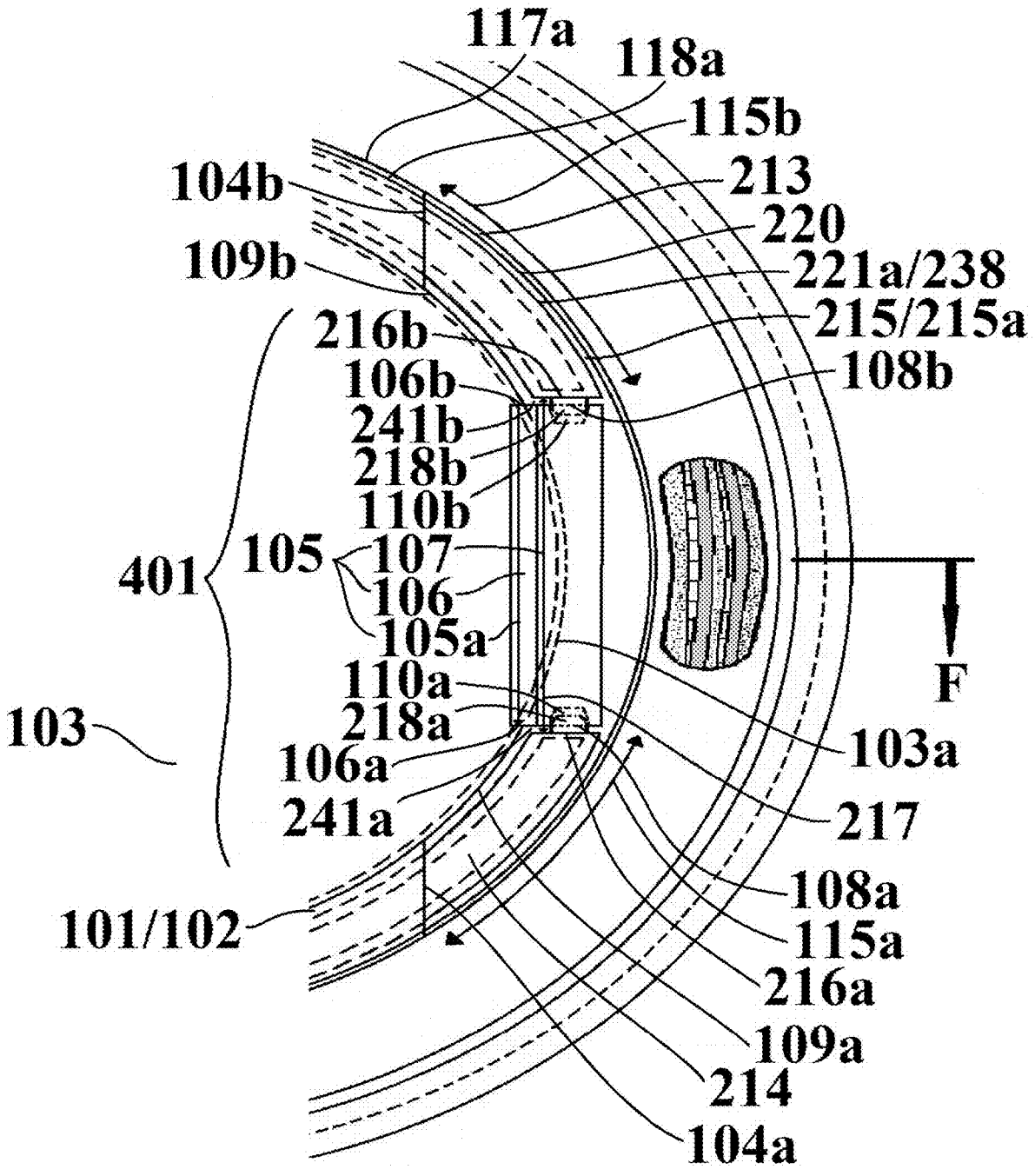
FIG. 10A is a partial top plan view on a larger scale of a portion of the dome and flat lid configurations in FIG. 10.

In a preferred embodiment, clamping rib 101/locking channel 102 (solid and phantom lines) are mated over retaining rib 214 (solid and phantom lines) through frictional fitment wherein clamping rib first outside wall 117*a*/locking channel first inside wall 118*a* frictionally fits into u-shaped trough 215 formed between second outside wall 213 and retaining rib first outside wall 221*a* (see FIGS. 11A and 11C). Clamping rib 101/locking channel 102 are terminated on opposing sides creating open ends 104*a* and 104*b*. Two symmetrically opposing equidistant segments 109*a* and 109*b*, further defined by respective segment arc lengths 115*a* and 115*b* (solid lines with double-headed arrows), are exposed around recessed top wall perimeter edge 103*a* between severed clamping rib 101/locking channel 102 open ends 104*a* and 104*b* and rectangular base end walls 106*a* and 106*b* (see also FIG. 10A), first described in FIG. 1A, wherein unmated equal and symmetric portions of retaining rib 214 are exposed. Segments 109*a* and 109*b* are necessary to allow hatch cover part 100 to pivot to its fully opened position, wherein segments 109*a* and 109*b* rest on planar top transition surface 212 as will be further discussed under FIG. 16A.

In a preferred embodiment gripping tab 111 is joined to the top of clamping rib 101 and is disposed outwards from clamping rib arch 120 (see FIG. 11A) in a substantially semi-circular shape with its curvilinear perimeter front edge 123 terminated marginally beyond the planar top transition surface outside perimeter edge 236, thereby providing an optional gripping means to the customer for grasping with their index finger 403 and thumb 404 (FIG. 8A) in order to raise hatch part 100, disengaging clamping rib 101/locking channel 102 from retaining rib 214 for the purposes of pivoting hatch cover part 100 to the fully opened position (see FIG. 16A) or some position between fully closed and fully opened positions. This plan view also shows gripping tab 111 completely covering the second drinking access port 231 (phantom lines) when hatch cover part 100 is in the fully closed position and also the relationship of string entry slit 112, string guide hole 113 and string retaining slot 114 to recessed hatch opening 227 (phantom line with double-headed arrows) as they relate to an infusion pouch and further discussed under FIGS. 21E to 21E.

Cylindrical housing 105 is comprised of rectangular base 106 and cylinder 107, wherein rectangular base 106 is joined to recessed top wall 103 of hatch cover part 100 and cylinder 107 is upwardly disposed from rectangular base 106. A portion of rectangular base 106 rests on annular interior rim 224 when hatch cover part 100 is in the fully closed position, whereby a portion of annular interior rim 224 is formed as a blended extension of planar transition panel 219, concealed partially by cylindrical housing 105. One end of planar transition panel 219 is contoured to second outside wall bottom furrow 220 extending to annular interior rim perimeter edge 226 and is also contiguous to end wall furrows 222*a* and 222*b* (not shown in FIG. 10, see FIGS. 4A and 4B), respectively at the base of opposing end walls 216*a* and 216*b* (also see FIGS. 4A and 4B) first gap 217 (solid line with double-headed arrows) between end walls 216*a* and 216*b* is equal to, or marginally wider than the cylindrical housing length 105*a* (solid line with double-headed arrows) of cylindrical housing 105 such that cylindrical housing 105 may be slidably inserted into first gap 217 (see FIG. 10A) for subsequent snap fitment and reversible attachment of hatch cover part 100 to the top portion of dome 200 or flat 300 brim mount part as discussed under FIG. 8A.

To assemble the separate detachable hinge parts, partially spherical indentation 110*a* and 110*b* are configured with radii substantially equal or slightly larger than the radii of partially spherical protrusions 218*a* and 218*b* to snugly enshroud partially spherical protrusions 218*a* and 218*b* whereby partially spherical indentation 110*a* and 110*b* define apertures sized to permit partially spherical protrusions 218*a* and 218*b* to be pressed firmly into the interior of partially spherical indentation 110*a* and 110*b*. The thin dimensional thickness of the separate hinge parts offer some flexibility combined with the smooth surface nature of thermoplastics thereby allowing the opposing end walls 216*a* and 216*b* to be flexed outwards, marginally expanding the dimensional length of first gap 217, thereby allowing cylindrical housing 105 to be slidably inserted into first gap 217, wherein the surfaces of opposing partially spherical protrusions 218*a* and 218*b* slide over the surfaces of respective opposing partially spherical indentation 110*a* and 110*b* into a concentric alignment, at which time the flexing of end walls 216*a* and 216*b* outwards is released, wherein the opposing partially spherical protrusions 218*a* and 218*b* are snap fitted into respective opposing partially spherical indentation 110*a* and 110*b* on the cylinder end walls 108*a* and 108*b* to form a constrained detachable hinge 401. The rigidity characteristics of the thin thermoplastics are strong enough to maintain the shape of the assembled detachable hinge 401 without deforming detachable hinge part 401. Each half of detachable hinge 401 is moulded as a complete unit with the hinge pieces in an assembled and operative condition. The respective cylinder end walls 108*a* and 108*b* and end walls 216*a* and 216*b*, are designed to be in intimate contact with each other, however, for illustrative purposes to better delineate the respective contacting end wall surfaces a first space 241*a* and a second space 241*b* have been introduced between the respective contacting end walls. As previously mentioned another optional method to assemble detachable hinge 401 involves flexing hatch cover part 100 to reduce the dimensional cylindrical housing length 105*a* of cylindrical housing 105 allowing cylinder 107 to be inserted into first gap 217 and bring partially spherical indentation 110*a* and 110*b* into concentric alignment with partially spherical protrusions 218*a* and 218*b*, at which time the flexing of hatch cover part 100 is released allowing cylindrical housing 105 to return to its original dimensional length wherein partially spherical indentation 110*a* and 110*b* enshroud and mate over partially spherical protrusions 218*a* and 218*b* (also see FIGS. 21F and 21F-1) forming detachable hinge 401 and connecting hatch cover part 100 to the top of dome 200 or flat 300 brim mount part.

In a preferred embodiment expediting the assembly of dome 400 and flat 500 lid configurations, the separate hinge parts, hatch cover part 100 and the respective dome 200 and flat 300 brim mount part, may preferably be made from resilient thermoplastic synthetic resins such as polystyrene and vinyl resins, which can be moulded and offer flexibility, memory properties, sufficient rigidity characteristics to maintain shape under high beverage temperatures, and possess smooth contact surface properties, thereby allowing for a snug fit between male and female respective detachable hinge parts 401 while allowing ease of rotation of hatch cover part 100 between fully closed and fully opened positions over recessed hatch opening 227. Lids may also be made from a resilient material composed of at least one of thermoplastic, non-thermoplastic, rubber or other material selected from a group consisting of polystyrene, polypropylene, polyethylene terephthalate (PETE), or made from a biodegradable material such as polylactic acid (PLA) or "corn plastic" plant-based materials and paper (cellulose) and may be manufactured by a variety of manufacturing processes, such as injection mouldings or a thermoforming operation, preferably vacuum forming and/or pressure forming from extruded polystyrene material or pulp moulded thereby offering flexing contact properties therein and may include methods of production with increased biodegradable benefits. Preferably hatch cover part 100, dome brim mount part 200 and flat brim mount part 300 are each formed from a one piece construction blank achieved when a thin sheet of polystyrene is extruded and, while still hot, delivered into a vacuum/pressure mould using male and female dies. The separate moulded units are removed from the sheets of the respective hinge parts and assembled forming dome lid 400 and flat lid 500.

FIG. 10A is a partial top plan view on a larger scale of a portion of dome 400 and flat 500 lid configurations in FIG. 10 with phantom lines depicting hidden elements. First gap 217 (solid line with double-headed arrows) is equal to, or marginally wider than the cylindrical housing length 105*a* (solid line with double-headed arrows) of cylindrical housing 105, thereby creating a snug interface between retaining rib end walls 216*a* and 216*b* and cylinder end walls 108*a* and 108*b*. These respective end walls are designed to be in intimate contact with each other, however, for illustrative purposes to better delineate the respective contacting end wall surfaces a first space 241*a* and a second space 241*b* have been introduced between the respective contacting end walls. The respective cylindrical housing length 105*a* (solid line with double-headed arrows) and first gap 217 would otherwise be manufactured with more intimate contact to meet their frictional surface contact functionality and preferred embodiments. Partially spherical indentation 110*a* and 110*b* snugly enshroud partially spherical protrusions 218*a* and 218*b* forming detachable hinge 401, allowing partially spherical indentation 110*a* and 110*b* to pivot in unison while limiting lateral movement that may disengage partially spherical protrusions 218*a* and 218*b* from partially spherical indentation 110*a* and 110*b*. Hatch cover part 100 is in the fully closed position wherein clamping rib first outside wall 117*a*/locking channel first inside wall 118*a* are frictionally wedged non-permanently between second outside wall 213 and retaining rib first outside wall 221*a* in u-shaped trough 215 with clamping rib first outside wall 117*a*/locking channel first inside wall 118*a* base 121*a* (not visible in FIG. 10 or 10A, see FIG. 11C) resting on u-shaped trough base 215*a* (not visible in FIG. 10A, see FIG. 11C) which is formed between second outside wall bottom furrow 220 and retaining rib first outside wall 221*a* bottom furrow 238 (retaining rib first outside wall 221*a* bottom furrow 238 are not distinguishable in FIG. 10A, see FIG. 7A for bottom furrow 238). U-shaped trough 215 and u-shaped trough base 215*a* are not distinguishable in FIG. 10A. Clamping rib 101/locking channel 102 (phantom and solid lines) are terminated on opposing sides creating open ends 104*a* and 104*b*. Two symmetrically opposing equidistant segments 109*a* and 109*b*, further defined by respective segment arc lengths 115*a* and 115*b* (solid lines with double-headed arrows), are exposed around recessed top wall perimeter edge 103*a* (perimeter edge 103*a* and segments 109*a* and 109*b* are not distinguishable in FIG. 10A) between severed clamping rib 101/locking channel 102 open ends 104*a* and 104*b* and rectangular base end walls 106*a* and 106*b* (see also FIG. 10A), first described in FIG. 1A, wherein unmated equal and symmetric portions of retaining rib 214 are exposed. Segments 109*a* and 109*b* are necessary to allow hatch cover part 100 to pivot to its fully opened position, wherein segments 109*a* and 109*b* rest on planar top transition surface 212 as will be further discussed under FIG. 16A. cylindrical housing 105 is further comprised of rectangular base 106 resting on top of recessed top wall 103 and also extending over recessed top wall perimeter edge 103*a*, and cylinder 107 resting on top of rectangular base 106.

FIG. 11A is a side view in section of dome lid 400 taken substantially along line F-F in FIG. 10, with hatch cover part 100 in the fully closed position, frictionally clamped to rolled rim 201 (phantom lines) of disposable beverage container 203 (compressed for ease of illustration). Planar transition panel 219 is disposed inwardly towards recessed hatch opening 227 (solid line with double-headed arrows) from second outside wall bottom furrow 220, extending horizontally below cylindrical housing 105 to merge and blend with annular interior rim 224 terminating at annular interior rim perimeter edge 226, which, together with anti-splash/spill apron 225, circumscribes recessed hatch opening 227. Anti-splash/spill apron 225 is downwardly dependent from annular interior rim perimeter edge 226, whereby anti-splash/spill apron 225 may be increased in vertical height forming extended anti-splash/spill apron 225*c* to penetrate beverage surface plane 228 as previously described under FIG. 7E, further restricting upward splashing from beverage surface plane 228.

In a preferred embodiment the first 230 and second 231 drinking access ports show the optionally integrated louvers 232 slanted downwards towards beverage surface plane 228 designed to restrict splashing upwards through drinking access ports, thereby redirecting splashing from beverage surface plane 228 back down into disposable beverage container 203. Louvers 232 were optionally introduced to the drinking access ports, wherein the number, length and width of louvers 232 may vary accordingly with the surface area of the drinking access ports to increase or decrease the degree of deflecting upwardly splashed beverage 209 back into disposable beverage container 203 and also control the volume of beverage 209 passing through the respective drinking access ports during consumption (see FIGS. 6A1-12).

In a further preferred embodiment of the present invention when hatch cover part 100 is in the fully closed position, the left side of FIG. 11A shows clamping rib 101/locking channel 102 frictionally fitted with downward finger pressing force (see FIG. 16D) exerted on the top wall 103 of hatch cover part 100 to press fit locking channel 102 to mate over retaining rib 214. Locking channel 102 discloses a first inside wall width 125 between locking channel 102 first 118*a* and second 118*b* inside walls which is equal to, or marginally narrower than retaining rib 214 outside wall width 242 (see FIG. 11C) between retaining rib first 221*a* and second 221*b* outside walls, whereby hatch cover part 100, pivoted to the fully closed position, is urged downward with gentle downward finger pressing force applied by thumb 404 and index finger 403 (see FIG. 16D) to clamping rib arch 120 and top wall 103, thereby flexing clamping rib 101/locking channel 102 respective first outside wall 117*a*/first inside wall 118*a* and second outside wall 117*b*/second inside wall 118*b* from an unstressed position outwards to deformably matingly fit over retaining rib 214 frictionally clamping locking channel first 118*a* and second 118*b* inside walls around retaining rib first 221*a* and second 221*b* outside walls in a reversible sturdy but non-permanent configuration (see FIG. 11C) seated closing abutment over retaining rib 214 and wherein the top wall perimeter edge 103*a*, on the bottom side of top wall 103 of hatch cover part 100, rests in a flush relationship with a top surface of annular interior rim 224, thus providing further support to hatch cover part 100 when in a fully closed position. Once locking channel 102 is mated over retaining rib 214 downward finger pressing force is released and locking channel 102 returns to its original unstressed configuration thereby locking hatch cover part 100 in the fully closed position over recessed hatch opening 227, bringing hatch cover part 100 recessed top wall 103 and dome brim mount part 200 recessed hatch opening 227 into a coplanar relationship, wherein the height of clamping rib arch 120 is at the same height as planar top transition surface 212. The mating of clamping rib 101/locking channel 102 onto retaining rib 214 terminates at open ends 104*a* and 104*b* (phantom lines, 104*b* not shown in this section) whereby segments 109*a* and 109*b* (phantom lines, 109*b* not shown in this section) are formed between open ends 104*a* and 104*b* (phantom lines, 104*b* not shown in this section) and rectangular base end walls 106*a* and 106*b* (phantom lines, 106*b* not shown in this section) with equally symmetric portions of clamping rib 101/locking channel 102 removed as shown in FIG. 1A.

Another preferred embodiment of the present invention shows the available vertical height 411 (vertical solid line with double-headed arrows) between beverage surface plane 228 and recessed top wall underside bottom surface 122, suitable for accommodating a whipped topping 410 (phantom lines) added to beverage surface plane 228 through recessed hatch opening 227 when hatch cover part 100 is in the fully opened position. Optionally, hatch cover part 100 may be fully closed without flattening whipped topping 410, thereby allowing whipped topping 410 to keep its physical appearance for separate consumption or to be optionally mixed in with beverage 209 at the customer's discretion.

FIG. 11B is a partial side view in section on a larger scale of a portion of dome lid 400 in FIG. 11A showing one half of detachable hinge 401 (see FIGS. 10 and 10A) comprised of centrally integrated partially spherical protrusions 218*a* and 218*b* (phantom lines, 218*b* not shown in this section) positioned on end walls 216*a* and 216*b* (phantom lines, 216*b* not shown in this section) seated in partially spherical indentation 110*a* and 110*b* (phantom lines, 110*b* not shown in this section), recessed, respectively, into cylinder end walls 108*a* and 108*b* (phantom lines, 108*b* not shown in this section). The centres of the partially spherical protrusions 218*a* and 218*b* and partially spherical indentation 110*a* and 110*b* are coincident. Cylinder 107 rests on rectangular base 106, both comprising cylindrical housing 105 which is joined to recessed top wall 103 of hatch cover part 100. The recessed top wall underside bottom surface 122 rests on annular interior rim 224.

FIG. 11C is a partial side view in section on a larger scale of a portion of dome lid 400 in FIG. 11A showing locking channel 102 mated over retaining rib 214 with clamping rib first outside wall 117*a*/locking channel first inside wall 118*a* interposed and wedged into, frictionally fitted between second outside wall 213 and retaining rib first outside wall 221*a* filling u-shaped trough 215 resting on u-shaped trough base 215*a* thereby further assisting to releasably lock hatch cover part 100 in a fully closed position uniformly reversible sealed configuration over recessed hatch opening 227 (see FIG. 11A). Locking channel 102 discloses a first inside wall width 125 (solid line with double-headed arrows) between locking channel first inside wall 118*a* and second inside wall 118*b* which is equal to, or marginally narrower than retaining rib outside wall width 242 (solid line with double-headed arrows) between retaining rib first 221*a* and second 221*b* outside walls, thereby allowing locking channel first 118*a* and second 118*b* inside walls to deformably reversibly frictionally mate over retaining rib first 221*a* and second 221*b* outside walls, when hatch part 100 is urged downward with gentle finger pressure applied by thumb 404 and index finger 403 (see FIG. 16D) to clamping rib arch 120, thereby flexing clamping rib 101/locking channel 102 respective first outside wall 117*a*/first inside wall 118*a* and second outside wall 117*b*/second inside wall 118*b* outwards to deformably mate over retaining rib 214 frictionally clamping locking channel 102 first 118*a* and second 118*b* inside walls around retaining rib first 221*a* and second 221*b* outside walls in a reversible sturdy but non-permanent configuration, releasably locking hatch cover part 100 in the fully closed position. The insertion of clamping rib first outside wall 117*a*/locking channel first inside wall 118*a* interposed and frictionally fitted between second outside wall 213 and retaining rib first outside wall 221*a* filling u-shaped trough 215 are drawn with a space introduced between second outside wall 213 and clamping rib first outside wall 117*a* and a space introduced between retaining rib first outside wall 221*a* and locking channel first inside wall 118*a* within u-shaped trough 215 to better illustrate their respective parts, however, when manufactured there would be no space between the respective walls as second outside wall 213 and retaining rib first outside wall 221*a* would be in more intimate contact respectively with clamping rib first outside wall 117*a* and locking channel first inside wall 118*a* inserted between second outside wall 213 and retaining rib first outside wall 221*a* (and also a space introduced between retaining rib second outside wall 221*b* and locking channel second inside wall 118*b* to better distinguish the respective walls) to generate the reversible deformable frictional fitment of locking channel 102 around retaining rib 214 holding hatch cover part 100 in the fully closed position. Recessed top wall 103 is inwardly disposed and forms around clamping rib second outside wall 117*b*/locking channel second inside wall 118*b* base 121*b* and blends into recessed top wall underside bottom surface 122. Clamping rib second outside wall 117*b*/locking channel second inside wall 118*b* base 121*b* rests on annular interior rim 224, whereby annular interior rim 224 prevents hatch cover part 100 from being pressed downwards and through recessed hatch opening 227 (see FIG. 10 and FIG. 16D) when finger pressure is applied to frictionally fit clamping rib 101/locking channel 102 onto retaining rib 214. The contact interface between locking channel 102 mated to retaining rib 214 offers a sealing interface between hatch cover part 100 and recessed hatch opening 227 of dome brim mount part 200 keeping beverage 209 within disposable beverage container 203 (see FIG. 11A).

Gripping tab 111 is joined to the top of clamping rib arch 120 and is outwardly disposed with its curvilinear perimeter front edge 123 just beyond the planar top transition surface outside perimeter edge 236, thereby providing a lip to optionally grasped between the customer's digits on either hand in order to lift hatch cover part 100 upwards to disengage locking channel 102 from retaining rib 214 (see FIG. 8A). Gripping tab 111 suitably covers the second drinking access port 231 when hatch cover part 100 is in the fully closed position. String entry slit 112 is defined by a single solid line while string guide hole 113 is defined by two parallel phantom lines on either side of string entry slit 112.

FIG. 11D is a side view in section of dome lid 400 taken substantially along line G-G in FIG. 10, with hatch cover part 100 in the fully closed position. The frictional mating of clamping rib 101/locking channel 102 (phantom lines) onto retaining rib 214 (phantom lines) is shown respectively at two positions on opposing sides of detachable hinge 401. In the first position the two opposing outside sections of clamping rib 101/locking channel 102 (phantom lines) are mated onto retaining rib 214 (phantom lines) in a symmetrical configuration to the right and left of adjacent second outside wall 213 on both the left and right side of this section disclosing a first inside wall width 125 (solid line with double-headed arrows) between locking channel first inside wall 118*a* and second inside wall 118*b*. At a second position the two opposing sections of clamping rib 101 (phantom lines) are severed forming clamping rib open ends 104*a* and 104*b* in a symmetrical configuration closer to retaining rib end walls 216*a* and 216*b* on either side of detachable hinge 401, resulting in a wider, second inside wall width 126 (solid line with double-headed arrows) between locking channel first inside wall 118*a* and second inside wall 118*b* compared with the narrower first inside wall width 125 (see also FIG. 11E). This wider second inside wall width 126 is needed when hatch cover part 100 is pivoted to the fully opened position, thereby allowing segments 109*a* and 109*b*, with the deleted severed sections of clamping rib 101 removed, to fit in intimate contact with planar top transition surface 212 as will be shown and discussed under FIG. 16A. Segments 109*a* and 109*b* are respectively interposed symmetrically between the terminating open ends 104*a* and 104*b* and rectangular base end walls 106*a* and 106*b*.

A further preferred embodiment in keeping with the principles of the present invention where clamping rib first outside wall 117*a* and second outside wall 117*b* form a broad rib width, providing a wider surface area for the customer to contact with digits of either hand to more gently mate and/or uncouple locking channel 102 and retaining rib 214 as shown in FIG. 16D, when respectively closing or opening hatch cover part 100. This does not preclude other friction fitting mating ribs of narrower width than those illustrated from being adopted which may see an increase in the diameter of recessed hatch opening 227 (solid line with double-headed arrows), offering further expanded opening for accessing beverage 209.

In another preferred embodiment of the present invention, retaining rib end walls 216*a* and 216*b* are in intimate contact with cylinder end walls 108*a* and 108*b*. Recessed inwardly from cylinder end walls 108*a* and 108*b* are centrally positioned opposing partially spherical indentation 110*a* and 110*b* configured with radii substantially equal to the radii of the partially spherical protrusions 218*a* and 218*b*, centrally positioned and extending outwardly on either side of end walls 216*a* and 216*b*, thereby permitting partially spherical protrusions 218*a* and 218*b* to be pressed snap fitted firmly into the interior of partially spherical indentation 110*a* and 110*b* thereby forming a constrained detachable hinge 401 (also see FIG. 11F). Partially spherical indentation 110*a* and 110*b* snugly enshroud partially spherical protrusions 218*a* and 218*b* showing their concentric relationship allowing partially spherical indentation 110*a* and 110*b* to pivot in unison about a longitudinal axis line 402 (solid line) while limiting lateral movement which may disengage partially spherical protrusions 218*a* and 218*b* from partially spherical indentation 110*a* and 110*b*. Retaining rib end walls 216*a* and 216*b* are in intimate contact with cylinder end walls 108*a* and 108*b*, however, these described parts are drawn with first space 241*a* and a second space 241*b* between them to better illustrate there respective parts. Retaining rib end walls 216*a* and 216*b* and cylinder end walls 108*a* and 108*b* would be manufactured such that these respective walls would be in contact with each other, allowing hatch cover part 100 to be pivoted due to the surface properties of the plastic to slide against each other, while the frictional contact between the respective walls would allow hatch cover part 100 to be pivoted to any intermediate opened position and retained at the chosen position without further assistance as will be further discussed under FIGS. 12 and 13.

FIG. 11E is a partial side view in section on a larger scale of a portion of dome lid 400 in FIG. 11D again showing the mating of clamping rib 101/locking channel 102 onto retaining rib 214. Clamping rib/locking channel open ends 104*a* and 104*b* (phantom lines, 104*b* not shown) are formed when clamping rib 101/locking channel 102 are severed forming a wider, second inside wall width 126 between locking channel 102 inside walls 118*a* and 118*b* compared with the narrower clamping rib/locking channel first inside wall width 125 between the same locking channel inside walls 118*a* and 118*b*.

FIG. 11F is a partial side view in section on a larger scale of a portion of dome lid 400 in FIG. 11D with phantom lines depicting hidden elements, showing respective retaining rib end walls 216*a* and 216*b* with partially spherical protrusions 218*a* and 218*b* enshrouded by partially spherical indentation 110*a* and 110*b* on the opposing ends of cylinder end walls 108*a* and 108*b*, comprising detachable hinge 401. First space 241*a* and a second space 241*b* are added for illustrative purposes to distinguish between the retaining rib end walls 216*a* and 216*b* cylinder end walls 108*a* and 108*b* which are configured to be in intimate contact as described under FIG. 11D.

In a further preferred embodiment end walls 216*a* and 216*b* are necessary to provide a vertical support surface for the two opposing partially spherical protrusions 218*a* and 218*b* which fit into the dished partially spherical indentation 110*a* and 110*b* when hatch cover part 100 is attached to dome brim mount part 200 to form dome lid 400. The flat side of partially spherical protrusions 218*a* and 218*b* extends from end walls 216*a* and 216*b*, therefore only the exposed semi-spherical half is mated with each dished partially spherical indentation 110*a* and 110*b*. Partially spherical indentation 110*a* and 110*b* on the cylinder end walls 108*a* and 108*b* are dished spherically configured with radii substantially equal to the radii of the partially spherical protrusions 218*a* and 218*b*. The dished partially spherical indentation 110*a* and 110*b* on cylinder end walls 108*a* and 108*b* snap in between partially spherical protrusions 218*a* and 218*b* thereby mating to complete the detachable hinge 401. Longitudinal axis line 402 (solid line) of detachable hinge 401 forms along the length of cylinder 107 of hatch cover part 100 and parallel to first gap 217 (solid line with double-headed arrows) of dome brim mount part 200. The radius of the dished out partially spherical indentation 110*a* and 110*b* and the radius of partially spherical protrusions 218*a* and 218*b* are designed to ensure the two parts mate and retain holding power and provide sufficient resistance to forces and moments which tend to separate detachable hinge 401, but of such resistance to allow for holding hatch cover part 100 in the fully closed position as well as at desired intermediate opened positions between a fully closed and a fully opened position, thereby restricting hatch cover part 100 from pivoting freely to another intermediate opened position or to fully opened position therein, while not impeding the pivoting movement of hatch cover part 100.

FIG. 11G is a side view in section of flat lid 500 taken substantially along line F-F in FIG. 10. All the preferred embodiments described in FIG. 11A are captured in FIG. 11G with one difference regarding the height of ring-shaped crown portion 210. In FIG. 11G ring-shaped crown portion 210 has been compressed to form compressed ring-shaped crown portion 301 and corresponding compressed first outside wall 302, however, ring-shaped crown portion second outside wall 213 and planar top transition surface 212 in FIG. 11A are not compressed and remain unchanged. This preferred embodiment was also previously described under FIG. 7G regarding flat brim mount part 300. Another preferred embodiment resulting from flat brim mount part 300 is the lowering of anti-splash/spill apron 225 base 225*d* to just above or below beverage surface plane 228 and/or into beverage 209, thereby affecting side-to-side sloshing of beverage surface plane 228 resulting from wave-action cause by normal agitation or jostling of disposable beverage container 203 (compressed for ease of illustration) due to walking or other movements of the hand. The lowering of anti-splash/spill apron wall base 225*d* increases the dampening of the side-to-side movement of beverage surface plane 228 reducing any upward splashing through recessed hatch opening 227 (solid line with double-headed arrows), and/or first 230 or second 231 drinking access ports.

The relative heights of compressed ring-shaped crown portion 301 with the top of clamping rib 101/locking channel 102 mated to retaining rib 214 remains unchanged as well as the assembling of hatch cover part 100 to flat brim mount part 300, wherein partially spherical indentation 110*a* and 110*b* (phantom line, 110*b* not shown in this section) and partially spherical protrusions 218*a* and 218*b* (phantom line, 218*b* not shown in this section) are snap fitted together to form a constrained detachable hinge 401.

A preferred embodiment of flat lid 500 is less material may be used in manufacturing, resulting in more units being stacked and stored in the same space compared with dome lid 400, while still offering the customer the ability to utilize flat lid 500 for optional dunking of a confection into a beverage 209 filled disposable container 203. In a further preferred embodiment, the option of a flat lid 500 with a pivoting hatch cover part 100 offers a "no frills" alternative to those grab-and go food outlets for customer's preferring their hot beverage without whipped toppings 410 such as whipped cream (see FIG. 11A). The flat lid 500 offers a more streamlined, lower profile disposable beverage container 203/flat lid 500 combination compared with the disposable beverage container 203/dome lid 400 option.

Figure 11H:
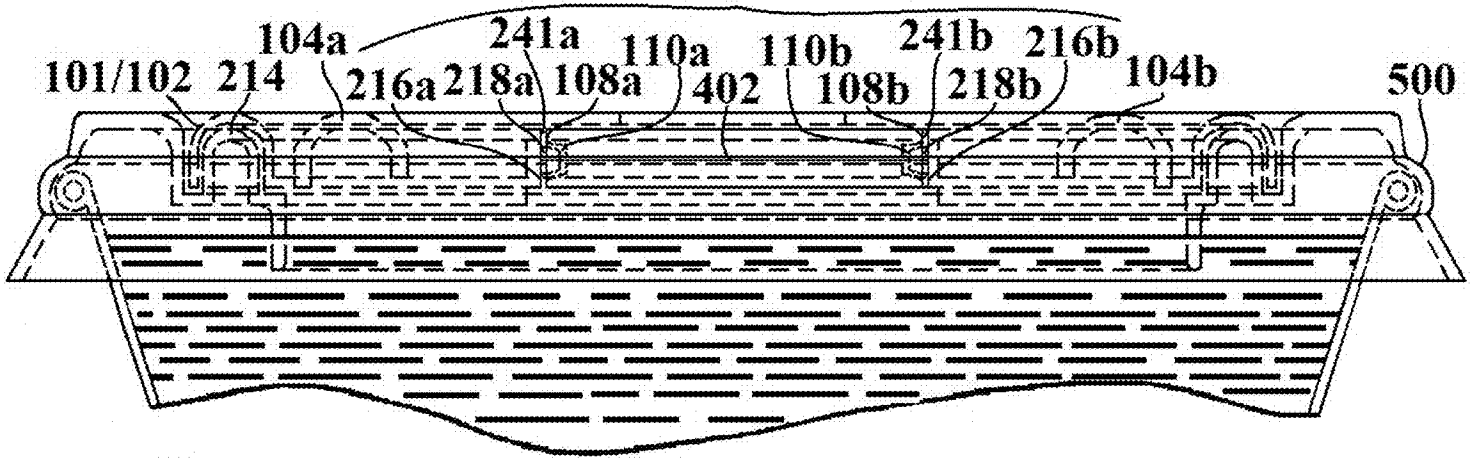
FIG. 11H is a side view in section of the flat lid configuration, mounted to the rolled rim of a beverage container, compressed for ease of illustration, with the hatch cover part in the fully closed position taken substantially along line G-G in FIG. 10.

FIG. 11H is a side view in section of flat lid 500 of the present invention taken substantially along line G-G in FIG. 10 showing a cross section of detachable hinge 401 along longitudinal axis line 402 (solid line) with partially spherical protrusions 218*a* and 218*b* snap fitted into partially spherical indentation 110*a* and 110*b* including first space 241*a* and a second space 241*b* to distinguish between the retaining rib end walls 216*a* and 216*b* cylinder end walls 108*a* and 108*b* which are configured to be in intimate contact as described under FIG. 11D. Open ends 104*a* and 104*b* are shown with removed clamping rib 101/locking channel 102. The preferred embodiments described in FIGS. 11E and 11F regarding the mating of clamping rib 101/locking channel 102 onto retaining rib 214 and the description and functionality of the parts comprising detachable hinge 401 are captured as well in FIG. 11H.

FIG. 12 is a perspective top view of dome lid 400 as described in FIG. 8A where the curvilinear perimeter front edge 123 of gripping tab 111 of hatch cover part 100 may be gripped between index finger 403 and thumb 404, or any combination of digits on either hand, initiating a progressive lifting of hatch cover part 100 (also see FIG. 8A) about detachable hinge 401 (not visible in this FIG. 12), disengaging locking channel 102 from retaining rib 214, partially pivoting hatch cover part 100 to an opened angle approximating 45°, allowing for more wafting of a combination of steam, heat and aroma 412 (solid wavy lines with single-headed arrows at the top) to escape from beverage 209 upwardly through recessed hatch opening 227 (solid line with double-headed arrows) while opposing thumb 406 steadies dome brim mount part 200 and at the same time opposing hand 405 and remaining fingers 405*a* steady disposable beverage container 203 (compressed for ease of illustration) or any combination of digits on either hand may be employed. FIG. 12 is another example demonstrating how the intimate snug interface between respective end walls 216*a* and 216*b* and cylinder end walls 108*a* and 108*b*, together with snug seated fitment of opposing partially spherical protrusions 218*a* and 218*b* within partially spherical indentation 110*a* and 110*b* (see FIGS. 10 and 10A), creates a passive frictional contact between these respective surfaces, allowing the customer to retain hatch cover part 100 at any intermediate opened position in its pivoting arc about detachable hinge 401 between a fully opened and a fully closed positions without the need of finger assistance to keep hatch cover part 100 in these intermediate opened positions. Although this tight interface creates friction to hold hatch cover part 100 at different positions without finger assistance, the suitability of the thermoplastic surface characteristics allows hatch cover part 100 to be easily pivoted between fully opened and fully closed positions, respectively, where hatch cover 100 is first partially opened in FIG. 12, and then subsequently pivoted to an opened angle approximately a 90° in FIG. 13, and finally in FIG. 16A hatch cover part 100 may be pivoted to a fully opened position approximating a 180° angle and retained in these respective positions due to the snug fitment of detachable hinge 401. These same preferred embodiments apply to flat lid 500.

FIG. 13 is a perspective top view of dome lid 400 as described in FIG. 8A where the curvilinear perimeter front edge 123 of gripping tab 111 has been lifted, pivoting hatch cover part 100 to approximately a 90° angle, again demonstrating how the customer or Barista and/or server may pivot hatch cover part 100 to any intermediate opened position between fully opened and fully closed positions, and where the preferred embodiments of this present invention allows hatch cover part 100 to be retained at any of these preferred positions without further finger assistance.

As previously discussed, this new invention introduces a paradigm shift in the preparation of grab-and-go beverages, reducing many of the risks encountered by both the Barista and/or server during the preparation process ending with the clamping of a lid to the beverage filled container, and to the customer who might wish to further customize their beverage and therefore pry the clamped lid from the rolled rim of the container. This new invention offers an alternative, safer approach to beverage preparation where the Barista and/or server may first clamp a dome 400 or flat 500 lid to the rolled rim 201 (see FIG. 8A) of an empty disposable beverage container 203 (compressed for ease of illustration). The Barista and/or server then pivots hatch cover part 100 to its fully opened position, beginning with optionally gripping the gripping tab 111 as described in FIG. 8A and ending with hatch cover part 100 pivoted to its fully opened position as shown in FIG. 16A. This exposes a recessed hatch opening 227 (solid and phantom lines with double-headed arrows) of sufficient diameter, not only suitable for dunking a confection, but broad enough to optionally receive a poured beverage 209 through recessed hatch opening 227 into disposable beverage container 203. The Barista and/or server may then add and stir condiments through recessed hatch opening 227 into the freshly poured beverage 209 within container 203. The beverage filled disposable container 203 may then be optionally served to the customer with hatch cover part 100 returned to its fully closed position as shown in FIGS. 8A and 9A. Alternatively, beverage 209 filled disposable container 203 may be served to the customer with hatch cover part 100 pivoted to any intermediate opened position therein. Although hatch cover part 100 may be fully opened when served to the customer, anti-splash/spill apron 225 of the respective dome 200 and flat 300 brim mount part respectively comprising dome 400 and flat 500 lid configurations will still reduce some side-to-side wave-action at the beverage surface plane 228 from creating upward splashing through recessed hatch opening 227 and/or through first 230 and/or second 231 drinking access ports arising when beverage 209 filled disposable container 203 is being transported compared with the potential upwards splashing created when transporting a beverage served without a disposable lid requiring the customer to take the opened beverage container to another station to acquire and attach a lid, risking possible spills during transport and further risk of spills when attaching a disposable lid. Even when this new disposable lid/container configuration is served with a fully opened hatch cover part 100, the potential for accidents related to splashing and spilling through recessed hatch opening 227 and/or first 230 and/or second 231 drinking access ports is reduced by anti-splash/spill apron 225 and the fact that this new two part container lid remains attached to the disposable container, through the beverage preparation, purchase and consumption periods, without the necessity to remove this new two part container lid to access the contents, significantly reducing the potential for upwards splashing and spills during beverage transport.

Recessed hatch opening 227 (phantom and solid lines) also allows the optional addition of a whipped topping 410 to float on beverage surface plane 228 (as seen in FIG. 11A) with a vertical peak without removing the dome 400 or flat 500 lid configurations from the disposable container. The Barista and/or server may add the whipped topping 410 through recessed hatch opening 227 when hatch cover part 100 is pivoted to the fully opened position (FIG. 16A). FIG. 13 shows an example of whipped topping 410 added through recessed hatch opening 227 attractively built up vertically on beverage surface plane 228 with hatch cover part 100 pivoted from the fully opened position to an opening of approximately 90° offering a partial protective barrier for whipped topping 410 in this 90° opening without contacting the peak of the whipped topping 410.

The addition of a whipped topping to a beverage surface continues to be a popular option. The irony is that often the customer is witness to the preparation process, seeing and hearing the fresh cream being whipped in a metal carafe followed by the Barista and/or server adding the whipped topping onto the beverage surface gradually building a suitable mound of whipped topping with a vertical peak while the customer's anticipation is also building, waiting for their beverage to be served. Some beverages are served without the lid attached, the whipped topping attractive and inviting, floating on the beverage surface, ready to be eaten separately or partially dissolved and sipped mixed in with the beverage. In this scenario the customer may optionally enjoy consuming the topping before optionally risking spills and possible injury clamping a lid to seal the container. In other instances beverages are prepared with added whipped topping only to have the Barista and/or server clamp a disposable lid onto the disposable container and serve it to the customer, the whipped topping hidden from view, compressed into the beverage within. The customer than has the option to drink the beverage with the mixed in whipped topping through the drinking access port, or risk quickly prying off the lid, grabbing a spoon to scoop up any undissolved whipped topping remaining on the beverage surface. In the short time between preparation and serving the sealed beverage container, any whipped topping added to the beverage surface is flattened, dissolving into the beverage below, with the only evidence a whipped topping was originally floating on the beverage surface found adhering to the underside surface of the lid. Why go through the time and effort to prepare an attractively topped drink only to deconstruct it when the lid is attached prior to serving? Within seconds of the lid being clamped to the container the pristine mound of whipped topping begins to dissolve into the beverage below. Unfortunately we have become accustomed to this unchecked flattening of our whipped toppings where it has also become acceptable to risk spills and accidents prying the lid off before the whipped topping completely dissolves into the beverage. No one wants to end up with a scalding hot beverage on their hands, on their clothes, and absolutely not on a nearby customer, which is avoided with this new invention, eliminating the need to remove the clamped lid from the container to access a whipped topping added to a beverage surface. Dome 400 and flat 500 lid configurations conveniently allow the Barista and/or server to pre-attach these respective lids, with the hatch cover part pivoted to the fully opened position, on to empty disposable beverage containers 203, pour beverage 209 through recessed hatch opening 227, optionally add condiments through recessed hatch opening 227, and top off the beverage with a whipped topping 410 rising upwards through recessed hatch opening 227, then serve it to a customer with the whipped topping pristine, unchanged and not squashed down through the beverage surface as past preparation processes have been described.

Disposable lids and containers are not designed for repeated engagement and disengagement of a lid, respectively, to and from the rolled rim of a container. The initial engagement of a new two part container lid to the rolled rim of a new disposable beverage filled container forms a tightly clamped interface between the two parts. Repeated removal and re-attachment of the lid gradually deforms the rolled rim of the container, loosening the clamped seal, leading to possible beverage leaks at this interface and the disengaging of the lid from the container. This new invention reduces the risks associated with the necessity of clamping a lid on, or prying a lid from, a beverage 209 filled disposable container 203, whereby both dome 400 and/or flat 500 lid configurations may be pre-attached to the rolled rim 201 of a disposable beverage container 203 followed by beverage 209 poured through recessed hatch opening 227, and then served to the customer, with the option of adding condiments or dunking a confection through recessed hatch opening 227 eliminating the risks associated with removing a disposable lid from a disposable container to access a beverage or to affix a disposable lid onto a disposable container after accessing a beverage within. The benefits of this new invention offering an alternative grab-and-go beverage preparation method takes on added importance since the advent of the Corona virus disease (COVID-19), whereby the number of "touches" the Barista and/or server introduce during the beverage preparation process, and by the customer following receipt of the beverage, are reduced, consequently reducing handling of the container and lid and the potential introduction of germs during the beverage preparation and consumption process. Although flat lid 500 is not shown with a partially opening of hatch cover part 100 in FIG. 12, the benefits described for dome lid 400 in FIGS. 12 and 13 also apply to flat lid 500.

Another preferred embodiment of this new invention relates to complimentary beverage refills offered by some fast food outlets. A complimentary refill often sees the disposable container re-used while the disposable lid is discarded and replaced with a new lid. Dome 400 and flat 500 lid configurations allow for the disposable container and disposable lid to be re-used and not disassembled to discard, and for a complimentary beverage 209 refill to be poured through recessed hatch opening 227 when hatch cover part 100 is pivoted to the fully opened position. This results in several benefits to the Barista and/or server and to the fast food establishment. This new invention allows the Barista and/or server to rapidly expedite refills in a risk-free manner through the recessed hatch opening 227 of this new invention, no longer requiring time expended removing the used lid and discarding it, and eliminating any risk when re-attaching a new lid to a refilled beverage container. This time savings allows the Barista and/or server to quickly perform complimentary refills while still expediting new beverage orders thereby meeting the grab-and-go fast food service business model. There is also the safety factor resulting from prying a clamped lid from a previously beverage filled disposable container, affecting the shape of the container rim and inviting risk of accidents when re-attaching a new lid to a previously used disposable container holding a freshly poured hot refill of beverage, where the seal between lid and container can no longer provide the same original tightly clamped interface as outlined above. Although the disposable beverage container/lid submitted for a refill should be discharged of all beverage from the previous order, this may not be the case in every instance as there may still be residual beverage in the disposable container which must be discarded, adding additional steps and expended time to the beverage refill process, and also which may be accidentally spilled during the removal of the lid. Time and space must be allotted in the confined preparation area within a fast food outlet to accommodate complimentary beverage refills while still preparing new beverage orders, which add to the possibility of accidents when removing and re-attaching lids to used disposable beverage containers. While the end results are essentially the same, a beverage filled disposable container, there are preparation process differences when preparing a new beverage order and a refilled beverage order. More time and care must be expended to address complimentary beverage refills into a used disposable container/lid configuration compared with filling a beverage into a fresh, unused disposable beverage container. There is also added pressure placed on the Barista and/or server to address refills which might impact on pending new orders from customers who have not yet received their first beverage purchase while other customers are already enjoying their complimentary refills, causing the Barista and/or server to ramp up the service potentially leading to accidents. Beverage refill requests are usually submitted some time after the initial beverage purchase has been consumed. During this time delay the disposable beverage container is no longer in its new, original, beverage filled condition. Instead, during this time, the disposable beverage container has undergone some weakening through contact with heat, in the case of a hot beverage, and liquid, for both hot and cold beverages, affecting and reducing the rigidity of the disposable beverage container wall requiring more care when gripping the disposable container to leverage the release of the lid from the rolled rim of the container. The same contributing factors of heat and liquid contact also impact the rolled rim of the disposable beverage container, causing the rolled rim to lose some of its original tightly compressed rolled shape and possibly unravel, weakening the interface when the new lid is clamped to the rolled rim of the used disposable refilled beverage container. Consequently, the weakening of the previously used disposable container affects the removal of the original clamped lid and also has an impact when clamping a new lid to the used disposable container rolled rim, leading to a poor seal at the interface and an increased likelihood of accidents when working with a used beverage filled disposable container instead of a new disposable beverage container and lid. Further risks ensue once the customer receives their refill, should the customer decide their beverage needs some further attention, again removing a new lid from a weakened rolled rim of a used disposable container, risking spills when removing, and subsequently spills when re-attaching the new lid to this progressively weakened used container rolled rim. The dome 400 and flat 500 lid configurations of this new invention eliminates these related issues as there is no longer a need to delicately grasp the used disposable container and to carefully and patiently pry the old lid from the disposable container rolled rim or to re-attach a new lid to a freshly filled, reused beverage container, no longer impacting the lid/container rim interface and also resulting in a time saving during the beverage refill process. The beverage refill may be completed in an expeditious and safe manner by the Barista and/or server following the same preparation process used to complete new beverage purchases of pouring beverage 209 through the recessed hatch opening 227 of a pre-attached dome 400 or flat 500 lid into an empty disposable beverage container 203 with hatch cover part 100 in the fully opened position. There is also a direct and immediate cost saving to the fast food outlet as beverage refills no longer need replacement of the used lid with a new lid as the original dome 400 or flat 500 lids can be reused, retaining their tight clamped interface to the rolled rim 201 of the used disposable beverage container 203, and a further cost saving to the company through better time management when offering refills through the recessed hatch opening 227 of this new invention, with less impact on new orders allowing less interruption in the fast food outlet's service flow. As replacement lids are not required when adopting this new invention for complimentary beverage refills there is also a reduction in the recycling footprint of disposable lids.

Figure 14:
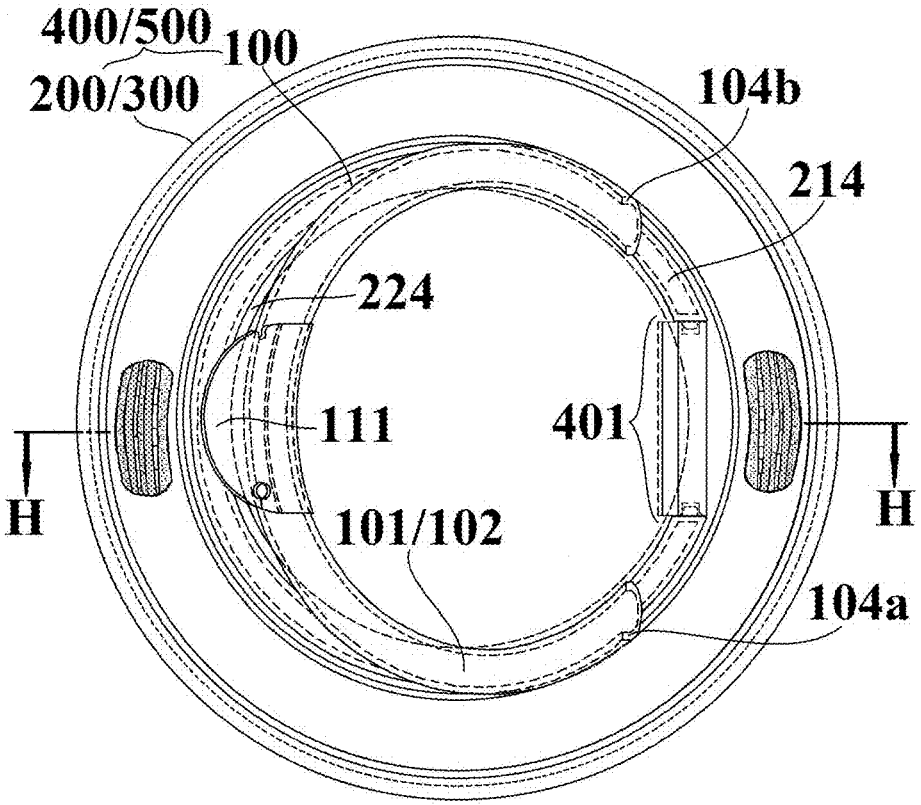
FIG. 14 is a top plan view of the dome lid configuration in FIG. 12.

FIG. 14 is a top plan view representing dome lid 400 in FIG. 12 showing hatch cover part 100 partially pivoted about detachable hinge 401, disengaging clamping rib 101/locking channel 102 (phantom and solid lines) from retaining rib 214 (phantom and solid lines) of either dome 200 or flat 300 brim mount parts (not distinguishable in FIG. 14), below gripping tab 111. Open ends 104*a* and 104*b* are vertically aligned directly above retaining rib 214. The lifting of hatch cover part 100 also discloses annular interior rim 224 (solid and phantom lines). Although FIG. 14 refers back to dome lid 400 in FIG. 12, and as flat lid 500 is not shown with hatch cover part 100 in the same partially opened position, FIG. 14 may also be representative of flat lid 500 with hatch cover part 100 in a partially opened position and include the above description and reference numbers, similar to FIG. 10 which represents both dome 400 nd flat 500 lid configurations in a plan view.

Figure 15:
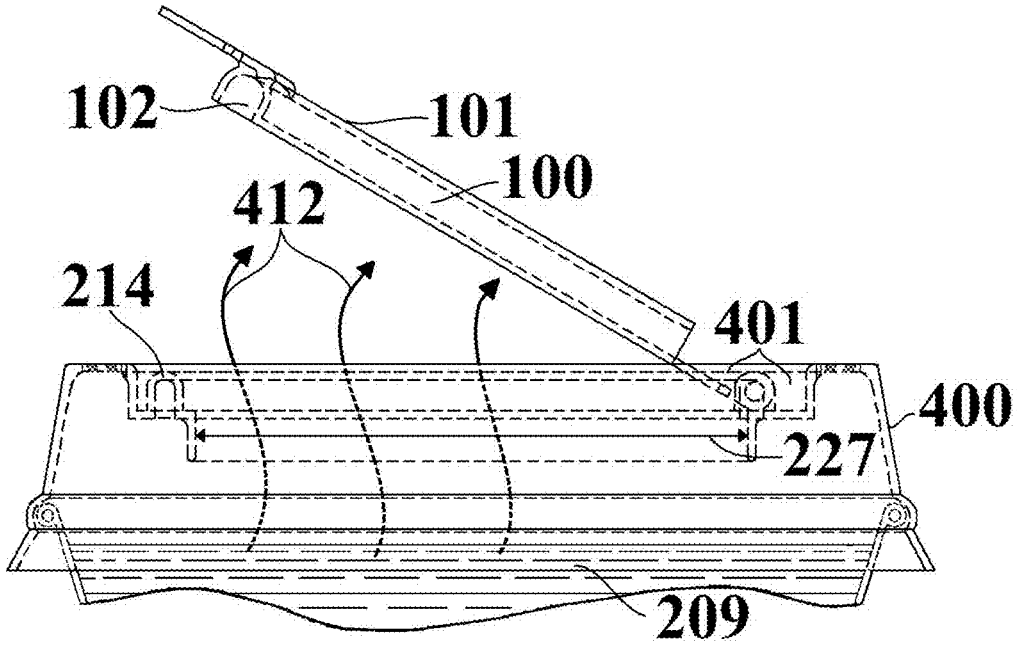
FIG. 15 is a side view in section of the dome lid taken substantially along line H-H in FIG. 14.

FIG. 15 is a side view in section of dome lid 400 taken substantially along line H-H in FIG. 14 with phantom lines depicting hidden elements and where hatch cover part 100 is in a partially opened position with clamping rib 101/locking channel 102 disconnected from retaining rib 214. Hatch cover part 100 is partially opened and held, hands-free, in this position due to the frictional contact between detachable hinge 401. A combination of steam, heat and aroma 412 (solid wavy lines with single-headed arrows at the top) escapes through recessed hatch opening 227 (solid line with double-headed arrows) which also provides a more efficient and rapid means to expedite cooling of a hot beverage 209 and dispensing aroma compared with lids fixed to disposable containers with single die-cut drinking access ports or scored, hinged drinking access ports. The ability to pivot hatch cover part 100 and stop at any position between a fully closed and fully opened positions, due to the preferred embodiment of the snug fitting parts comprising detachable hinge 401, enables hatch cover part 100 to be easily pivoted and held at different intermediate opened positions, of which there are a multitude of intermediate opened positions between closed and fully opened positions, of which one intermediate opened position is selected, without slipping and rotating to either a fully closed (see FIG. 8A) or a fully opened position (see FIG. 16A) with respect to recessed hatch opening 227.

FIG. 16A is a perspective top view of dome lid 400 with hatch cover 100 pivoted to a fully opened position about detachable hinge 401 thereby exposing concealed centrally positioned substantially annular recessed hatch opening 227 (solid line with double-headed arrows) concentric within the periphery of anti-splash spill apron 225 and annular interior rim 224. The opening of hatch cover 100 can be described as progressing from the fully closed position in FIG. 8A to an intermediate partially opened hatch cover part 100 in FIG. 12, eventually pivoted to a fully opened position, completely disengaging locking channel 102 from retaining rib 214 in FIG. 16A. The degree of rotation of hatch cover part 100 to its fully opened position may vary accordingly depending on relative changes in the dimensions of other parts. The diameter of recessed hatch opening 227 may vary accordingly with the respective diameters of dome brim mount part 200 and hatch cover part 100 and the corresponding diameters of circumscribing second outside wall 213 of ring-shaped crown portion 210, clamping rib 101/locking channel 102 and retaining rib 214, whereby a larger or smaller diameter, and therefore surface area, of recessed hatch opening 227 may be adopted including a smaller recessed hatch opening 227 for smaller disposable container/lid configurations offered for grab-and-go espresso beverages. Adopting a drinking access port configuration with a narrower width such as that shown in FIG. 6A-10 may conversely narrow the width of planar top transition surface 212 and expand the diameters of circumscribing inside wall 213 and retaining rib 214 increasing the diameter and overall surface area of recessed hatch opening 227.

Recessed hatch opening 227 is of sufficient diameter offering substantial surface area for unobstructed and easy access to beverage 209 for the purposes of dunking a confection or performing other actions on beverage 209 without the necessity and risks of removing dome lid 400 from disposable beverage container 203 (compressed for ease of illustration). In its fully opened position, hatch cover part 100 is removed from interfering with accessing the area of recessed hatch opening 227 and discloses an inclined recessed top wall underside bottom surface 122, inverted gripping tab 111 and inverted clamping rib 101 with locking channel 102 facing upwards. The large surface area of recessed hatch opening 227 offers expedited cooling of a hot beverage deemed too hot to consume by promoting expanded venting of steam and heat 412 (solid wavy lines with single-headed arrows at the top), thereby rapidly cooling the beverage to a comfortable temperature and avoiding the addition of liquid cooling condiments diluting the beverage flavour.

When hatch cover part 100 is in the fully opened position it partially covers the first drinking access port 230 (phantom lines), while simultaneously uncovering the second drinking access port 231 from under gripping tab 111, thereby making it available to the customer for consuming beverage 209. The customer has the option of alternating between dunking a confection into beverage 209 via recessed hatch opening 227 and sipping beverage 209 through the second drinking access port 231. Thus hatch cover part 100 may be readily placed into its fully open position or fully closed position, or any intermediate opened position between fully closed and fully opened positions, by the customer or Barista and/or server very quickly and reliably.

Two symmetrically opposing equidistant segments 109*a* and 109*b*, first introduced in FIG. 1A, respectively define two opposing segment arc lengths 115*a* and 115*b* (not shown in FIG. 16A, see FIG. 2) around recessed top wall 103 (phantom and solid lead line) perimeter edge 103*a* (solid and phantom lines) where corresponding clamping rib 101/locking channel 102 sections are removed, exposing unmated sections of retaining rib 214, and where segments 109*a* and 109*b* are further interposed between open ends 104*a* and 104*b* (solid and phantom lines) and the opposing respective rectangular base 106 end walls 106*a* and 106*b* (see FIG. 1A). Segments 109*a* and 109*b*, denoting the absence of sections of clamping rib 101/locking channel 102, are necessary to allow hatch cover 100 to pivot to its fully opened position without clamping rib arch 120 resting on planar top transition surface 212. The two symmetrically opposing equidistant segments 109*a* and 109*b* and recessed top wall 103 rest against planar top transition surface inside perimeter edge 237 (solid and phantom lines) and an adjacent portion of planar top transition surface 212, and similarly for flat lid 500 in FIG. 17A, hatch cover part 100 rests against planar top transition surface inside perimeter edge 237 and an adjacent portion on planar top transition surface 212 of compressed ring-shaped crown portion 301.

Figure 18:
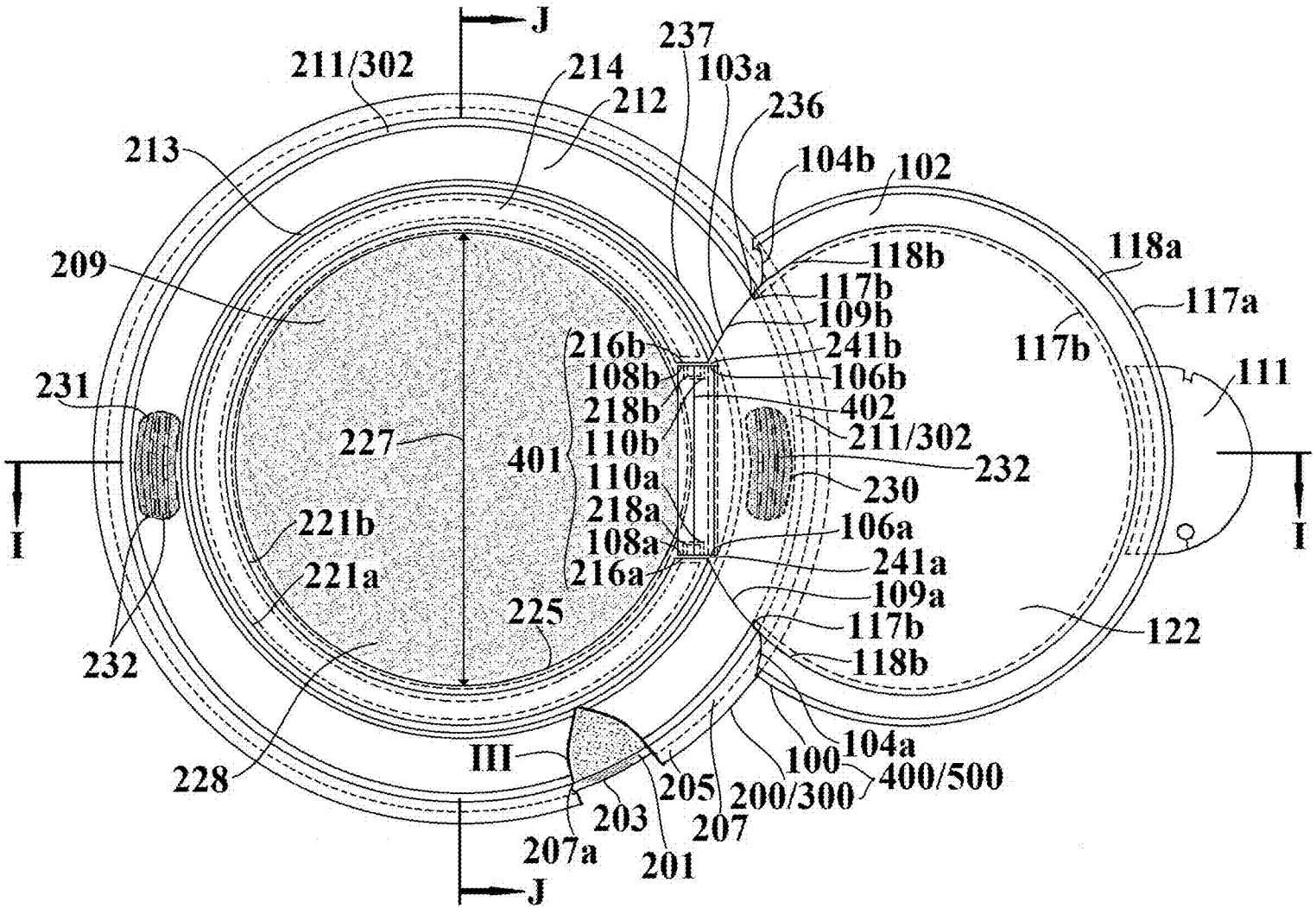
FIG. 18 is a top plan view representing both the dome and flat lid configurations in FIGS. 16A and 17A, respectively.
Figure 18A:
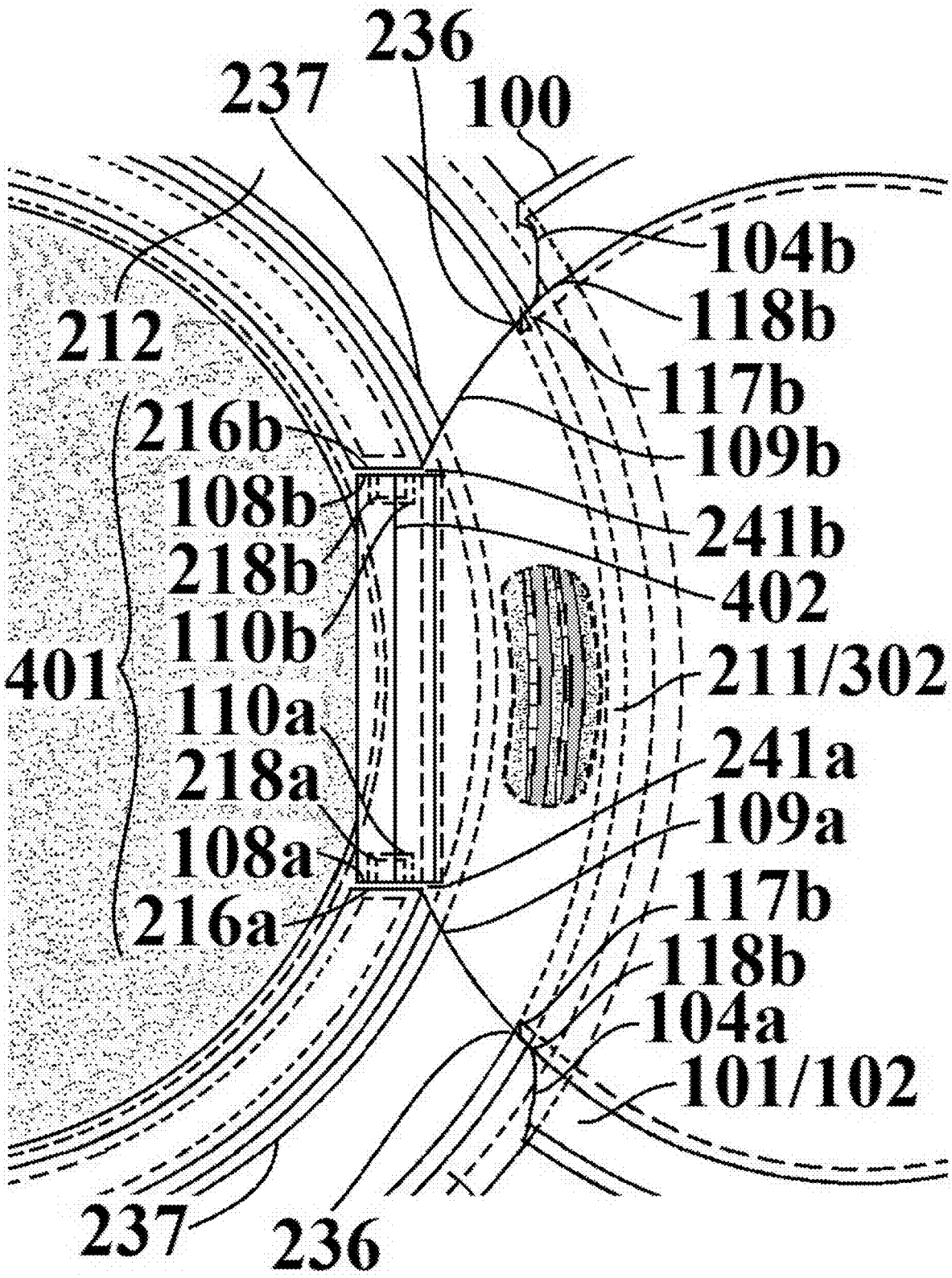
FIG. 18A is a partial top plan view on a larger scale of a portion of the dome lid and flat lid configurations in FIG. 18.

In another preferred embodiment opposing open ends 104*a* and 104*b* (solid and phantom lines) terminate clamping rib first outside wall 117*a*/locking channel first inside wall 118*a* (solid and phantom lines) and clamping rib second outside wall 117*b*/locking second inside wall 118*b* (solid and phantom lines), wherein the open ends 104*a* and 104*b* of clamping rib first outside wall 117*a*/locking channel first inside wall 118*a* are not in contact with ring-shaped crown portion first outside wall 211, while open ends 104*a* and 104*b* of clamping rib second outside wall 117*b*/locking channel second inside wall 118*b* are gently wedged into intimate contact with first outside wall 211 and planar top transition surface outside perimeter edge 236 (solid and phantom lines) through gentle downward pressure using digits of either hand when hatch cover part 100 is pivoted to its fully opened position (also see FIGS. 18 and 18A). The frictional contact between the open ends 104*a* and 104*b* of clamping rib second outside wall 117*b*/locking channel second inside wall 118*b* remains wedged against first outside wall 211 in a non-permanent manner retaining hatch cover part 100 in the fully opened position until the customer gently pries hatch cover part 100 upwards with digits of either hand to gently disengage the open ends 104*a* and 104*b* of clamping rib second outside wall 117*b*/locking channel second inside wall 118*b* from frictional contact with first outside wall 211, to pivot hatch cover part 100 back to the fully closed position or another intermediate opened position therein. The frictional interface between cylinder end walls 108*a* and 108*b* and end walls 216*a* and 216*b* (see FIGS. 10A and 18A) also combine with the wedging of open ends 104*a* and 104*b* of clamping rib second outside wall 117*b*/locking channel second inside wall 118*b* against first outside wall 211 to further retain hatch cover part 100 in the fully opened position. This preferred embodiment also applies to retaining hatch cover part 100 where open ends 104*a* and 104*b* of clamping rib second outside wall 117*b*/locking channel second inside wall 118*b* are frictionally wedged against compressed first outside wall 302 for flat lid 500 in FIG. 17A.

Figure 16B:
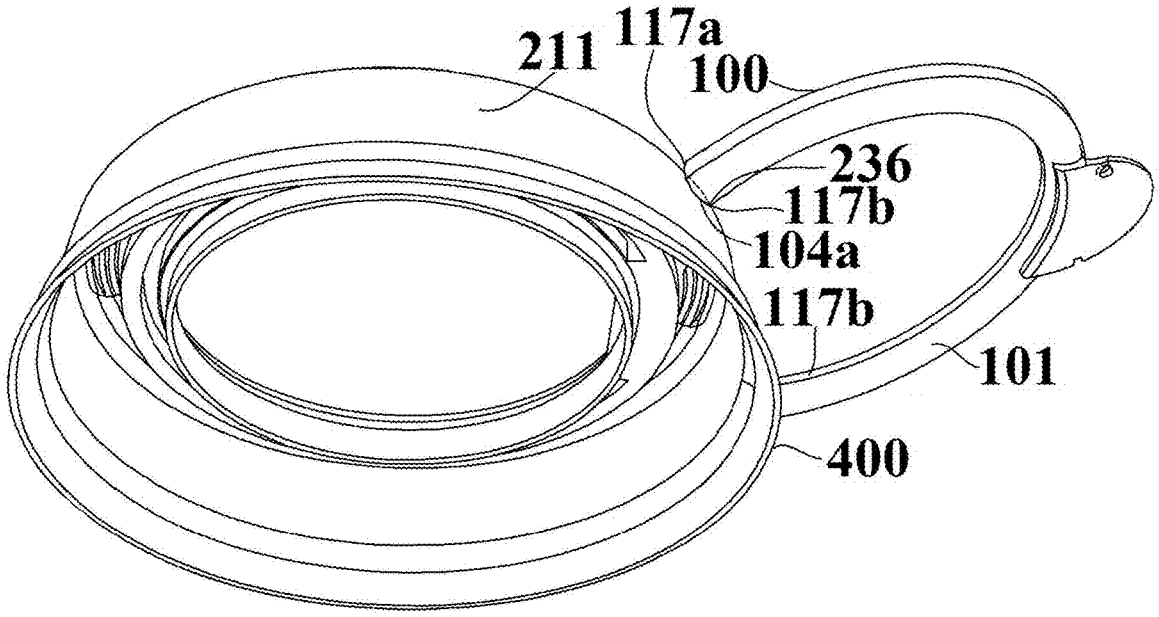
FIG. 16B is a perspective bottom view of the dome lid configuration in FIG. 16A.
Figure 16D:
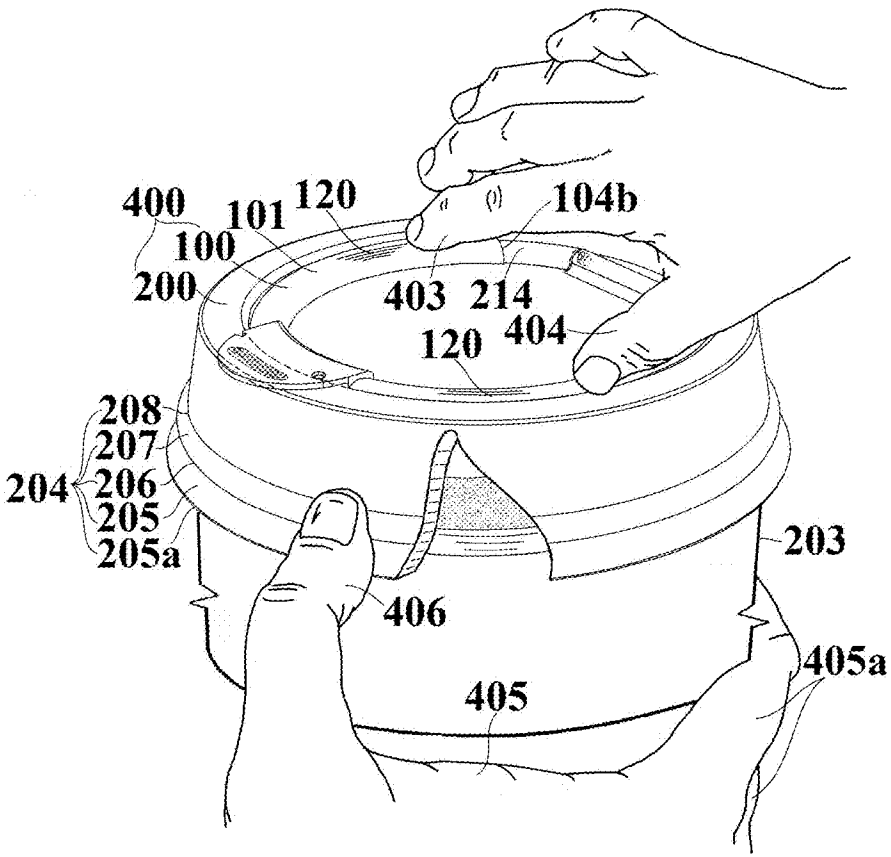
FIG. 16D is a perspective top view of the dome lid configuration, mounted to the rolled rim of a beverage container, compressed for ease of illustration, with the hatch cover part in the fully closed position with the index finger and thumb of one hand pressing down on the top of the hatch cover part.
Figure 16C:
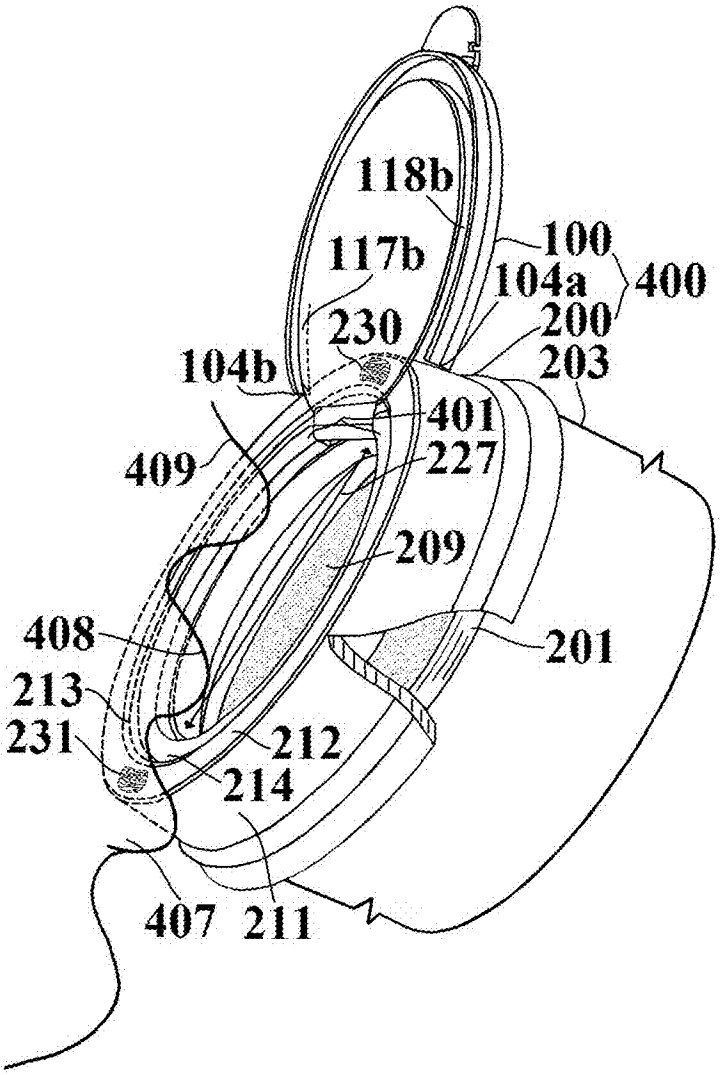
FIG. 16C is a perspective top view of the dome lid configuration with the hatch cover part n the fully opened position with a customer drinking from the second drinking access port.

FIG. 16B is a perspective bottom view of dome lid 400 with hatch cover part 100 in the fully opened position. This is another view of a preferred embodiment of the present invention wherein opposing clamping rib 101/locking channel 102 (102 not shown) open ends 104*a* and 104*b* (104*b* not shown) of clamping rib first outside wall 117*a*/locking channel first inside wall 118*a* (118*a* not shown) are not in contact with planar top transition surface outside perimeter edge 236 (solid and phantom lines) and also not wedged against first outside wall 211 (also see FIGS. 18 and 18A), as also shown in FIG. 16A, The open ends 104*a* and 104*b* (104*b* not shown) of clamping rib second outside wall 117*b*/locking channel second wall 118*b* (118*b* not shown) are in contact with planar top transition surface outside perimeter edge 236 (phantom lines) and also wedged against first outside wall 211 (see FIGS. 18 and 18A), again demonstrating how clamping rib second outside wall 117*b*/locking channel second inside wall 118*b* assists in retaining hatch cover part 100 in the fully opened position.

FIG. 16C is a perspective top view of dome lid 400 with hatch cover part 100 in the fully opened position with dome brim mount part 200 clamped to rolled rim 201 of disposable beverage container 203, compressed for ease of illustration and in a tilted position showing the relationship between the customer's bottom lip 407, top lip 408 and nose 409 when drinking from dome lid 400. When hatch cover part 100 is pivoted to the fully opened position, the second drinking access port 231 becomes available for the customer to access beverage 209 while also exposing recessed hatch opening 227 (solid line with double-headed arrows). Recessed hatch opening 227 provides additional depth to accommodate the customer's top lip 408 and nose 409 compared with the depth of recessed top wall 103 in FIG. 8C when the customer is drinking through the first drinking access port 230 (phantom lines) when hatch cover part 100 is in the fully closed position. With hatch cover part 100 in the fully opened position, the customer's bottom lip 407 and top lip 408 form a seal around the second drinking access port 231 (phantom lines) with the bottom lip 407 in contact with first outside wall 211 and planar top transition surface 212 and the customer's top lip 408 in contact with second outside wall 213 and retaining rib 214 and also accommodated by recessed hatch opening 227. The customer's nose 409 is accommodated by recessed hatch opening 227 as the customer tilts disposable beverage container 203 at an increased angle promoting delivery of beverage 209 through the second drinking access port 231 as the volume of beverage 209 decreases in disposable beverage container 203. When hatch cover part 100 is pivoted to its fully opened position it does not interfere with the customer's nose 409 or other parts of the face and head while the customer consumes beverage 209 through the second drinking access port 231. The snug frictional contact between detachable hinge 401 and the friction contact between opposing clamping rib open ends 104*a* and 104*b* of clamping rib second outside wall 117*b*/locking channel second inside wall 118*b* (phantom and solid lines) wedged against first outside wall 211 ensures hatch cover part 100 remains in the fully opened position as the customer tilts disposable beverage container 203 to drink from the second drinking access port 231 thereby preventing hatch cover part 100 from pivoting back to the fully closed position and coming in contact with the customer's face. The customer's bottom lip 407 and top lip 408 would form a seal around the second drinking access port 231 when drinking from flat lid 500 and the customer's nose 409 would as well be more easily accommodated by the additional depth offered through recessed hatch opening 227 when hatch cover part 100 is in the fully opened position compared when drinking from the first drinking access port 230 when hatch cover part 100 is in the fully closed position.

FIG. 16D is a perspective top view of the dome lid 400 showing the customer re-closing hatch cover 100 from one of the opened positions described in either FIG. 12, 13, or 16A where the same steps for opening hatch cover part 100 are followed in reverse. When closing hatch cover part 100 the customer steadies disposable beverage container 203 by wrapping opposing hand 405 and remaining fingers 405*a* around disposable beverage container 203 (compressed for ease of illustration) with opposing thumb 406 extended to apply downward pressure to outside perimeter free edge 205*a*, bottom flange 205, lower 206 and upper 208 furrows and clamping curvature 207 of annular skirt 204 of brim mount part 200 while simultaneously optionally positioning index finger 403 and thumb 404 of the other hand to grip curvilinear perimeter front edge 123 of inverted gripping tab 111 and pivot hatch cover part 100 upwards and in the reverse direction, from the fully opened position towards a closing position and beginning to cover recessed hatch opening 227 as shown in FIG. 12. Once hatch cover part 100 is pivoted from the fully opened position to a partially closed intermediate position as shown in FIG. 12, clamping rib/locking channel ends 104*a* and 104*b* and portions of clamping rib 101/locking channel 102 receding from open ends 104*a* (not shown in FIG. 16D) and 104*b* begin to overlap with retaining rib 214 as seen in FIGS. 12, 14 and 15. The closing of hatch cover part 100 is a dynamic process with hands, fingers and thumbs continually being repositioned. Referring back to FIG. 12, thumb 404 and index finger 403 are released from holding curvilinear perimeter front edge 123 of gripping tab 111 and repositioned as seen in FIG. 16D, where index finger 403 may be brought into contact with clamping rib arch 120 on one side of clamping rib 101 while thumb 404, diametrically opposite index finger 403, is moved into position and brought into contact with clamping rib arch 120 on the opposite side of clamping rib 101. Once in position, index finger 403 and thumb 404 apply gentle downward finger pressure to clamping rib arch 120 on either side of clamping rib 101 until locking channel 102 (not shown in FIG. 16D) is frictionally pressed onto retaining rib 214 to form a reversible mated frictional fitment over retaining rib 214. Referring once again to FIG. 11C, the mating of clamping rib 101/locking channel 102 onto retaining rib 214 shows clamping rib first outside wall 117*a*/locking channel first inside wall 118*a* inserted into u-shaped trough 215 between second outside wall 213 and retaining rib first outside wall 221*a* and where clamping rib first outside wall 117*a*/locking channel first inside wall 118*a* base 121*a* becomes seated on top of u-shaped trough base 215*a* thereby completing the resealing and releasably locking of hatch cover part 100 into the closed position. Depending on handedness of the customer, the hands, fingers and thumbs described above may be interchanged or other hand, finger and thumb configurations may be adopted when applying gentle downward finger pressure to mate clamping rib 101/locking channel 102 onto retaining rib 214.

FIG. 17A is a perspective top view of flat lid 500 with hatch cover part 100 in the fully opened position with the minor variation where first outside wall 211 on dome brim mount part 200 is compressed to form compressed first outside wall 302 of compressed ring-shape crown portion 301 of flat brim mount part 300. Cut-away II discloses the cooperative engaging of bottom flange 205 and interior sealing curvature 207*a*, sealingly mating to rolled rim 201 of disposable beverage container 203 (compressed for ease of illustration) as previously discussed under FIG. 9A. FIG. 17A captures all the preferred embodiments described in FIG. 16A with a minor variation in first outside wall 211 which is compressed thereby bringing recessed hatch opening 227 (solid line with double-headed arrows) vertically closer to beverage surface plane 228 (also see FIG. 19C). Although first outside wall 211 has been compressed to form compressed first outside wall 302 there is adequate available wall surface area for opposing clamping rib/locking channel open ends 104*a* and 104*b* (solid and phantom lines) of clamping rib second outside wall 117*b*/locking channel second inside wall 118*b* (solid and phantom lines) to frictionally wedge against compressed first outside wall 302 and planar top transition surface outside perimeter edge 236 (solid and phantom lines) to further retain hatch cover part 100 in the fully opened position, while clamping rib first outside wall 117*a*/locking channel first inside wall 118*a* are not in contact with compressed first outside wall 302. The two symmetrically opposing equidistant segments 109*a* and 109*b* and recessed top wall 103 (see FIG. 16A) rest against planar top transition surface inside perimeter edge 237 (solid and phantom lines) and an adjacent portion of planar top transition surface 212. The angle of recessed top wall underside bottom surface 122, when hatch cover part 100 is in the fully opened position, is similar to the angle of recessed top wall underside bottom surface 122 described for hatch cover part 100 in FIG. 16A for dome lid 400.

Figure 17B:
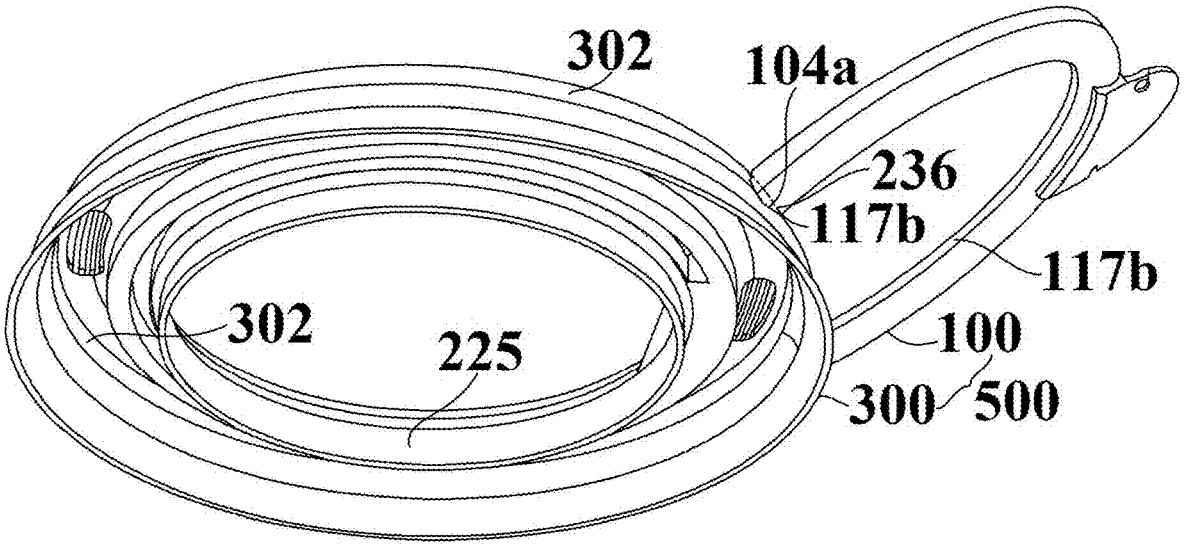
FIG. 17B is a perspective bottom view of the flat lid configuration in FIG. 17A.

FIG. 17B is a perspective bottom view of flat lid 500 in FIG. 17A with hatch cover part 100 in the fully opened position. FIG. 17B shows the same preferred embodiments as described in FIG. 16B whereby a minor variation in first outside wall 211, resulting from a shortening in vertical height, forms compressed first outside wall 302 as referenced on both the outside and inside of flat brim mount part 300. This vertical compression is a minor variation of dome lid 400 and does not change any of the preferred embodiments previously described. The relative lowering of anti-splash/spill apron 225 reflects the compression of flat lid 500 when compared with anti-splash/spill apron 225 for the bottom view of dome lid 400 in FIG. 16B. This is another view of a preferred embodiment of the present invention retained for flat lid 500 where opposing clamping rib/locking channel open ends 104*a* and 104*b* (104*b* not shown) of clamping rib second outside wall 117*b*/locking channel inside wall 118*b* (118*b* not shown) are in contact with planar top transition surface outside perimeter edge 236 (solid and phantom lines) to frictionally wedge against compressed first outside wall 302 to further retain hatch cover part 100 in the fully opened position.

FIG. 18 is a top plan view representing dome lid 400 in FIG. 16A and flat lid 500 in FIG. 17A with hatch cover part 100 in the fully opened position showing the spatial relationship of several preferred embodiments of the present invention. First outside wall 211 and compressed first outside wall 302 (phantom and solid lines), respectively, of dome 200 and flat 300 brim mount part, are not distinguishable in this plan view. Cut-away III shows bottom flange 205 which assists in guiding clamping curvature 207/interior sealing curvature 207*a* (solid and phantom lines) to sealingly mate and clamp to rolled rim 201 of disposable beverage container 203 as previously discussed under FIG. 10.

In a preferred embodiment of dome 400 and flat 500 lid configurations, segments 109*a* and 109*b*, with equal and opposing sections of clamping rib 101 (not shown)/locking channel 102 (phantom and solid lines) removed from the recessed top wall perimeter edge 103*a* (103*a* not distinguishable from 109*a* and 109*b* in FIG. 18) are disposed between clamping rib/locking channel open ends 104*a* and 104*b* and rectangular base end walls 106*a* and 106*b*, first introduced in FIGS. 1 and 2. Segments 109*a* and 109*b* allow hatch cover part 100 to be pivoted to its fully opened position, whereby segments 109*a* and 109*b* and recessed top wall 103 (not shown in FIG. 18) rest on planar top transition surface inside perimeter edge 237 (solid and phantom lines) and part of planar top transition surface 212 (phantom and solid lines, also see FIG. 19A). In a further preferred embodiment of the present invention where the ends of clamping rib second outside wall 117*b*/locking channel second inside wall 118*b* terminate at end walls 104*a* and 104*b*, respectively, are in intimate contact with planar top transition surface outside perimeter edge 236 (solid and phantom lines) and non-permanently frictionally wedged against first outside wall 211 or compressed first outside wall 302, respectively, for dome 400 and flat 500 lid configurations (phantom and solid lines), when gentle downward finger pressure is applied to recessed top wall underside bottom surface 122. The wedging of clamping rib second outside wall 117*b*/locking channel second inside wall 118*b* at end walls 104*a* and 104*b* against first outside wall 211 or compressed first outside wall 302 in combination with the snug frictional contact between cylinder end walls 108*a* and 108*b* and retaining rib end walls 216*a* and 216*b* (also see FIG. 18A), work together to retain hatch cover part 100 in the fully opened position until such time as the customer gently lifts gripping tab 111 lifting hatch cover part 100 upwards to gently pry and disengage open end 104*a* and 104*b* of clamping rib second outside wall 117*b*/locking channel second inside wall 118*b* from frictional contact with first outside wall 211 or compressed wall 302, pivoting hatch cover part 100 back to the closed position or to be stabilized at any other intermediate opened position therein.

Although there is intimate frictional contact between cylinder end walls 108*a* and 108*b* and retaining rib end walls 216*a* and 216*b*, a first space 241*a* and a second space 241*b* have been introduced between these respective end walls in FIGS. 18 and 18A for illustrative purposes to better distinguish the respective contact walls.

In another preferred embodiment of the present invention, when hatch cover part 100 is fully opened it partially covers the first drinking access port 230 (phantom lines) while at the same time making second drinking access port 231 available to the customer. A second drinking access port has been introduced into this new invention to allow the customer to both dunk their confection through recessed hatch opening 227 (solid line with double-headed arrows) when hatch cover part 100 is pivoted to the fully opened position and also have the option of drinking from disposable beverage container 203.

This plan view illustrates the broad surface area of recessed hatch opening 227 (solid line with double-headed arrows), enclosed by anti-splash/spill apron 225, offering a substantially sized opening to receive confections dunked by the customer or to add toppings to beverage surface plane 228 (also see FIG. 19A) or perform other functions on beverage 209. The surface area of the first 230 and second 231 drinking access ports in planar top transition surface 212 may be optionally increased or decreased, respectively, to increase or decrease beverage flow delivery through the respective drinking access ports to the customer as shown with the optional variations in shape and size of the drinking access ports disclosed in FIGS. 6A1-12. The introduction of optional louvers 232, integrated across the first 230 and second 231 drinking access ports (see FIG. 4A), and die-cut through planar top transition surface 212 at the same time as the respective drinking access ports, are designed to deflect upwardly splashed beverage 209 from passing through the drinking access ports and splashing onto the outside of the container/lid configurations and further onto the customer, a common complaint from customers as previously discussed. However, while deflecting upwardly splashed beverage 209 back down into disposable beverage container 203, the louvers 232 also reduce the available surface area of the first 230 and second 231 drinking access ports, thereby directly affecting beverage flow. When consuming a hot beverage at temperatures described previously as in the range of 160° F., dangerously high, posing health risks upon repeated consumption, the dampening of beverage flow through the first 230 and second 231 drinking access ports by louvers 232 offers an inherent benefit reducing potential burns to the customer's lips and mouth from a too rapid beverage flow delivery (also see FIG. 16C). The preferred embodiments of optionally incorporating louvers 232 and the ability to vary the size of the first 230 and second 231 drinking access ports offer benefits which both protect and enhance the customer's beverage consumption experience wherein FIGS. 6A1-12 also discloses optional configurations for inserting louvers 232 within the different configured drinking access ports.

In still another preferred embodiment of the present invention there is the option to reduce the width of planar top transition surface 212 and the corresponding widths of the first 230 and second 231 drinking access ports (see FIG. 6A-10), thereby increasing the inside diameter of second outside wall 213 and the diameter of retaining rib 214, subsequently increasing the diameter and surface area of recessed hatch opening 227 and increasing accessibility to beverage 209. Furthermore, narrowing the width between retaining rib first outside wall 221*a* and second outside wall 221*b* would again further increase the diameter and circumference of recessed hatch opening 227. Narrowing retaining rib first outside wall 221*a* and second outside wall 221*b* width would require the width between clamping rib first outside wall 117*a*/second outside wall 117*b* and also the width between locking channel first inside wall 118*a* and second inside wall 118*b* to undergo a corresponding decrease in width while retaining frictional fitment when mated over retaining rib 214 when hatch part 100 is in the closed position.

In a preferred embodiment of dome 400 and flat 500 lid configurations the pivoting of hatch cover 100 to the fully opened position is possible when partially spherical protrusions 218*a* and 218*b* are within partially spherical indentation 110*a* and 110*b*, wherein the centres of partially spherical protrusions 218*a* and 218*b* and partially spherical indentation 110*a* and 110*b* are concentric, resulting in a spherical geometry that facilitates full pivoting of hatch cover part 100 about the concentric centres along longitudinal axis line 402 (solid line). This pivoting is constrained by the edge of the dished depressions of partially spherical indentation 110*a* and 110*b* thereby preventing the partially spherical protrusions 218*a* and 218*b* from disengaging from partially spherical indentation 110*a* and 110*b* on cylinder end walls 108*a* and 108*b*. The intimate mating of the male and female hinge parts provides a constrained detachable hinge 401 construction with very little play within. Accordingly, the pivoting motion of the article sections is confined to a precise pivoting path, which is often desirable. Detachable hinge 401 simultaneously serve two purposes, first they facilitate movement in certain directions and second constrain movement in other directions. The first function facilitates movement and change of shape, in this case changing hatch cover part 100 from a fully closed to a fully opened position, and any intermediate opened positions therein. The second function facilitates alignment of parts and resistance to external forces, thereby keeping detachable hinge parts 401 in a snug mated arrangement.

FIG. 18A is a partial top plan view on a larger scale of a portion of dome 400 and flat 500 lid configurations in FIG. 18 with phantom lines depicting hidden elements. Hatch part 100 is pivoted about detachable hinge 401 to a fully opened position whereby segments 109*a* and 109*b*, with removed portions of clamping rib 101 (not shown)/locking channel 102, allow recessed top wall 103 (not visible in FIG. 18A) hatch cover part 100 to rest in contact with planar top transition surface inside perimeter edge 237 (solid and phantom lines) and part of planar top transition surface 212 (phantom and solid lines, also see FIG. 19A). Hatch cover part 100 is retained in the fully opened position in a non-permanent manner due in part to a combination of the snug interface between retaining rib end walls 216*a* and 216*b* and cylinder end walls 108*a* and 108*b* and the further intimate surface contact where partially spherical indentation 110*a* and 110*b* snugly enshroud partially spherical protrusions 218*a* and 218*b* allowing partially spherical indentation 110*a* and 110*b* to pivot in unison about partially spherical protrusions 218*a* and 218*b* along longitudinal axis line 402 (solid line) while limiting lateral movement and retaining frictional contact between the surface interfaces for unassisted retention of hatch cover part 100 at different intermediated opened positions. The respective end walls 216*a* and 216*b* and cylinder end walls 108*a* and 108*b* are designed to be in intimate contact with each other, however, for illustrative purposes to better delineate the respective contacting end wall surfaces a first space 241*a* and a second space 241*b* have been introduced between the respective contacting end walls. Hatch cover part 100 is further held in an non-permanent fully opened position through the frictional wedging of the ends of clamping rib second outside wall 117*b*/locking channel second inside wall 118*b* where they terminate at open ends 104*a* and 104*b*, respectively, against first outside wall 211 or compressed first outside wall 302 and also contact with planar top transition surface outside perimeter edge 236 (solid and phantom lines, also see FIG. 19A).

Figure 19A:
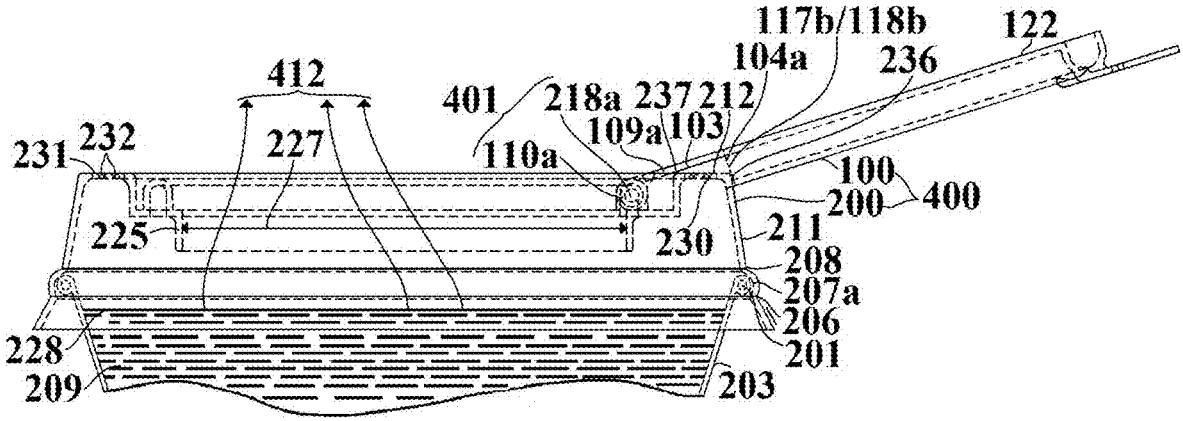
FIG. 19A is a side view in section of the dome lid configuration taken substantially along line I-I in FIG. 18.

FIG. 19A is a side view in section of dome lid 400 taken substantially along line I-I in FIG. 18, with hatch cover part 100 in the fully opened position where dome brim mount part 200 interior sealing curvature 207*a*, positioned between lower furrow 206 and upper furrow 208, is shaped to frictionally clamp around rolled rim 201 (phantom lines) of disposable beverage container 203 (compressed for ease of illustration). Segments 109*a* and 109*b* (109*b* not shown) are in intimate contact with planar top transition surface 212 and where opposing open ends 104*a* and 104*b* (phantom line, 104*b* not shown) of clamping rib second outside wall 117*b*/locking channel second inside wall 118*b* (phantom line, not distinguishable from open ends 104*a* in FIG. 19A) are frictionally wedged against planar top transition surface outside perimeter edge 236 (solid and phantom lines) and first outside wall 211. Hatch cover part 100 is prevented from being brought into a full 180° pivot as recessed top wall 103 rests in contact with planar top transition surface inside perimeter edge 237 (phantom lines) and part of planar top transition surface 212. The raised angle of hatch cover part 100 at its fully opened position creates a downward disposed sloped surface on recessed top wall underside bottom surface 122 toward recessed hatch opening 227 (solid line with double-headed arrows) and may be optionally used for the purposes of draining residual beverage 209 from a retrieved infusion pouch 416 pulled from beverage 209 and placed to rest on recessed top wall underside bottom surface 122 as will be discussed under FIG. 21C.

In another preferred embodiment the concentric relationship between mated partially spherical protrusions 218*a* and 218*b* (218*b* not shown), respectively, to partially spherical indentation 110*a* and 110*b* (110*b* not shown) remain unchanged and in intimate contact upon pivoting of hatch cover part 100 to the fully opened position even with the wedging of open ends 104*a* and 104*b* (104*b* not shown) of clamping rib second outside wall 117*b*/locking channel second inside wall 118*b* (phantom line, not distinguishable in FIG. 19A) against first outside wall 211. This mating of the partially spherical protrusions 218*a* and 218*b* (218*b* not shown) enshrouded by partially spherical indentation 110*a* and 110*b* (218*b* not shown) provides a detachable hinge 401 construction with very little play in it. Accordingly, the pivoting motion of the article sections is confined to a precise rotational path, which is often desirable.

In another preferred embodiment of dome 400 and flat 500 lid configurations, in keeping with the principles of the present invention, the detachable hinge part 401 offer a more robust pivoting hinge compared with u-shaped living hinge 112 in prior art U.S. Pat. Nos. 10,604,308 and 10,710,779, where a minimal number of repeated pivots about a u-shaped living hinge of respective hatch cover part 116 and 201 over a short period of use escalates the wear on the folding portion of u-shaped hinge 112 when accessing beverage 103 (see FIG. 3 and FIG. 9, respectively, in prior art U.S. Pat. Nos. 10,604,308 and 10,710,779). In this new invention the detachable hinge 401 will last longer as less wear develops on the concentric hinge parts, thereby promoting broader options for the Barista and/or server and the customer when addressing beverage preparation and customization.

In a further preferred embodiment of dome lid 400, anti-splash/spill apron 225, together with optional extended anti-splash/spill apron 225*c* (see FIG. 7E), dampen wave-action at the beverage surface plane 228 from creating side-to-side sloshing of beverage from gaining momentum as a result of minimal movement when holding disposable beverage container 203 while walking or other accidental jostling of container 203 thereby reducing splashing of beverage 209 upwards through recessed hatch opening 227 while optional drinking access port louvers 232 offer to reduce splashing of rising beverage 209 through the first 230 and/or second 231 drinking access ports.

In still another preferred embodiment of dome lid 400 is the expediting cooling of a hot beverage when hatch cover part 100 in the fully opened position, without removing dome lid 400 from the rolled rim 201 of disposable beverage container 203. The ability to fully open hatch cover part 100 to fully expose an unobstructed recessed hatch opening 227 allows for a more rapid and controlled cooling of a beverage as shown by the release of a combination of steam, heat and aroma 412 (solid wavy lines with single-headed arrows at the top) to reach suitable beverage temperatures below that which are considered dangerous for beverage consumption. The other benefit of this expedited cooling through the fully exposed recessed hatch opening 227 is that less liquid condiments are required, unless preferred, for cooling purposes, allowing the beverage to retain its original brewed taste and appearance.

Figure 19B:
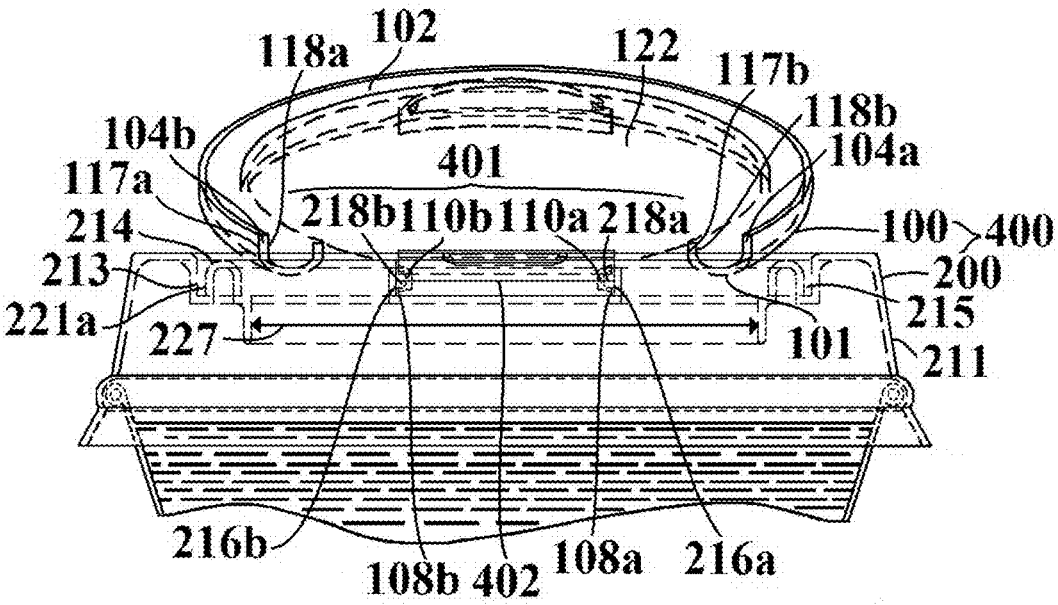
FIG. 19B is a side view in section of the dome lid configuration taken substantially along line J-J in FIG. 18.

FIG. 19B is a side view in section of dome lid 400 taken substantially along line J-J in FIG. 18. In a preferred embodiment of the present invention, the pivoting of hatch cover part 100 between fully opened and closed positions is due to the detachable hinge 401 which permits partially spherical indentation 110*a* and 110*b* to pivot freely while snugly enshrouding partially spherical protrusions 218*a* and 218*b*. Partially spherical indentation 110*a* and 110*b* reside as dished depressions within cylinder end walls 108*a* and 108*b*, which have an exterior surface having a pivoting longitudinal axis line 402 (solid line) passing through the centre of partially spherical indentation 110*a* and 110*b* and partially spherical protrusions 218*a* and 218*b*, which extend from end walls 216*a* and 216*b*. When partially spherical indentation 110*a* and 110*b* are snap fitted over partially spherical protrusions 218*a* and 218*b*, partially spherical indentation 110*a* and 110*b* form a collar which partially enshrouds partially spherical protrusions 218*a* and 218*b*. The smooth surface of the material allows for the free pivoting of partially spherical indentation 110*a* and 110*b* around partially spherical protrusions 218*a* and 218*b* while partially spherical protrusions 218*a* and 218*b* remain constrained within partially spherical indentation 110*a* and 110*b* restricting lateral movement of partially spherical protrusions 218*a* and 218*b* outside the dished collar of partially spherical indentation 110*a* and 110*b*. Conversely, as described earlier, partially spherical protrusions 218*a* and 218*b* may extend from cylinder end walls 108*a* and 108*b* partially spherical indentation 110*a* and 110*b* may be formed as dished recessions on end walls 216*a* and 216*b*, with the free pivoting of partially spherical protrusions 218*a* and 218*b* within partially spherical indentation 110*a* and 110*b*.

Recessed top wall underside bottom surface 122 of hatch cover part 100 is shown sloping downwards towards recessed hatch opening 227 (solid line with double-headed arrows) together with the wedging of opposing open ends 104*a* and 104*b* of clamping rib second outside wall 117*b*/locking channel second inside wall 118*b* against first outside wall 211 of dome brim mount part 200. U-shaped trough 215 is clearly viewable with the removal of clamping rib first outside wall 117*a*/locking channel first inside wall 118*a* from frictional fitment between retaining rib 214 first outside wall 221*a* and ring-shaped crown portion 210 second outside wall 213 (also see FIG. 16A) when hatch cover part 100 is pivoted to the fully opened position and clamping rib 101 (inverted)/locking channel 102 are disengaged from mated contact over retaining rib 214.

Figure 19C:
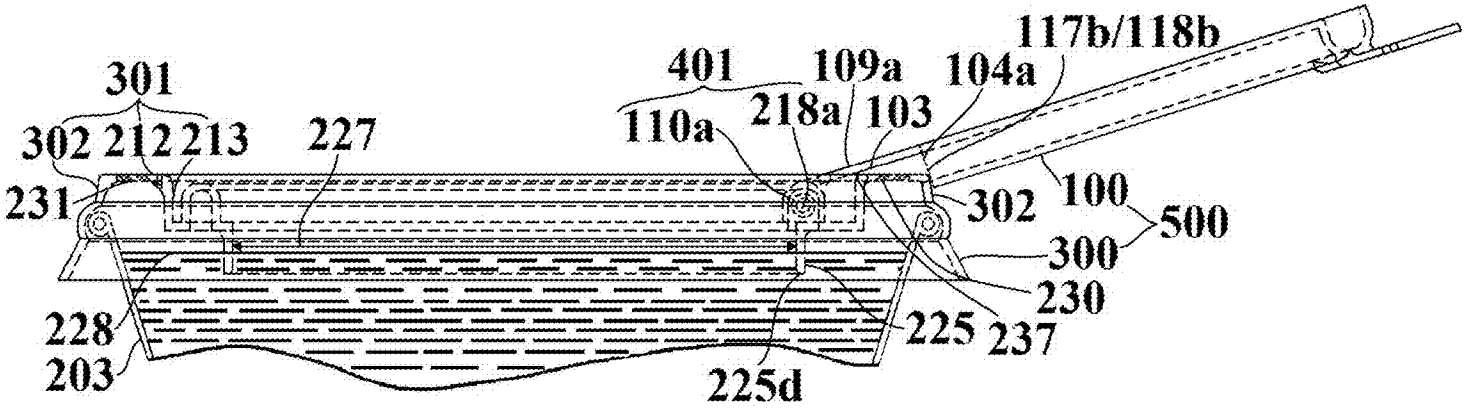
FIG. 19C is a side view in section of the flat lid configuration taken substantially along line I-I in FIG. 18.

FIG. 19C is a side view in section of flat lid 500 taken substantially along line I-I in FIG. 18 showing the same preferred embodiments described in FIG. 19A with the exception of compressed first outside wall 302 which forms compressed ring-shaped crown portion 301, with planar top transition surface 212 and second outside wall 213 unchanged, thereby compressing the dome-shape of dome brim mount part 200 to form flat brim mount part 300, bringing flat lid 500 into closer proximity to beverage surface plane 228. The closer proximity of recessed hatch opening 227 (solid line with double-headed arrows) to beverage surface plane 228 reduces the splashing distance beverage surface plane 228 has to travel upwards to pass through recessed hatch opening 227 and/or first 230 and/or second 231 drinking access ports. However, as flat brim mount part 300 is closer to beverage surface plane 228, anti-splash/spill apron wall base 225*d* of anti-splash/spill apron 225 (and the optional use of extended anti-splash/spill apron 225*c* discussed under FIG. 7E) are brought into closer proximity to beverage surface plane 228 and possibly passing through beverage surface plane 228, thereby acting to reduce slide-to-side surface sloshing of beverage due to wave-action created through agitation to container 203 (compressed for ease of illustration). Detachable hinge 401 is reproduced with partially spherical indentation 110*a* and 110*b* (110*b* not shown) pivoting about partially spherical protrusions 218*a* and 218*b* (218*b* not shown) bringing hatch cover part 100 to it fully opened position. Segments 109*a* and 109*b* (109*b* not shown) and inverted recessed top wall 103 are in intimate contact with planar top transition surface 212 and planar top transition surface inside perimeter edge 237, while opposing open ends 104*a* and 104*b* (phantom line, 104*b* not shown) of clamping rib second outside wall 117*b*/locking channel second inside wall 118*b* (phantom line, not distinguishable from open ends 104*a* in FIG. 19A) are frictionally wedged against compressed first outside wall 302.

Figure 19D:
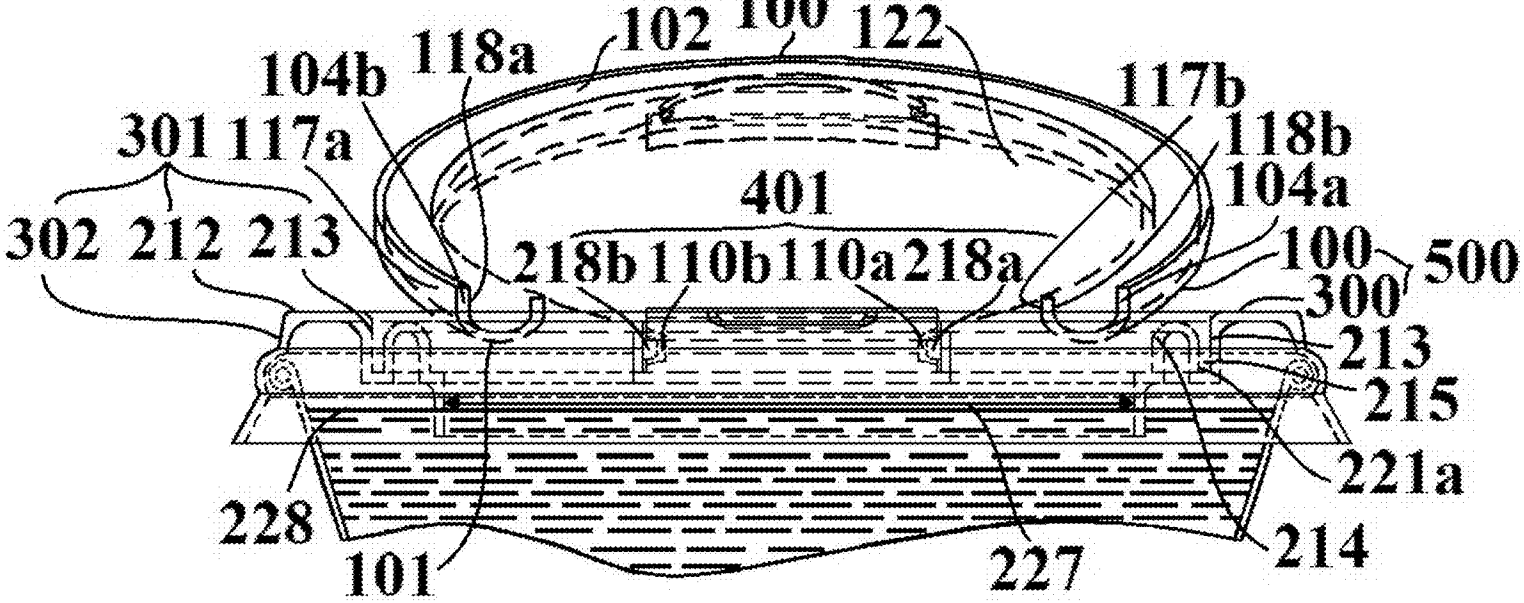
FIG. 19D is a side view in section of the flat lid configuration taken substantially along line J-J in FIG. 18.

FIG. 19D is a side view in section of flat lid 500 taken substantially along line J-J in FIG. 18 showing the same preferred embodiments described in FIG. 19B with the exception of compressed first outside wall 302 which forms compressed ring-shaped crown portion 301 with planar top transition surface 212 and second outside wall 213 unchanged, thereby compressing the dome-shape of dome brim mount part 200 to form flat brim mount part 300, bringing flat lid 500 into closer proximity to the beverage surface plane 228. The preferred embodiments described for partially spherical protrusions 218*a* and 218*b* and partially spherical indentation 110*a* and 110*b* comprising detachable hinge 401 regarding the pivoting of hatch cover part 100 are retained for flat lid 500 when hatch cover part 100 is in the fully opened position. Recessed top wall underside bottom surface 122 slopes downwardly towards recessed hatch opening 227 (solid line with double-headed arrows) and opposing open ends 104*a* and 104*b* of clamping rib second outside wall 117*b*/locking channel second inside wall 118*b* are wedged against compressed first outside wall 302 while clamping rib first outside wall 117*a*/locking channel first inside wall 118*a* are not in contact with compressed first outside wall 302. U-shaped trough 215 is clearly viewable with the removal of clamping rib first outside wall 117*a*/locking channel first inside wall 118*a* from frictional fitment between retaining rib 214 first outside wall 221*a* and ring-shaped crown portion 301 second outside wall 213 when hatch cover part 100 is pivoted to the fully opened position and clamping rib 101 (inverted)/locking channel 102 (inverted) are disengaged from mated contact over retaining rib 214.

Figure 20B:
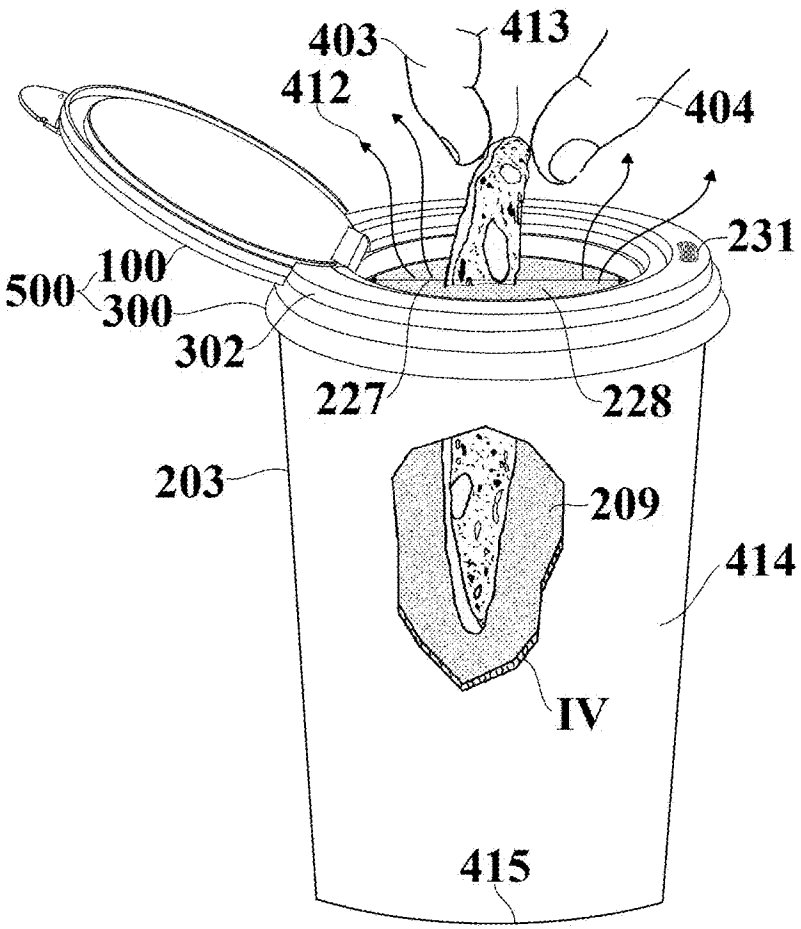
FIG. 20B is a perspective top view of the flat lid configuration, mounted to the rolled rim of a beverage container, with the hatch cover part in the fully opened position wherein a customer is dunking a confection through the hatch opening into a beverage within the container.
Figure 20A:
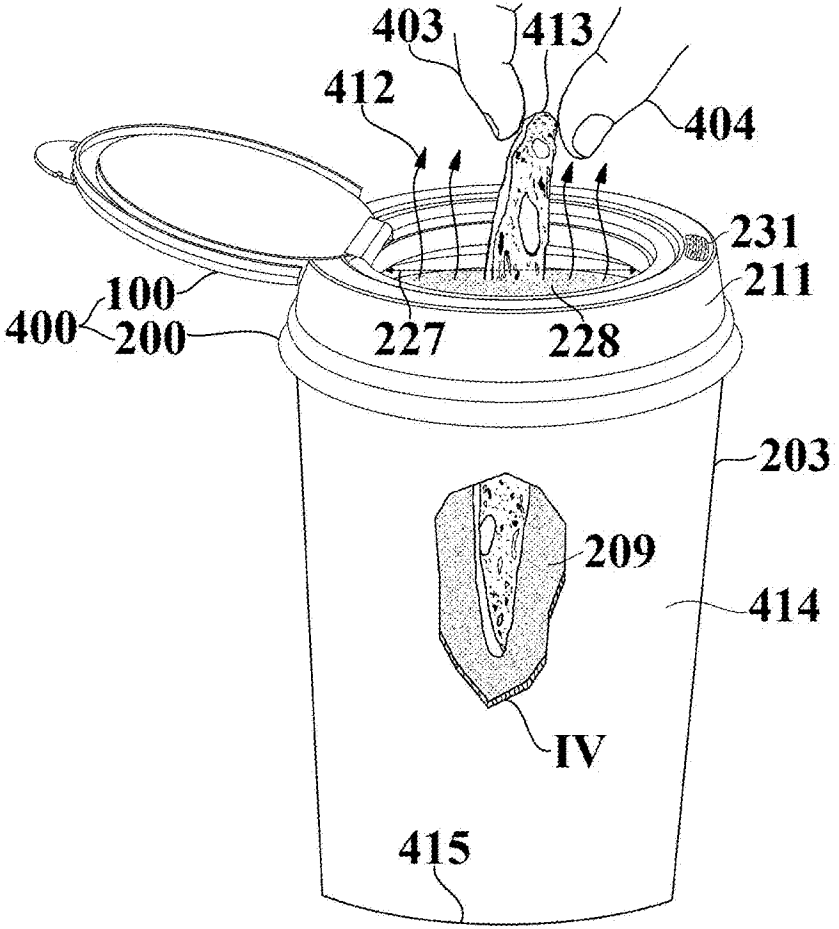
FIG. 20A is a perspective top view of the dome lid configuration, mounted to the rolled rim of a beverage container, with the hatch cover part in the fully opened position wherein a customer is dunking a confection through the hatch opening into a beverage within the container.

FIG. 20A is a perspective view of dome lid 400 with the dome brim mount part 200 portion clamped to the rolled rim 201 (see FIG. 16A) of disposable beverage container 203 with hatch cover part 100 in the fully opened position exposing recessed hatch opening 227 (solid and phantom lines with double-headed arrows) with beverage 209 therein and a combination of steam, heat and aroma 412 (solid wavy lines with single-headed arrows at the top) escaping upwardly therefrom. In a preferred embodiment of the present invention recessed hatch opening 227 is of sufficient diameter to allow for the unobstructed dunking of a confection 413, such as a biscotto, into a beverage 209, to a desired depth in a safe manner without the necessity of first removing dome lid 400 from disposable beverage container 203.

Confection 413 may be gripped for dunking between the ends of a person's index finger 403 and thumb 404 of either hand, simultaneously engaging the sides of confection 413, keeping index finger 403 and thumb 404 at a safe distance from beverage surface plane 228 (see FIG. 19C). Confection 413 is dunked into beverage 209 to a suitable depth to soften, but not disintegrate, such that only that portion submerged will be enjoyably consumed. A cut-away IV in the side of container wall 414 is for illustrative purposes only, showing confection 413 dunked into beverage 209 and is not meant to represent the depth confection 413 is dunked as this will vary between customers, the length of different confections 413, the height of the container 203 and the distance between the recessed hatch opening 227 of dome 400 or flat 500 lids and the beverage surface plane 228 height within container 203.

As mentioned under the background section, a dunked confection 413 must be retrieved from a beverage 209 when it has been suitably softened for consumption and not allowed to remain submerged too long upon which it will break apart and drop to the container bottom surface 415. The size of bite portioned from different dunked confections 413 will vary among customers, further impacting on the depth a confection 413 may be dunked.

The purpose of dunking a confection 413 into a beverage 209 is to enhance the beverage flavour by introducing the flavourings of a confection into the beverage 209 and conversely infusing beverage 209 into the confection 413 to enhance the taste of the confection 413, and also to soften the confection 413, in the case of biscotti, for easier consumption. Confections are routinely selected by customers when purchasing their grab-and-go beverage for consuming while alternately drinking their beverage. This does not preclude customers from prying the lid from the rolled rim of a container for the purposes of dunking their confection into a beverage within. As mentioned the container 203/lid rolled rim 201 interface (see FIG. 8A) is not designed for easy disengagement to remove the lid to access the beverage 209 within container 203 without risk of accidents. Hard cooked confections 413, such as biscotti, are not often the first confection of choice because they must be softened in many instances to be more easily consumed which requires dunking, which invites risks described above as they relate to removing a clamped lid from a container rolled rim to access the beverage within for the purposes of dunking. Grab-and-go customers consume their beverage purchase while on-the-go and, while they may purchase a cookie or other confection, they are drinking while on-the-go from a disposable beverage container with a lid clamped to the rolled rim as they separately consume their confection. The grab-and-go beverage purchase and the on-the-go beverage consumption do not lend themselves to the patience and time necessary to safely remove a clamped lid from the rolled rim of a disposable beverage filled container, manage the disconnected lid, while holding the disposable container and dunking a confection. Dunking any confection into a hot or cold beverage offers the customer an enhanced beverage/confection experience not offered when eating a confection separately while periodically sipping from a sealed disposable beverage container, and, for this reason, hard baked confections 413, such as biscotti, requiring dunking to be more easily ingested, are not usually included for consumption with the beverage purchase while on-the-go. While confections may, and have been dunked into a beverage in the past, dunking overall has been all but eliminated as an option with grab-and-go beverages delivered with lids firmly clamped to the rolled rim of disposable containers. Consequently, some confections 413, such as biscotti, requiring dunking into a beverage to soften for consumption, have become conspicuous by their absence as a confection 413 offering at fast food outlets. To enjoy the experience of dunking any confection into a hot or cold beverage 209 and make this combo attractive to the grab-and-go beverage customer for consuming a beverage 209 infused confection while on-the-go, the beverage 209 must be easily and safely accessed in an expeditious manner, which is accomplished with this new invention through the pivoting of hatch cover part 100 allowing expedited access to the recessed hatch opening 227 and the beverage 209, while dome 400 or flat 500 lid configurations remain clamped to the rolled rim 201 of disposable beverage container 203. Once a confection 413, such as a biscotto, is consumed following adequate dunking the customer may continue drinking beverage 209 through the second drinking access port 231 with hatch cover part 100 in the fully opened position (see FIG. 16C). Conversely, hatch cover part 100 may be returned to its fully closed position allowing the customer to continue sipping beverage 209 from the first drinking access port 230 (see FIG. 8C)

FIG. 20B is a perspective view of flat lid 500 of the present invention with the flat brim mount part 300 portion clamped to the rolled rim 201 (see FIG. 17A) of disposable beverage container 203 with hatch cover part 100 in the fully opened position exposing recessed hatch opening 227 (solid and phantom line with double-headed arrows) with beverage 209 therein and a combination of steam, heat and aroma 412 (solid wavy lines with single-headed arrows at the top) escaping upwardly therefrom. Flat lid 500 includes all of the preferred embodiments described for dome lid 400 in FIG. 20A except for first outside wall 211 which has been compressed to form compressed first outside lid 302. Recessed hatch opening 227 does not change in size and a confection 413, such as biscotti, may be dunked and retrieved in the same manner as described under FIG. 20A. A preferred embodiment of flat lid 500 is that it brings recessed hatch opening 227 into a more intimate relationship with beverage surface plane 228, thereby offering the customer a shorter distance to dunk confection 413 before reaching beverage surface plane 228 for subsequent beverage infusion compared with the longer distance the customer must dunk confection 413 when dunked through recessed hatch opening 227 on dome lid 400. The customer still must be mindful of the potential for the digits of either hand to make contact with beverage surface plane 228 as they attempt to submerge and infuse confection 413, thereby avoiding scolds to digits and transferring germs to beverage 209. Cut-away IV is again included in the side of container wall 414 showing confection 413 dunked into beverage 209 together with container bottom surface 415. Once a confection 413, such as a biscotto, is consumed following adequate dunking, the customer may continue drinking beverage 209 through the second drinking access port 231 with hatch part 100 in the fully opened position (also see FIG. 16C).

Figure 21A:
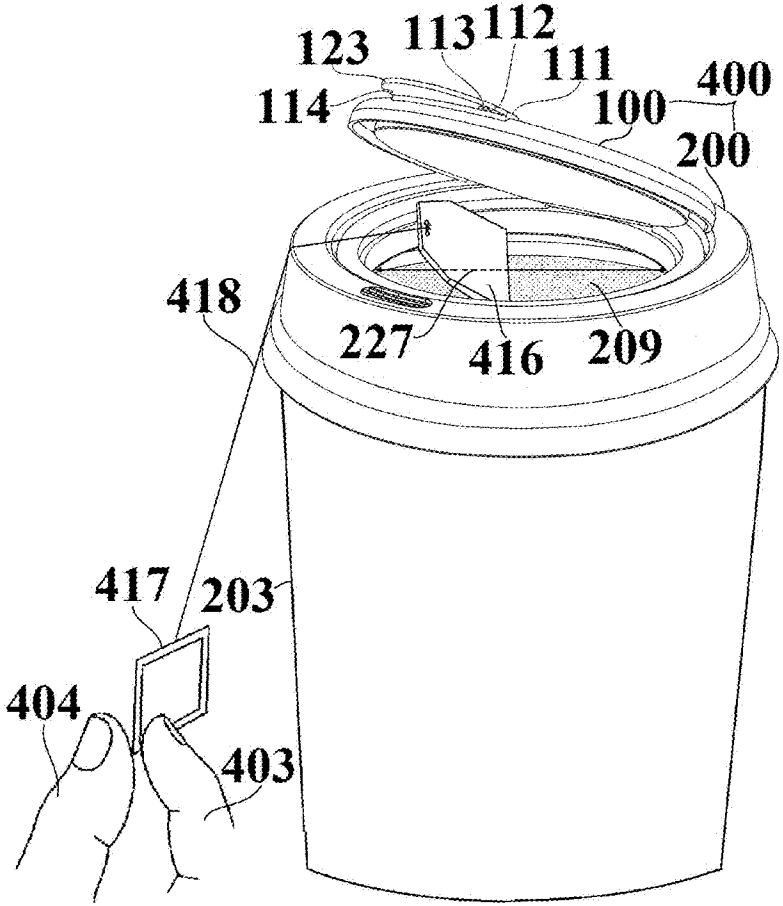
FIG. 21A is a perspective top view of the dome lid configuration, mounted to the rolled rim of a beverage container, with the hatch cover part in a partially opened position wherein an infusion pouch is inserted through the hatch opening into the beverage within the container.

FIG. 21A is a perspective top view of dome lid 400 as described in FIG. 12 where the curvilinear perimeter front edge 123 of gripping tab 111 has been lifted, pivoting hatch cover part 100 to a partially opened position or any intermediate position therein, providing adequate space to insert an infusion pouch 416 through recessed hatch opening 227 (solid and phantom lines with double-headed arrows) for the purposes of infusing beverage 209. In this example infusion pouch 416 is freely inserted through the partially opened hatch cover part 100 and dropped through recessed hatch opening 227 without utilizing string entry slit 112, string guide hole 113 or string retaining slot 114 die-cut through gripping tab 111 (also see FIG. 1A). In one optional method of inserting an infusion pouch 416 into beverage 209 filled disposable container 203 the index finger 403 and thumb 404 of either hand grasp infusion pouch tag 417 retaining infusion pouch string 418 and holding infusion pouch 416 at a preferred depth (see FIG. 21B) within beverage 209 in disposable beverage container 203 to ensure maximum infusion. This demonstrates a further preferred embodiment of the present invention wherein an organically flavoured infusion pouch 416, such as a tea bag for example, may take advantage of this new invention for the insertion of an infusion pouch 416 into a beverage 209 through recessed hatch opening 227 without necessitating the removal of the lid from rolled rim 201 (see FIG. 17A) of disposable beverage container 203 and incurring associated risks of liquid spillage and injury. Presently a customer may be served a disposable container of hot water with the disposable lid clamped to the rolled rim of the container and the infusion pouch provided separately, requiring the customer to unclamp the disposable lid from the disposable container, insert the infusion pouch into the disposable container, allow the beverage to steep and then remove the infusion pouch with residual beverage to discard, and then optionally add condiments and optionally re-attach the disposable lid to an already weakened container rolled rim, risking spills or other accidents described above during both the removal and re-attachment of the disposable lid to a hot water filled disposable beverage container. Alternatively, a customer may be served a hot water filled disposable container with an infusion pouch already inserted in the disposable beverage container without the disposable lid attached, allowing the customer to remove the infusion pouch with residual beverage, add condiments, and optionally risk clamping a disposable lid to the rolled rim of the container. These two scenarios introduce the risks of spilling beverage and possible injury due to either prying the lid from disposable beverage container to insert an infusion pouch or attaching the lid to the rolled rim of disposable beverage container after an infusion pouch has been removed and discarded following suitable steeping. The risks associated when inserting an infusion pouch 416, such as a tea bag, through the recessed hatch opening 227 in the top wall of dome 200 or flat 300 brim mount part while dome 400 and flat 500 lid configurations remain attached to the rolled rim 201 of a disposable beverage container 203 are eliminated with this new invention.

FIG. 21B is a perspective top view of dome lid 400 as described in FIG. 8A with hatch cover part 100 in the fully closed position. Once infusion pouch 416 has been inserted through recessed hatch opening 227 (see FIG. 21A) when hatch cover part 100 is pivoted to a fully opened position, it is lowered to a suitable depth in beverage 209 as viewed through cut-away V in container wall 414 of disposable container 203. Hatch cover part 100 is then pivoted to a fully closed position wherein infusion pouch string 418 (phantom and solid lines) is held in place sandwiched between clamping rib 101/locking channel 102 and retaining rib 214 arch 239, thereby retaining infusion pouch 416 at a suitable height in beverage 209 within disposable beverage container 203 as viewed through cut-away V in container wall 414. Infusion pouch string 418 hangs over planar top transition surface 212 with infusion pouch tag 417 resting against first outside wall 211 of dome brim mount part 200.

Figure 21C:
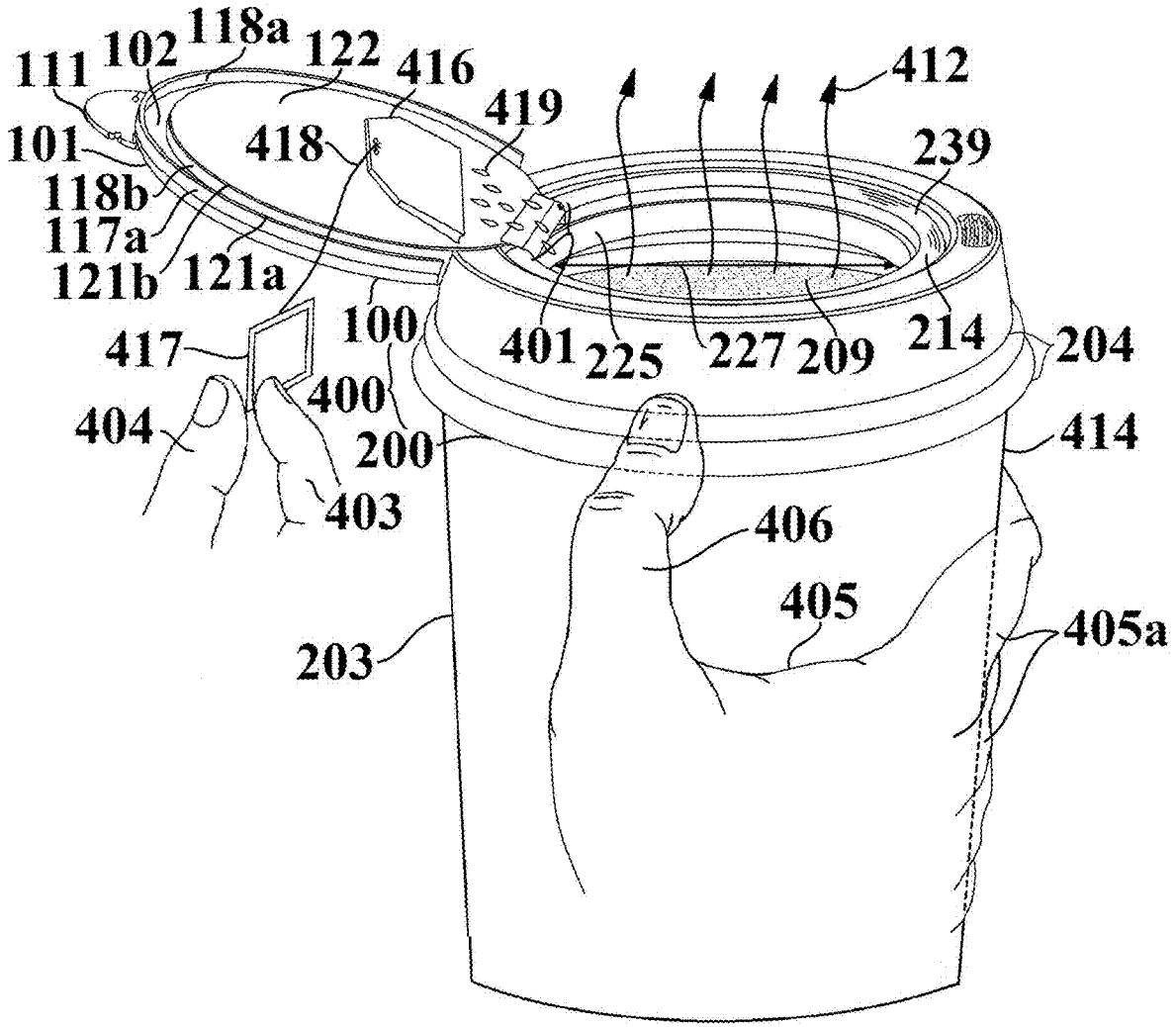
FIG. 21C is a perspective top view of the dome lid configuration, mounted to the rolled rim of a beverage container, with the hatch cover part in the fully opened position with a retrieved infusion pouch resting on the underside bottom surface of the hatch cover part.

FIG. 21C is a perspective top view of dome lid 400 as described in FIG. 16A. Following steeping of infusion pouch 416 in FIG. 21B, under closed hatch cover part 100, gripping tab 111 may be gripped by index finger 403 and thumb 404 of either hand, prying hatch cover part 100 upwards while the opposing thumb 406 holds down annular skirt 204 and opposing hand 405 and remaining fingers 405*a* stabilize disposable beverage container 203 as shown in FIG. 8A, releasing frictional fitment between clamping rib 101/locking channel 102 from retaining rib 214 and pivoting hatch cover part 100 to its fully opened position, thereby releasing infusion pouch string 418 from being sandwiched between locking channel 102 and retaining rib arch 239. Although index finger 403 and thumb 404 of either hand are often referred to throughout specification in regards to lifting gripping tab 111 and also the use of opposing thumb 406 to hold down annular skirt 204 and opposing hand 405 and remaining fingers 405*a* to grip container 203, this does not preclude the use of other digits of either hand configured in combination or unilaterally when performing actions of lifting hatch cover part 100 between fully closed and fully opened positions or gripping container 203 or holding down annular skirt 204. Index finger 403 and thumb 404 release their grip on gripping tab 111 and then grip infusion pouch tag 417, and, while still steadying disposable beverage container 203 with opposing thumb 406 applying downward pressure to annular skirt 204 of dome brim mount part 200 and opposing hand 405 and remaining fingers 405*a* grip disposable beverage container 203 outside wall 414, pull infusion pouch tag 417 and attached infusion pouch string 418, retrieving infusion pouch 416 from disposable beverage container 203 to optionally rest infusion pouch 416 on sloped recessed top wall underside bottom surface 122 of hatch cover part 100. A combination of steam, heat and aroma 412 (solid wavy lines with single-headed arrows at the top) are shown escaping upwardly from recessed hatch opening 227 (solid line with double-headed arrows). In a further preferred embodiment of the present invention, the elevated sloped recessed top wall underside bottom surface 122 promotes the draining of infused residual beverage 419 through gravity down elevated inclined recessed top wall underside bottom surface 122 passing over detachable hinge 401, cascading down anti-splash/spill apron 225 through recessed hatch opening 227 into disposable beverage container 203, thereby further maximizing infusion of beverage 209, before infusion pouch 416 is discarded. The infusion pouch string 418 and attached infusion pouch tag 417 drop over clamping rib 101/locking channel 102 first outside wall 117*a*/first inside wall 118*a* base 121*a* and clamping rib 101/locking channel 102 second outside wall 117*b* (not visible in FIG. 21C)/second inside wall 118*b* base 121*b*, hanging freely while infused residual beverage 419 continues to drain from the infusion pouch 416 and cascade down inclined recessed top wall underside bottom surface 122. After infusion pouch 416 is sufficiently drained, infusion pouch string 418 and/or infusion pouch tag 417 are gripped by index finger 403 and thumb 404 of either hand and lifted to remove the infusion pouch 416 from recessed top wall underside bottom surface 122 to be discarded.

Figure 21E:
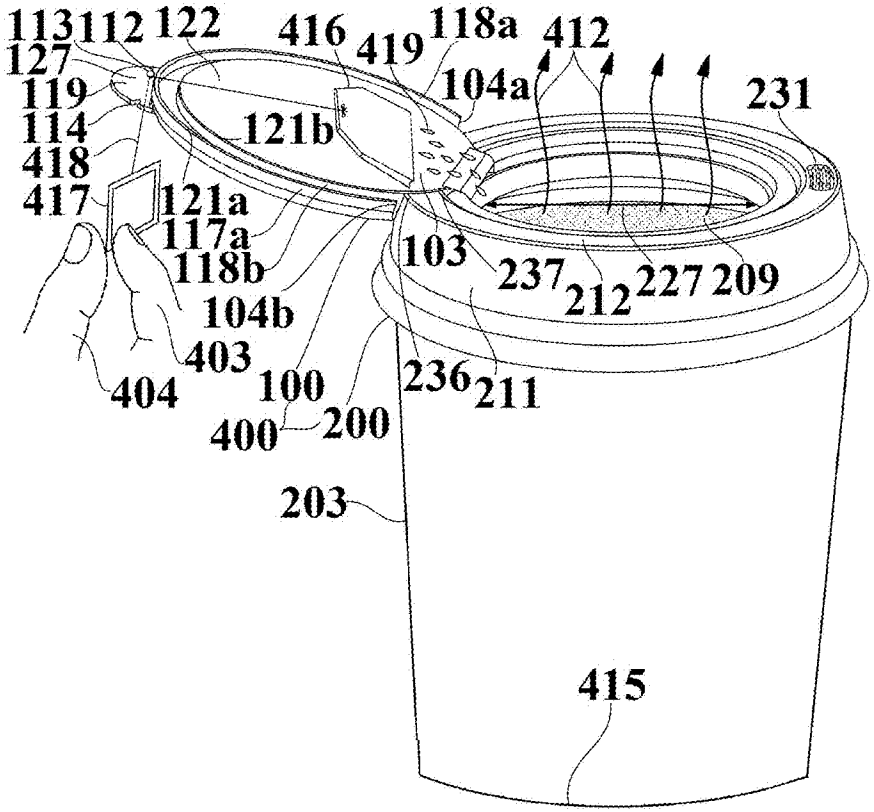
FIG. 21E is a perspective top view of the dome lid configuration, mounted to the rolled rim of a beverage container, with the hatch cover part in the fully opened position wherein a retrieved infusion pouch is resting on the inverted underside bottom surface of the hatch part and the infusion pouch string is within the string guide hole in the gripping tab.
Figure 21D:
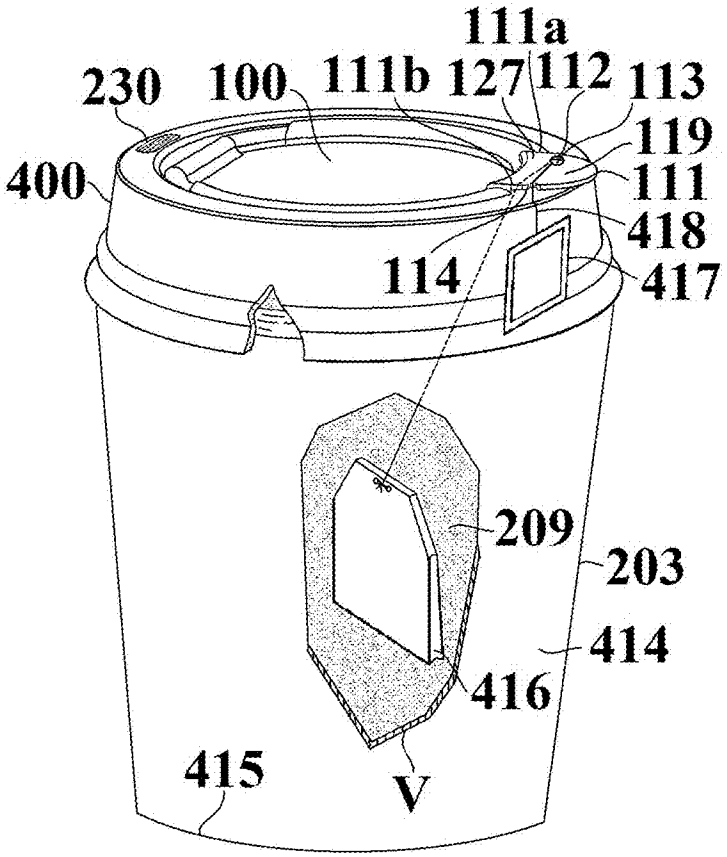
FIG. 21D is a perspective top view of the dome lid configuration, mounted to the rolled rim of a beverage container, with the hatch cover part in the fully closed position wherein an infusion pouch is suspended in the beverage within the container and the infusion pouch string is wrapped around the top and bottom surfaces of the gripping tab.
Figure 21F:
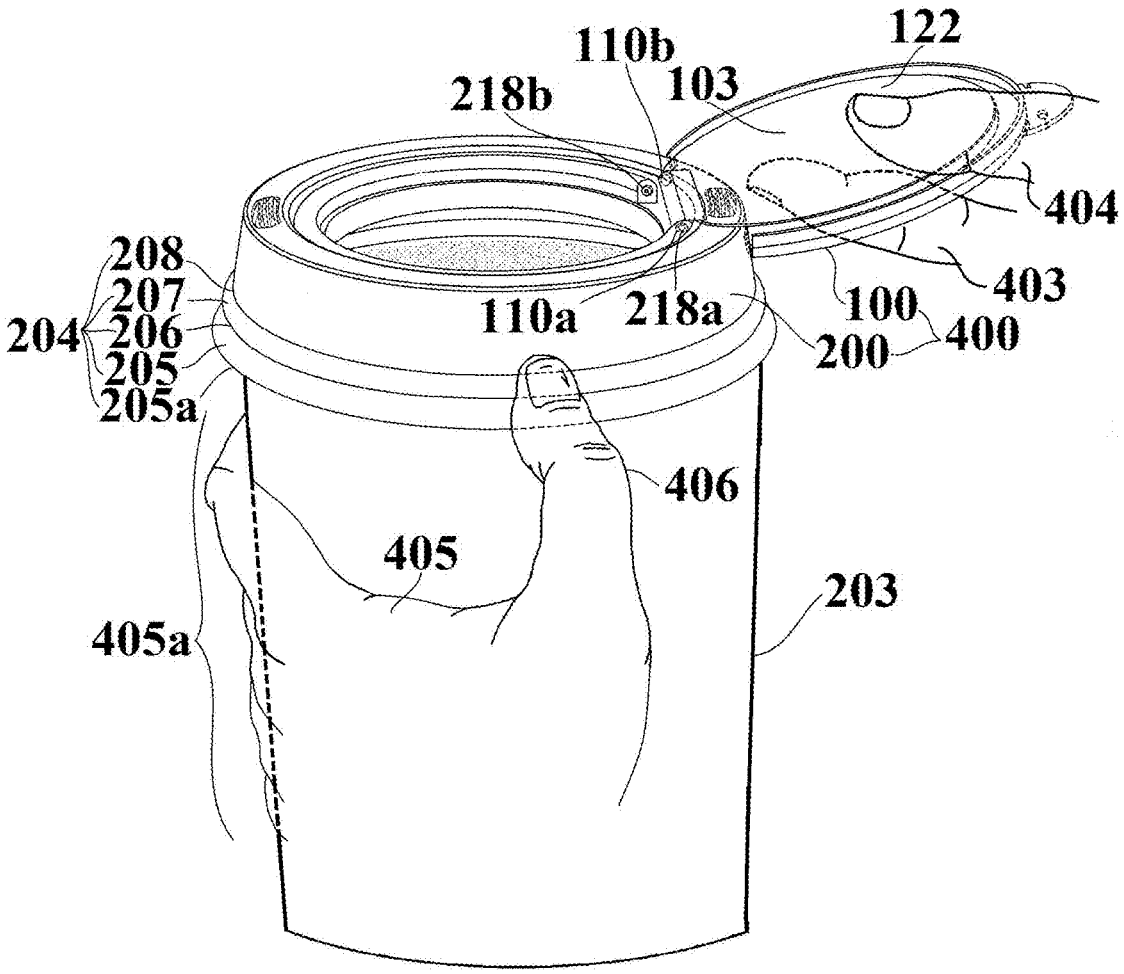
FIG. 21F is perspective top view of the dome lid configuration mounted to the rolled rim of a beverage container, wherein the fully opened hatch cover part is in the process of being disengaged from the top of the dome brim mount part.
Figures 1, 21F:
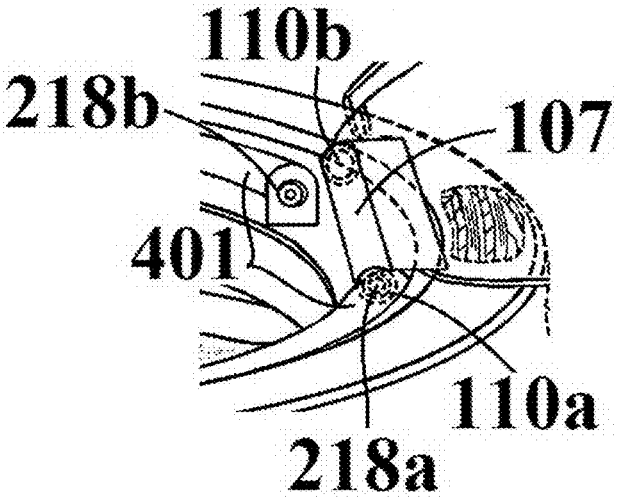
Figures 3, 21F:
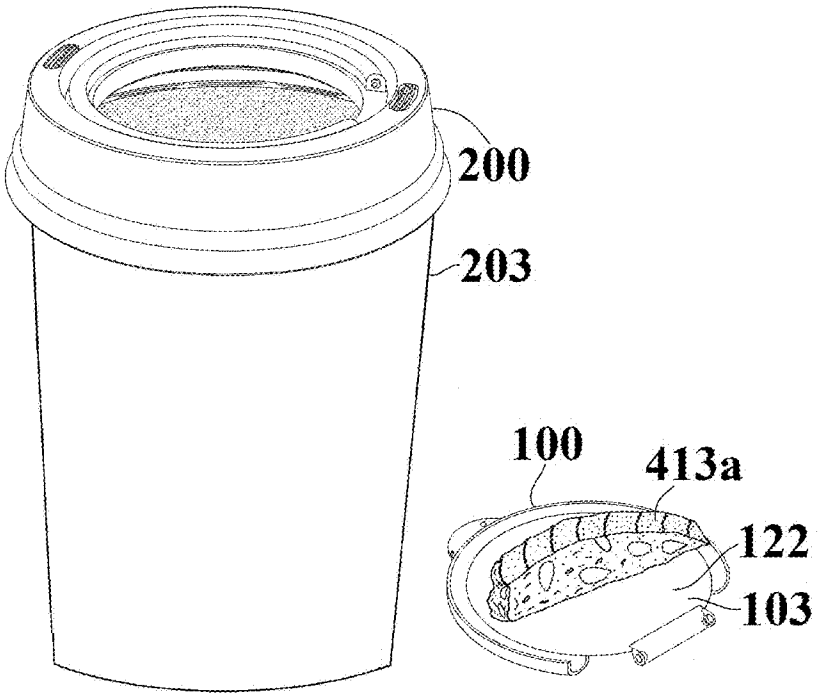
Figures 2, 21F:
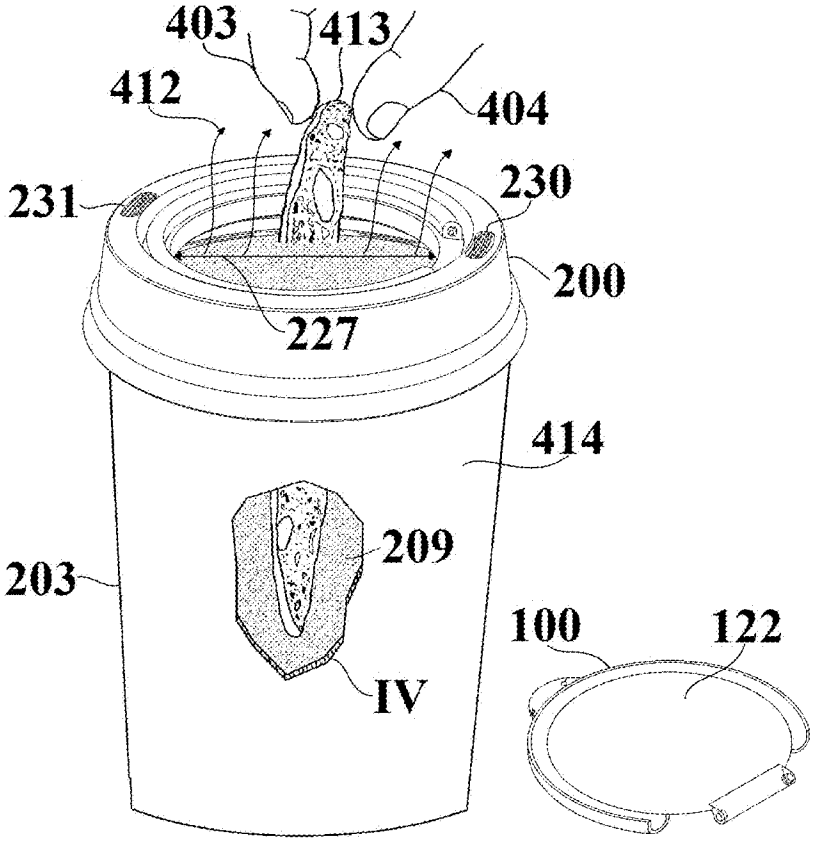

FIG. 21D is a perspective top view of dome lid 400 illustrating an alternative option to retaining infusion pouch 416 in beverage 209 within disposable beverage container 203 following inserting infusion pouch 416 through recessed hatch opening 227 (see FIG. 21E) into disposable beverage container 203 as described under FIG. 21A.

In another preferred embodiment of the present invention, infusion pouch tag 417 and attached infusion pouch string 418, may optionally be gripped by index finger 403 and thumb 404 (of either hand, see FIG. 21A), to manoeuver infusion pouch string 418 through string entry slit 112, into string guide hole 113, of gripping tab 111. Once infusion pouch string 418 is in string guide hole 113 it will move up and down freely, thereby allowing the customer to lower infusion pouch 416 to a suitable depth in disposable beverage container 203 as shown through cut-away V in container wall 414. Once depth of infusion pouch 416 is determined, infusion pouch string 418 may then be optionally pulled back into string entry slit 112 and allowed to remain wedged in string entry slit 112, along first side perimeter edge 111*a* of gripping tab 111, thereby suspending infusion pouch 416 at the preferred depth to steep. Alternatively, once infusion pouch string 418 is in string guide hole 113, infusion pouch string 418 (solid and phantom lines) may then be wrapped around gripping tab top surface 127 and gripping tab bottom surface 119 (not visible in FIG. 21D) and placed in string retaining slot 114, diametrically opposite string guide hole 113 on the opposite side second perimeter edge 111*b* of gripping tab 111, thereby retaining infusion pouch 416 at an optimal preferred height for maximum infusion and convection circulation within beverage 209.

Retaining infusion pouch 416 at mid height in disposable beverage container 203 maximizes infusion of hot beverage 209 by taking advantage of convection circulation, in the case of hot water, to more evenly diffuse the organic flavour which might not otherwise be achieved if infusion pouch 416 were allowed to rest on the disposable beverage container bottom surface 415. While infusion pouch 416 is steeping in beverage 209 hatch cover part 100 may be optionally returned to its fully closed position to retain heat. The customer has the option of drinking steeping beverage through first drinking access port 230 while infusion pouch 416 is confined within disposable beverage container 203.

FIG. 21E is a perspective view of dome lid 400 attached to beverage 209 filled disposable container 203 with hatch cover part 100 in the fully opened position with infusion pouch 416 resting on recessed top wall underside bottom surface 122 of inverted hatch cover part 100 inclined at a low angle of slope due to recessed top wall 103 (not viewable) resting on planar top transition surface inside perimeter edge 237 and planar top transition surface 212, with a downward slope towards recessed hatch opening 227 (solid line with double-headed arrows). A combination of steam, heat and aroma 412 (solid wavy lines with single-headed arrows at the top) escapes from beverage 209 through recessed hatch opening 227 (solid line with double-headed arrows), demonstrating the cooling function offered by pivoting hatch cover part 100 without necessitating the removal of dome brim mount part 200 from rolled rim 201 (see FIG. 17A) of disposable beverage container 203.

When hatch cover part 100 has been pivoted about detachable hinge 401 (see FIG. 16A) to the fully opened position, the snug frictional surface contact between partially spherical protrusions 218*a* and 218*b* and partially spherical indentation 110*a* and 110*b* (also shown in FIGS. 16A and 17A), together with the intimate frictional contact wedging between open ends 104*a* and 104*b* of clamping rib second outside wall 117*b*/locking channel second inside wall 118*b* (clamping rib second outside wall 117*b* is not visible in FIG. 21E) against planar top transition surface outside perimeter edge 236 and first outside wall 211, combine to retain hatch cover part 100 in a rigid opened position remote from recessed hatch opening 227 (also shown in FIGS. 16A and 17A).

At such time as the customer is satisfied with the degree of steeping of infusion pouch 416 in beverage 209, they may proceed to pull infusion pouch 416 from disposable beverage container 203. In one optional method of retrieving infusion pouch 416 the customer may grip infusion pouch string 418 near recessed hatch opening 227 and pull infusion pouch 416 from disposable beverage container 203 to rest on the inclined recessed top wall underside bottom surface 122 of hatch cover part 100 to drain infused residual beverage 419 while the remaining infusion pouch string 418 is still entwined around string guide hole 113 and string retaining slot 114, as also seen in FIG. 21D. In another optional method of retrieving infusion pouch 416 the customer may grasp infusion pouch tag 417 between index finger 403 and thumb 404 and unwind infusion pouch string 418 from encircling gripping tab top surface 127 (not visible in FIG. 21E, see also FIG. 21D) and bottom surface 119. Alternatively, if infusion pouch string 418 has been wedged in string entry slit 112, the customer may grasp infusion pouch tag 417 between index finger 403 and thumb 404 and manoeuver infusion pouch string 418 out of the string entry slit 112, optionally pulling infusion pouch string 418 into the string guide hole 113 to pull infusion pouch string 418 freely together with attached infusion pouch 416 from beverage 209, or, in another option, the customer may just pull infusion pouch 416 from beverage 209, and rest infusion pouch 416 on recessed top wall underside bottom surface 122 to drain infused residual beverage 419 leaving infusion pouch string 418 and infusion pouch tag 417 hanging over clamping rib fist outside wall 117*a*/locking channel first inside wall 118*a* base 121*a* and clamping rib second outside wall 117*b* (not visible in FIG. 21E)/locking channel second inside wall 118*b* base 121*b* as described in FIG. 21C. Alternatively, the customer may just pull infusion pouch 416 via infusion pouch tag 417 and/or infusion pouch string 418 from disposable beverage container 203 and immediately discard without further draining infused residual beverage 419 from infusion pouch 416 on hatch cover part 100 inclined recessed top wall underside bottom surface 122.

As mentioned above hot water may be served to a customer with or without a disposable lid attached to the top of a disposable beverage container and with or without an infusion pouch inserted in the beverage container. When served with the lid detached and with the infusion pouch inserted into the beverage or provided separately, the customer avoids the risks of accidental spills and injury incurred removing a clamped lid from a container rolled rim to access the hot water, and may therefore remove an inserted infusion pouch or insert an infusion pouch, monitoring the steeping of the infusion pouch in the beverage and insuring that the attached tag and string don't slip into the container and fall to the bottom of the beverage, requiring a utensil or other means to retrieve the pouch for discarding. When retrieving and discarding an infusion pouch it may still retain residual infused beverage which may potentially drip onto the customer and on the surfaces surrounding the disposable beverage container and likely necessitate a napkin to contain the dripping from the infusion pouch. After removing the infusion pouch the customer may add condiments and either consume the beverage without a lid attached or again risk possible accidental spills and injury when clamping a lid to the beverage container for subsequent consumption through an aperture in the lid. When a hot beverage is served with the lid clamped to the container rolled rim and the infusion pouch inserted in the container or provided separately, the customer has the additional task of removing the clamped lid and risk accidental spills and injury, to retrieve the inserted infusion pouch, and optionally add condiments. In addition to monitoring the steeping of an infusion pouch in the beverage and insuring the attached tag and string do not slip in and fall to the bottom of the container, the customer must also manage a disconnected lid. The infusion pouch may be subsequently retrieved, again contending with dripping residual infused beverage and also optionally risk re-attaching a lid to a container rolled rim which might have lost it original shape between the time allowed for steeping and initial removal of the lid. These examples of infusion pouch and beverage management slow down the grab-and-go, on-the-go beverage purchase through the various steps and risks associated with inserting, and removing, an infusion pouch to, and from a hot water filled disposable container and the subsequent removal and/or re-attachment of a disposable lid to the disposable container rolled rim.

The above described problems and risks associated when infusing a beverage with an infusion pouch are avoided with this new invention. An infusion pouch 416 may be inserted through recessed hatch opening 227 in either the dome 400 or flat 500 lid configurations without removing the lid from the rolled rim 201 of the container thereby avoiding accidental spills and injury. The procedure for suspending an infusion pouch 416 into a beverage filled 209 disposable container 203, and optionally wedging infusion pouch string 418 into string entry slit 112 to suspend an infusion pouch in the beverage, may vary from person to person and does not preclude merely using string entry slit 112 to bring infusion pouch string 418 into string guide hole 113 and letting the infusion pouch 416 rest on container bottom surface 415 while string guide hole 113 prevents infusion pouch tag 417 from falling completely into disposable beverage container 203, thereby avoiding the need to physically manage the infusion pouch tag and string (see FIG. 21D). The infusion pouch tag 417 is readily available to pull infusion pouch 416 onto the sloped recessed top wall underside bottom surface 122 to drain residual beverage 419 (see FIG. 21E), leaving a drained infusion pouch 416 to discard without residual infused beverage 419 dripping from the infusion pouch 416 around the surface area and on the customer, reducing the need for a napkin to contain drippings when discarding an infusion pouch. After infusion pouch 416 is discarded, hatch cover part 100 may again be optionally pivoted from the fully open to the fully closed position, again sealing recessed hatch opening 227, keeping beverage 209 warm while the customer sips from the first drinking access port 230 (see FIG. 21D), or, alternatively, hatch cover part 100 may remain in the fully opened position providing access to perform further operations on beverage 209 such as dunking a confection 413 (see FIG. 20A) while the customer alternately sips beverage 209 from the second drinking access port 231. This new invention helps to expedite grab-and-go, on-the-go beverage purchases involving the management of an infusion pouch 416 for the purposes of infusing a hot water filled disposable beverage container without necessitating the removal of the attached disposable lid from the container rolled rim.

FIGS. 21A through 21E illustrate an infusion pouch 416 suspended through various optional methods utilizing gripping tab 111 of hatch cover part 100 of dome lid 400, however, the same processes and arrangement for suspending infusion pouch 416 would also be adopted and used for flat lid 500 with the same preferred embodiments for inserting, suspending and retrieving infusion pouch 416 as described for dome lid 400 above.

FIG. 21F is perspective top view of dome lid 400 with hatch cover part 100 (phantom and solid lines) in the fully opened position in the process of being disconnected from the top of dome brim mount part 200. The reversible, non-permanent engagement of partially spherical indentation 110*a* and 110*b* comprising hatch cover hinge part 100 female hinge part enshrouding partially spherical protrusions 218*a* and 218*b*, dome brim mount part 200 male hinge part, to form a constrained detachable hinge 401 discussed in FIG. 8A also allows for hatch cover part 100 to be optionally disconnected from the top of dome brim mount part 200 in a similar manner when gentle force is sufficiently applied to flex dished rims of partially spherical indentation 110*a* and 110*b* to slide over, and disconnect from, mated fitment over partially spherical protrusions 218*a* and 218*b*, thereby releasing hatch cover part 100 male hinge part from the top portion of dome brim mount part 200 female hinge part (also see FIG. 21F-1).

One optional approach to disconnect hatch cover part 100 from the top of dome brim mount part 200 is to arrange the thumb 406 of either hand 405 to apply gentle downward pressure to outside perimeter free edge 205*a*, bottom flange 205, lower 206 and upper 208 furrows and clamping curvature 207 of annular skirt 204 while the hand 405 and remaining fingers 405*a* wrap around disposable beverage container 203 (phantom and solid lines) to retain dome brim mount part 200 clamped to rolled rim 201 (see FIG. 17A) of disposable beverage container 203 as first shown in FIG. 16D. The index finger 403 (phantom and solid lines) and thumb 404 of the opposing hand respectively grasp recessed top wall 103 (not visible) and recessed top wall underside bottom surface 122 of hatch cover part 100 to gently pull hatch cover part 100 from one side, gently bending and flexing hatch cover part 100 to slide mated recessed rim of partially spherical indentation 110*a* over partially spherical protrusions 218*b* freeing it from mated fitment. As one side of the mated fitment is disconnected the opposite partially spherical indentation 110*a* is freely disengaged from mated fitment to partially spherical protrusions 218*a*, releasing hatch cover part 100 from the top of dome brim mount part 200. The positioning of hands, thumbs and fingers arranged for the removal of hatch cover part 100 from the top portion of either dome 200 or flat 300 brim mount part, together with the angle hatch cover part 100 is opened to be gripped, and the side of detachable hinge 401 chosen to begin the disconnection process, may vary from person to person.

FIG. 21F-1 is a partial perspective view on a larger scale of a portion of dome lid 400 in FIG. 21F where partially spherical indentation 110*a* has become disconnected from mated fitment to partially spherical protrusions 218*b* on one side of cylinder 107 of detachable hinge 401. On the opposite end of cylinder 107 partially spherical indentation 110*a* can then easily disconnected from partially spherical protrusion 218*a*.

FIG. 21F-2 is perspective top view of dome brim mount part 200 mounted to the rolled rim 201 (see FIG. 17A) of a beverage container 203 with the disconnected hatch cover part 100 inverted with recessed top wall underside bottom surface 122 facing upwards, resting on a surface adjacent to beverage container 203. A customer is dunking a confection 413 through the recessed hatch opening 227 (solid and phantom lines with double-headed arrows) into a beverage 209 within the container 203 with a combination of steam, heat and aroma 412 (solid wavy lines with single-headed arrows at the top) escaping upwardly therefrom. Cut-away IV in the beverage container wall 414 shows confection 413 held between index finger 403 and thumb 404 submerged within beverage 209. The disconnected inverted hatch cover part 100 provides an alternative surface to rest anything that may have accompanied the beverage 209 purchase including condiments, napkins or a utensil. While consuming a confection 413, the confection 413 may be periodically rested on the inverted hatch cover part 100 recessed top wall underside bottom surface 122 following dunking (see FIG. 21F-3) while the customer alternately drinks beverage 209 from either the first 230 or second 231 drinking access ports. The option to disconnect hatch cover part 100 from a dome 200 or flat 300 brim mount part and rest the disconnected hatch cover part 100 in an inverted configuration to utilize the flat recessed top wall underside bottom surface 122 provides an optional, more hygienic surface, with provenance from your beverage purchase as opposed to resting accompanying items on an unfamiliar, potentially less hygienic surface, without prior knowledge of what was previously placed on the surface and whether or not the surface had been cleaned.

FIG. 21F-3 is perspective top view of dome brim mount part 200 mounted to the rolled rim 201 (see FIG. 17A) of a disposable beverage container 203 with the disconnected hatch cover part 100 inverted with recessed top wall underside bottom surface 122 facing upwards and recessed top wall 103 (not visible) facing downwards, resting on a surface adjacent to beverage container 203. As discussed under FIG. 21F-2 the purpose of removing hatch cover part 100 from dome brim mount part 200 is to optionally use recessed top wall underside bottom surface 122 as a detachable support providing a substantially clean surface when none is readily available to rest a confection 413 such as a biscotto or rest any other subsidiary accompaniment such as a retrieved infusion pouch 416, utensil, napkin and the like. The detached hatch cover part 100 in FIG. 21F-3 is supporting a partially eaten confection 413*a* following dunking in FIG. 21F-2 thereby providing an optional clean surface to rest the partially eaten confection 413*a*. Hatch cover part 100 may also be disconnected from flat brim mount part 300 for flat lid 500 configuration in a similar manner for use as an optional support.

Figure 22A:
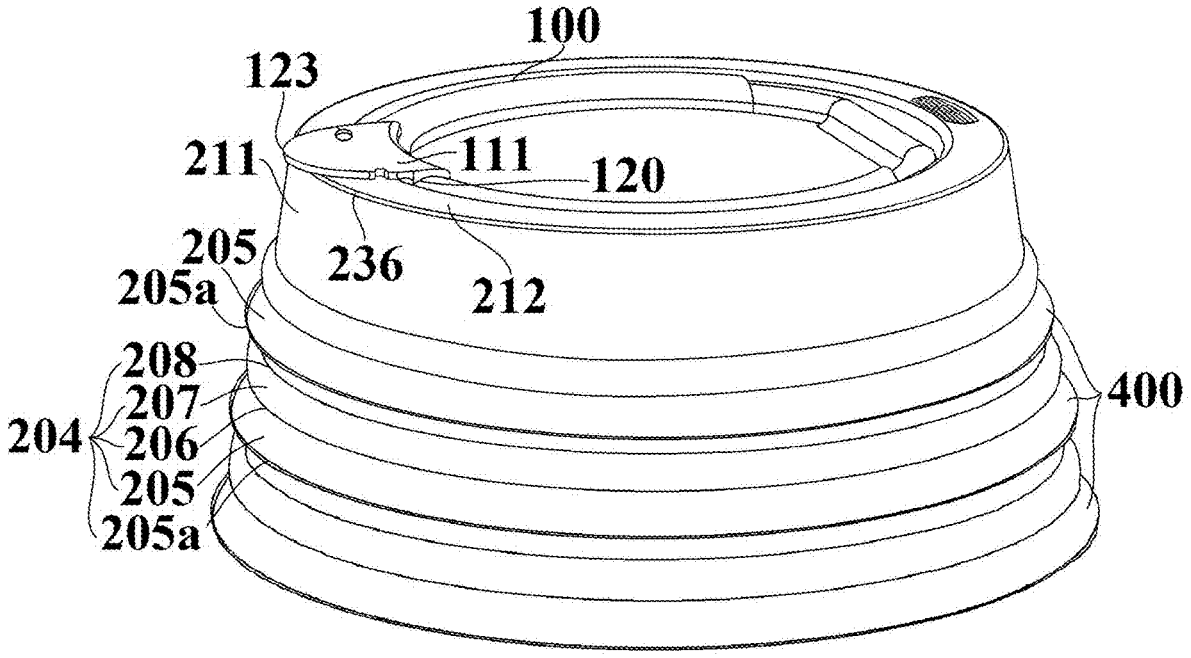
FIG. 22A is a perspective top view of a plurality of dome lids with the hatch cover part in the fully closed position shown in a stacking arrangement.

FIG. 22A is a perspective view of a plurality of dome lids 400, in accordance with the preferred embodiments of FIG. 8A, with hatch cover part 100 in the fully closed position, wherein hatch cover part 100 and gripping tab 111 have been designed to allow dome lids 400 to be easily stacked in a stable configuration one on top of the other for access and space considerations in preparation for use.

Figure 22B:
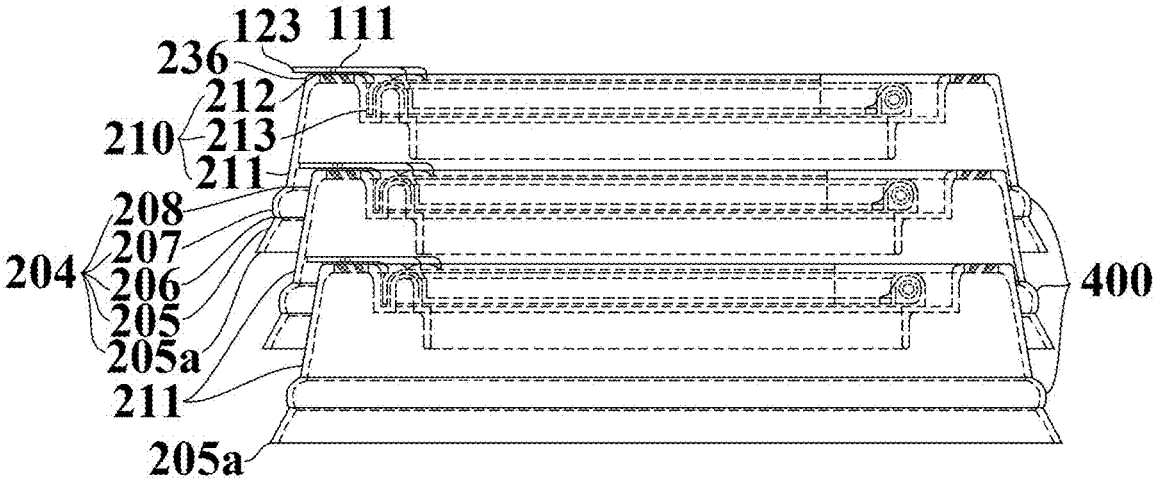
FIG. 22B is a side view section of the dome lid in FIG. 11A shown in a stacking arrangement as seen in FIG. 22A.

In a further preferred embodiment allowing for stacking of dome lids 400, gripping tab 111 projects outwardly from clamping rib arch 120, with curvilinear perimeter front edge 123 extending marginally beyond planar top transition surface outside perimeter edge 236 of planar top transition surface 212 while still remaining within the outside diameter of the outside perimeter free edge 205*a* of bottom flange 205, thereby allowing for the stacking of dome lids 400 in a stable configuration with curvilinear perimeter front edge 123 nested on the inside wall of first outside wall 211 (see FIG. 22B). Gripping tab 111 provides an optional gripping means to lift flat 400 or dome 500 lid in their entirety from a respective nesting stack of dome 400 or flat 500 lids.

There are times when removing a single disposable lid from the top of a stack of disposable lids requires using both hands, one to grasp the top lid, while the opposing hand and fingers hold down the lid below thereby retaining the underlying lids in a stacked configuration. This is not a hygienic option for subsequent customers removing the next lid from a stack of lids as the previous customer may have contaminated the next lid below through hand contact. A preferred embodiment of the present invention is the ability to optionally grasp the curvilinear perimeter front edge 123 of gripping tab 111 by the index finger 403 and thumb 404 of either hand to disengage the top dome lid 400 or flat lid 500 from a stack of lids avoiding using the fingers of the opposing hand to hold down the annular skirt 204, comprised of outside perimeter free edge 205*a* of bottom flange 205, upper 208 and lower 206 furrows, and clamping curvature 207, to retain the underlying lids in a stacking arrangement and avoid potential unhygienic practices through contact with the subsequent underlying lids. Alternatively a digit on either hand may be position under bottom surface 119 of gripping tab 111 to lift it upwards from the underlying lids to subsequently remove the top lid thereby leaving the underlying stack of lids in tact.

While there are benefits offered to the stacking and retrieval of this new two part container lid from a hygienic standpoint when a Barista and/or server is acquiring the lid for clamping to the rolled rim of a container, the advent of the Corona virus disease (COVED-19) around the world has forced a reassessment, and likely a discontinuation of the practice of allowing the customer to optionally customize their beverage with additional condiments after receipt of their grab-and-go, on-the-go beverage and to further acquire a lid for clamping to their beverage container at a self-serve condiment station provided by the fast food outlet. This new invention allows the customer to receive pre-packaged condiments from the Barista and/or server and to add them to their beverage container through recessed hatch opening 227 (see FIG. 16A) when hatch cover part 100 is pivoted to an opened position without the necessity of acquiring and attaching a lid, or the risks associated with disengaging a lid from the container and without having to acquire condiments, utensils and a lid from a self-serve condiment station. Whether or not this is a permanent paradigm shift where the Barista and/or server is optionally now responsible for the entire preparation of the beverage, including adding condiments as well as clamping the lid to a disposable beverage container, will be measured against the successful response to the Corona virus disease (COVED-19).

FIG. 22B is a side view in section of dome lid 400 shown in FIG. 11A, taken substantially along line F-F in FIG. 10, arranged in a stacked configuration, further illustrating the stacking of dome lid 400 in FIG. 22A. The stacking of the cross section shown in FIG. 11A shows first outside wall 211 slanting from planar top transition surface outside perimeter edge 236 outwards where it meets upper furrow 208, thereby allowing for each subsequent dome lid 400 to nest on top of the dome lid 400 below, whereby this widening in the diameter of annular skirt 204, from the planar top transition surface outside perimeter edge 236 downwards to the outside perimeter free edge 205*a*, accommodates ring-shaped crown portion 210 and also curvilinear perimeter front edge 123 portion of gripping tab 111 which extends marginally beyond the planar top transition surface outside perimeter edge 236.

Figure 23A:
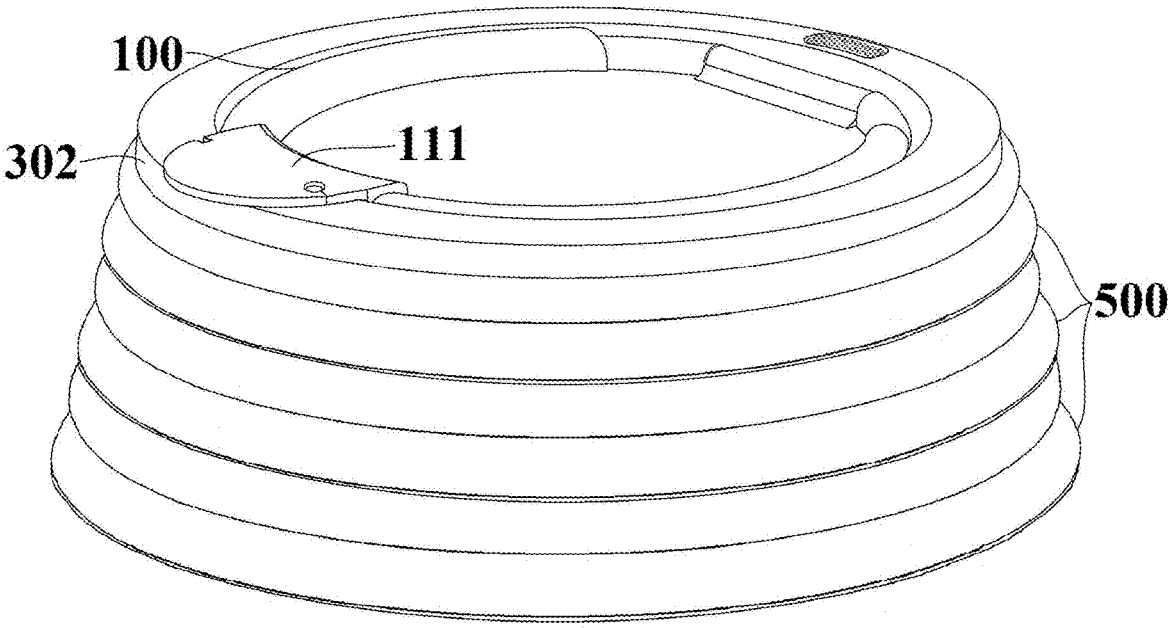
FIG. 23A is a perspective top view of a plurality of flat lids with the hatch part in the fully closed position shown in a stacking arrangement.

FIG. 23A is a perspective view of a plurality of flat lids 500, in accordance with the preferred embodiments of FIG. 9A, with hatch cover part 100 in the fully closed position, where hatch cover part 100 and gripping tab 111 have been designed to allow flat lids 500 to be stacked in a stable configuration one on top of the other for access and space considerations in preparation for use in a manner to that shown for dome lid 400 in FIG. 22A. All the preferred embodiments described for dome lids 400 under FIG. 22A apply to flat lids 500 in FIG. 23A allowing for the nesting of flat lid 500 one on top of the other with the only difference being a variation in height where flat lid 500 is shorter in vertical height due to a vertical reduction in height of first outside wall 211 forming compressed first outside wall 302 compared with the dome lid 400 in FIG. 22A. Hatch cover part 100 and integrated gripping tab 111 have been designed to accommodate stacking.

Figure 23B:
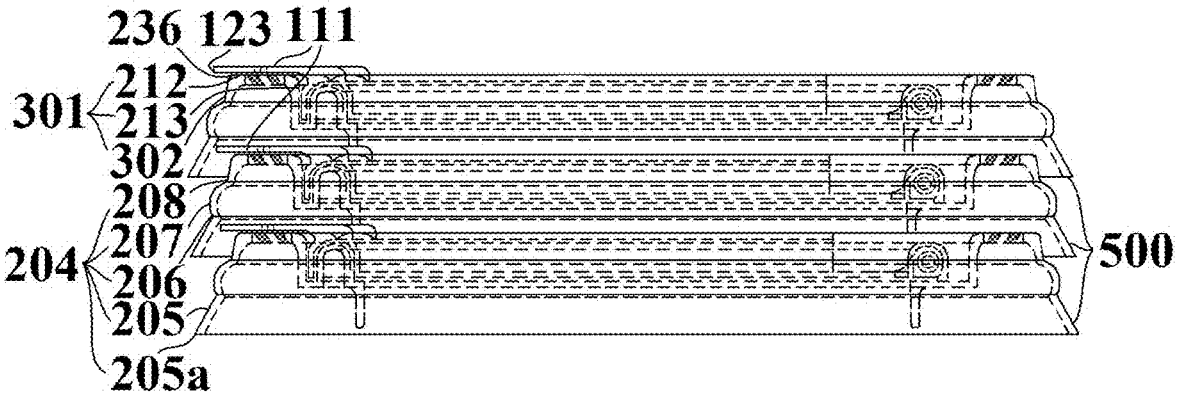
FIG. 23B is a side view in section of the flat lid in FIG. 11G shown in a stacking arrangement as seen in FIG. 23A.

FIG. 23B is a side view in section of flat lid 500 shown in FIG. 11G, taken substantially along line F-F in FIG. 10, arranged in a stacked configuration, further illustrating the stacking of flat lids 500 in FIG. 23A. The stacking of the cross section shown in FIG. 11G shows compressed first outside wall 302 slanting downwards from planar top transition surface outside perimeter edge 236, and outwards, where it meets upper furrow 208, thereby allowing for each subsequent flat lid 500 to nest on top of the flat lid 500 below. This widening in the diameter of annular skirt 204 from the planar top transition surface outside perimeter edge 236 downwards to the outside perimeter free edge 205*a* of bottom flange 205, accommodates compressed ring-shaped crown portion 301, and also the curvilinear perimeter front edge 123 portion of gripping tab 111 which extends marginally beyond the planar top transition surface outside perimeter edge 236.

This new invention expands upon the grab-and-go, on-the-go beverage experience by introducing new disposable dome 400 and flat 500 lid configurations (see FIGS. 8A and 9A) providing access to a beverage 209 within a disposable beverage container 203 in a safe, expeditious manner without requiring the removal of either of these new disposable lids from the rolled rim 201 of the container 203. This new invention arrives as a timely and attractive option to mitigate the impact the Corona virus disease (COVED-19) has had, and future pandemic viruses may have, on the fast food service industry by reducing handling, by the Barista and/or server, during the beverage preparation process. This new invention allows the Barista and/or server the option of pre-clamping this new two part container lid to the rolled rim 201 of a disposable beverage container 203, pouring beverage 209, and subsequently adding condiments, through recessed hatch opening 227 or optionally transferring the customization of the beverage to the customer in a safe manner through recessed hatch opening 227 while the new two part container lid remains clamped to the rolled rim 201 of the container 203. This new invention has the potential to increase beverage throughput, benefiting the fast food outlet and the customer, through the reduction in beverage preparation steps while reducing accidental spills and injury by eliminating the need to clamp a lid to a hot beverage filled disposable container and/or prepare complimentary beverage refills requiring clamping a new disposable lid to a used disposable container rolled rim with a weakened structure.

This new invention allows for dunking a confection 413 (see FIGS. 20A and 20B), such as a biscotto, through the recessed hatch opening 227, accessing the beverage 209, while on-the-go, promoting a more enhanced beverage 209/confection 413 experience for grab-and-go, on-the-go beverage purchasers beyond consuming a beverage from a sealed disposable beverage container while separately consuming a confection. Pivoting hatch cover part 100 (see FIGS. 12, 13, and 16A) to expose the recessed hatch opening 227 in this new invention provides a safe option for dunking a confection into a beverage and resurrects what may historically be the original fast food confection 413, the biscotto, which requires softening through dunking into a beverage 209 to be consumed and which is accomplished when dunked through the recessed hatch opening 227 when the hatch cover part 100 is pivoted to its fully opened position, thereby providing an enhanced beverage 209/confection 413 experience without the aforementioned associated risks and necessary expended time associated with carefully removing a disposable clamped lid from the rolled rim 201 of a disposable container 203 to access the beverage contents. The ability to dunk a confection 413, such as seldom requested biscotto, offers the customer and the fast food outlet, respectively, more purchasing options and more sales options.

As discussed above, this new invention may be manufactured in varying vertical profile heights as demonstrated by dome 400 and flat 500 lid configurations, respectively shown in FIGS. 8A and 9A. This new invention may be horizontally increased or decreased in size by changing the diameter of dome 200 and flat 300 brim mount part, respectively FIGS. 4A and 5A, and the corresponding diameter of hatch cover part 100 (FIG. 1A), such that dome 400 and flat 500 lid configurations may fit different diameter upper end openings for different diameter disposable beverage containers. The preferred embodiments of the present invention, while allowing for a variation in horizontal dimensions, may be suitably adopted for use on disposable containers offered by both grab-and-go fast food establishments and restaurants offering take-out options where such containers offer a wider diameter container top upper end opening for the purposes of carrying grab-and-go hot or cold prepared foods for consumption on-the-go or at another location such as the office, home, table in a food court, park bench, picnic table, or any other area where the customer may stand or sit, hold or rest their on-the-go disposable food container for subsequent consumption of the food contained within.

This variation on this new invention for use with disposable food containers offers the customer another unique means to eat their grab-and-go meal while on-the-go. Eliminating the need to remove the lid to access the food within the container, allowing the customer to pivot the hatch cover part to a fully opened position while holding the disposable food container in one hand and using the necessary utensil to retrieve the food contents through the exposed recessed hatch opening while standing, eating directly from the container without the need of a support surface and without the requirement of managing a separately removed disposable lid. Disposable food containers are also provided to diners in restaurants where uneaten food left over at the end of a meal may be placed in a disposable food container for later consumption by the diner and carried in a bag upon leaving, often referred to as a "doggie bag." The leftovers may be eaten directly from the disposable food container through the reclosable recessed hatch opening when the hatch cover part is pivoted to a fully opened position, reducing the footprint required to consume these restaurant leftovers and grab-and-go purchases. Alternatively, portions of the contents within the food containers can be removed from the reclosable recessed hatch opening and then resealed with the pivoting hatch cover part 100 to retain the temperature of the food within and for subsequent storage of the remaining food within the container.

Dome 400 and flat 500 lid configurations, respectively in FIGS. 8A and 9A, can be suitably adopted for use on larger diameter fast food disposable food containers with some minor variations in design, whereby these minor variations do not constitute a new species. The dome 400 and flat 500 lid configurations are easily adopted for use on different diameter containers by varying the diameter of the respective dome 200 and flat 300 brim mount part, respectively shown in FIGS. 4A and 5A, and corresponding diameter of hatch cover part 100 in FIG. 1A, without affecting a change in design and therefore not introducing another species while keeping the core preferred embodiments of this new invention intact.

Adopting a variation of this new invention by increasing the respective dome 200 and flat 300 brim mount part diameters, and corresponding hatch cover part 100 diameter, for use on larger diameter disposable containers designed to carry foods also recognizes that these grab-and-go fast foods would not be consumed through the first 230 or second 231 drinking access ports on dome 200 or flat 300 brim mount part. Instead, foods served in disposable food containers are consumed with the aid of a utensil such as a spoon or a fork, after the lid has been pried from the disposable food container rolled rim. As there is no longer a functional purpose for the first 230 and second 231 drinking access ports die-cut through the planar top transition surface 212 of ring-shaped crown portion 210 and compressed ring-shaped crown portion 301, respectively, on dome 200 and flat 300 brim mount parts, the equivalent of the planar top transition surface 212 thereby becomes redundant and no longer offers a functional preferred embodiment when this new invention is adopted for use on larger diameter disposable containers designed for carrying hot and cold foods. Consequently, the equivalent of ring-shaped crown portion 210 and compressed ring-shaped crown portion 301, respectively, from dome 200 and flat 300 brim mount parts, can also be removed, further increasing the diameter of the new recessed hatch openings when this new invention is adopted for use on larger diameter disposable containers designed for carrying hot and cold foods. The adoption of this new invention for use on disposable food containers does not introduce another species but merely offers a variation of the present invention for use with disposable food containers. This variation on this new two part container lid invention for use on larger diameter disposable food containers may still be releasably clamped to the rolled rim of a larger diameter disposable food container with a pivoting hatch cover part attached to the top portion of the brim mount part through a detachable hinge, allowing the customer to access the food within the disposable container through a recessed hatch opening, exposed when the hatch cover part is pivoted to its fully opened position, thereby simultaneously eliminating the risks of spills and injuries associated with removing the lid to access the food within the disposable food container. Reference again is made throughout the remainder of this patent application to the upper end rolled rim of disposable food containers as many disposable lids are designed to reversibly clamp to the rolled rim of a disposable container. This again, however, does not preclude other upper end disposable food container rolled rim designs and corresponding disposable lid annular skirt configurations from being adopted or utilized to reversibly clamp a disposable lid to the upper end of a disposable food container, thereby eliminating leaking through this interface and retaining the clamped lid to the disposable food container.

In summary this new invention introduced dome 400 and flat 500 lid configurations, each with the same detachable hinge 401 (see FIGS. 8B, 10 and 10A), connecting centrally positioned hatch cover part 100 to the top portion of respective dome 200 and flat 300 brim mount parts, releasably covering a recessed hatch opening 227 offering access to beverage 209 in disposable beverage container 203 without necessitating the removal of the respective lids, with the only difference being a variation in relative heights and not the introduction of two distinct species. A further variation of this new invention introduces dome 400 and flat 500 lid configurations with an increase in diameter and removal of ring-shaped crown portion 210 and compressed ring-shaped crown portion 301, for sealing grab-and-go disposable food containers, while retaining the same detachable hinge 401 attaching a hatch cover part to the top portion of their respective brim mount parts offering access to the food within the disposable food containers through a recessed hatch opening in the top portion of the respective brim mount parts without necessitating the removal of the lid from the disposable food container rolled rim, and again including the same variation in relative brim mount part heights. This subsequent variation of the aforementioned dome 400 and flat 500 lid configurations for use on wider diameter disposable food containers retains many of the benefits and advantages introduced for this new invention, and will be expanded upon in the following figures detailing the description of this variation on dome 400 and flat 500 lid configurations for use on wider diameter disposable food containers.

Figure 24A:
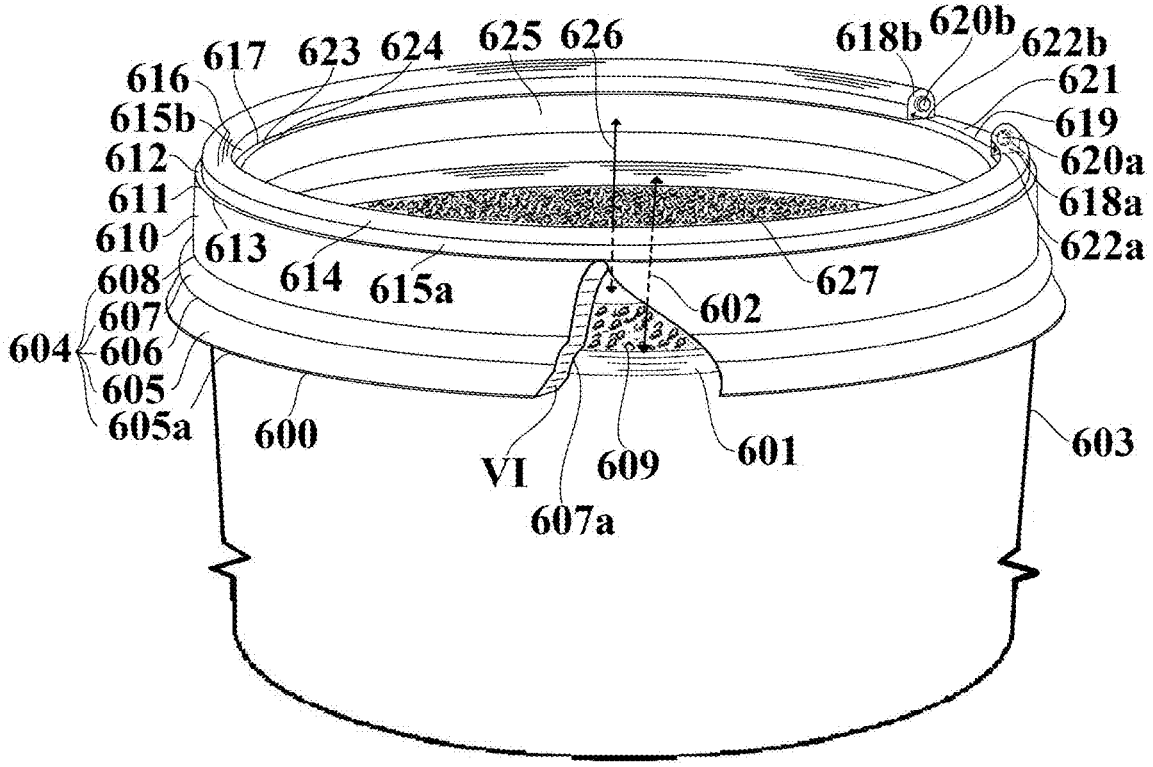
FIG. 24A is a top perspective view of a variation of the dome brim mount part in FIG. 4A, horizontally increased in diameter with the ring-shaped crown portion removed, mounted to the rolled rim of a food container, compressed for ease of illustration.

FIG. 24A is a perspective top view of dome brim mount part 600 where the equivalent of ring-shaped crown portion 210, on dome brim mount part 200 in FIG. 4A, is removed when dome brim mount part 200 has undergone an increase in diameter and is sized to fit over, and reversibly, securely seal to, the rolled rim 601 around the periphery of the upper end opening 602 (solid and phantom lines with double-headed arrows) of disposable food container 603 (compressed for ease of illustration) and made in a suitable manner. Disposable beverage containers 203 are not restricted from what they can carry and may be suitably adopted to carry grab-and-go prepared foods and prepared treats such as ice creams and frozen yogurts, without a disposable lid attached, consumed with a utensil and not through a straw or a drinking access port of a disposable lid covering a disposable container. However, the converse is not true for disposable food containers 603 which are not typically utilized to carry grab-and-go beverages as lids for disposable food containers 603 do not typically include drinking access ports to deliver beverage through the attached lid.

Dome brim mount part 600 comprises an annular configuration to conform to the shape and size of the upper end opening 602 of a disposable food container 603. The base of dome brim mount part 600 is defined by an annular skirt 604 comprised of a perimeter bottom flange 605, with a outside perimeter free edge 605*a* with a lower furrow 606 separating bottom flange 605 from an clamping curvature 607, interposed between lower furrow 606 and an upper furrow 608, clamping curvature 607 is further configured on the inside with an interior sealing curvature 607*a*. A preferred embodiment similar to dome 200 and flat 300 brim mount parts (FIGS. 4A and 5A) is that bottom flange 605 and outside perimeter free edge 605*a* work in combination serving as pilot guide diameter portions to assist in mounting interior sealing curvature 607*a* onto rolled rim 601. A cut-away VI in the annular skirt 604, illustrates how bottom flange 605 and outside perimeter free edge 605*a* cooperatively work as rim-engaging means to guide interior sealing grove 607*a* to clamp to rolled rim 601, reversibly engaging dome brim mount part 600 onto rolled rim 601 in a mutually reversible non-permanent relatable locking relationship. Interior sealing curvature 607*a* clamps dome brim mount part 600 safely and reliably to rolled rim 601 without the risk that dome brim mount part 600 may become inadvertently detached from disposable food container 603, thereby reducing pop-off incidents and providing a more secure lid fit, reducing leakage of food 609 at the interface between dome brim mount part 600 and rolled rim 601.

In another preferred embodiment of this variation on this new invention, following an increase in the diameter of dome brim mount part 200 to form dome brim mount part 600, is the removal of the equivalent of planar top transition surface 212 and second outside wall 213 of ring-shaped crown portion 210 configured in dome brim mount part 200 in FIG. 4A, while retaining the equivalent of first outside wall 211, which, with the increased diameter, becomes outside wall 610. Outside wall 610 is disposed upwardly from upper furrow 608 to outside perimeter edge 611. An outside annular exterior rim 612 forms inwardly from outside perimeter edge 611 a short distance stopping at bottom furrow 613 at the base of retaining rib 614 first outside wall 615*a*. retaining rib first outside wall 615*a* height is the same as the height of retaining rib first outside wall 221*a* in FIG. 4A and continues upwards forming a retaining rib arch 616. The opposite side of retaining rib arch 616 turns downward forming retaining rib second outside wall 615*b* terminating at retaining rib second outside wall bottom furrow 617.

Although retaining rib 614 has a larger circumference compared with retaining rib 214 in FIG. 6, retaining rib 614 retains the symmetrical truncations forming opposing retaining rib end walls 618*a* (phantom and solid lines) and 618*b*, separated by interposed first gap 619 (solid line with double headed arrows). End walls 618*a* and 618*b* also reproduce the respective vertical support surfaces whereby two opposing partially spherical protrusions 620*a* (phantom lines) and 620*b* are centrally moulded to, and extend horizontally therefrom, and represent the hinge part of a detachable hinge first introduced in FIG. 4A for dome brim mount part 200. An interposed planar transition panel 621 further defines first gap 619 and is blended in part to outside annular exterior rim 612, disposed from outside perimeter edge 611 at the top of outside wall 610 and is horizontally inwardly dependent therefrom extending past retaining rib first outside wall 615*a* and contiguous to opposing retaining rib end wall bottom furrows 622*a* (phantom lines) and 622*b*, respectively, at the base of retaining rib end walls 618*a* and 618*b*. Planar transition panel 621, may be configured with an optional downward slope, extending beyond retaining rib second outside wall 615*b* and is further contiguous to retaining rib second outside wall bottom furrow 617 wherein planar transition panel 621 blends in part into inside annular interior rim 623 where inside annular interior rim 623 encircles the inside perimeter of retaining rib second outside wall bottom furrow 617. This is similar to a annular interior rim 224 encircling inside perimeter of retaining rib second outside wall bottom furrow 223 in FIG. 4A for dome brim mount part 200. retaining rib second outside wall bottom furrow 617 separates retaining rib second outside wall 615*b* from inside annular interior rim 623. Inside annular interior rim 623 provides the same described support surface as an annular interior rim 224 shown in FIG. 4A for hatch cover part 100 clamping rib base 121*b* when hatch cover part 100 is in the fully closed position in FIG. 8A and will be discussed further under FIG. 34D. Inside annular interior rim 623 terminates at inside ledge perimeter edge 624 where anti-splash/spill apron 625 (introduced in FIG. 4B as anti-splash/spill apron 225) is also optionally retained, disposed downwardly from inside ledge perimeter edge 624 forming a circumscribing interior wall denoting recessed hatch opening 626 (solid and phantom lines with double-headed arrows) with an increased diameter compared with recessed hatch opening 227 in FIG. 4A. Anti-splash/spill apron 625 forms a partial peripheral barrier above rolled rim 601 of disposable food container 603 and continues to function and offer the same preferred embodiments as described for anti-splash/spill apron 225 on dome brim mount part 200 in FIG. 4A, which is to disrupt side-to-side wave-action at food surface plane 627 (see also FIG. 27A) from food 609 rising upwards during transport of disposable food container 603 and splashing or spilling through recessed hatch opening 626.

Figure 24B:
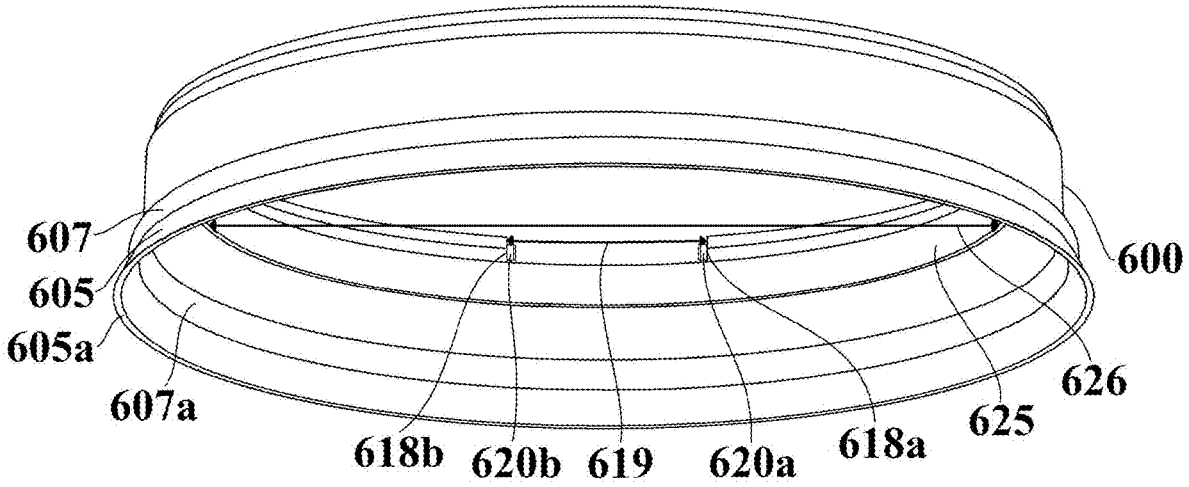
FIG. 24B is a bottom perspective view of the dome brim mount part in FIG. 24A.

FIG. 24B is a perspective bottom view of dome brim mount part 600 in FIG. 24A where the equivalent of ring-shaped crown portion 210, on dome brim mount part 200 in FIG. 4A, has been removed from dome brim mount part 600. Anti-splash/spill apron 625 circumscribes recessed hatch opening 626 (solid with double-headed arrows) with first gap 619 (solid line with double headed arrows) interposed between end walls 618*a* and 618*b* forming respective vertical support surfaces whereby two opposing partially spherical protrusions 620*a* and 620*b* are centrally moulded and extend horizontally outwards therefrom into first gap 619. Interior sealing curvature 607*a* is shown on the inside of side horizontal rib 607. Outside perimeter free edge 605*a* works in combination with bottom flange 605 as rim engaging means to guide interior sealing curvature 607*a* over rolled rim 601 (see FIG. 24A) in a similar manner as discussed under FIG. 8A.

Figure 25A:
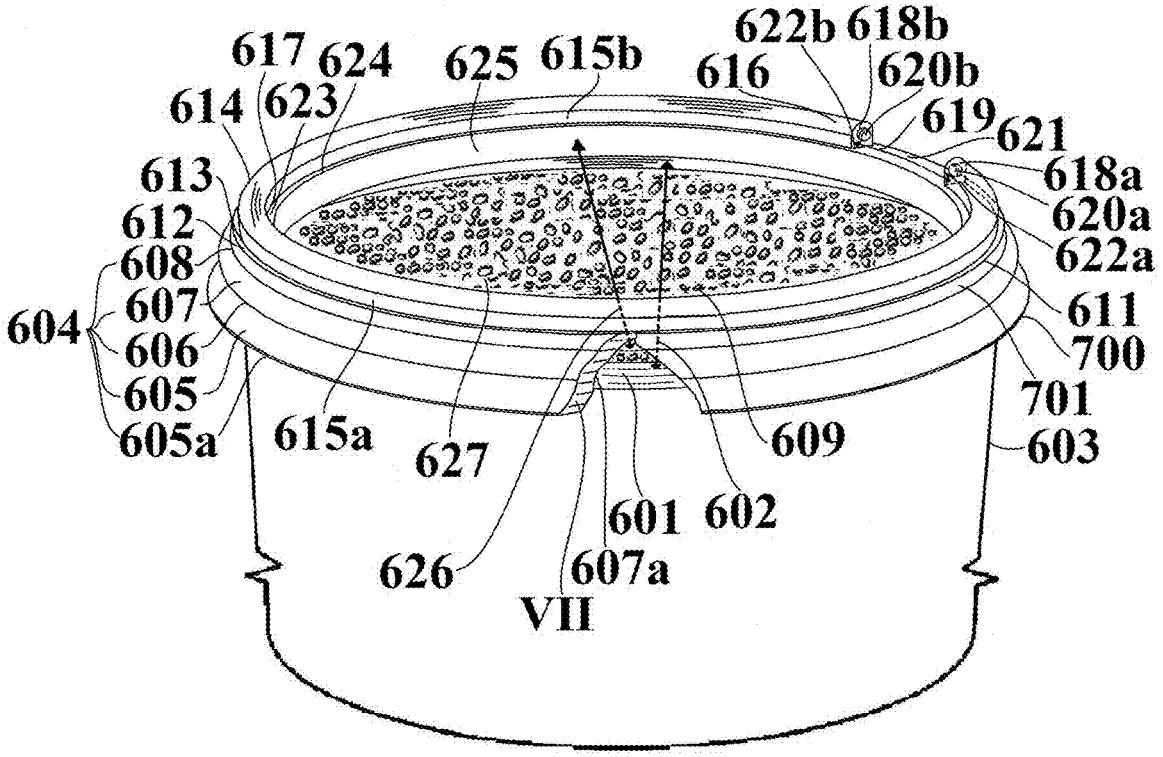
FIG. 25A is a top perspective view of a variation of the flat brim mount part in FIG. 5A, horizontally increased in diameter, with the ring-shaped crown portion removed, mounted to the rolled rim of a food container, compressed for ease of illustration.

FIG. 25A is a perspective top view of flat brim mount part 700 formed when the equivalent of compressed ring-shaped crown portion 301, on flat brim mount part 300 in FIG. 5A, is removed followed by flat brim mount part 300 undergoing an increase in diameter, sized to fit over, and reversibly, securely seal to, the rolled rim 601 around the periphery of the upper end opening 602 (solid and phantom line with double-headed arrows) of a disposable food container 603 (compressed for ease of illustration) made in a suitable manner.

Flat brim mount part 700 comprises an annular configuration to conform to the shape and size of the upper end opening 602 of a disposable food container 603 with the same annular skirt 604 comprised of a perimeter bottom flange 605, with an outside perimeter free edge 605*a*, as described for dome brim mount part 600 in FIG. 24A, with a lower furrow 606 separating bottom flange 605 from an outside clamping curvature 607, interposed between lower furrow 606 and an upper furrow 608. Clamping curvature 607 is further configured on the inside with an interior sealing curvature 607*a*. Bottom flange 605 and outside perimeter free edge 605*a* guide interior sealing curvature 607*a* onto rolled rim 601 for interior sealing curvature 607*a* to clamp flat brim mount part 700 safely and reliably to rolled rim 601. Flat brim mount part 700 includes the same preferred embodiments described for dome brim mount part 600 in FIG. 24A related to its reversible non-permanent releasable locking relationship with rolled rim 601 as captured in cut-away VI (FIG. 24A) and reproduced in cut-away VII in FIG. 25A.

In preferred embodiment of this variation on this new invention, following an increase in the diameter of flat brim mount part 300 to form flat brim mount part 700, the equivalent of compressed ring-shaped crown portion 301, configured to flat brim mount part 300 in FIG. 5A, is removed, while retaining compressed first outside wall 302, which, with the increased diameter, becomes compressed outside wall 701. Compressed outside wall 701 is upwardly dependent from upper furrow 608 to outside perimeter edge 611. An outside annular exterior rim 612 forms inwardly from outside perimeter edge 611 a short distance stopping at bottom furrow 613 at the base of retaining rib 614 first outside wall 615*a*. Retaining rib first outside wall 615*a* height is the same as the height of retaining rib first outside wall 221*a* in FIG. 5A and continues upwards forming a retaining rib arch 616. The opposite side of retaining rib arch 616 turns downward forming retaining rib second outside wall 615*b* terminating at retaining rib second outside wall bottom furrow 617.

Compressed outside wall 701 is the only difference between dome brim mount part 600 and flat brim mount part 700. Flat brim mount part 700 retains the preferred embodiments described in FIG. 24A for dome brim mount part 600 including retaining rib 614 with corresponding diameter and symmetrical opposing end walls 618*a* (phantom lines) and 618*b* providing vertical support surfaces for opposing partially spherical protrusions 620*a* (phantom lines) and 620*b*, representing the male hinge part of the detachable hinge 401 and separated by first gap 619 (solid line with double-headed arrows). An interposed planar transition panel 621, further defining first gap 619, is blended in part to outside annular exterior rim 612, disposed from outside perimeter edge 611 at the top of compressed outside wall 701 and is horizontally inwardly dependent therefrom extending past retaining rib first outside wall 615*a* and contiguous to opposing retaining rib end wall bottom furrows 622*a* (phantom lines) and 622*b*, respectively, at the base of retaining rib end walls 618*a* and 618*b*, wherein planar transition panel 621 further extends beyond retaining rib second outside wall 615*b* blending into inside annular interior rim 623, which circumscribes the inside perimeter of retaining rib second outside wall bottom furrow 617. Inside annular interior rim 623 terminates at inside ledge perimeter edge 624 where anti-splash/spill apron 625 is optionally added, forming a downwardly dependent wall circumscribing recessed hatch opening 626 (solid and phantom line with double-headed arrows). Anti-splash/spill apron 625 is brought into closer contact with food surface plane 627 to better disrupt side-to-side wave-action at food surface plane 627 (see also FIG. 27C) from food 609 rising upwards during transport of disposable food container 603 and splashing or spilling through recessed hatch opening 626.

Figure 25B:
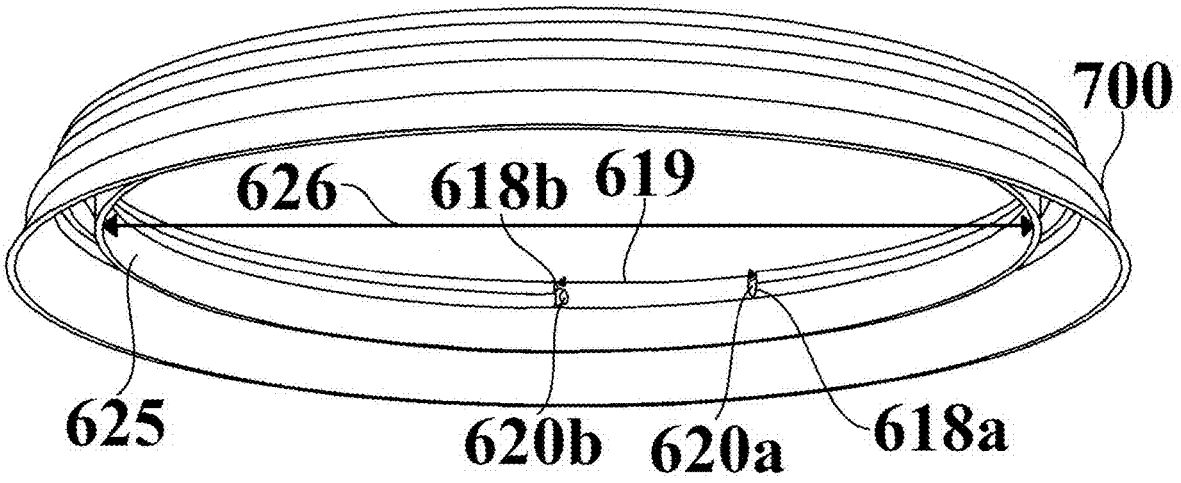
FIG. 25B is a bottom perspective view of the flat brim mount part in FIG. 25A.

FIG. 25B is a perspective bottom view of flat brim mount part 700 in FIG. 25A showing anti-splash/spill apron 625 circumscribing recessed hatch opening 626 (solid line with double-headed arrows) from the reverse side first gap 619 is interposed between end walls 618*a* and 618*b* which in turn provide vertical support surfaces for opposing partially spherical protrusions 620*a* and 620*b*, centrally moulded to, and extend horizontally therefrom, representing the male hinge part of a detachable hinge 401.

Figure 26:
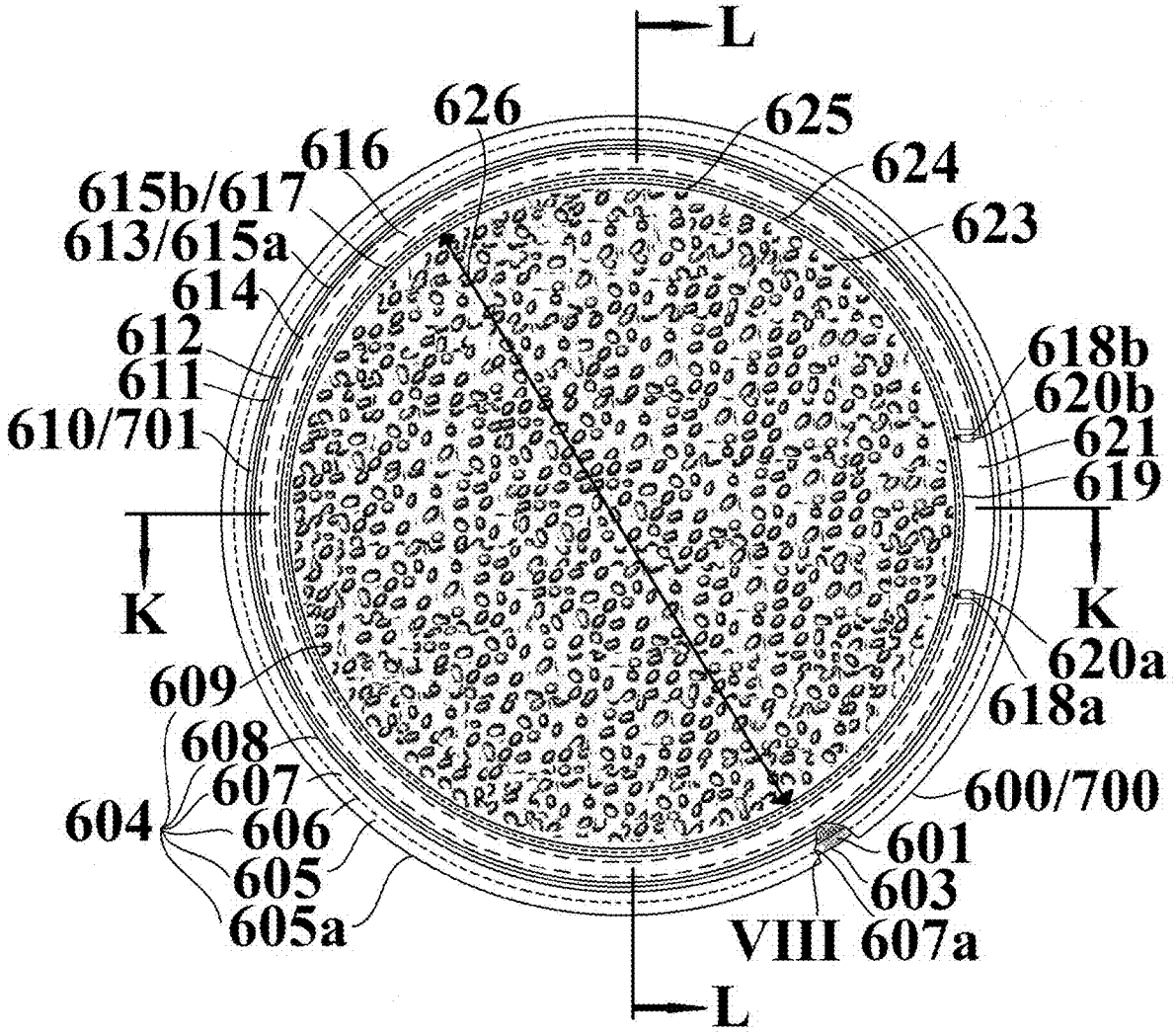
FIG. 26 is a top plan view representing both the dome and flat brim mount parts in FIGS. 24A and 25A, respectively, with the ring-shaped crown portion removed.

FIG. 26 is a top plan view representing dome brim mount part 600 in FIG. 24A and flat brim mount part 700 in FIG. 25A with the equivalent of ring-shaped crown portion 210 and compressed ring-shaped crown portion 301, respectively, removed and replaced with retaining rib 614, which has undergone an increase in diameter in accordance with the increase in the horizontal size of dome brim mount part 600 and flat brim mount part 700 to fit larger diameter disposable food container 603 upper end opening 602 (see FIGS. 24A and 25A) representing a variation, respectively, in dome brim mount part 200 and flat brim mount part 300. Outside wall 610 and compressed outside wall 701, respectively, are not distinguishable in this plan view. The removal of the ring-shaped crown portions further increases the diameter of recessed hatch opening 626 (solid line with double-headed arrows), on dome brim mount part 600 and flat brim mount part 700. With the ring-shaped crown portions removed some of the other preferred embodiments have undergone minor changes as well to correspond to this variation in dome brim mount part 600 and flat brim mount part 700.

Cut-away VIII discloses annular skirt 604 bottom flange 605 and outside perimeter free edge 605*a* acting as pilot guide diameter portions cooperative engaging interior sealing curvature 607*a* to slide over, and frictionally clamp to rolled rim 601 of disposable food container 603 in a relatable non-permanent manner, reversibly clamping dome 600 and flat 700 brim mount parts to rolled rim 601 of disposable food container 603 similar to that shown in FIG. 6. Moving along bisecting line K-K from left to right we see clamping curvature 607 interposed between lower furrow 606 (phantom lines) and upper furrow 608 completing the formation of annular skirt 604. Outside wall 610 and compressed outside wall 701 are upwardly disposed from upper furrow 608 terminating at outside perimeter edge 611. Inwardly disposed from outside perimeter edge 611 is a narrow outside annular exterior rim 612 terminating at first outside wall bottom furrow 613 (see FIG. 27A) of retaining rib 614 first outside wall 615*a*, wherein first outside wall 615*a* and first outside wall bottom furrow 613 are not distinguishable in this plan view. Retaining rib first outside wall 615*a* is upwardly disposed from retaining rib first outside wall bottom furrow 613, terminating on one side of retaining rib arch 616 (also see FIG. 27A). On the opposite side of retaining rib arch 616, retaining rib second outside wall 615*b* is downwardly disposed terminating at retaining rib second outside wall bottom wall furrow 617 (see FIG. 27A), wherein second outside wall bottom wall furrow 617 and second outside wall 615*b* are also not distinguishable in this plan view. A second narrow inside annular interior rim 623 is disposed inwardly from retaining rib second outside wall bottom furrow 617 terminating at inside ledge perimeter edge 624. Anti-splash/spill apron 625 (solid and phantom lines) may be optionally introduced below inside annular interior rim 623 circumscribing recessed hatch opening 626, wherein anti-splash/spill apron 625 again assists in reducing wave-action causing sloshing of food 609 from splashing upwards through recessed hatch opening 626.

The equivalent of planar transition panel 621 is no longer bounded on one side by the second outside wall 213 of ring-shaped crown portion 210 and compressed ring-shaped crown portion 301 as seen respectively in FIGS. 4A and 5A and instead is open on two opposing ends, where planar transition panel 621 is inwardly disposed from outside perimeter edge 611, blended in part to outside annular exterior rim 612 and inside a annular interior rim 623, terminating at inside ledge perimeter edge 624. First gap 619 (solid line with double-headed arrows) is more clearly defined between end walls 618*a* and 618*b*. Opposing partially spherical protrusions 620*a* and 620*b*, extend horizontally outward respectively from their centrally positioned locations on the end walls 618*a* and 618*b*, forming the male hinge part of a the detachable hinge 401.

Figure 27A:
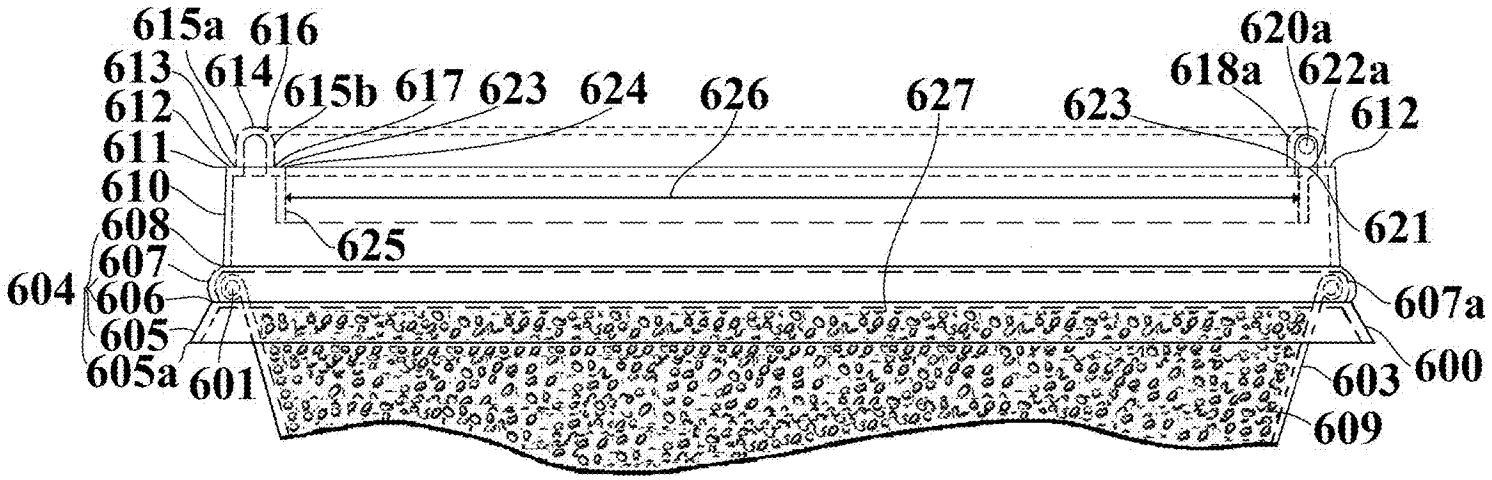
FIG. 27A is a side view in section of the dome brim mount part taken substantially along line K-K in FIG. 26.

FIG. 27A is a side view in section of dome brim mount part 600 taken substantially along line K-K in FIG. 26. Annular skirt 604, remains unchanged when compared with annular skirt 204 in FIGS. 4A and 5A, except for an increase in diameter to fit the rolled rim 601 of disposable food containers 603 (compressed for ease of illustration), and is further comprised of outside perimeter free edge 605*a* contiguous to bottom flange 605 (phantom and solid lines), clamping curvature 607 with interior sealing curvature 607*a* (phantom and solid lines) on the opposite side and positioned between lower furrow 606 and upper furrow 608. Outside perimeter free edge 605*a* and bottom flange 605 (phantom and solid lines) serve as a pilot guide diameter portions assisting in sliding clamping interior sealing curvature 607*a* onto rolled rim 601 forming a non-permanent, reversible frictional clamping fitment retaining dome brim mount part 600 on disposable food container 603 (compressed for ease of illustration) rolled rim 601 thereby preventing leakage of food 609 at the interface between dome brim mount part 600 and rolled rim 601.

Outside wall 610 is disposed upwards from upper furrow 608 and retains the height of first outside wall 211 shown in FIG. 7A to account for the dome shape of dome brim mount part 600. Outside wall 610 terminates at outside perimeter edge 611 whereby outside annular exterior rim 612 is disposed inwardly from outside perimeter edge 611 terminating at retaining rib first outside wall bottom furrow 613. Narrow outside annular exterior rim 612 and narrow inside annular interior rim 623 are necessary to provide support, respectively, for clamping rib first outside wall 804*a*/locking channel first inside wall 802*a* base 816*a* and clamping rib second outside wall 804*b*/locking channel second inside wall 802*b* base 816*b* of hatch cover part 800 and will be further discussed under FIG. 34D. Retaining rib 614 is comprised of retaining rib first outside wall 615*a*, disposed vertically upwards from retaining rib first outside wall bottom furrow 613, where it continues into retaining rib arch 616. On the opposite side of retaining rib arch 616, retaining rib second outside wall 615*b* is vertically downwardly dependent stopping at retaining rib second outside wall bottom furrow 617, whereby a narrow inside annular interior rim 623 is inwardly disposed therefrom terminating at inside ledge perimeter edge 624. Anti-splash/spill apron 625 is downwardly disposed from inside ledge perimeter edge 624 and forms a wall circumscribing recessed hatch opening 626 (solid line with double-headed arrows) therein. Anti-splash/spill apron 625 disrupts side-to-side wave-action at the food surface plane 627, reducing food upwardly splashing through recessed hatch opening 626. This variation on dome brim mount part 200 removes ring-shaped crown portion 210 and increases the diameter of retaining rib 214 in plan view FIG. 6, thereby forming new retaining rib 614.

Planar transition panel 621 is blended in part to outside annular exterior rim 612 and inside annular interior rim 623. Because of the annular formation of dome brim mount part 600 and its respective parts, planar transition panel 621 appears to be horizontally narrower, however, this is not the case when observing planar transition panel 621 in plan view in FIG. 26. Planar transition panel 621 is contiguous to retaining rib end wall bottom furrows 622*a* and 622*b* (622*b* not shown). End walls 618*a* and 618*b* (618*b* not shown) provide a vertical surface for centrally positioned, horizontally extending opposing partially spherical protrusions 620*a* and 620*b* (620*b* not shown), representing the male hinge part of a detachable hinge 401.

Figure 27B:
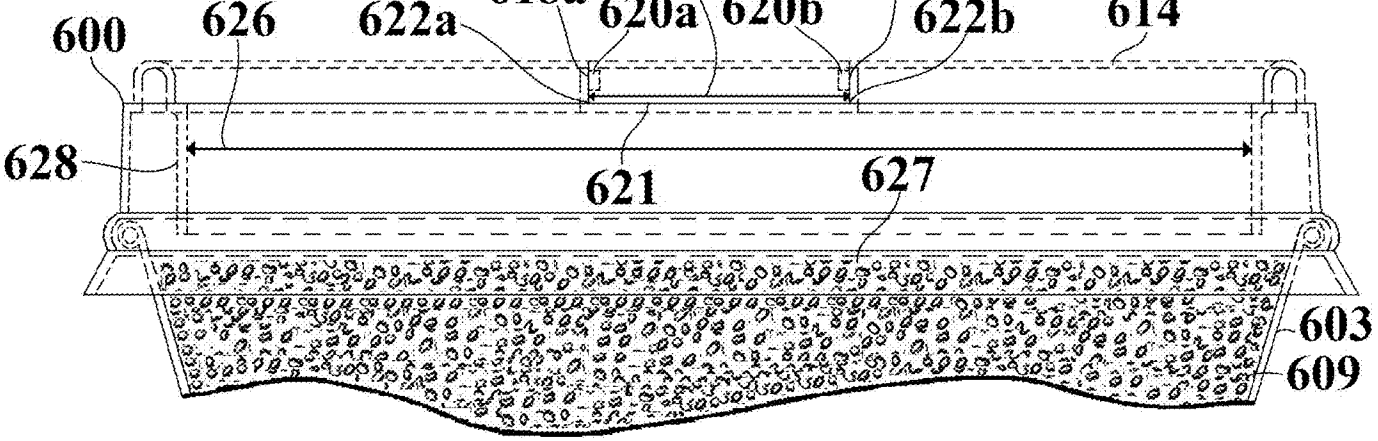
FIG. 27B is a side view in section of the dome brim mount part taken substantially along line L-L in FIG. 26.

FIG. 27B is a side view in section of dome brim mount part 600 taken substantially along line L-L in FIG. 26, showing a variation of the anti-splash/spill apron 625 described in FIG. 27A, where the vertical height of anti-splash/spill apron 625 (phantom lines) has been extended to create new extended anti-splash/spill apron 628 (phantom lines) which is disposed downwardly making contact with, and possibly submerging below, food surface plane 627, depending on the height of food 609 in disposable food container 603. This optional extended anti-splash/spill apron 628 (phantom lines) is designed to increase the effectiveness in dampening wave-action causing side-to-side sloshing of foods 609 from moving into the area below recessed hatch opening 626 (solid line with double-headed arrows) and possibly splashing upwards and is similar to extended anti-splash/spill apron 225*c* in FIG. 7E for dome brim mount part 200.

First gap 619 (solid line with double-headed arrows) is formed a result of the symmetrical termination of retaining rib 614 creating end walls 618*a* and 618*b* providing respective vertical supporting surfaces for opposing partially spherical protrusions 620*a* and 620*b*, extending horizontally outwards therefrom, representing the male hinge part of the detachable hinge 401. Planar transition panel 621 is positioned between, and contiguous to, retaining rib end wall bottom furrows 622*a* and 622*b*. First gap 619 is the space created to receive the female hinge part (described in FIG. 28A) of detachable hinge 401 as discussed under FIGS. 31A and 31B.

Figure 27C:
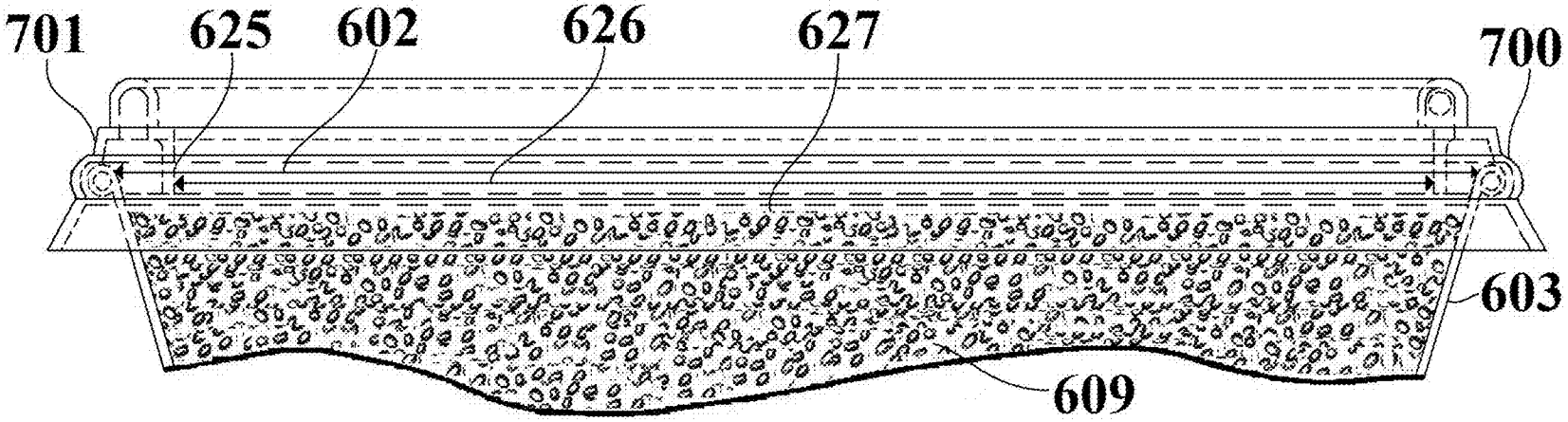
FIG. 27C is a side view in section of the flat brim mount part taken substantially along line K-K in FIG. 26.

FIG. 27C is a side view in section of flat brim mount part 700 taken substantially along line K-K in FIG. 26. All the preferred embodiments described in FIG. 27A are captured in FIG. 27C with one difference regarding the height of outside wall 610 which is compressed in FIG. 27C forming compressed outside wall 701. A preferred embodiment of flat brim mount part 700 is that compressed outside wall 701 brings recessed hatch opening 626 (solid line with double-headed arrows) into closer proximity to food surface plane 627 thereby reducing the vertical distance between recessed hatch opening 626 and food surface plane 627 offering closer utensil access to food 609 within disposable food container 603.

Another preferred embodiment of flat brim mount part 700 is the lowering of anti-splash/spill apron 625 into a closer proximity to food surface plane 627 where anti-splash/spill apron 625 may become submerged below food surface plane 627. While the vertical height dimension of anti-splash/spill apron 625 is unchanged between dome brim mount part 600 and flat brim mount part 700, its effectiveness in blocking and dampening wave-action causing side-to-side sloshing of food 609 resulting from sudden or random movements to disposable food container 603 has increased due to its closer proximity to food surface plane 627, thereby further reducing food 609 from using the full area of upper end opening 602 (solid line with double-headed arrows) of disposable food container 603 to build side-to-side momentum, which may result in food 609 splashing and/or spilling upwards through recessed hatch opening 626 (double-headed arrows).

Figure 27D:
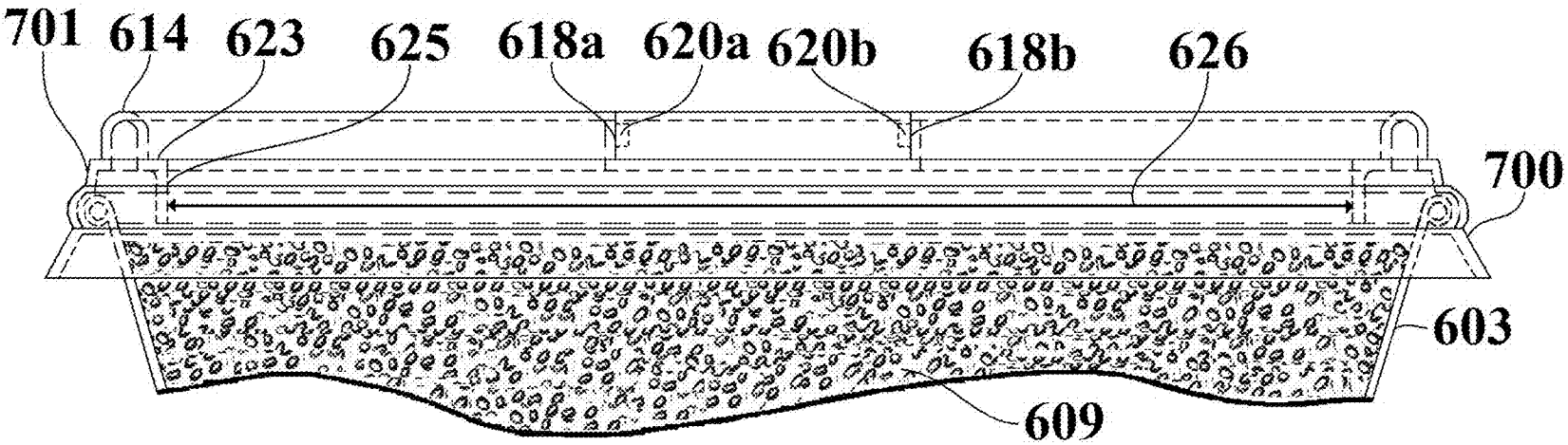
FIG. 27D is a side view in section of the flat brim mount part taken substantially along line L-L in FIG. 26.

FIG. 27D is a side view in section of flat brim mount part 700 taken substantially along line L-L in FIG. 26. All the preferred embodiments described in FIG. 27B, with the exception of optionally extended anti-splash/spill apron 628, and outside wall 610, which is replaced with compressed outside wall 701, are captured in FIG. 27D. The opposing partially spherical protrusions 620*a* and 620*b*, representing the male hinge part of the detachable hinge and centrally extending horizontally outwards from retaining rib end walls 618*a* and 618*b*, are reproduced in FIG. 27D.

The removal of the equivalent of ring-shaped crown portion 210 is replaced with wider diameter retaining rib 614 for dome brim mount part 600 and flat brim mount part 700, thereby increasing the diameter of inside annular interior rim 623, anti-splash/spill apron 625 wall, and recessed hatch opening 626 (solid line with double-headed arrows), respectively. The increase in the diameter of recessed hatch opening 626 (solid line with double-headed arrows) offers an increased area to accommodate the addition of condiments and a wider variety of accompanying foods which might be added to, or dipped into, the main food 609 within disposable food container 603. The increased diameter of recessed hatch opening 626 provides even wider access and maneuverability when using utensils to retrieve food 609 within disposable food container 603.

Figure 28A:
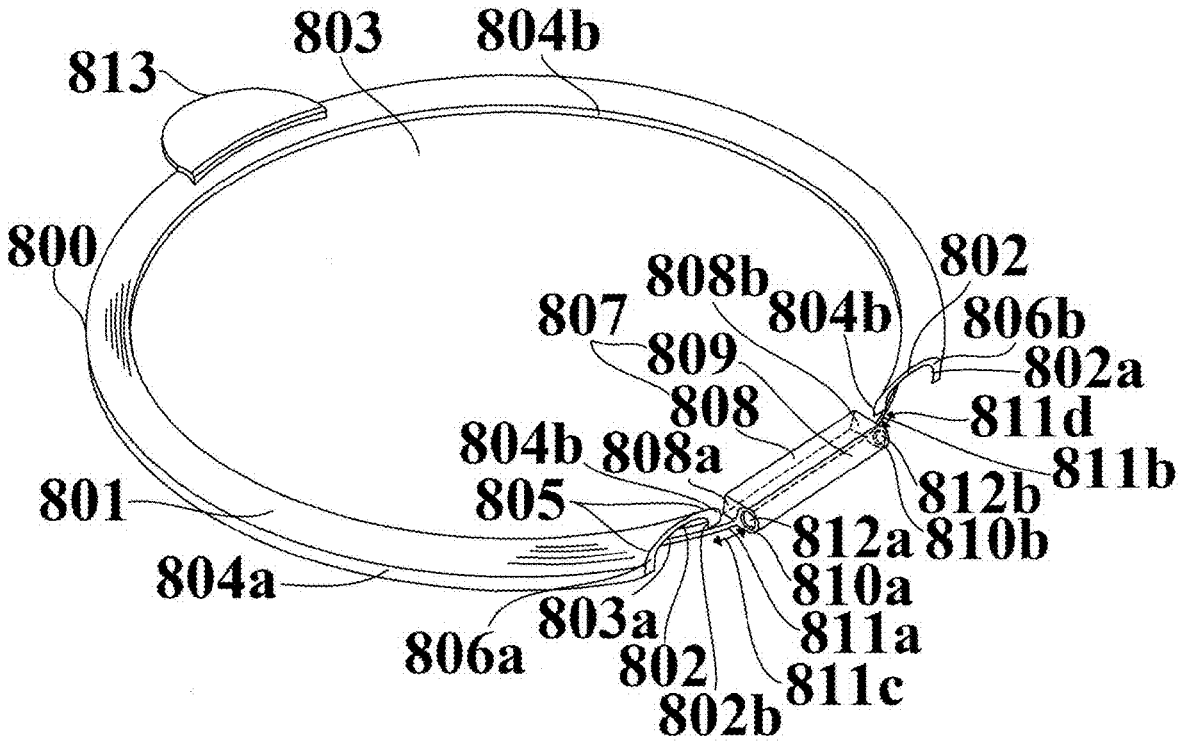
FIG. 28A is a perspective top view of a variation of the hatch cover part in FIG. 1A, horizontally increased in diameter, corresponding to the wider diameter dome and flat brim mount parts in FIGS. 24A and 25A, respectively.

FIG. 28A is a perspective top view of hatch cover part 800 with a substantially annular perimeter raised outer clamping rib 801 and locking channel 802 therein, substantially circumscribing a recessed top wall 803. Hatch cover part 800 captures many of the preferred embodiments described for hatch cover part 100 in FIGS. 1A and 1*s* a variation on hatch cover part 100 whereby hatch cover part 800 is larger in diameter to frictionally fit retaining rib 614 for dome brim mount part 600 and flat brim mount part 700 and will be further discussed under FIGS. 32 and 33.

Clamping rib 801/locking channel 802 are comprised of clamping rib first outside wall 804*a*/locking channel first inside wall 802*a* and clamping rib second outside wall 804*b*/locking channel second inside wall 802*b*. Clamping rib arch 805 joins the tops of the two respective clamping rib 801/locking channel 802 walls, completing the formation of clamping rib 801/locking channel 802. Clamping rib 801/locking channel 802 is symmetrically severed creating two opposing open ends 806*a* and 806*b*. Interposed between open ends 806*a* and 806*b* is cylindrical r housing 807 comprised of a rectangular front is block 808, disposed upwards from, and joined to, recessed top wall 803. Cylinder 809 is disposed from the rear of a rectangular frontis block 808 and is partially attached to, and extends beyond top wall perimeter edge 803*a* of recessed top wall 803. Cylinder 809 is further comprised of two opposing cylinder end walls 810*a* and 810*b* (phantom and solid lines). Unlike clamping rib 101/locking channel 102 for hatch cover part 100 in FIG. 1A, clamping rib 801/locking channel 802 for hatch cover part 800 is not severed further back from the respective rectangular frontis block end walls 808*a* and 808*b* and therefore segments 109*a* and 109*b* for hatch cover part 100 in FIG. 1A are replaced with segments 811*a* and 811*b* with much shorter respective segment arc lengths 811*c* and 811*d* (curved line with double-headed opposing arrows), disposed between respective rectangular frontis block end walls 808*a* and 808*b* and open ends 806*a* and 806*b* (also see FIG. 33A). The two symmetrically opposing open ends 806*a* and 806*b* terminate with the opposing ends of clamping rib second outside wall 804*b*/locking channel second inside wall 802*b* intimately closer to, but not touching, the opposing frontis block end walls 808*a* and 808*b* of rectangular frontis block 808, thereby leaving two symmetrical recessed top wall perimeters edges 803*a* on either side uncovered thereby forming small segments 811*a* and 811*b* (also see FIG. 33A). This is due to the removal of the equivalent of ring-shaped crown portion 210 from dome brim mount part 600 and flat brim mount part 700 and will be further explained under FIGS. 36 and 37.

Figure 31A:
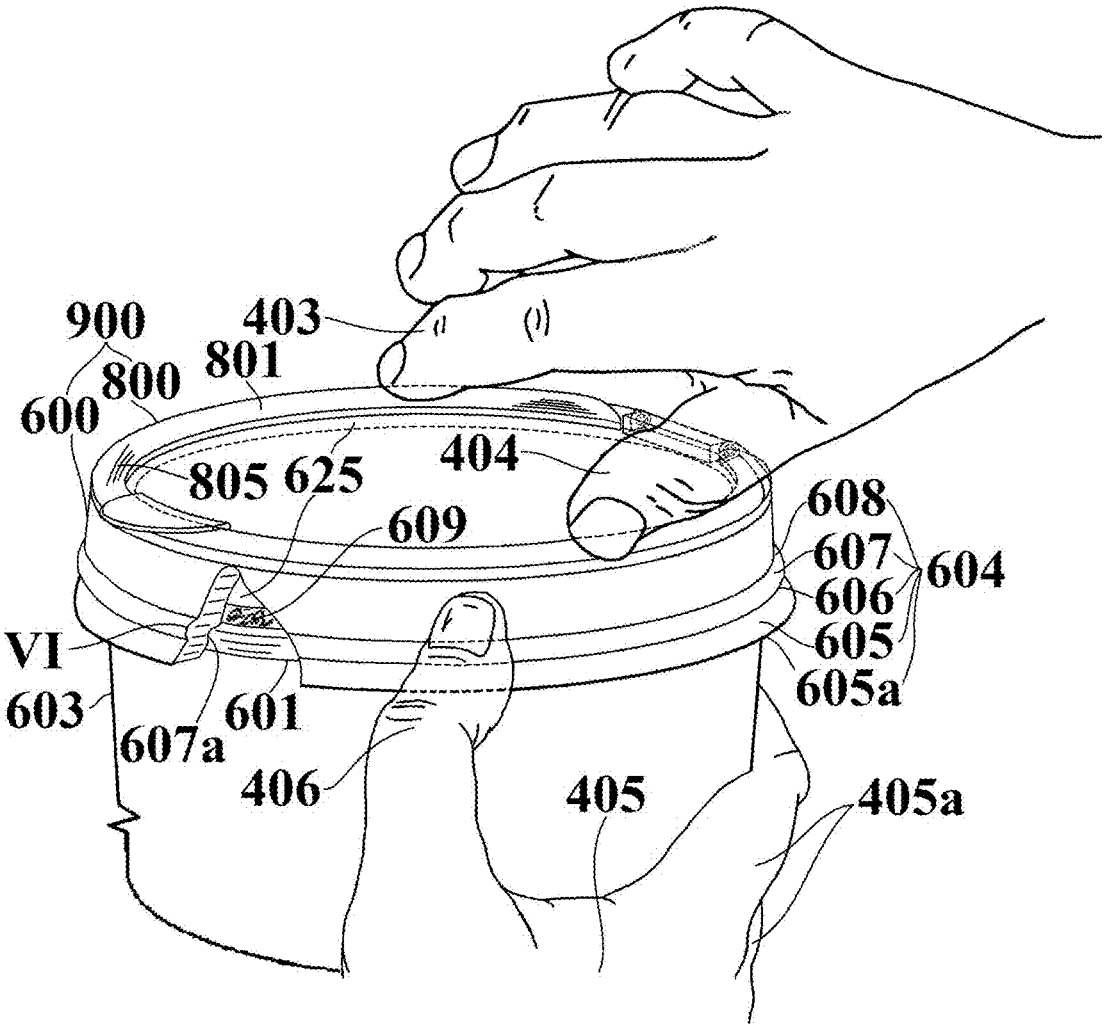
FIG. 31A is a perspective top view of the hatch cover part (see FIG. 28A) in a fully closed position attached to the dome brim mount part (see FIG. 24A), mounted to the rolled rim of a food container, compressed for ease of illustration, thereby forming the dome lid configuration, a variation of the dome lid configuration in FIG. 8A.
Figure 31B:
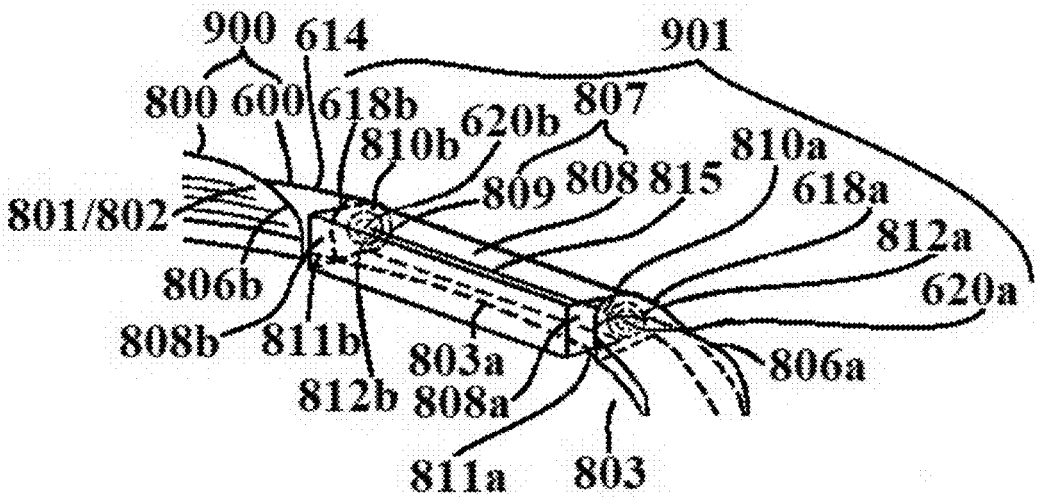
FIG. 31B is a partial perspective view on a larger scale of a portion of FIG. 31A.
Figure 33:
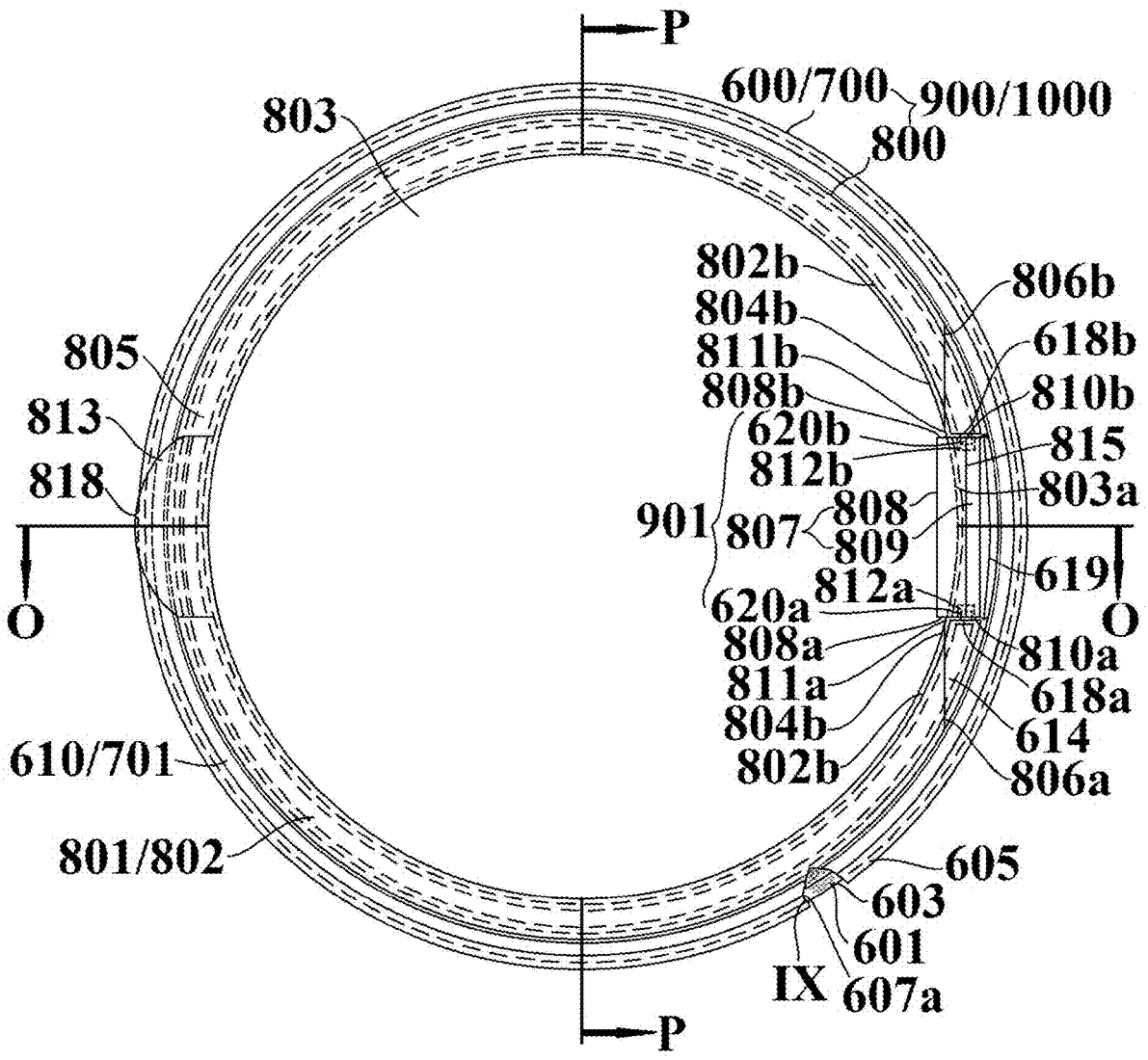
FIG. 33 is a top plan view representing both the dome and flat lid configurations in FIGS. 31A and 32, respectively.
Figure 33A:
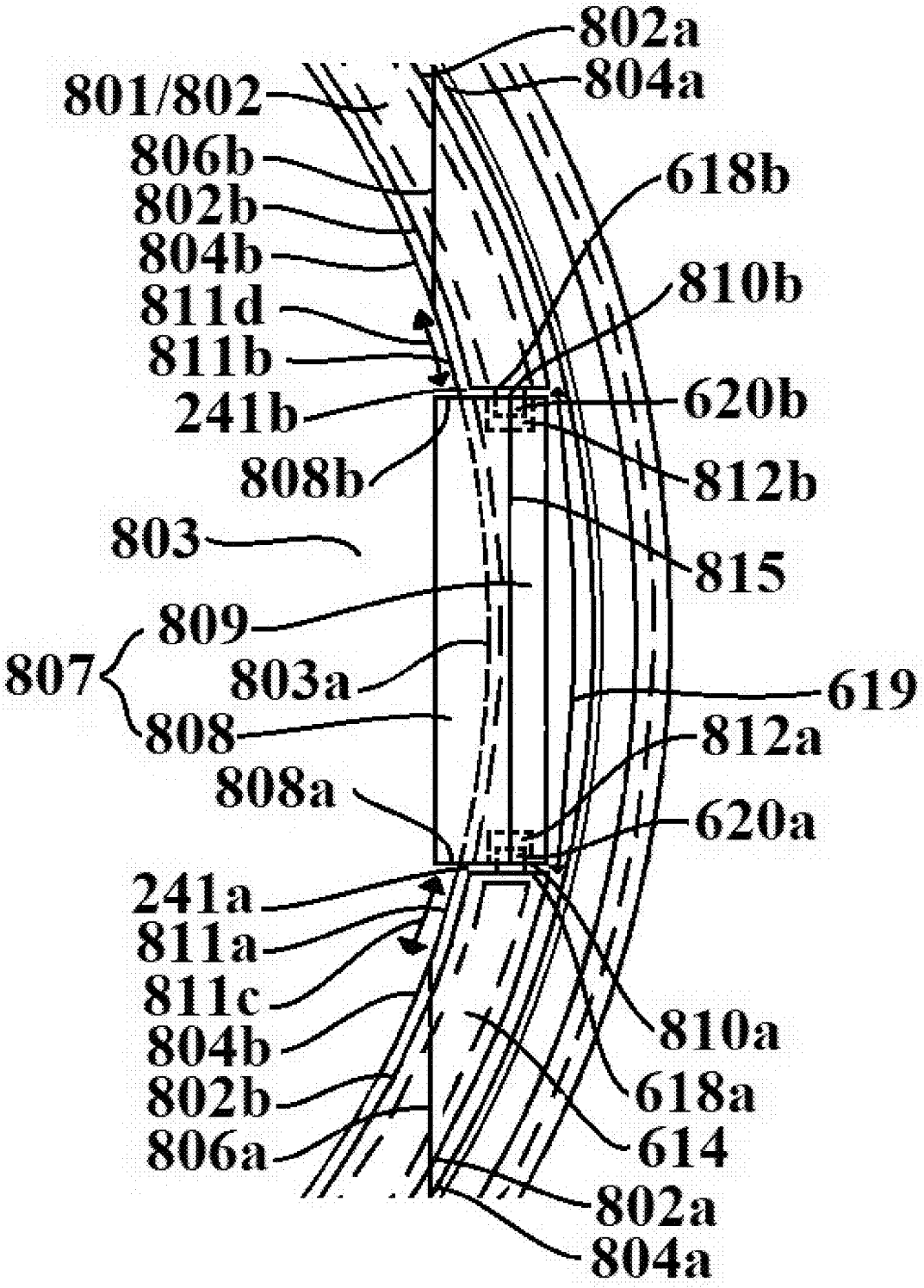
FIG. 33A is a partial top plan view on a larger scale of a portion of FIG. 33.

In a preferred embodiment of hatch cover part 800, cylindrical housing 807 represents the female hinge part of a detachable hinge with retaining means comprised of partially spherical indentation 812*a* and 812*b* (phantom and solid lines) forming dished opposing recesses depending inwards from opposing cylinder end walls 810*a* and 810*b*, mating over male hinge part opposing partially spherical protrusions 620*a* and 620*b*, respectively, for dome brim mount part 600 and flat brim mount part 700 described in FIG. 26 and further discussed in FIGS. 31B, 33 and 33A.

A further preferred embodiment of hatch cover part 800 is gripping tab 813, outwardly disposed from clamping rib arch 805, positioned diametrically opposite cylindrical housing 807. The optional string entry slit 112, string guide hole 113 and string retaining slot 114, found scored or die-cut into gripping tab 111 for hatch cover part 100 in FIG. 1A have been removed from gripping tab 813 as they are not required to support the use of an infusion pouch 416.

Figure 28B:
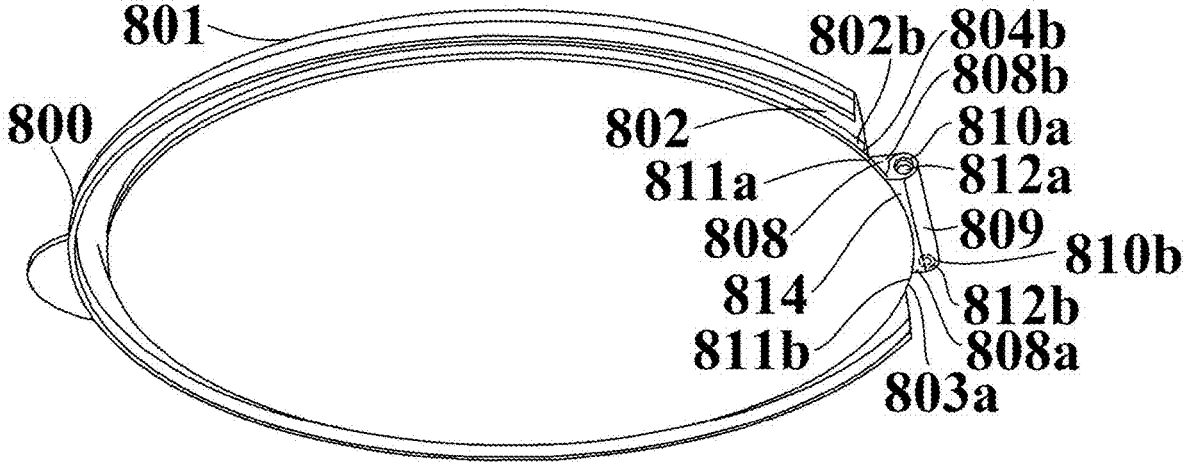
FIG. 28B is a perspective bottom view of the hatch cover part in FIG. 28A.

FIG. 28B is a perspective bottom view of hatch cover part 800 in FIG. 28A showing locking channel 802 formed on the underside of clamping rib 801. The cylinder underside 814 of cylinder 809 is shown to be partially integrated to recessed top wall perimeter edge 803*a* and also disposed from the rear of rectangular frontis block 808. Partially spherical indentation 812*a* and 812*b* (solid and phantom lines) are shown from this bottom perspective on the opposing ends of cylinder end walls 810*a* and 810*b*. Segment 811*a* and 811*b* are visible showing the respective small open space between clamping rib second outside wall 804*b*/locking channel second inside wall 802*b*, and rectangular frontis block end walls 808*a* and 808*b*.

Figure 29:
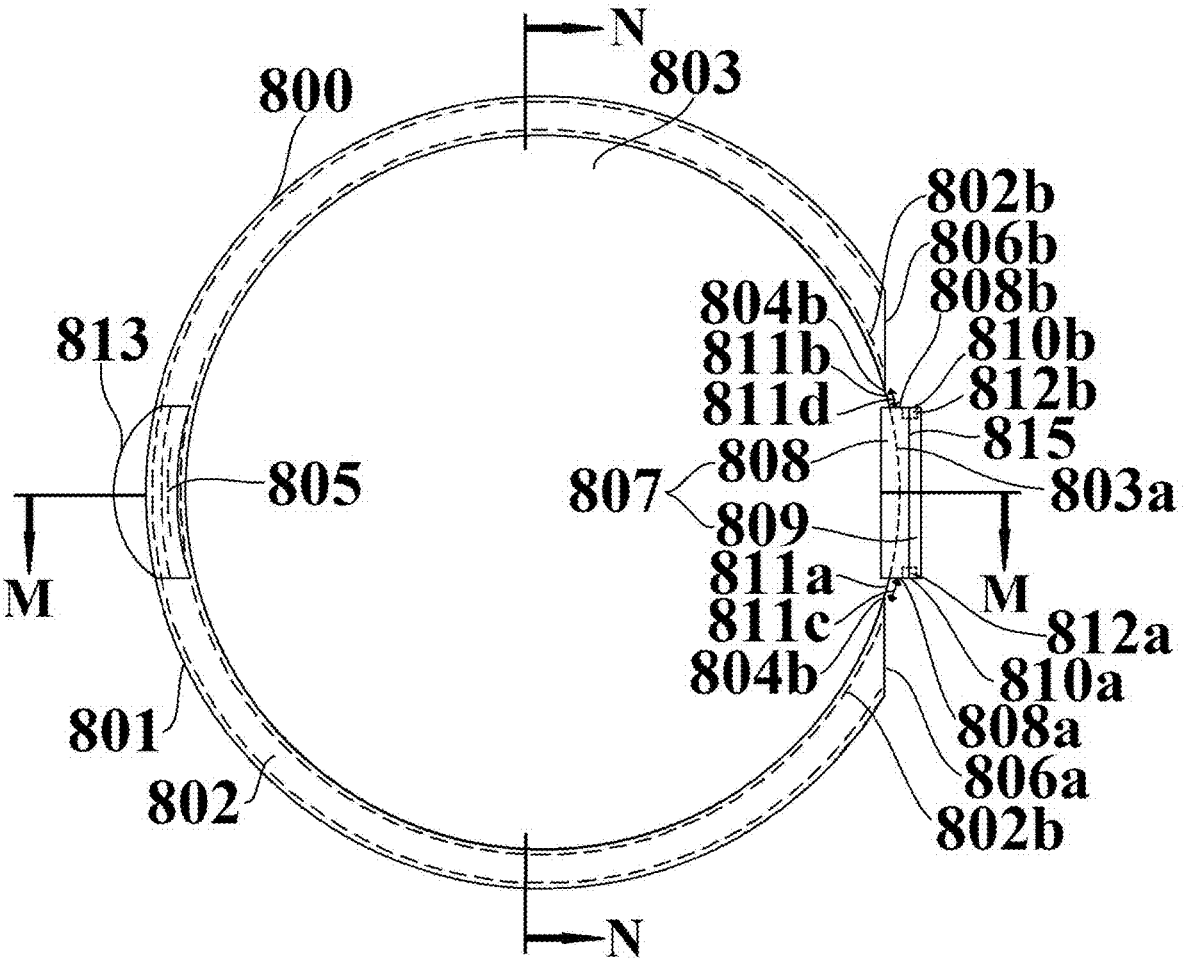
FIG. 29 is a top plan view of the hatch cover part in FIG. 28A.

FIG. 29 is a top plan view of hatch cover part 800 as seen in FIG. 28A showing cylindrical housing 807, comprised of rectangular frontis block 808, joined to recessed top wall 803, and cylinder 809 joined to the back of rectangular frontis block 808 and with cylinder underside 814 (see FIGS. 28B and 30A) partially overlapping top wall perimeter edge 803*a*. Partially spherical indentation 812*a* and 812*b* (phantom lines) are inwardly disposed from cylinder end walls 810*a* and 810*b* at opposing ends of cylinder 809. The two symmetrically opposing open ends 806*a* and 806*b* terminate with the opposing ends of clamping ribs 801 second outside wall 804*b*/locking channel 802 (phantom lines) second inside wall 802*b* (phantom lines) intimately close to, but not touching, rectangular frontis block end walls 808*a* and 808*b* thereby leaving two symmetrically recessed top wall perimeters edges 803*a* uncovered on either side thereby forming small segments 811*a* and 811*b* with respective segment arc length 811*c* and 811*d* (curved line with double-headed opposing arrows), also see FIG. 33A. A longitudinal axis line 815 (solid line) runs through the length of cylinder 809. Gripping tab 813 is disposed diametrically opposite cylindrical housing 807, extending outwardly from clamping rib arch 805.

Figure 30A:
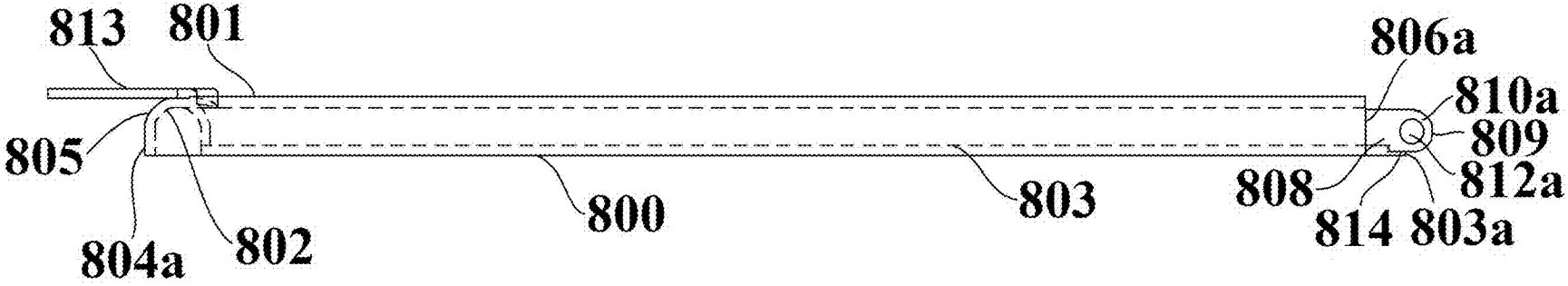
FIG. 30A is a side view in section of the hatch cover part taken substantially along line M-M in FIG. 29.

FIG. 30A is a side view in section of hatch cover part 800 taken substantially along line M-M in FIG. 29. Clamping rib/locking channel open ends 806*a* and 806*b* (806*b* not shown) terminate adjacent to cylinder end walls 810*a* and 810*b* (810*b* not shown). Rectangular frontis block 808 is disposed upwards from recessed top wall 803 and cylinder 809 is disposed horizontally outwards from the rear of rectangular frontis block 808 and cylinder underside 814 partially overlaps and is attached to top wall perimeter edge 803*a* (see FIG. 28B). Partially spherical indentation 812*a* and 812*b* (812*b* not shown) are centrally positioned on, and inwardly dependent from, cylinder end walls 810*a* and 810*b* (810*b* not shown) and recessed therein. Gripping tab 813 is joined to clamping rib arch 805 and disposed outwards passing clamping rib first outside wall 804*a*. Clamping rib 801/locking channel 802 are shown in section below gripping tab 813.

Figure 30B:
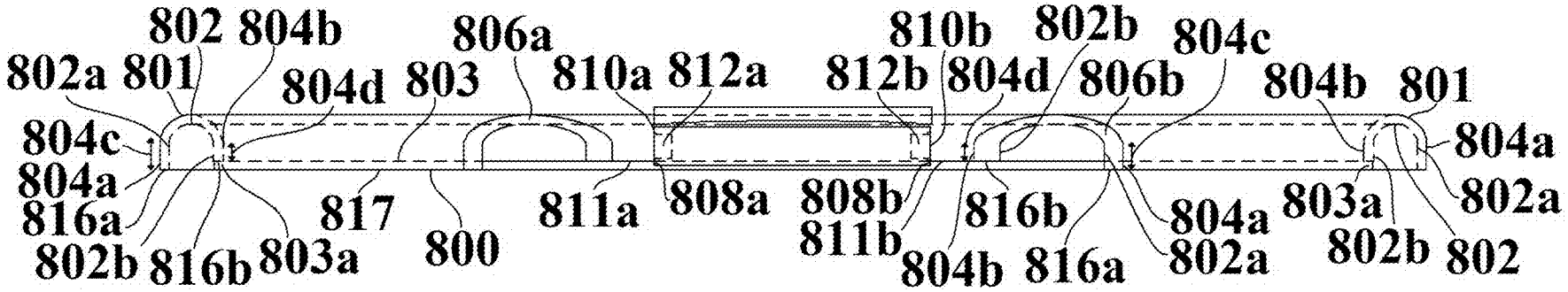
FIG. 30B is a side view in section of the hatch cover part taken substantially along line N-N in FIG. 29.

FIG. 30B is a side view in section of hatch cover part 800 taken substantially along the line N-N in FIG. 29. Clamping rib 801/locking channel 802 are shown in section (with phantom and solid lines) to the extreme right and left denoting their respective formation around recessed top wall perimeter edge 803*a* and further defined by clamping rib first outside wall 804*a*/locking channel first inside wall 802*a* and clamping rib second outside wall 804*b*/locking channel second inside wall 802*b*. Clamping rib second outside wall 804*b*/locking channel second inside wall 802*b* base 816*b* is joined to recessed top wall 803 and is shorter in vertical height 804*d* (solid vertical line with double-headed arrows at the outside left side section of clamping rib 801/locking channel 802) than clamping rib first outside wall 804*a*/locking channel first inside wall 802*a* vertical height 804*c* (solid vertical line with double-headed arrows at the outside left side section of clamping rib 801/locking channel 802) where clamping rib first outside wall 804*a*/locking channel first inside wall 802*a* base 816*a* is lower and even with the underside bottom surface 817 of recessed top wall 803. Similarly, clamping rib second outside wall 804*b*/locking channel second inside wall 802*b* base 816*b* is joined to recessed top wall 803 and is shorter in vertical height 804*d* (solid vertical line with double-headed arrows to the left of end wall 806*b*) than clamping rib first outside wall 804*a*/locking channel first inside wall 802*a* vertical height 804*c* (solid vertical line with double-headed arrows to the right of end wall 806*b*) where clamping rib first outside wall 804*a*/locking channel first inside wall 802*a* base 816*a* is lower and even with the underside bottom surface 817 of recessed top wall 803. Clamping rib/locking channel open ends 806*a* and 806*b* are separated from rectangular frontis block end walls 808*a* and 808*b* by segments 811*a* and 811*b*. Cylinder end walls 810*a* and 810*b* are further defined by inwardly disposed partially spherical indentation 812*a* and 812*b* (phantom lines).

FIG. 31A is a perspective top view of dome lid 900 comprising two separately moulded parts, hatch cover part 800, in the fully closed position, attached to the top wall of dome brim mount part 600. As discussed earlier under FIG. 8A and FIG. 24A, disposable container lids formed using thermoplastic resins demonstrate resilient flexibility, pliability and memory characteristics. These characteristics work cooperatively when clamping dome lid 900 to rolled rim 601 of disposable food container 603 (compressed for ease of illustration) around the upper end opening 602 (see FIG. 24A, phantom line with double headed arrows) wherein outside perimeter free edge 605*a* guides bottom flange 605 bringing interior sealing curvature 607*a* mated and clamp onto rolled rim 601 of disposable food container 603. One optional method for clamping dome lid 900 (or flat lid 1000) to rolled rim 601 utilizes index finger 403 and thumb 404 of either hand to apply downward finger pressure to clamping rib 801 arch 805. At the same time the customer wraps opposing hand 405 and remaining fingers 405*a* around disposable food container 603 with opposing thumb 406 extended to apply downward pressure to annular skirt 604 causing the outside perimeter free edge 605*a*, bottom flange 605 and interior sealing curvature 607*a* and corresponding outside clamping curvature 607, between lower furrow 606 and upper furrow 608, to flex outwards gradually pushing interior sealing curvature 607*a* over rolled rim 601, as shown in cut-away VI wherein anti-splash/spill apron 625 (solid and phantom lines) and food 609 within container 203 are also viewable. Once interior sealing curvature 607*a* is seated onto rolled rim 601, the memory characteristics of the polystyrene returns bringing bottom flange 605 and interior sealing curvature 607*a* back to their original moulded, pre-flexed, unstressed positions thereby creating a snug clamping fitment of interior sealing curvature 607*a* onto rolled rim 601 of disposable food container 603.

FIG. 31B is a partial perspective view on a larger scale of a portion of dome lid 900 in FIG. 31A. A preferred embodiment of thermoplastic resins discussed earlier and adopted for this variation of beverage dome 400 and flat 500 lid configurations, is their characteristic smooth surface, promoting suitability when two thermoplastic parts are in intimate contact and moving against each other. The smooth nature of the part surfaces together with the inherent flexibility, pliability and memory characteristics of the thin thermoplastics forming hatch cover part 800 and dome brim mount part 600, respective halves of dome lid 900, allows for the female hinge part cylindrical housing 807 (phantom and solid lines), comprised of rectangular frontis block 808 (solid and phantom lines), joined to recessed top wall 803 and cylinder 809 (solid and phantom lines), depending outwards from the rear of rectangular frontis block 808, and, as well, partially joined to recessed top wall perimeter edge 803*a* (phantom lines), to be slidably inserted first gap 619 (refer to FIGS. 33 and 33A) between the male hinge part, retaining rib end walls 618*a* and 618*b* (phantom and solid lines) on dome brim mount part 600 when manufacturing and assembling hatch cover part 800 to the top portion of dome 600 or flat 700 brim mount parts. As similarly described under FIG. 8A, one method to assemble hatch cover part 800 to dome 600 or flat 700 brim mount parts forming the detachable hinge is for male hinge part opposing partially spherical protrusions 620*a* and 620*b* (phantom lines) and retaining rib end walls 618*a* and 618*b* to be pliably and cooperatively flexed outwards on either side, increasing the dimensional length of the first gap 619 allowing cylindrical housing 807 (see FIGS. 33 and 33A) to be slidably press snap fitted into first gap 619. Once partially spherical indentation 812*a* and 812*b* (phantom lines, also see FIGS. 33 and 33A) on the opposing cylinder end walls 810*a* and 810*b* (phantom and solid lines) are in coincident alignment with opposing partially spherical protrusions 620*a* and 620*b*, the flexing of opposing partially spherical protrusions 620*a* and 620*b* outwards is released, wherein first gap 619 (FIGS. 33 and 33A) returns to its original dimensional length allowing the male hinge part opposing partially spherical protrusions 620*a* and 620*b* (phantom lines) to intimately seat within the respective female hinge part partially spherical indentation 812*a* and 812*b* (phantom lines, also see FIGS. 33 and 33A) and for the partially spherical indentation 812*a* and 812*b* to mate over and enshroud the partially spherical protrusions 620*a* and 620*b*, thereby joining hatch cover part 800 in a non-permanent releasable manner to the top wall portion of dome brim mount part 600 (or to flat brim mount part 700, see FIG. 32) completing the formation of the detachable hinge 901. Detachable hinge 901 snaps together or apart when sufficient force is applied to elastically flex the dimensional length of the first gap 619, forcing the partially spherical protrusions 620*a* and 620*b* apart so that they pass over the outside rims of the partially spherical indentation 812*a* and 812*b*. In another optional method of attaching hatch cover part 800 to the top of dome 600 or flat 700 brim mount parts during manufacture and assembly involves hatch cover part 800 being flexed to reduce the dimensional length of cylindrical housing 807 longitudinal axis line 815 (solid line) allowing cylinder 809 to be inserted into first gap 619 and bring partially spherical indentation 812*a* and 812*b* into concentric alignment with partially spherical protrusions 620*a* and 620*b*, at which time the flexing of hatch cover part 800 is released allowing cylindrical housing 807 to return to its original dimensional length wherein partially spherical indentation 812*a* and 812*b* enshroud and mate over partially spherical protrusions 620*a* and 620*b*. This method of attaching hatch cover part 800 to the top portion of either dome 600 or flat 700 brim mount parts may as well be accomplished with dome 600 or flat 700 (see FIG. 25A) brim mount parts clamped to the rolled rim 601 of container 603 as first discussed in FIGS. 21F and 21F-1 for dome 400 and flat 500 lid configurations used on beverage containers 203. FIG. 39A illustrates this latter method for engagement and disengagement of hatch cover part 800, respectively, to, and from, dome brim mount part 600 while dome brim mount part 600 is attached to rolled rim 601 of container 603 and will be discussed further under FIG. 39A.

Partially spherical indentation 812*a* and 812*b* provide retaining means to confine male hinge part opposing partially spherical protrusions 620*a* and 620*b* within female hinge part partially spherical indentation 812*a* and 812*b*, thereby snap fitting the two halves of the hinge together forming detachable hinge 901 and completing the attachment of hatch cover part 800 to dome brim mount part 600 thereby creating dome lid 900. The dimensional length of longitudinal axial line 815 of cylinder 809 (also see FIGS. 33 and 33A) is equal to, or slightly less than linear dimension of first gap 619 (see FIGS. 33 and 33A), such that when cylindrical housing 807 partially spherical indentation 812*a* and 812*b* are snap fitted into first gap 619 (see FIGS. 33 and 33A) over opposing partially spherical protrusions 620*a* and 620*b*, the snug mating of the male and female hinge part retains hatch cover part 800 to top wall portion of dome 600 or flat 700 (see FIGS. 33 and 33A) brim mount parts, restricting lateral movement, while allowing hatch cover part 800 to pivot and be retained at different intermediate opened positions in a hands-free manner between fully closed and fully opened positions. This detachable hinge configuration may be reversed with partially spherical indentation 812*a* and 812*b* recessed within the opposing retaining rib end walls 618*a* and 618*b* and opposing partially spherical protrusions 620*a* and 620*b* extending from opposing cylinder end walls 810*a* and 810*b*.

In still another preferred embodiment of this variation on this new invention is the symmetric severing and removal of a portion of clamping rib 801/locking channel 802 to create open ends 806*a* and 806*b* such that when detachable hinge 901 is formed, open ends 806*a* and 806*b* are respectively intimately closer to opposing cylinder end walls 810*a* and 810*b* compared with open ends 104*a* and 104*b* on hatch cover part 100 in FIG. 8A, which were severed further back from cylinder end walls 108*a* and 108*b* to allow hatch cover part 100 to be pivoted to its fully opened position without interfering with planar top transition surface 212 of ring-shaped crown portion 210 and compressed ring-shaped crown portion 301 (see FIGS. 16A and 17A). However, with the removal of the equivalent of ring-shaped crown portion 210 and compressed ring-shaped crown portion 301, respectively, from dome brim mount part 600 and flat brim mount part 700, open ends 806*a* and 806*b* are severed much closer to rectangular frontis block end walls 808*a* and 808*b* and cylinder end wall 810*a* and 810*b* because hatch cover part 800 must now only clear retaining rib 614 and not both retaining rib 214 and planar top transition surface 212 as required for beverage dome 400 and flat 500 lid configurations as shown in FIG. 16A, to be pivoted to its fully opened position. Segments 109*a* and 109*b* between rectangular base end walls 106*a* and 106*b* and open ends 104*a* and 104*b* in FIG. 16A are replaced with segments 811*a* and 811*b* with respective shorter segment arc lengths 811*c* and 811*d* (not shown in FIG. 31B, see FIGS. 28A and 29), compared with segment arc lengths 115*a* and 115*b* in FIG. 2, wherein the shorter segments 811*a* and 811*b* are positioned between open ends 806*a* and 806*b* and rectangular frontis block end walls 808*a* and 808*b* (see FIG. 33A). This will be further discussed under FIGS. 35 and 36.

Figure 31C:
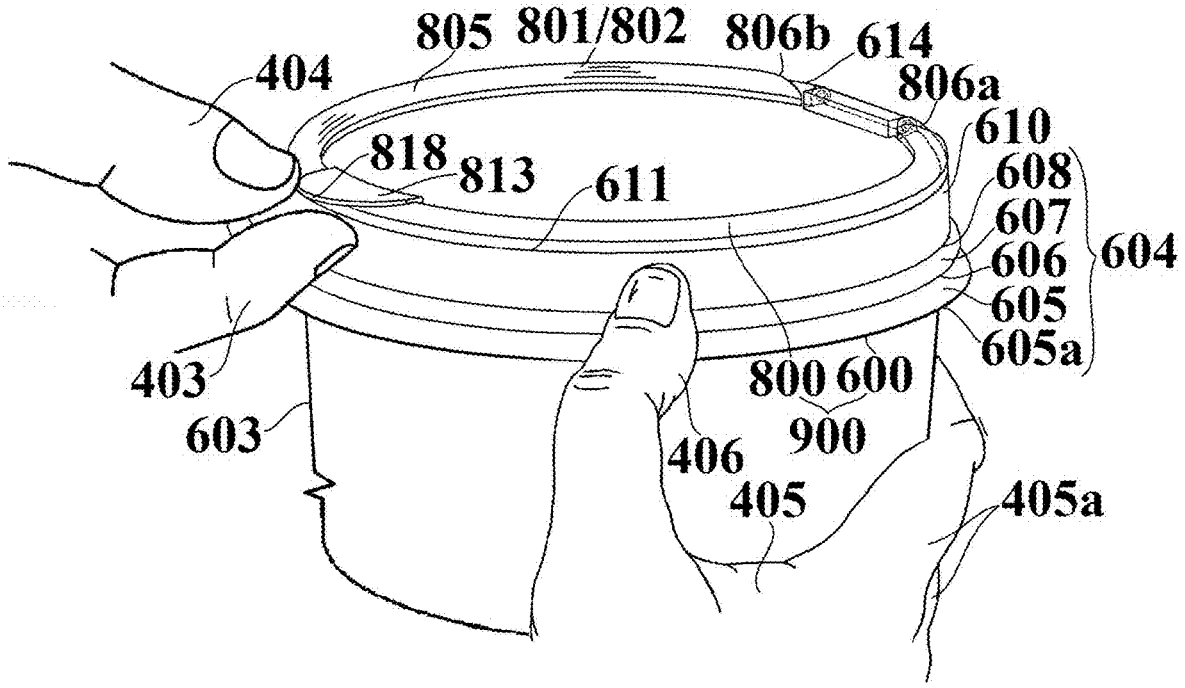
FIG. 31C is a perspective top view of the dome lid configuration in FIG. 31A initiating the lifting and pivoting of the hatch cover part.
Figure 35:
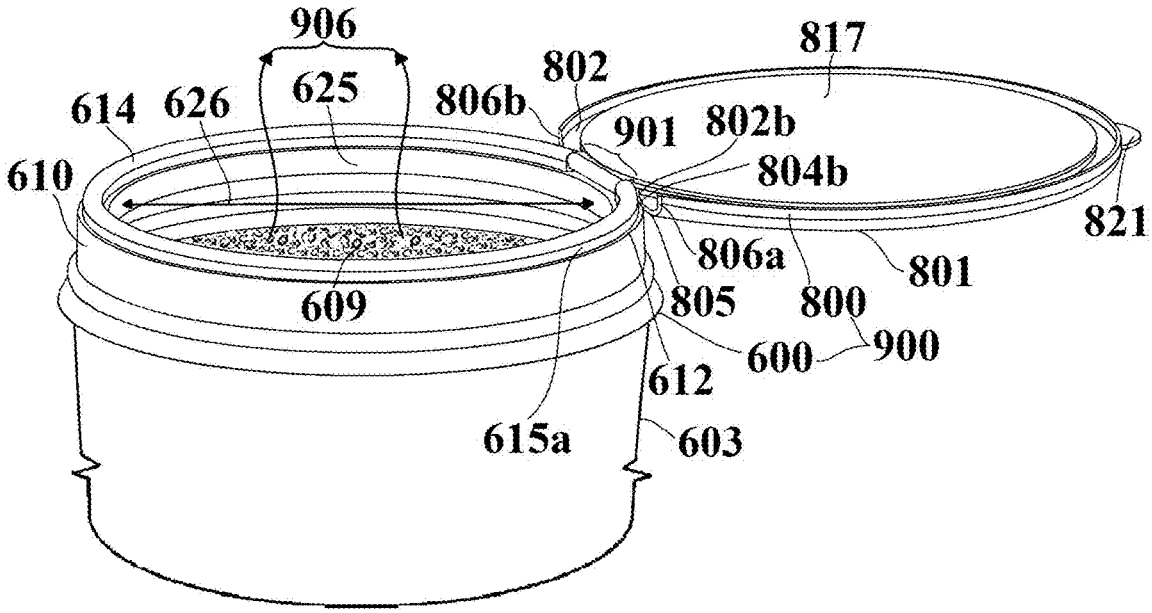
FIG. 35 is a perspective top view of the dome lid configuration, mounted to the rolled rim of a food container, compressed for ease of illustration, with the hatch cover part in the fully opened position.
Figure 36:
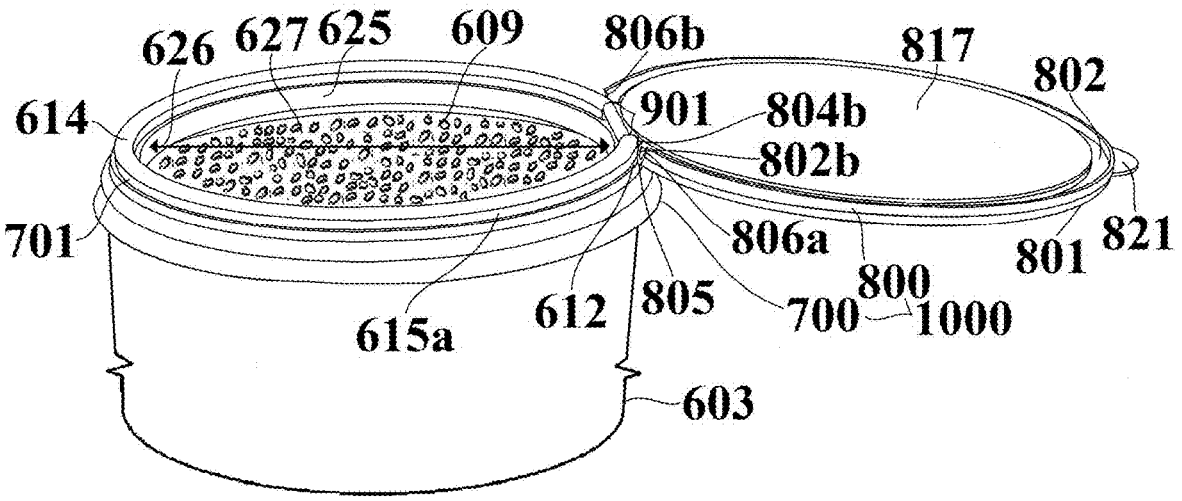
FIG. 36 is a perspective top view of the flat lid configuration, mounted to the rolled rim of a food container, compressed for ease of illustration, with the hatch cover part in the fully opened position.

FIG. 31C is a perspective top view of dome lid 900 mounted to the upper end rolled rim 601 (see FIG. 24A) of disposable food container 603 (compressed for ease of illustration). Hatch cover part 800 is in the fully closed position showing front edge 818 of gripping tab 813 optionally gripped between index finger 403 and thumb 404 (similar to that shown in FIG. 8A) initiating the lifting and pivoting of hatch cover part 800 while opposing hand 405 and remaining fingers 405*a* are wrapped around disposable food container 603 with opposing thumb 406 extended to apply downward pressure to annular skirt 604, comprised of outside perimeter free edge 605*a*, bottom flange 605, lower furrow 606, clamping curvature 607 and upper furrow 608. This positioning of opposing hand 405 and remaining fingers 405*a* steadies disposable food container 603 and holds dome brim mount part 600 down as index finger 403 and thumb 404 continue pulling gripping tab 813 upwards, thereby prying clamping rib 801/locking channel 802 (802 not shown) free and disengaging them from frictional mated fitment to retaining rib 614, similar to the partial pivoting of hatch cover part 100 upwards disengaging clamping rib 101/locking channel 102 from retaining rib 214 for beverage dome lid 400 in FIG. 12 to a partially opened position, and subsequently to a fully opened position as shown in FIGS. 35 and 36 for dome lid 900. This arrangement of index finger 403 and thumb 404 and opposing thumb 406, hand 405 and remaining fingers 405*a*, does not preclude other configurations of digits and hands, unilaterally or in combination, from being adopted to pivot hatch cover part 800 and/or grip container 603 and/or apply downward pressure to annular skirt 604 as described above.

Figure 34A:
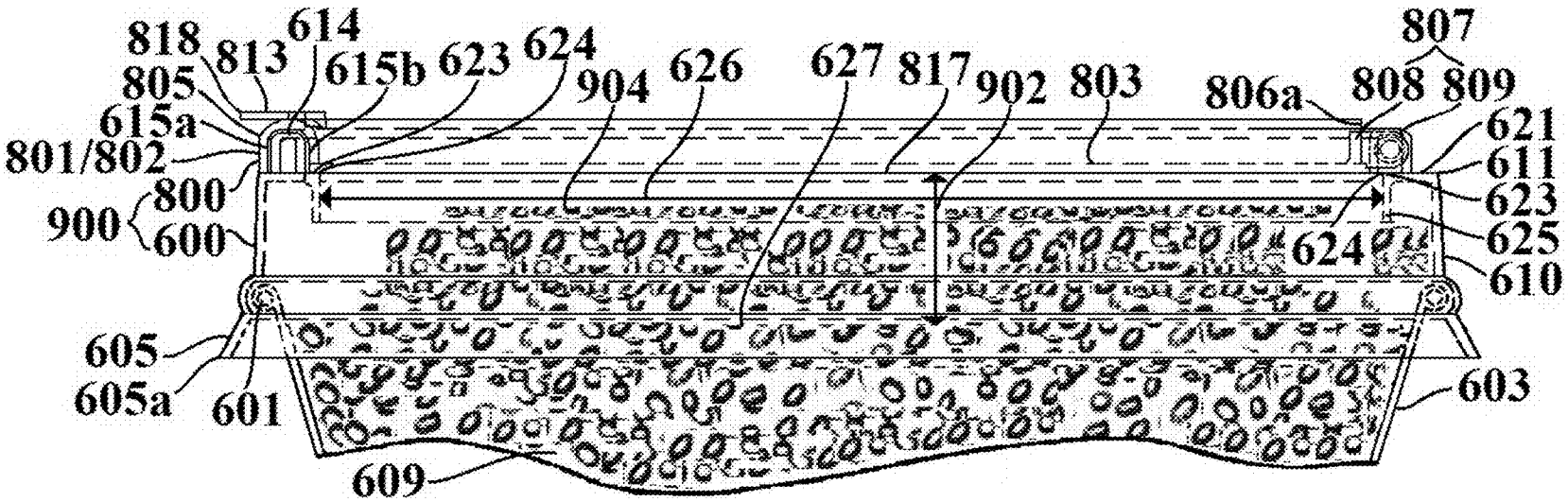
FIG. 34A is a side view in section of the dome lid configuration, mounted to the rolled rim of a food container, compressed for ease of illustration, with the hatch cover part in the fully closed position taken substantially along line O-O in FIG. 33.

The fully opened hatch cover part 800 (see FIG. 35) may be brought to the fully closed position by following the same steps used to open hatch cover part 800 in reverse. Index finger 403 and thumb 404 again may grip front edge 818 of gripping tab 813 to begin pivoting fully opened hatch cover part 800 (see FIG. 35) upwards, pivoting to the fully closed position, while the customer wraps opposing hand 405 and remaining fingers 405*a* around disposable food container 603 with opposing thumb 406 extended to apply downward pressure to annular skirt 604 of dome brim mount part 600, thereby steadying disposable food container 603. Alternatively, the customer may just take the palm of either hand and place it under inverted recessed top wall 803 while using the opposing hand to grip container 603 and raise hatch cover part 800, pivoting to a fully closed position. When hatch cover part 800 is pivoted from the fully opened position to an intermediate opened position that is partially closing hatch cover part 800, similar to that described for hatch cover part 100 in FIG. 12, open ends 806*b* and 806*a*, and a portion of clamping rib 801/locking channel 802, begin to overlap retaining rib 614 and are brought into intimate contact with retaining rib 614. At this stage of closing hatch cover part 800, index finger 403 and thumb 404 of either opposite hand 405 are released from holding front edge 818 of gripping tab 813 and repositioned, moving to make contact with recessed top wall 803 and/or clamping rib arch 805, and gently applying downward finger pressure until clamping rib 801/locking channel 802 are frictionally pressed onto retaining rib 614 forming a mated frictional fitment over retaining rib 614 as shown in FIGS. 31A and 34A. FIG. 31A represents examples of two actions, the first being the clamping of dome lid 900 onto rolled rim 601 with index finger 403 and thumb 404 pushing down on clamping rib 801, and secondly, the same image demonstrates the closing of hatch cover part 800 with the same placement of index finger 403 and thumb 404 when hatch cover part 800 is fully closed onto retaining rib 614 of dome brim mount part 600. This arrangement of hands and fingers gripping disposable food container 603, dome lid 900 and gripping tab 813, may change with handedness and repositioning of fingers and thumb. Optionally, the respective outside width of clamping rib 801 and respective inside width of locking channel 802, and corresponding outside width of retaining rib 614 may be reduced while still retaining the mated frictional fitment of clamping rib 801/locking channel 802 onto retaining rib 614 when hatch cover part 800 is in the closed position, thereby offering a further increase in diameter of recessed hatch opening 626 (see FIGS. 24A and 25A).

Figure 41A:
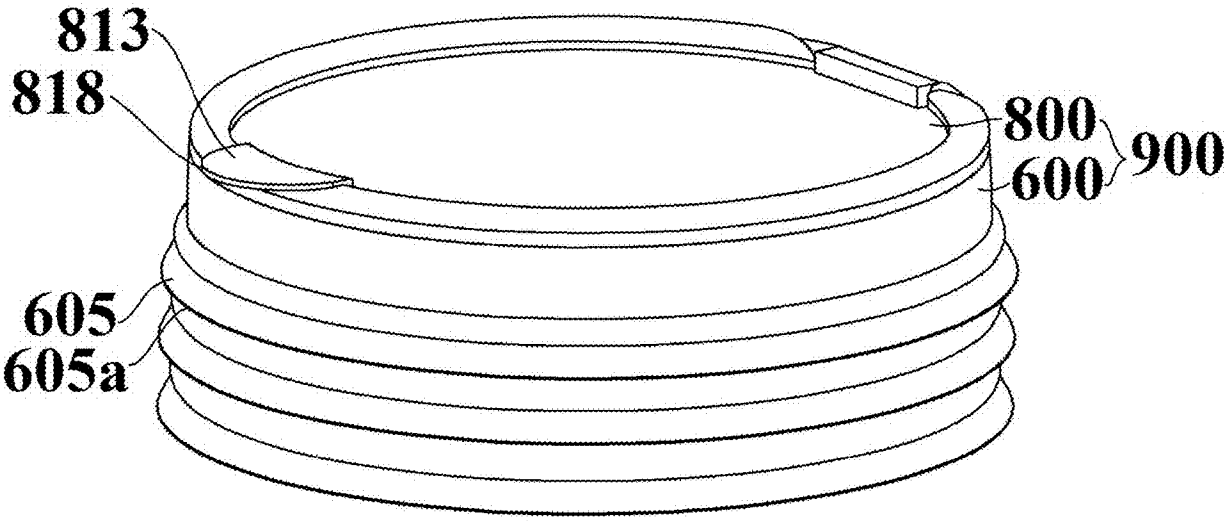
FIG. 41A is a perspective top view of a plurality of the dome lid configurations (see FIG. 31A) with the hatch cover part in the fully closed position shown in a stacking arrangement.
Figure 41B:
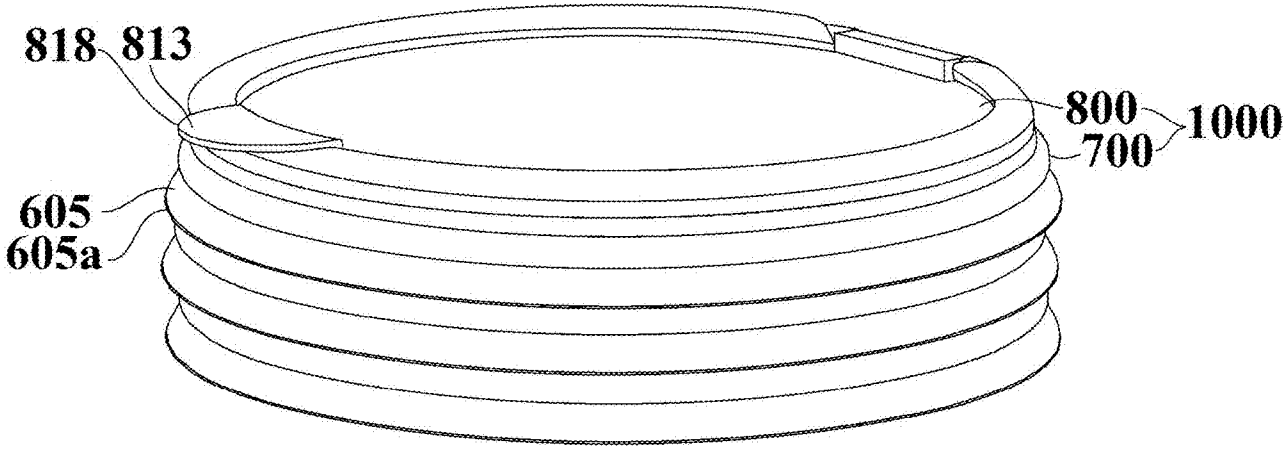
FIG. 41B is a perspective top view of a plurality of the flat lid configurations (see FIG. 32) with the hatch cover part in the fully closed position shown in a stacking arrangement.

In still another further preferred embodiment of this variation on this new invention front edge 818 of gripping tab 813 extends marginally beyond the outside perimeter edge 611 while still remaining within the outside diameter of outside perimeter free edge 605*a*, restricting the distance front edge 818 of gripping tab 813 may be outwardly disposed, thereby allowing for dome lid 900 to be arranged in a stacking arrangement as will be further discussed under FIGS. 41A and 41B.

Figure 32:
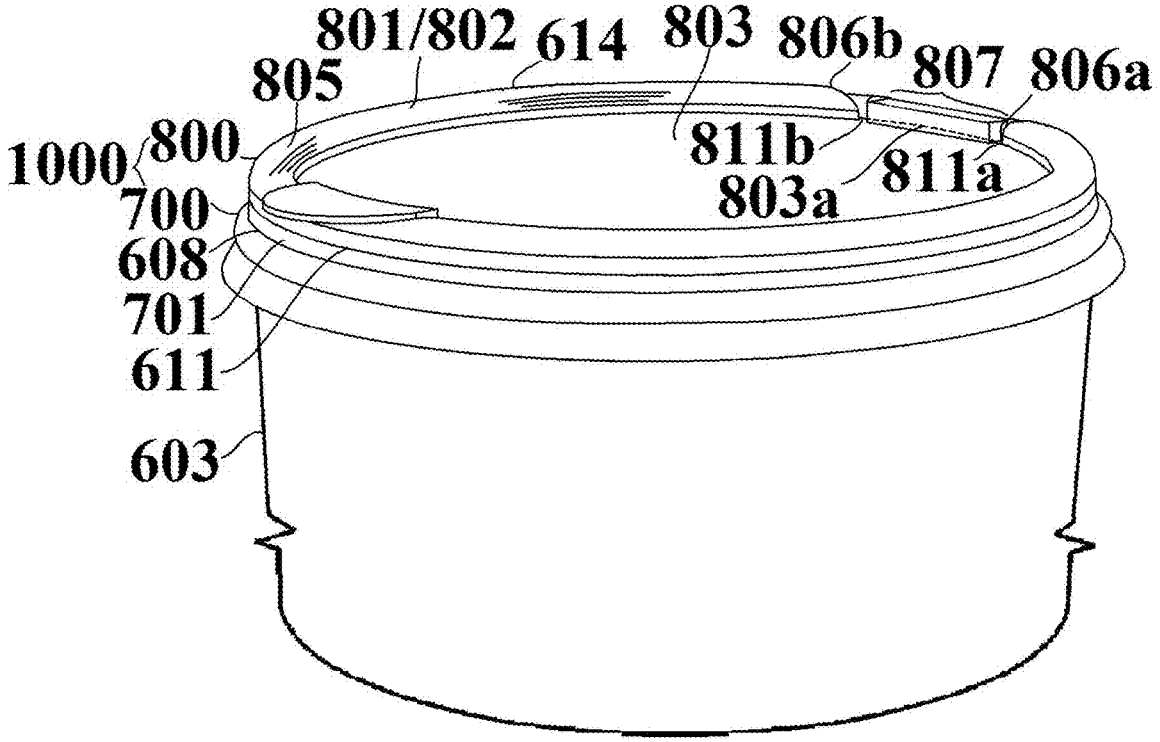
FIG. 32 is a perspective top view of the hatch cover part (see FIG. 28A) in a fully closed position attached to the flat brim mount part (see FIG. 25A), mounted to the rolled rim of a food container, compressed for ease of illustration, thereby forming the flat lid configuration, a variation of the flat lid configuration in FIG. 9A.

FIG. 32 is a perspective top view of flat lid 1000 with hatch cover part 800 in the fully closed position and flat brim mount part 700 clamped to rolled rim 601 (see FIG. 25A) and includes all of the preferred embodiments described for dome lid 900 in FIGS. 31A-31C except for outside wall 610 (see FIG. 31C) which is vertically compressed to form compressed outside wall 701. Although compressed outside wall 701 has resulted in vertically compressing dome lid 900 to form flat lid 1000, all other part heights and dimensions in dome lid 900 are reproduced in flat lid 1000. Retaining rib 614 remains unchanged with the same dimensions and repositioning replacing equivalent of compressed ring-shaped crown portion 301 as shown in FIG. 9A and where compressed outside wall 701 does not change the recessed planar relationship between recessed top wall 803 and clamping rib arch 805 where recessed top wall 803 remains sufficiently recessed below clamping rib arch 805. Compressed outside wall 701 is upwardly dependent from upper furrow 608 terminating at outside perimeter edge 611.

The same index finger 403, thumb 404, opposing hand 405, remaining fingers 405*a* and opposing thumb 406 arrangement shown in FIG. 31C may be adopted when clamping flat lid 1000 to rolled rim 601 (see FIG. 25A) on disposable food container 603 (compressed for ease of illustration) and also for releasing clamping rib 801/locking channel 802 (not shown) on hatch cover part 800 from retaining rib 614 when opening hatch cover part 800 to access food 609 within disposable food container 603 as described under FIG. 31A. Clamping rib 801/locking channel 802 are severed at the same position, forming open ends 806*a* and 806*b*, intimately close to the opposing cylinder end walls 810*a* and 810*b* (not shown, see FIG. 31B) of cylindrical housing 807, but still leaving a small arc length of uncovered recessed top wall perimeter edge 803*a* (phantom and solid lines), thereby creating the same shortened segments 811*a* and 811*b* as also shown in FIG. 31B with respective short segment arc lengths 811*c* and 811*d* (see also FIG. 29).

The option of a flat lid 1000 may be preferred by fast food establishments as this lid occupies less vertical space when stored in a stacking arrangement as will be further discussed under FIG. 41B and may be nominally less expensive to manufacture because less material is being used. The flat lid 1000 option offers customers a more streamlined disposable food container 603/flat lid 1000 configuration and a disposable food container 603/flat lid 1000 vertical height which is less than the vertical height of disposable food container 603/dome lid 900 configuration (see FIG. 31A), allowing for less vertical height when stacking equivalent numbers of disposable food containers 603 in bags, one on top of the other, when used for take out food purchases and deliveries, and packing up leftovers at the end of dine-in meals.

The relative heights of outside wall 610 for dome lid 900 and compressed outside wall 701 for flat lid 1000 are for illustrative purposes to show the relative differences in respective dome and flat lid configurations. This does not preclude changing the relative heights of outside walls 610 (see FIG. 31C) and compressed outside wall 701, respectively, while maintaining their respective distinctive dome and flat profiles and where such marginal changes in relative heights must be tempered against any loss in functionality and preferred embodiments in keeping with the principles of this variation of this new invention.

FIG. 33 is a top plan view representing dome lid 900 in FIG. 31A and flat lid 1000 in FIG. 32 showing clamping rib 801/locking channel 802 frictionally mated on top of retaining rib 614 circumscribing and occupying the annular space which would otherwise be occupied by the equivalent of ring-shaped crown portion 210 and compressed ring-shaped crown portion 301, respectively, as seen in FIG. 10, before the ring-shaped crown portions were removed and clamping rib 101/locking channel 102 and retaining rib 214 were increased in diameter to fit disposable food container 603 as shown respectively in FIGS. 31A and 32. Outside wall 610 and compressed outside wall 701, respectively, are not distinguishable in this plan view. FIG. 33 includes many of the preferred embodiments described in FIG. 10 for dome 400 and flat 500 lid configurations, with some minor variations and exclusions, thereby supporting the argument that dome 900 and flat 1000 lid configurations, respectively, with the equivalents of ring-shaped crown portion 210 and compressed ring-shaped crown portion 301 removed, together with an increase in diameter to fit the rolled rim 601 of disposable food container 603, are variations on beverage dome 400 and flat 500 lid configurations, respectively, and do not represent new species. Cut-away IX discloses the cooperative engaging of bottom flange 605 and interior sealing curvature 607*a* to sealingly mate interior sealing curvature 607*a* to rolled rim 601 of disposable food container 603 as previously discussed under FIG. 26.

Another variation between the respective lids referred to in FIGS. 10 and 33 is the location of the severing of clamping rib 101/locking channel 102 on hatch part 100 and the positioning of open ends 104*a* and 104*b* compared with the severing of clamping rib 801/locking channel 802 on hatch cover part 800, forming open ends 806*a* and 806*b*. In FIG. 10 the open ends 104*a* and 104*b* are severed further back from rectangular base end walls 106*a* and 106*b*, creating opposing symmetrical positioned segments 109*a* and 109*b* of respective longer arc lengths 115*a* and 115*b*, wherein sections of clamping rib 101/locking channel 102 are removed from hatch cover part 100. Segments 109*a* and 109*b* (see FIG. 2), are necessary to allow the pivoting of hatch cover part 100 to the fully opened position without clamping rib arch 120 making contact with planar top transition surface 212 of ring-shaped crown portion 210 and compressed ring-shaped crown portion 301, which would otherwise prevent hatch cover part 100 from pivoting to its fully opened position as described under FIGS. 16A and 17A. Clamping rib 801/locking channel 802 are severed intimately closer to opposing rectangular frontis block end walls 808*a* and 808*b*, while still leaving shortened symmetrical segments 811*a* and 811*b*, where clamping rib 801/locking channel 802 are missing from a small portion of recessed top wall perimeter edge 803*a* (solid and phantom lines) as further shown in the exploded view in FIG. 33A. The removal of equivalent ring-shaped crown portion 210 and compressed ring-shaped crown portion 301 from respective dome brim mount part 600 and flat brim mount part 700 no longer requires the broader segments 109*a* and 109*b* shown in FIG. 10 to allow hatch cover part 800 to pivot to its fully opened position. The length of segment arc lengths 115*a* and 115*b* for segments 109*a* and 109*b* in FIG. 2 are significantly shortened to form segment arc lengths 811*c* and 811*d* (see FIGS. 29 and 33A), respectively, for shorter segments 811*a* and 811*b* due to the preferred embodiments of bringing open ends 806*a* and 806*b* closer to respective rectangular frontis block end walls 808*a* and 808*b*. Although segment arc lengths 811*c* and 811*d* are significantly shorter for hatch cover part 800 compared with segments 115*a* and 115*b* for hatch cover part 100, the opposing clamping rib second outside wall 804*b*/locking channel second inside wall 802*b* at the ends of open ends 806*a* and 806*b* can still be wedged against outside wall 610 and/or compressed outside wall 701 when hatch cover part 800 is pivoted to its fully opened positions as shown in FIGS. 35 and 36, to assist in retaining hatch cover part 800 in the fully opened position, in the same way as described earlier under FIGS. 16A and 17A for hatch cover part 100 when pivoted to the fully opened position. This further demonstrates that dome 900 and flat 1000 lid configurations are respective variations of beverage dome 400 and flat 500 lid configurations and not new species.

Although cylindrical housing 807 on hatch cover part 800 discloses some minor variation when compared with cylindrical housing 105 for hatch cover part 100, the respective detachable hinges, 401 and 901, disclose the same preferred embodiments and are snap fitted together in a similar manner. As previously described in FIG. 8A, the same process for connecting female hinge hatch cover part 100 onto male hinge part dome 200 and flat 300 brim mount parts is also applied for connecting female hinge part hatch cover part 800 onto male hinge part dome 600 and flat 700 brim mount parts to form dome 900 and flat 1000 lid configurations. The insertion of cylindrical housing 807 is initiated when the opposing end walls 618*a* and 618*b* on either dome 600 or flat 700 brim mount parts are cooperatively flexed outwards thereby increasing first gap 619 allowing the female hinge part of cylindrical housing 807 (see FIGS. 28A and 29) to be inserted into first gap 619 bringing opposing female hinge part partially spherical indentation 812*a* and 812*b* (phantom lines), on opposing cylinder end walls 810*a* and 810*b*, and opposing partially spherical protrusions 620*a* and 620*b* (phantom lines) into a concentric alignment, whereby opposing partially spherical indentation 812*a* and 812*b* slide over respective opposing partially spherical protrusions 620*a* and 620*b* at which time the outward flexing of opposing end walls 618*a* and 618*b* is released returning first gap 619 to its original pre-flexed width, allowing partially spherical protrusions 620*a* and 620*b* to seat within partially spherical indentation 812*a* and 812*b* and for partially spherical indentation 812*a* and 812*b* to enshroud partially spherical protrusions 620*a* and 620*b*. Partially spherical indentation 812*a* and 812*b* provide a retaining means to confine male hinge part opposing partially spherical protrusions 620*a* and 620*b* within female hinge part partially spherical indentation 812*a* and 812*b*. This results in snap fitting the two halves of the hinge parts together forming detachable hinge 901 and completing the attachment of the hatch cover part 800 onto dome brim mount part 600 and flat brim mount part 700 in a non-permanent releasable manner, thereby respectively creating dome 900 and flat 1000 lid configurations. Longitudinal axis line 815 (solid line, also see FIGS. 29 and 33A), denoting the linear dimensional length of cylinder 809, is equal to, or slightly less than linear dimensional length of first gap 619 (curved line with double-headed arrows, also see FIGS. 26 and 33A) such that cylinder 809 can be snap fitted into first gap 619, thereby creating a snug fit. Detachable hinge 901 snaps together or apart when sufficient force is applied to elastically flex the dimensional length of the first gap 619, forcing the partially spherical protrusions 620*a* and 620*b* apart so that they pass over the outside rims of the partially spherical indentation 812*a* and 812*b*.

In a preferred embodiment, gripping tab 813 is joined to clamping rib arch 805 (see FIG. 34A) and is disposed outwards from clamping rib arch 805 in a substantially semi-circular shape with its curvilinear perimeter front edge 818 terminated marginally beyond bottom flange 605 thereby providing a lifting means to the customer for grasping the front edge 818 optionally with their index finger 403 and thumb 404 in order to raise hatch cover part 800, or any other combinations of digits and hands, as shown in FIG. 31C.

FIG. 33A is a partial top plan view on a larger scale of a portion of the plan view representing dome lid 900 and flat lid 1000 configurations in FIG. 33 with phantom lines depicting hidden elements. The severing of clamping rib 801/locking channel 802 shows the close proximity of clamping rib second outside wall 804*b*/locking channel second inside wall 802*b* of open end 806*a* and 806*b* to the opposing rectangular frontis block end walls 808*a* and 808*b* while still leaving shortened symmetrical segments 811*a* and 811*b*, together with respective segment arc lengths 811*c* and 811*d*, where clamping rib 801/locking channel 802 are missing from a small portion of the recessed top wall perimeter edge 803*a*. While the angle of severing of clamping rib 801/locking channel 802 forming open ends 806*a* and 806*b* brings clamping rib second outside wall 804*b*/locking channel second inside wall 802*b* intimately closer to rectangular frontis block end walls 808*a* and 808*b*, clamping rib first outside wall 804*a*/locking channel first inside wall 802*a* are further from rectangular frontis block end walls 808*a* and 808*b*. The marginal difference in axial length between longitudinal axis line 815 (solid line), denoting the linear dimensional length of cylindrical housing 807, which is equal to, or slightly less than linear dimensional length of first gap 619 (solid curved line with double-headed arrows), thereby allows for partially spherical indentation 812*a* and 812*b* at the opposing ends of cylinder 809 end walls 810*a* and 810*b* to be snap fitted over opposing partially spherical protrusions 620*a* and 620*b* on opposing ends of retaining rib 614 end walls 618*a* and 618*b* in a similar manner to that described for connecting hatch cover part 100 to dome 200 and flat 300 brim mount parts as described under FIGS. 8A and 9A, thereby forming dome 900 and flat 1000 lid configurations as described under FIG. 33. Retaining rib 614 end walls 618*a* and 618*b* are separated by first space 241*a* and a second space 241*b* (first introduced under FIG. 10A) for illustrative purposes only to distinguish end walls 618*a* and 618*b* and opposing cylinder end walls 810*a* and 810*b*. This further demonstrates the consistency between the variation of beverage dome 400 and flat 500 lid configurations of the new invention to create dome 900 and flat 1000 lid configurations for use on disposable food containers 603.

FIG. 34A is a side view in section of dome lid 900 taken substantially along line O-O in FIG. 33, with hatch cover part 800 in the fully closed position and dome brim mount part 600 frictionally clamped to rolled rim 601 (phantom lines) of disposable food container 603 (compressed for ease of illustration). Planar transition panel 621 is disposed inwardly from outside perimeter edge 611, extending horizontally below rectangular frontis block 808 and cylinder 809 of cylindrical housing 807 to merge with inside annular interior rim 623 terminating at inside ledge perimeter edge 624 wherein anti-splash/spill apron 625 wall is downwardly dependent and circumscribes recessed hatch opening 626 (solid line with double-headed arrows), directly below hatch cover part 800 underside bottom surface 817 of recessed top wall 803. Anti-splash/spill apron 625 may be increased in vertical height bringing it closer to food surface plane 627 as previously described in FIG. 27B for extended anti-splash/spill apron 628.

In a further preferred embodiment of this variation on this new invention where hatch cover part 800 is in the fully closed position, the left side of FIG. 34A shows clamping rib 801/locking channel 802 frictionally fitted with downward finger pressure (see FIG. 31A) applied to press fit locking channel 802 to mate over retaining rib 614 first 815*a* and second 815*b* outside walls. Briefly referring to FIG. 34C, locking channel 802 discloses a first inside wall width 819 (double-headed arrows) between locking channel 802 first 802*a* and second 802*b* inside walls which is equal to or marginally narrower than the retaining rib outside wall width 629 (double-headed arrows) between retaining rib 614 first 615*a* and second 615*b* outside walls. This allows locking channel 802 to be reversibly deformably frictionally mated over retaining rib 614 to releasibly lock hatch cover part 800 in the fully closed position when hatch cover part 800 is urged downward with gentle finger pressure applied by thumb 404 and index finger 403 (see FIG. 31A), or any combination of digits on either hand, to clamping rib arch 805, thereby flexing clamping rib 801/locking channel 802 respective first outside wall 804*a*/first inside wall 802*a* and second outside wall 804*b*/second inside wall 802*b* outwards to deformably mate over retaining rib 614 frictionally clamping locking channel 802 first 802*a* and second 802*b* inside walls in a frictional fitment around retaining rib 614 first 615*a* and second 615*b* outside walls in a reversible sturdy but non-permanent configuration, releasably locking hatch cover part 800 in the fully closed position. To better distinguish between locking channel 802 first 802*a* and second 802*b* inside walls and retaining rib 614 first 615*a* and second 615*b* outside walls a third space 905 has been introduced in FIG. 34C for illustrative purposes which gives the appearance that locking channel 802 discloses an inside wall width 819 which is wider than the retaining rib outside wall width 629, which is not the case as mentioned above, wherein locking channel 802 inside wall width 819 is equal to, or marginally narrower than retaining rib outside wall width 629 to allow locking channel 802 to reversibly frictionally mate over retaining rib 614. Returning back to FIG. 34A, the mating of clamping rib 801/locking channel 802 onto retaining rib 614 terminates at open ends 806*a* and 806*b* (phantom lines, 806*b* not shown in this section).

Another preferred embodiment of this variation on this new invention is the vertical height 902 (vertical solid line with double-headed arrows) between food surface plane 627 and underside bottom surface 817 of recessed top wall 803 when hatch cover part 800 is in the fully closed position, which is the consistent with the vertical height 411 for dome lid 400 in FIG. 11A, thereby providing suitable space for accommodating an increased height of food 609 placed in disposable food container 603 or accommodating a topping 903 added to the food surface plane 627, as shown in FIG.

40. This increased vertical height allows hatch cover part 800 to be fully closed without compressing the added topped up layer of food 904 or flattening the peak of added topping 903, thereby maintaining an attractive physical appearance to the prepared food 609 within disposable food container 603 upon pivoting hatch cover part 800 to the fully opened position. This consistency in vertical height between beverage dome lid 400 and dome lid 900 again demonstrates that dome lid 900 is a variation on beverage dome lid 400 and does not represent a separate new species.

Gripping tab 813 is outwardly disposed from clamping rib arch 805 with a front edge 818 lifted by digits of either hand to disengage hatch cover part 800 locking channel 802 from retaining rib 614 for pivoting hatch cover part 800 between fully opened and fully closed positions. Front edge 818 extends just beyond outside wall 610, but within the outside perimeter free edge 605*a* of bottom flange 605, allowing for stacking of dome 900 and flat 1000 lid configurations as shown respectively, in FIGS. 41A and 41B.

Figure 34C:
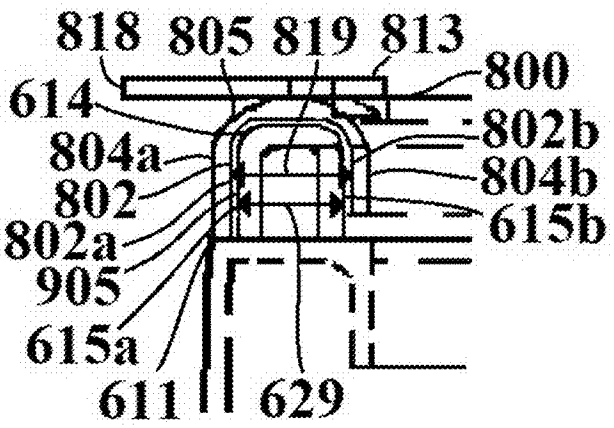
FIG. 34C is a partial side view in section on a larger scale of a portion of the dome lid configuration in FIG. 34A.
Figure 34B:
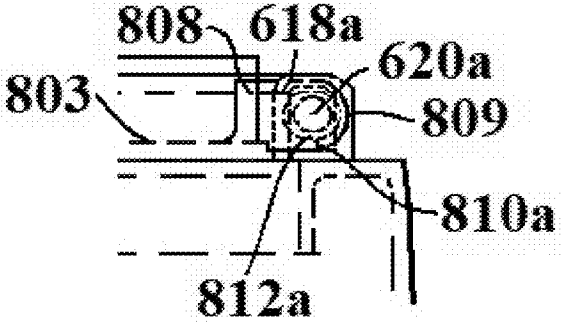
FIG. 34B is a partial side view in section on a larger scale of a portion of the dome lid configuration in FIG. 34A.

FIG. 34B is a partial side view in section on a larger scale of a portion of dome lid 900 in FIG. 34A showing one half of detachable hinge 901 (see FIGS. 33 and 33A) comprised of centrally integrated opposing partially spherical protrusions 620*a* and 620*b* (phantom lines, 620*b* not shown in this section) extending from opposing end walls 618*a* and 618*b* (phantom lines, 618*b* not shown in this section) seated intimately into partially spherical indentation 812*a* and 812*b* (phantom lines, 812*b* not shown in this section), respectively, forming inwardly recessed dished impressions on cylinder end walls 810*a* and 810*b* (phantom lines, 810*b* not shown in this section). The centres of the opposing partially spherical protrusions 620*a* and 620*b* and partially spherical indentation 812*a* and 812*b* are concentric. Cylinder 809 is integrated to rectangular frontis block 808, whereby the bottom of rectangular frontis block 808 is joined to, and upwardly disposed from, recessed top wall 803.

FIG. 34C is a partial side view in section on a larger scale of a portion of dome lid 900 in FIG. 34A showing locking channel 802 mated over retaining rib 614. Locking channel 802 (not at severing location, see FIG. 34D) discloses an inside wall width 819 (solid line with double-headed arrows) between locking channel first 802*a* and second 802*b* inside walls which is equal to, or marginally narrower than the retaining rib outside wall width 629 (solid line with double-headed arrows) between retaining rib 614 first 615*a* and second 615*b* outside walls, thereby allowing locking channel 802 to be reversibly deformably frictionally mated over retaining rib 614 to releasably lock hatch cover part 800 in the fully closed position. Locking channel 802 first inside wall 802*a* and second inside wall 802*b* are in frictional intimate contact respectively with retaining rib 614 first outside wall 615*a* and second outside wall 615*b*, however, to better distinguish the respective inside and outside walls, a third space 905 has been introduced between the walls. Locking channel 802 inside wall width 819 appears wider than retaining rib 614 outside wall width 629, as mentioned above, for illustrative purposes only and is not the case, as locking channel 802 inside wall width 819 is equal to, or marginally narrower than retaining rib 614 outside wall width 629 to allow locking channel 802 to frictionally clamp over retaining rib 614 and reversibly lock hatch cover part 800 over retaining rib 614.

Gripping tab 813 is joined to clamping rib arch 805 and is outwardly disposed terminating at front edge 818 just beyond outside perimeter edge 611, thereby providing a lip to be grasped between the customer's digits of either hand in order to lift hatch cover part 800 upwards to disengage locking channel 802 from retaining rib 614.

Figure 34D:
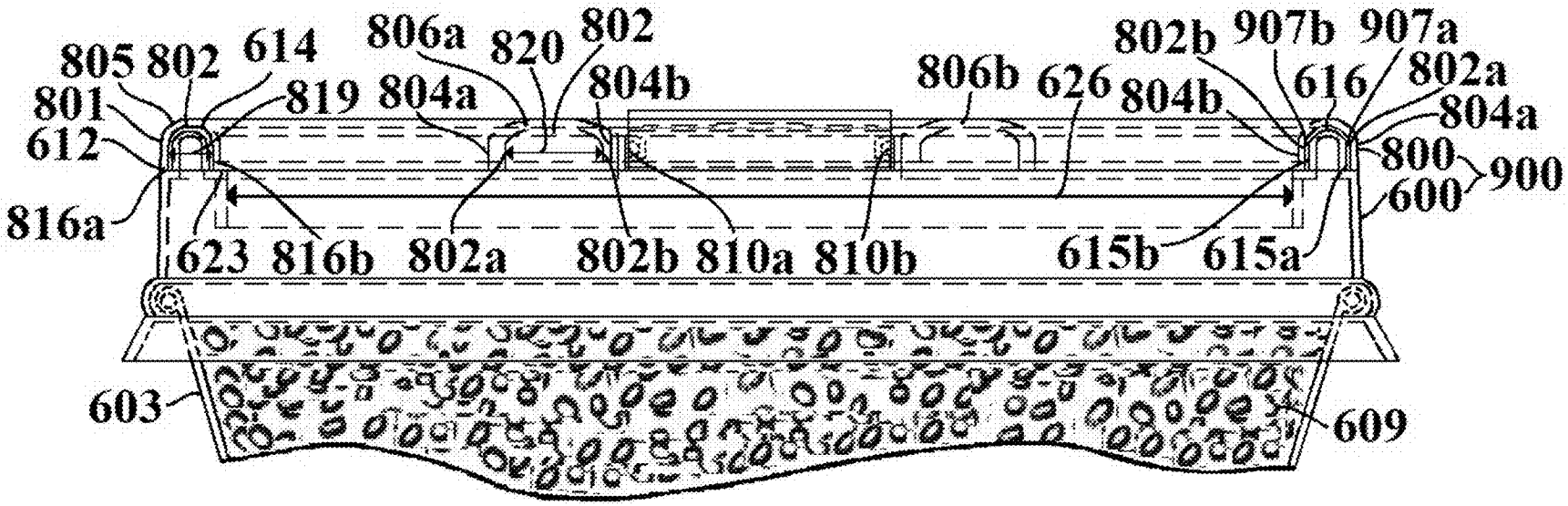
FIG. 34D is a side view in section of the dome lid configuration, mounted to the rolled rim of a food container, compressed for ease of illustration, with the hatch cover part in the fully closed position taken substantially along line P-P in FIG. 33.

FIG. 34D is a side view in section of dome lid 900 taken substantially along line P-P in FIG. 33, with hatch cover part 800 in the fully closed position. Clamping rib 801/locking channel 802 (phantom and solid lines) is reversibly frictionally mated over retaining rib 614 (phantom lines) to releasably lock hatch cover part 800 in the fully closed position shown in opposing cross sections on the extreme left and right outside perimeter of FIG. 34D. Clamping rib first outside wall 804*a*/locking channel first inside wall 802*a* base 816*a* rests on outside annular exterior rim 612, and clamping rib second outside wall 804*b*/locking channel second inside wall 802*b* base 816*b* rests on inside annular interior rim 623, wherein these respective annular exterior and interior rims provide support for locking channel first 802*a* and second 802*b* inside walls to form a snug mated frictional fitment over retaining rib first 615*a* and second 615*b* outside walls when downward pressure is applied by digits of either hand to clamping rib 801/locking channel 802 to frictionally fit locking channel 802 and mate over retaining rib 614. A fourth space 907*a* has been introduced between locking channel first inside wall 802*a* and retaining rib first outside wall 615*a* and a fifth space 907*b* introduced between locking channel second inside wall 802*b* and retaining rib second outside wall 615*b* for illustrative purposes to identify the respective walls are in frictional mated fitment. The contact interface between locking channel 802 mated to retaining rib 614 offers a sealing interface between hatch cover part 800 and dome brim mount part 600 keeping foods 609 within disposable food container 603 and retaining their hot or cold temperatures.

Clamping rib 801/locking channel 802 is severed forming clamping rib/locking channel open ends 806*a* and 806*b* which are intimately closer to cylinder end walls 810*a* and 810*b*. Locking channel 802 (at severing point) discloses a second inside wall width 820 (solid line with double headed arrows) between locking channel first inside wall 802*a* and second inside wall 802*b* (with corresponding clamping rib first outside wall 804*a* and second outside wall 804*b*) which is wider than the second inside wall width 126 (at severing point) between locking channel 102 first inside walls 118*a* and second inside wall 118*b* for hatch cover part 100 on dome lid 400 in FIGS. 11D and 11E wherein clamping rib 101/locking channel 102 were severed further back from cylinder end walls 108*a* and 108*b*. This severing point for clamping rib 801/locking channel 802 offers the benefit of a more complete mating of clamping rib 801/locking channel 802 onto retaining rib 614 to maximize the seal of fully closed hatch cover part 800 over recessed hatch opening 626 (solid line with double-headed arrows) compared with the mating of locking channel 102 over retaining rib 214 in FIG. 11D. The removal of the equivalent of ring-shaped crown portion 210 in this variation on beverage dome 400 and flat 500 lid configurations, also allows hatch cover part 800 to be pivoted to a more horizontal fully opened position without clamping rib arch 805 interfering with retaining rib arch 616 and will be further discussed under FIGS. 35, 37, 38 and 39. Although the locking channel second inside wall width 820 is wider at this location of severing, compared with the locking channel first inside wall width 819 (solid line with double-headed arrows) there is no loss in the intimate mated fitment of clamping rib 801/locking channel 802 over retaining rib 614 thereby retaining a snug interface and again representing a variation on this new invention and not an introduction of a new species.

Figure 34E:
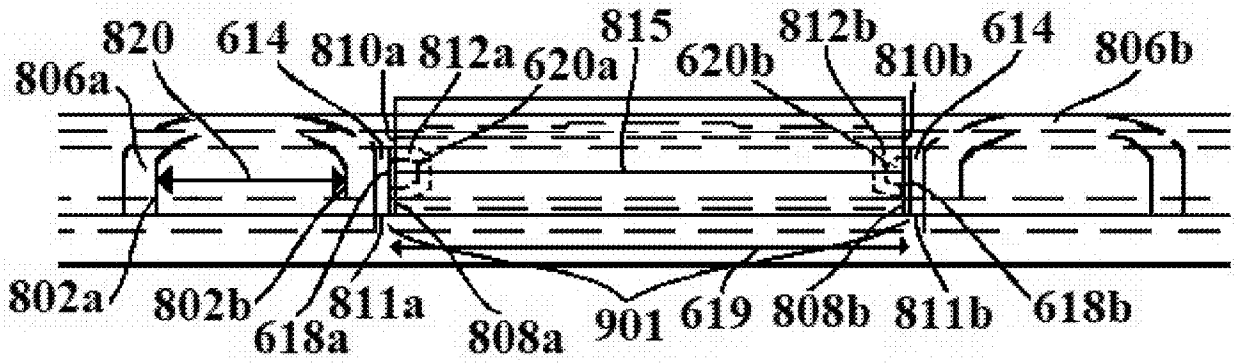
FIG. 34E is a partial side view in section on a larger scale of a portion of the dome lid configuration in FIG. 34D.

FIG. 34E is a partial side view in section on a larger scale of a portion of dome lid 900 in FIG. 34D with phantom lines depicting hidden elements and showing respective clamping rib/locking channel open ends 806*a* and 806*b*, wherein a portion of retaining rib 614 is exposed and narrow segments 811*a* and 811*b* are formed between clamping rib/locking channel open ends 806*a* and 806*b* and rectangular frontis block end walls 808*a* and 808*b*. Opposing partially spherical protrusions 620*a* and 620*b*, respectively extend from retaining rib end walls 618*a* and 618*b* seating inside partially spherical indentation 812*a* and 812*b*, respectively, formed at the opposing ends of cylinder end walls 810*a* and 810*b*, comprising detachable hinge 901. This enlarged view also shows locking channel severed first inside wall 802*a* and second inside wall 802*b* separated by second inside wall width 820 (solid line with double-headed arrows) which is wider when compared with second inside wall width 126 (taken at the severing point) between locking channel 102 inside walls 118*a* and 118*b* for hatch cover part 100 on beverage dome lid 400 in FIGS. 11D and 11E.

Detachable hinge 901 is formed in the same manner as detachable hinge 401 for beverage dome 400 and flat 500 lid configurations in FIGS. 10, 11D and 11H when assembling hatch cover part 800 to the top portion of dome 600 or flat 700 brim mount parts. The joining of female hinge part hatch cover part 800 to male hinge part dome 600 and flat 700 brim mount parts is initiated when opposing end walls 618*a* and 618*b* are flexed outwards increasing the longitudinal dimension of first 619 (solid line with double-headed arrows). This allows for cylindrical housing 807 (see FIGS. 33 and 33A) to be inserted into first gap 619 until the two opposing partially spherical protrusions 620*a* and 620*b* (phantom lines), respectively extruding from end walls 618*a* and 618*b*, are concentric with partially spherical indentation 812*a* and 812*b* (phantom lines). Partially spherical indentation 812*a* and 812*b* are inwardly disposed dished recessions, respectively on opposing cylinder end walls 810*a* and 810*b* with radii equal or slightly larger than the radii of the opposing partially spherical protrusions 620*a* and 620*b*. Once the respective male and female hinge part are aligned the flexing of first gap 619 is released, returning first gap 619 to its original, pre-flexed longitudinal dimension. This allows partially spherical indentation 812*a* and 812*b*, respectively, to snugly envelope opposing partially spherical protrusions 620*a* and 620*b*, permitting partially spherical indentation 812*a* and 812*b* to be pressed snap fitted firmly over opposing partially spherical protrusions 620*a* and 620*b*, forming a snug fit into the interior of dished partially spherical indentation 812*a* and 812*b* thereby forming a constrained detachable hinge 901, wherein the respective end walls 618*a* and 618*b* are also brought into intimate contact with cylinder end walls 810*a* and 810*b*. Opposing partially spherical protrusions 620*a* and 620*b* allow the dished partially spherical indentation 812*a* and 812*b*, enshrouding the opposing partially spherical protrusions 620*a* and 620*b*, to pivot in unison about a longitudinal axis line 815 (solid line) while limiting lateral movement which may disengage partially spherical indentation 812*a* and 812*b* from opposing partially spherical protrusions 620*a* and 620*b*. The depth of the dished out partially spherical indentation 812*a* and 812*b* at the ends of cylinder end walls 810*a* and 810*b* and the depth of opposing partially spherical protrusions 620*a* and 620*b* extending from end walls 618*a* and 618*b* are designed to ensure the two parts mate and retain holding power and provide sufficient resistance to forces and moments which tend to separate detachable hinge 901, but of such resistance, together with the intimate contact of the respective end walls, to allow for holding hatch cover part 800 in the fully closed or fully opened positions, and any intermediate opened position in between, while not impeding the articulated movement of hatch cover part 800. Similarly, hatch cover part 800 may be attached to the top portion of dome 600 and flat 700 brim mount parts, while dome 600 and flat 700 brim mount parts are clamped to container 603 through an alternative method described earlier under FIG. 31B.

Figure 34F:
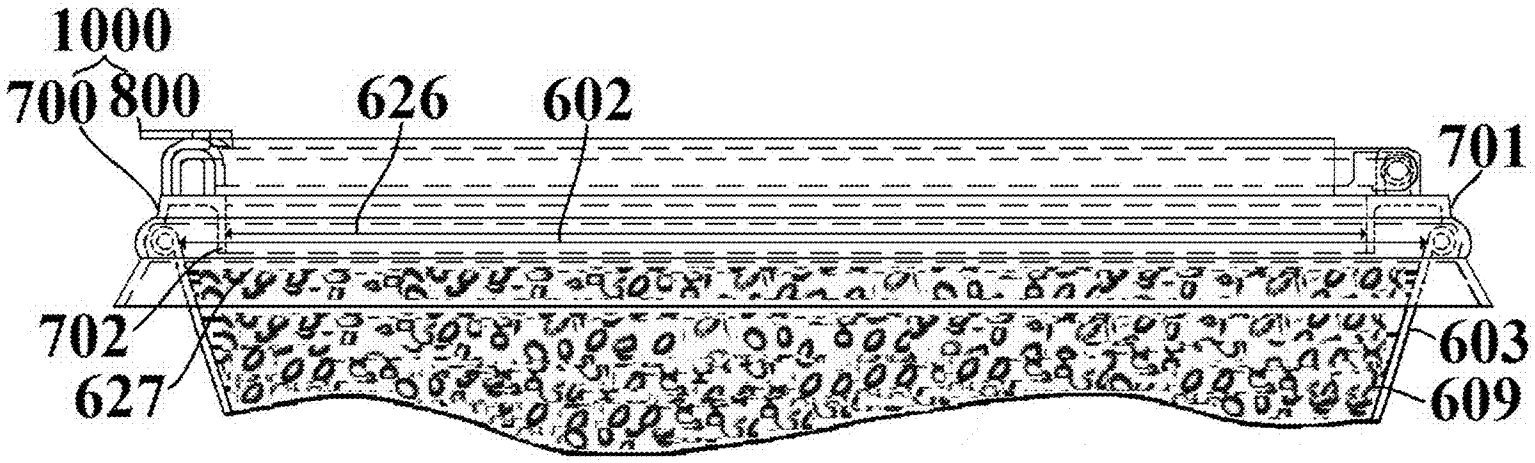
FIG. 34F is a side view in section of the flat lid configuration, mounted to the rolled rim of a food container, compressed for ease of illustration, with the hatch cover part in the fully closed position taken substantially along line O-O in FIG. 33.

FIG. 34F is a side view in section of flat lid 1000 of this variation on this new invention taken substantially along line O-O in FIG. 33. All the preferred embodiments and parts described in FIG. 34A are captured in FIG. 34F with one difference regarding the height of outside wall 610 which has been vertically reduced in height forming compressed outside wall 701 on flat brim mount part 700. As previously described under FIG. 9A regarding flat brim mount part 300, this variation in beverage flat lid 500 for use on disposable food containers 603 (compressed for ease of illustration), lowers hatch cover part 800 bringing it into a closer relationship with upper end opening 602 (solid line with double-headed arrows) of disposable food container 603 and also lowers anti-splash/spill apron base 702 to just above or submerged below food surface plane 627, thereby further reducing side-to-side movement of food 609 at food surface plane 627 from rising upwards through recessed hatch opening 626 (solid line with double-headed arrows) as a result of movement or jostling of disposable food container 603 due to walking or other movements of the hand.

A preferred embodiment of flat lid 1000, consistent with beverage flat lid 500, is that marginally less material may be used in manufacturing, resulting in more units being stacked and stored in the same space compared with dome lid 900. Flat lid 1000 offers a more streamlined disposable food container 603/lid 1000 combination which may be more manageable in some instances than taller disposable food container 603/dome lid 900 configuration options, and may have other benefits related to stacking food containers for packaging, thereby offering merchants two lid configuration options for sealing disposable food containers 603.

Figure 34G:
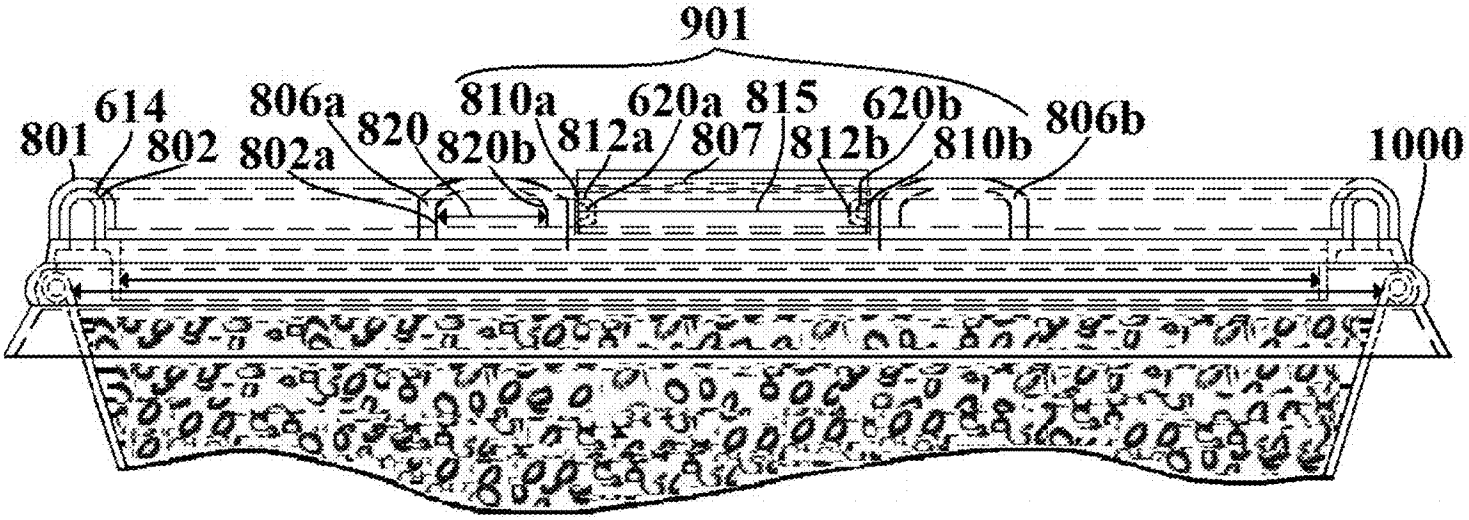
FIG. 34G is a side view in section of the flat lid configuration, mounted to the rolled rim of a food container, compressed for ease of illustration, with the hatch cover part in the fully closed position taken substantially along line P-P in FIG. 33.

FIG. 34G is a side view in section of flat lid 1000 of this variation on this new invention taken substantially along line P-P in FIG. 33 showing a cross section of cylindrical housing 807 along its longitudinal axis line 815 (solid line) with opposing partially spherical protrusions 620*a* and 620*b* snap fitted into partially spherical indentation 812*a* and 812*b* and the relationship of open ends 806*a* and 806*b* relative to cylinder end walls 810*a* and 810*b*. The preferred embodiments described in FIGS. 34D and 34E regarding the mating of clamping rib 801/locking channel 802 onto retaining rib 614 and the description and functionality of the parts comprising detachable hinge 901 are captured in FIG. 34G. Locking channel second inside wall width 820 (solid line with double-headed arrows) between locking channel first inside wall 802*a* and second inside wall 802*b* due to the severing angle when clamping rib 801/locking channel 802 are severed closer to cylinder end walls 810*a* and 810*b* and retained in flat lid 1000 in FIG. 34G.

FIG. 35 is a perspective top view of dome lid 900, with dome brim mount part 600 clamped to the rolled rim 601 (see cut-away VI in FIG. 24A) of disposable food container 603 (compressed for ease of illustration) with hatch cover part 800 pivoted about detachable hinge 901 to its fully opened position thereby exposing concealed centrally positioned substantially annular recessed hatch opening 626 (solid line with double-headed arrows) circumscribed within the wall of anti-splash/spill apron 625. The opening of hatch cover part 800 progresses from the fully closed position in FIG. 31C to a fully opened position, completely disengaging clamping rib 801/locking channel 802 from frictional mated fitment to retaining rib 614.

Recessed hatch opening 626 offers substantial surface area for unobstructed and easy access to foods 609 through the top of dome lid 900 for the purposes of inserting a utensil to retrieve food 609 within disposable food container 603 without the necessity and risks of removing dome lid 900 from rolled rim 601 of disposable food container 603. In its fully opened position, hatch cover part 800 is inverted, showing underside bottom surface 817 of recessed top wall 803 (not shown), gripping tab underside surface 821 and locking channel 802 facing upwards, wherein hatch cover part 800 is removed from interfering when accessing recessed hatch opening 626 with a utensil to retrieve food 609 or adding different toppings 903 (see FIG. 40) or condiments, or dunking an adjoining food with the meal within disposable food container 603. Hatch cover part 800 may be readily pivoted into its fully opened position or put into its fully closed position, by the customer and/or server or barista, very quickly and reliably, wherein opening and closing may be accomplished any number of times with minimal wear on the respective detachable hinge parts. The snug interface between the opposing ends of detachable hinge 901 parts allows hatch cover part 800 to be pivoted to any intermediate opened position between the fully closed and fully opened positions for such purposes as cooling a hot food through the venting of steam and heat 906 (solid wavy lines with single arrows at the top) through exposed recessed hatch opening 626 from disposable food container 603.

In another preferred embodiment clamping rib/locking channel open ends 806*a* and 806*b* bring clamping rib second outside wall 804*b*/locking channel second inside wall 802*b* into intimate contact with retaining rib 614 first outside wall 615*a* (also see FIG. 37) when gentle downward finger pressure is applied to inverted hatch cover part 800 underside bottom surface 817 after pivoting hatch cover part 800 to the fully opened position thereby creating frictional contact between clamping rib second outside wall 804*b*/locking channel second inside wall 802*b* and retaining rib 614 first outside wall 615*a* of dome brim mount part 600, wedging and retaining hatch cover part 800 in the fully opened position. Contact between the opposing side of clamping rib second outside wall 804*b*/locking channel second inside wall 802*b* on open end 806*b* with retaining rib 614 first outside wall 615*a* is not visible in FIG. 35. Hatch cover part 800 remains in the fully opened position until the customer gently pries hatch cover part 800 upwards to gently disengage clamping rib second outside wall 804*b*/locking channel second inside wall 802*b* at opens 806*a* and 806*b* from frictional contact with retaining rib 614 first outside wall 615*a*, to pivot hatch cover part 800 back to the fully closed position (FIG. 31A). The frictional interface between cylinder end walls 810*a* and 810*b* and retaining rib end walls 618*a* and 618*b* (see FIGS. 34D and 34E) also combine with the wedging of clamping rib second outside walls 804*b*/locking channel second inside wall 802*b* against retaining rib 614 first outside wall 615*a* to further retain hatch cover part 800 in the fully opened position. This preferred embodiment also applies to retaining hatch cover part 800 where clamping rib second outside walls 804*b*/locking channel second inside wall 802*b* on respective opposing open ends 806*a* and 806*b* are frictionally wedged against retaining rib 614 first outside wall 615*a* for flat lid 1000 in FIG. 36. To prevent hatch cover part 800 from pivoting below the recessed plane of recessed hatch opening 626 (see FIGS. 38A and 38C) and to further stabilize hatch cover part 800 in the fully opened position, a portion of clamping rib arch 805 on the inverted side of clamping rib 801 (facing downwards) rests on outside annular exterior rim 612 (also see FIG. 36) thereby offering further support to retain hatch cover part 800 in the fully opened position approaching a substantially horizontal configuration and preventing hatch cover part 800 from pivoting below the recessed plane of recessed hatch opening 626 (also see FIG. 38A).

FIG. 36 is a perspective top view of flat lid 1000, with flat brim mount part 700 clamped to rolled rim 601 (see cutaway VII in FIG. 25A) of disposable food container 603 (compressed for ease of illustration) with hatch cover part 800 pivoted about detachable hinge 901 to its fully opened inverted position showing underside bottom surface 817 of recessed top wall 803 (not shown), gripping tab underside surface 821 and locking channel 802 facing upwards, and exposing concealed recessed hatch opening 626 (solid line with double-headed arrows) centrally positioned and substantially annular concentric within circumscribing anti-splash spill apron 625 wall. Flat lid 1000 retains all of the preferred embodiments described for dome lid 900 when hatch cover part 800 is in the fully opened position as described under FIG. 35, with only one difference between the two lid configurations, which is the compression of outside wall 610 on dome lid 900 to form compressed outside wall 701 on flat brim mount part 700 of flat lid 1000 in FIG. 36. Although flat lid 1000 has a compressed outside wall 701, clamping rib/locking channel open ends 806*a* and 806*b* bring clamping rib second outside wall 804*b*/locking channel second inside wall 802*b* into intimate contact with retaining rib 614 first outside wall 615*a* (also see FIG. 37) when gentle downward pressure from digits of either hand is applied to inverted hatch cover part 800 underside bottom surface 817 after pivoting hatch cover part 800 to the fully opened position, thereby creating frictional contact between clamping rib second outside wall 804*b*/locking channel second inside wall 802*b* and retaining rib 614 first outside wall 615*a*, wedging and retaining hatch cover part 800 in the fully opened position. Contact between opposing side of clamping rib second outside wall 804*b*/locking channel second inside wall 802*b* on open end 806*b* with retaining rib 614 first outside wall 615*a* is not visible in this FIG. 36. Similarly a portion of clamping rib arch 805 on the inverted side of clamping rib 801 (facing downwards) rests on outside annular exterior rim 612 (also see FIG. 35) thereby offering further support to retain hatch cover part 800 in the fully opened position approaching a substantially horizontal configuration and preventing hatch cover part 800 from pivoting below the recessed plane of recessed hatch opening 626 (also see FIG. 38C).

Another preferred embodiment of flat lid 1000 is that recessed hatch opening 626 is brought into closer proximity to food surface plane 627 (also see FIGS. 38C and 38D), thereby allowing for utensils to more easily manoeuver to the full depth of disposable food container 603 when retrieving food 609 from within food container 603.

The ability to open hatch cover part 800 without the necessity of removing dome 900 and flat 1000 lid configurations from rolled rim 601, reduces the container/lid configuration to a sealed, single unit rather than two separate units, which otherwise requires the lid to be disengaged from rolled rim 601 of disposable food container 603 and entirely removed in order to access food 609 within disposable food container 603. Additionally the customer must manage two units while also attempting to access food 609 within disposable food container 603 and subsequently consume this retrieved food 609. This variation on this new invention adopting this new two part container lid configuration for use on disposable food container 603 allows the server and/or barista or the customer to pivot hatch cover part 800 to the fully opened position to deposit food into disposable food container 603 through recessed hatch opening 626 with dome 900 or flat 1000 lid configurations pre-attached to rolled rim 601 of disposable food container 603. This eliminates the step of first filling disposable food container 603 with food then clamping dome 900 or flat 1000 lid configurations to rolled rim 601 and risking possible accidents in the process. This is consistent with the option described for beverage 209 filled disposable container 203 where beverage dome 400 and flat 500 lid configurations may be optionally first clamped to rolled rim 201 of disposable beverage container 203 followed by pivoting hatch cover part 100 to the fully opened position and then pouring beverage through recessed hatch opening 227 as described earlier under FIGS. 8A and 16A, and, therefore supports dome 900 and flat 1000 lid configurations as respective variations of beverage dome 400 and flat 500 configurations and not indicative as a new and separate species.

Figure 37:
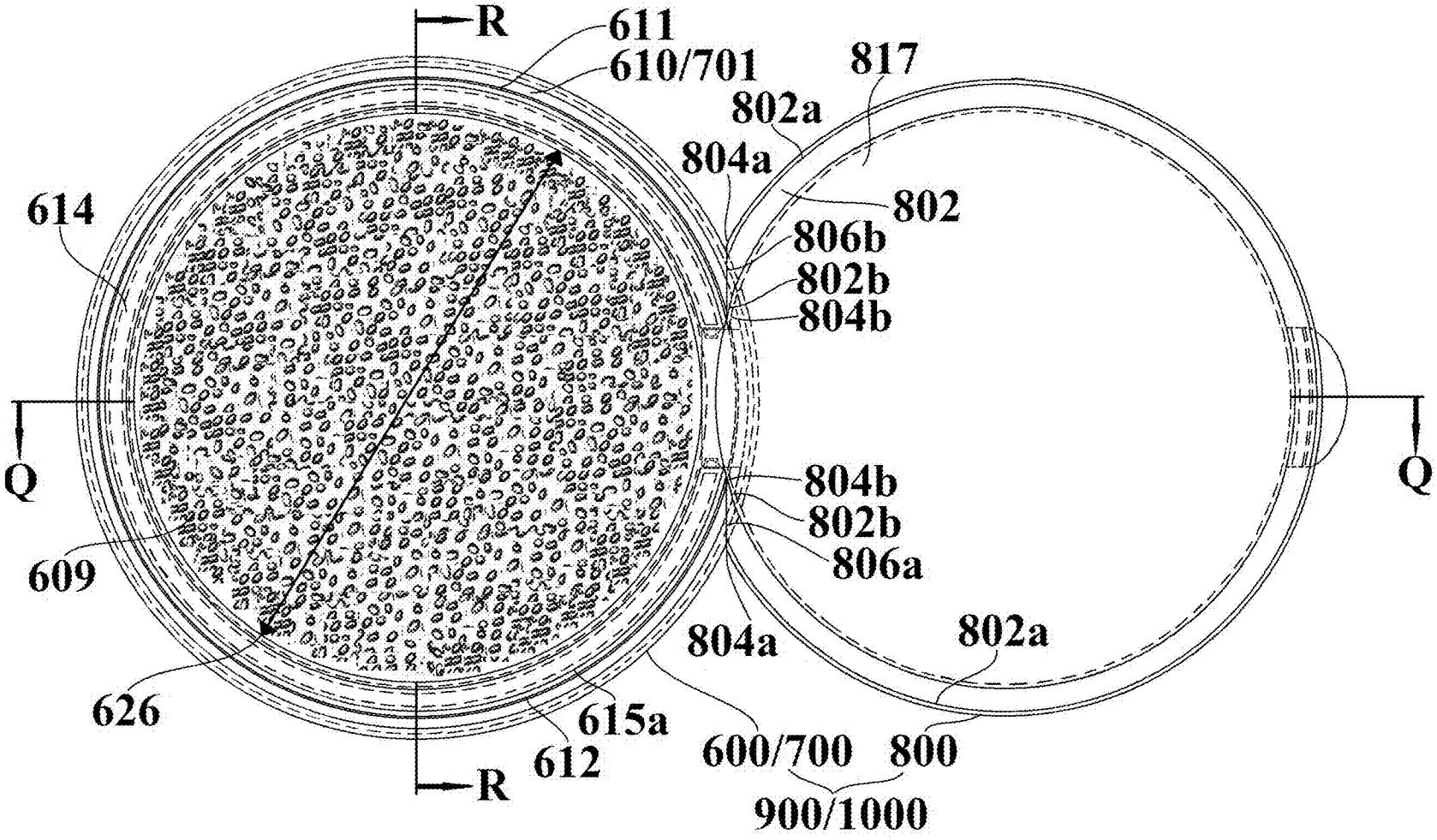
FIG. 37 is a top plan view representing both the dome and flat lid configurations in FIGS. 35 and 36, respectively.

FIG. 37 is a top plan view representing dome lid 900 in FIG. 35 and flat lid 1000 in FIG. 36 with hatch cover part 800 in the fully opened position. Outside wall 610 and compressed outside wall 701, respectively, for dome 600 and flat 700 brim mount part, are not distinguishable in this plan view. The removal of equivalent ring-shaped crown portion 210 and compressed ring-shaped crown portion 301, respectively, further increases the diameter of the already enlarged recessed hatch opening 626 (solid line with double-headed arrows) created with the expanded diameter of retaining rib 614, occupying the vacated space where the ring-shaped crown portions would be located if retained following the increased diameter of beverage dome 400 and flat 500 lid configurations for use on disposable food containers 603 (see FIG. 26). This variation on beverage dome 400 and flat 500 lid configurations are suitably adopted for use on disposable food containers 603, providing a recessed hatch opening 626 of sufficient diameter necessary to easily and efficiently extract foods 609 from within disposable food container 603 with utensils through the recessed hatch opening 626 without removing either dome 900 or flat 1000 lid configurations from disposable food container 603. The increase in diameter of recessed hatch opening 626 on dome 600 and flat 700 brim mount parts is only marginally less than the diameter of the upper end opening 602 of disposable food container 603 (see FIG. 34F), thereby minimizing the reduction in access to the upper end opening 602 of disposable food container 603 when dome 900 and flat 1000 lid configurations are clamped to rolled rim 601 (see FIG. 33) and hatch cover part 800 is pivoted to the fully opened position. The suitably enlarged recessed hatch opening 626 also offers a sufficiently sized diameter opening for dunking accompanying foods such as crackers included with the main food 609 within disposable food container 603 and will be further discussed under FIG. 39.

Figure 37A:
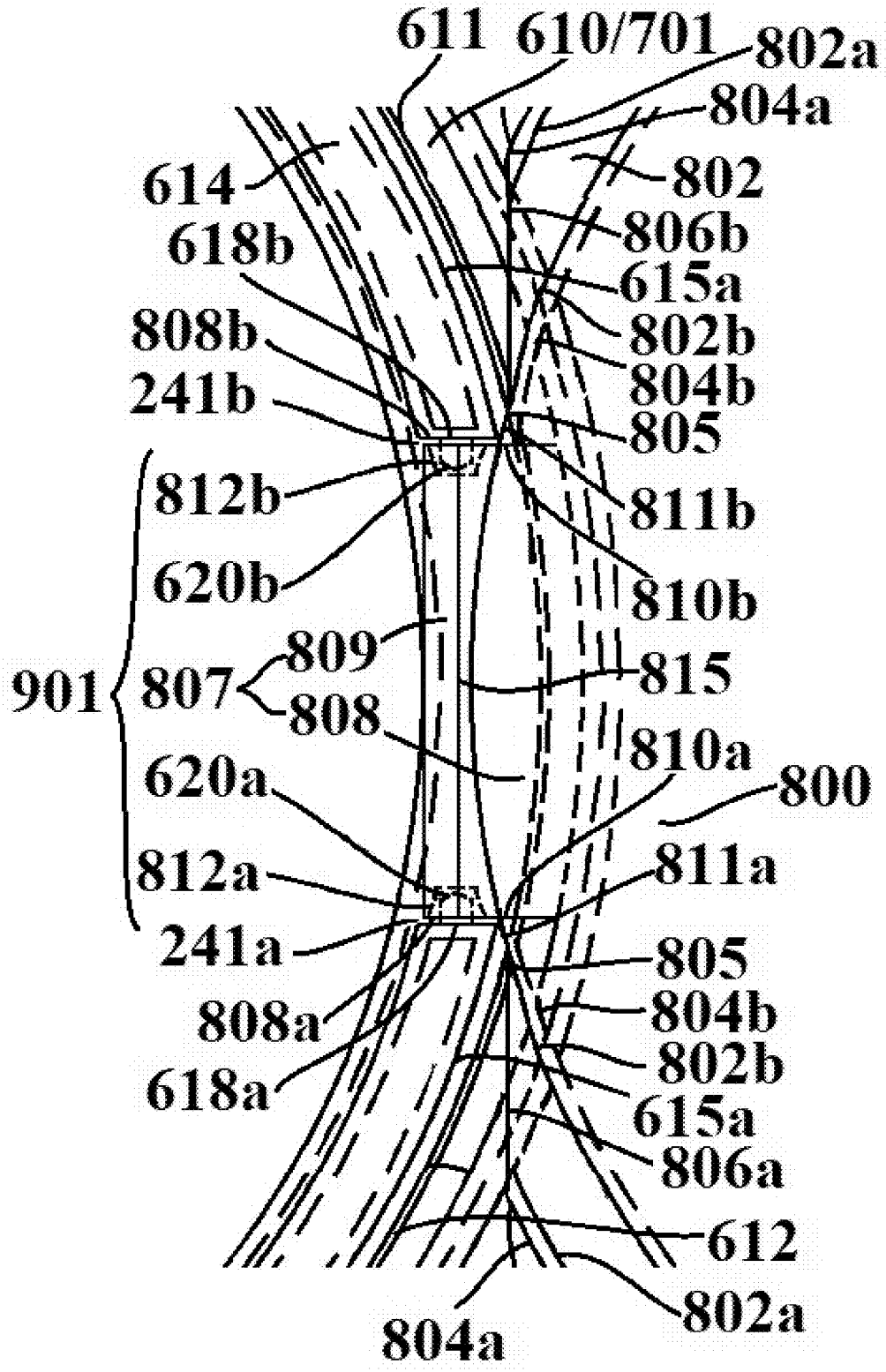
FIG. 37A is a partial top plan view on a larger scale of a portion of the dome and flat lid configurations in FIG. 37.

In a preferred embodiment of this variation on the present invention and consistent with hatch cover part 100 in FIG. 18, FIG. 37 shows hatch cover part 800 pivoted to its fully opened position and gently pressed downward bringing clamping rib second outside wall 804*b*/locking channel second inside wall 802*b* on both respective ends of clamping rib/locking channel open ends 806*a* and 806*b* of clamping rib 801 (not visible in FIG. 37)/locking channel 802 (facing upwards) into intimate contact with, and frictionally wedged against, retaining rib 614 first outside wall 615*a* assisting in retaining hatch cover part 800 in a rigid opened position, as first shown in FIGS. 35 and 36 and further demonstrated again in FIG. 37A. Clamping rib first outside wall 804*a*/locking channel first inside wall 802*a* are shown beyond outside perimeter edge 611 and outside wall 610 and compressed outside wall 701 and not in contact with retaining rib 614 first outside wall 615*a*. A portion of clamping rib arch 805 (not visible in FIG. 37) on the inverted side of clamping rib 801 (not visible, facing downwards), rests on outside annular exterior rim 612 (see FIGS. 35, 36, 38A) thereby offering further support to retain hatch cover part 800 in the fully opened position and preventing hatch cover part 800 from pivoting below the recessed plane of recessed hatch opening 626, and is further illustrated in side section FIG. 38A. This preferred embodiment helps to stabilize hatch cover part 800 in a firm horizontal position for the optional purpose of using underside bottom surface 817 of recessed top wall 803 (not shown) as a support to rest accompanying foods, such as crackers, included with the main food 609, or a utensil, or a napkin, as an alternative surface and will be further discussed in FIG. 39.

FIG. 37A is a partial top plan view on a larger scale of a portion of the plan view representing dome lid 900 and flat lid 1000 in FIG. 37 with phantom lines depicting hidden elements. In a preferred embodiment of this variation on this new invention, where hatch cover part 800 is pivoted to the fully opened position, gentle downward pressure from digits of either hand, distributed on locking channel 802, brings clamping rib second outside wall 804*b*/locking channel second inside wall 802*b* of the respective clamping rib/locking open ends 806*a* and 806*b*, into intimate contact with, and frictionally wedged against, retaining rib 614 first outside wall 615*a* to retain hatch cover part 800 in a rigid opened position as first shown in FIGS. 35 and 36. Clamping rib first outside wall 804*a*/locking channel first inside wall 802*a* are shown beyond outside perimeter edge 611 and outside wall 610 and compressed outside wall 701 and not in contact with retaining rib 614 first outside wall 615*a*. Narrow segments 811*a* and 811*b* are formed between the ends of clamping rib second outside wall 804*b* and rectangular frontis block end walls 808*a* and 808*b* of rectangular frontis block 808. A portion of clamping rib arch 805 (facing downwards) on the underside of inverted clamping rib 801 (not visible in FIG. 37A) rests on outside annular exterior rim 612 thereby offering further support to retain hatch cover part 800 in the fully opened position and preventing hatch cover part 800 from pivoting below the recessed plane of recessed hatch opening 626 (see also FIG. 38A).

Opposing partially spherical protrusions 620*a* and 620*b*, respectively extend from retaining rib end walls 618*a* and 618*b* seating inside partially spherical indentation 812*a* and 812*b*, respectively formed at the opposing ends of cylinder end walls 810*a* and 810*b* of cylinder 809, part of cylindrical housing 807, comprising detachable hinge 901. Longitudinal axis line 815 (solid line) shows the concentric relationship and alignment of opposing partially spherical protrusions 620*a* and 620*b* respectively seated in partially spherical indentation 812*a* and 812*b*. FIG. 37A shows a first space 241*a* and a second space 241*b*, respectively, between end walls 618*a* and 618*b* and cylinder end walls 810*a* and 810*b* for illustrative purposes to better identify these respective parts, however, end walls 618*a* and 618*b* and cylinder end walls 810*a* and 810*b* are designed and manufactured for the purposes of being in intimate contact to generate the friction between the contact walls to retain hatch cover part 800 at respective intermediate opened positions in a hands-free manner, as previously described.

Figure 38A:
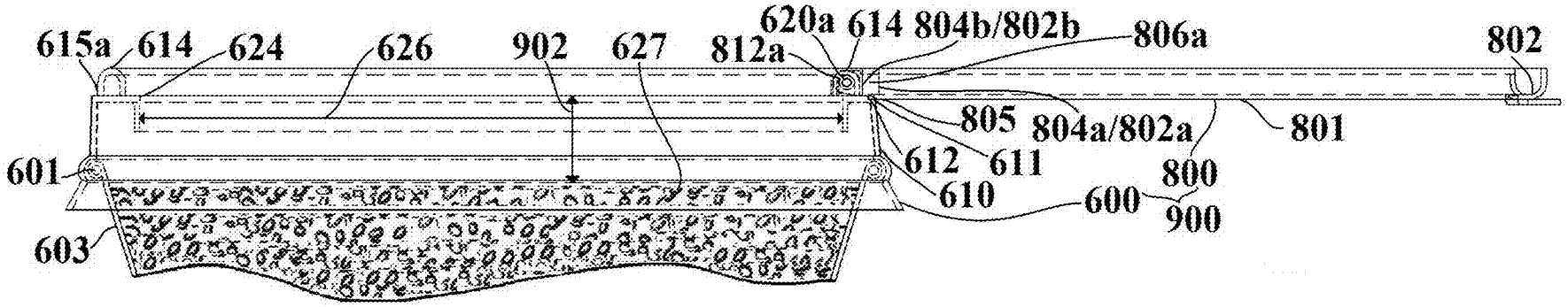
FIG. 38A is a side view in section of the dome lid configuration, mounted to the rolled rim of a food container, compressed for ease of illustration, with the hatch cover part in the fully opened position taken substantially along line Q-Q in FIG. 37.

FIG. 38A is a side view in section of dome lid 900 taken substantially along line Q-Q in FIG. 37, with hatch cover part 800 in the fully opened position and with dome brim mount part 600 frictionally clamped to rolled rim 601 (phantom lines) of disposable food container 603 (compressed for ease of illustration). Eliminating the equivalent of ring-shaped crown portion 210 and compressed ring-shaped crown portion 301 and replacing with expanded diameter retaining rib 614 allows hatch cover part 800 to pivot more closely to a horizontal position unlike the pivoting of hatch cover part 100 in FIGS. 16A and 17A for beverage dome 400 and flat 500 lid configurations, where hatch cover part 100 is at a low angle of slope when in the fully opened position. This brings clamping rib/locking channel ends 806*a* and 806*b* (806*b* not shown) intimately closer to retaining rib 614 first outside wall 615*a* where clamping rib second outside wall 804*b*/locking channel second inside wall 802*b* (the opposing side of clamping rib second outside wall 804*b* and locking channel second inside wall 802*b* is not shown) are frictionally wedged against retaining rib 614 first outside wall 615*a* as shown in FIGS. 35, 36, 37 and 37A. Clamping rib second outside wall 804*b*/locking channel second inside wall 802*b* are not distinguishable in this cross-section. Clamping rib first outside wall 804*a*/locking channel first inside wall 802*a* (opposite side of clamping rib first outside wall 804*a*/locking channel first inside wall 802*a* are not shown) are shown parallel to clamping rib second outside wall 804*b*/locking channel second inside wall 802*b* and are beyond outside perimeter edge 611 of outside wall 610 and are not in contact with retaining rib 614 first outside wall 615*a* as shown in FIGS. 37 and 37A. Clamping rib first outside wall 804*a*/locking channel first inside wall 802*a*, as well, are not distinguishable in this cross section. Partially spherical indentation 812*a* (partially spherical indentation 812*b* is not shown) enshrouds opposing partially spherical protrusion 620*a* (opposing partially spherical protrusion 620*b* is not shown). A portion of clamping rib arch 805 on the inverted side of clamping rib 801 facing downwards, and locking channel 802 facing upwards, rests on outside annular exterior rim 612 thereby offering further support to retain hatch cover part 800 in a fully opened position and preventing hatch cover part 800 from pivoting below the plane of recessed hatch opening 626 (solid line with double-headed arrows) formed around inside ledge perimeter edge 624.

Figure 40:
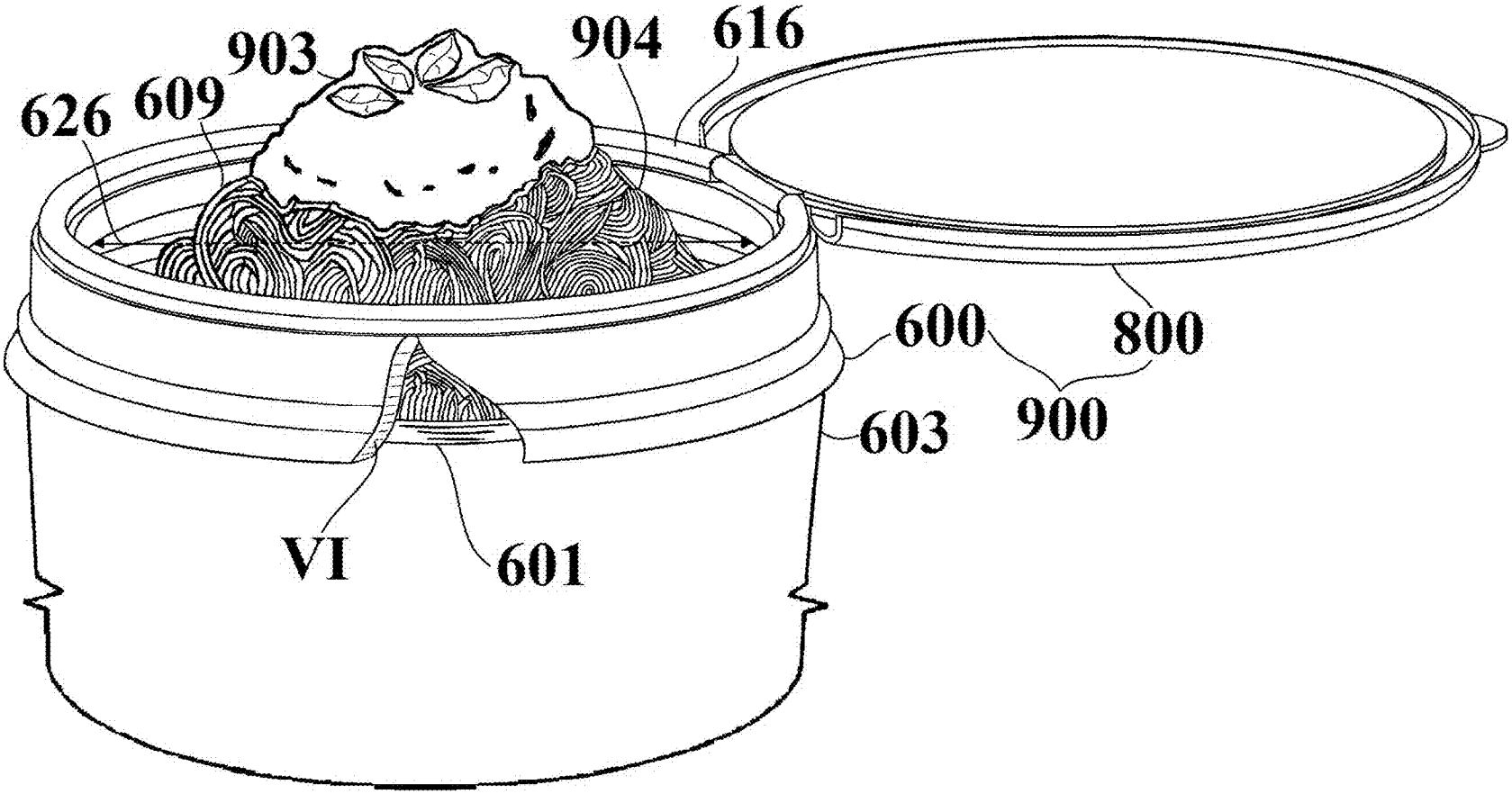
FIG. 40 is a top perspective view of the dome lid configuration, mounted to the rolled rim of a food container, compressed for ease of illustration, with the hatch cover part in the fully opened position showing a prepared food in the container.

The opened hatch cover part 800 in FIG. 38A shows the increase in vertical height 902 (solid vertical line with double-headed arrows), also see FIG. 34A when hatch cover part 800 is in the fully closed position, to accommodate increased height of toppings 903 added to the food surface plane 627 without toppings 903 potentially dripping beyond the circumference of recessed hatch opening 626 and over retaining rib 614, as further discussed under FIG. 40.

Figure 38B:
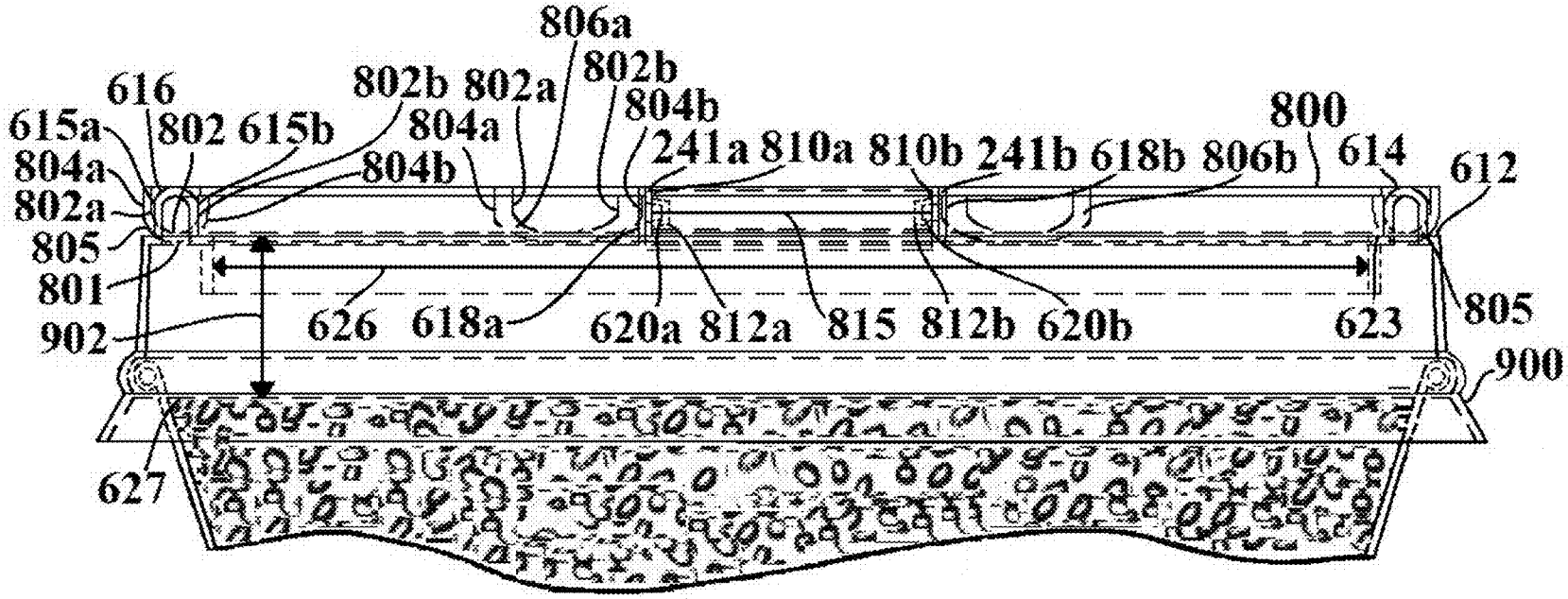
FIG. 38B is a side view in section of the dome lid configuration, mounted to the rolled rim of a food container, compressed for ease of illustration, with the hatch cover part in the fully opened position taken substantially along line R-R in FIG. 37.

FIG. 38B is a side view in section of dome lid 900 taken substantially along line R-R in FIG. 37, with hatch cover part 800 in the fully opened position. At the right and left sides of FIG. 38B retaining rib 614 is positioned between outside annular exterior rim 612 and inside annular interior rim 623. Clamping rib 801 and locking channel 802 are inverted with clamping rib arch 805 facing downwards and locking channel 802 facing upwards and are in vertical overlapping alignment with retaining rib 614 wherein clamping rib first outside wall 804*a*/locking channel first inside wall 802*a* are aligned and overlapping retaining rib 614 first outside wall 615*a*, and clamping rib second outside wall 804*b*/locking channel second inside wall 802*b* overlap retaining rib 614 second outside wall 615*b* respectively, with retaining rib arch 616 separating retaining rib 614 first outside wall 615*a* and second outside wall 615*b*.

Clamping rib/locking open ends 806*b* and 806*a* are inverted with hatch cover part 800 in the fully opened position where clamping rib second inside wall 804*b*/locking channel second inside wall 802*b* at the severing point (defined by clamping rib/locking channel open ends 806*b* and 806*a*) of clamping rib 801/locking channel 802 are intimately close to cylinder end walls 810*a* and 810*b* with a portion of clamping rib arch 805 resting on outside annular exterior rim 612 as seen in FIG. 38A. Clamping rib first outside wall 804*a*/locking channel first inside wall 802*a* are also shown at the ends of clamping rib/locking channel open ends 806*b* and 806*a*. A first space 241*a* and a second space 241*b* between end walls 618*a* and 618*b* and cylinder end walls 810*a* and 810*b* have been added to better distinguish these respective end walls, which are in fact in intimate contact utilizing their frictional fitment to retain hatch cover part 800 at different intermediate opened positions between fully open and fully closed positions. Longitudinal axis line 815 (solid line) shows the concentric relationship and alignment of opposing partially spherical protrusions 620*a* and 620*b* respectively seated in partially spherical indentation 812*a* and 812*b*. The vertical height 902 (solid vertical line with double-headed arrows) has been included showing the available space between the food surface plane 627 and recessed hatch opening 626 (solid line with double-headed arrows).

Figure 38C:
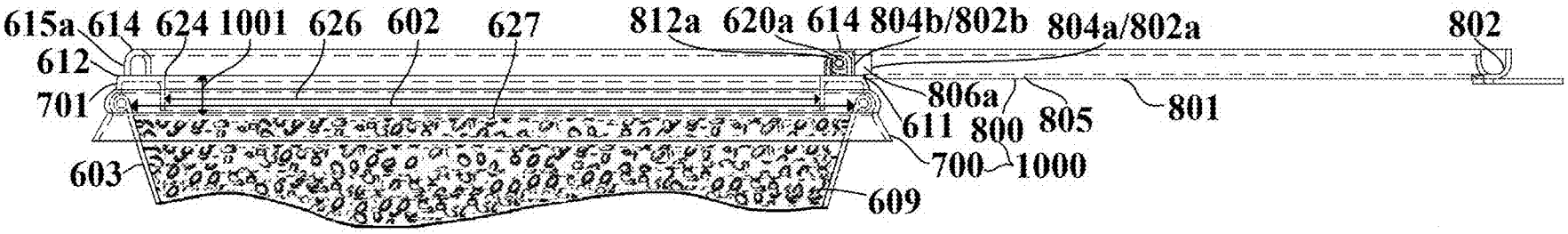
FIG. 38C is a side view in section of the flat lid configuration, mounted to the rolled rim of a food container, compressed for ease of illustration, with the hatch cover part in the fully opened position taken substantially along line Q-Q in FIG. 37.

FIG. 38C is a side view in section of flat lid 1000 taken substantially along line Q-Q in FIG. 37, with hatch cover part 800 in the fully opened position. Some of the same preferred embodiments and reference numbers described for dome lid 900 under FIG. 38A, with the only variation being the introduction of compressed outside wall 701 for flat brim mount part 700, are reproduced for flat lid 1000 in FIG. 38C. A preferred embodiment of flat lid 1000 is that recessed hatch opening 626 (solid line with double-headed arrows) is vertically lower and closer to food surface plane 627 and food 609 in disposable food container 603 upper end opening 602 (solid line with double-headed arrows) due to compressed outside wall 701 as shown with reduced vertical height 1001 (solid vertical line with double-headed arrows) compared with vertical height 902 in FIG. 38A, thereby creating a reduced distance the customer must extend a utensil to reach the full depth of disposable food container 603 to retrieve the food 609 within. Clamping rib/locking channel ends 806*a* and 806*b* (opposite side end 806*b* not shown) are intimately closer to retaining rib 614 first outside wall 615*a* wherein clamping rib second outside wall 804*b*/locking channel second inside wall 802*b* (opposing clamping rib second outside wall 804*b*/locking channel second inside wall 802*b* is not shown) are frictionally wedged against retaining rib 614 first outside wall 615*a* as shown in FIGS. 35, 36, 37 and 37A. Clamping rib second outside wall 804*b*/locking channel second inside wall 802*b* are not distinguishable in this cross-section. Clamping rib first outside wall 804*a*/locking channel first inside wall 802*a* (opposing side of clamping rib first outside wall 804*a* and locking channel first inside wall 802*a* are not shown) are shown parallel to second outside wall 804*b*/locking channel second inside wall 802*b* and beyond outside perimeter edge 611 of compressed outside wall 701 and are not in contact with retaining rib 614 first outside wall 615*a* as shown in FIGS. 37 and 37A. Clamping rib first outside wall 804*a*/locking channel first inside wall 802*a* are not distinguishable in this cross-section. Partially spherical indentation 812*a* (partially spherical indentation 812*b* is not shown) enshrouds opposing partially spherical protrusion 620*a* (opposing partially spherical protrusion 620*b* is not shown). A portion of clamping rib arch 805 on the inverted side of clamping rib 801, facing downwards, and locking channel 802 facing upwards, and formed from clamping rib second outside wall 804*b*, rests on outside annular exterior rim 612 thereby offering further support to retain hatch cover part 800 in a fully opened position and preventing hatch cover part 800 from pivoting below the recessed plane of recessed hatch opening 626 (solid line with double-headed arrows) formed around inside ledge perimeter edge 624.

Figure 38D:
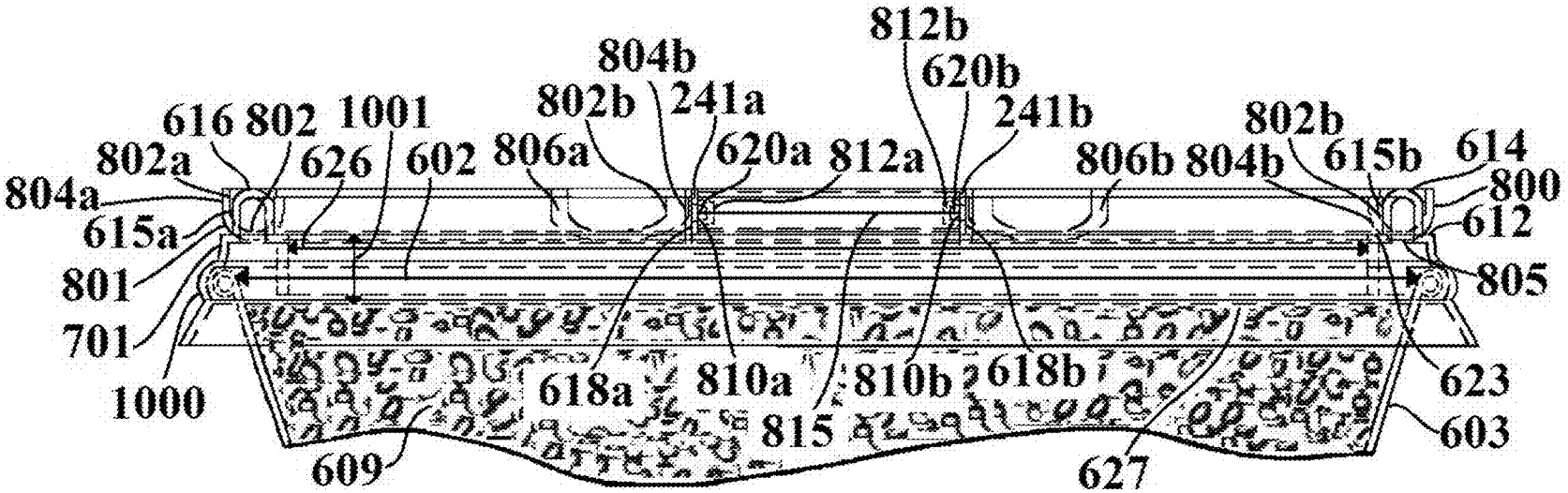
FIG. 38D is a side view in section of the flat lid configuration, mounted to the rolled rim of a food container, compressed for ease of illustration, with the hatch cover part in the fully opened position taken substantially along line R-R in FIG. 37.

FIG. 38D is a side view in section of flat lid 1000 taken substantially along line R-R in FIG. 37, with hatch cover part 800 in the fully opened position. FIG. 38D captures most of the same preferred embodiments and reference numbers described for dome lid 900 under FIG. 38B with the only variation being the introduction of compressed outside wall 701. Compressed outside wall 701 creates a reduced vertical height 1001 (solid vertical line with double-headed arrows) bringing recessed hatch opening 626 (solid line with double-headed arrows) closer to food 609 in disposable food container 603. At the right and left sides of FIG. 38D retaining rib 614 is positioned between outside annular exterior rim 612 and inside annular interior rim 623. Clamping rib 801/locking channel 802 are inverted with clamping rib 801 and clamping rib arch 805 facing downwards and locking channel 802 facing upwards and are vertically overlapping retaining rib 614 wherein clamping rib first outside wall 804*a*/locking channel first inside wall 802*a* are aligned over retaining rib 614 first outside wall 615*a*, and clamping rib second outside wall 804*b*/locking channel second inside wall 802*b* are overlapping retaining rib 614 second outside wall 615*b* respectively, with retaining rib arch 616 connecting retaining rib 614 first outside wall 615*a* and second outside wall 615*b*.

Clamping rib/locking channel open ends 806*b* and 806*a* are inverted with hatch cover part 800 in the fully opened position where clamping rib second inside wall 804*b*/locking channel second inside wall 802*b* at the severing point (defined by clamping rib/locking channel open ends 806*b* and 806*a*) of clamping rib 801/locking channel 802 are intimately close to cylinder end walls 810*a* and 810*b* with a portion of clamping rib arch 805 resting on outside annular exterior rim 612 as seen in FIG. 38A. A first space 241*a* and a second space 241*b* between end walls 618*a* and 618*b* and cylinder end walls 810*a* and 810*b* have been added to better distinguish these respective end walls, which are in fact in intimate contact utilizing their frictional contact to hold hatch cover part 800 at different intermediate opened positions between fully open and fully closed positions. Longitudinal axis line 815 (solid line) shows the concentric relationship and alignment of opposing partially spherical protrusions 620*a* and 620*b* respectively seated in partially spherical indentation 812*a* and 812*b*. The reduced vertical height 1001 (solid vertical line with double-headed arrows) shows less available vertical space between upper end opening 602 (solid line with double-headed arrows) and food surface plane 627 and recessed hatch opening 626 (solid line with double-headed arrows) to accommodate a topping 903 (see FIG. 40) when hatch cover part 800 is in the fully closed position, however, there are no restrictions accommodating a topping when hatch cover part 800 is in the fully opened position as shown in FIG. 38C for flat lid 1000.

Figure 39:
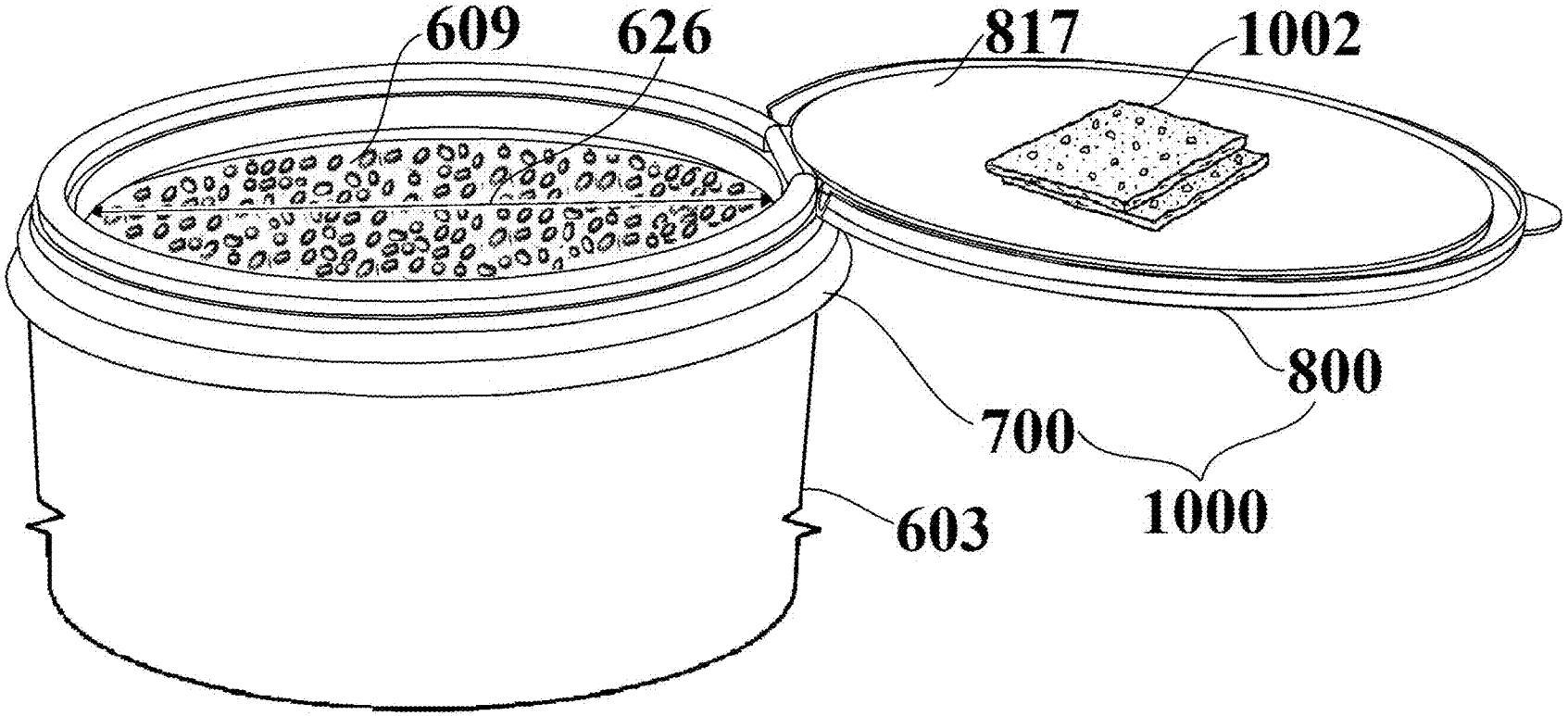
FIG. 39 is a perspective top view of the flat lid configuration, mounted to the rolled rim of a food container, compressed for ease of illustration, with the hatch cover part in the fully opened position showing food in the container and an accompanying food, crackers in this example, resting on the inverted underside bottom surface of the hatch cover part.
Figure 39A:
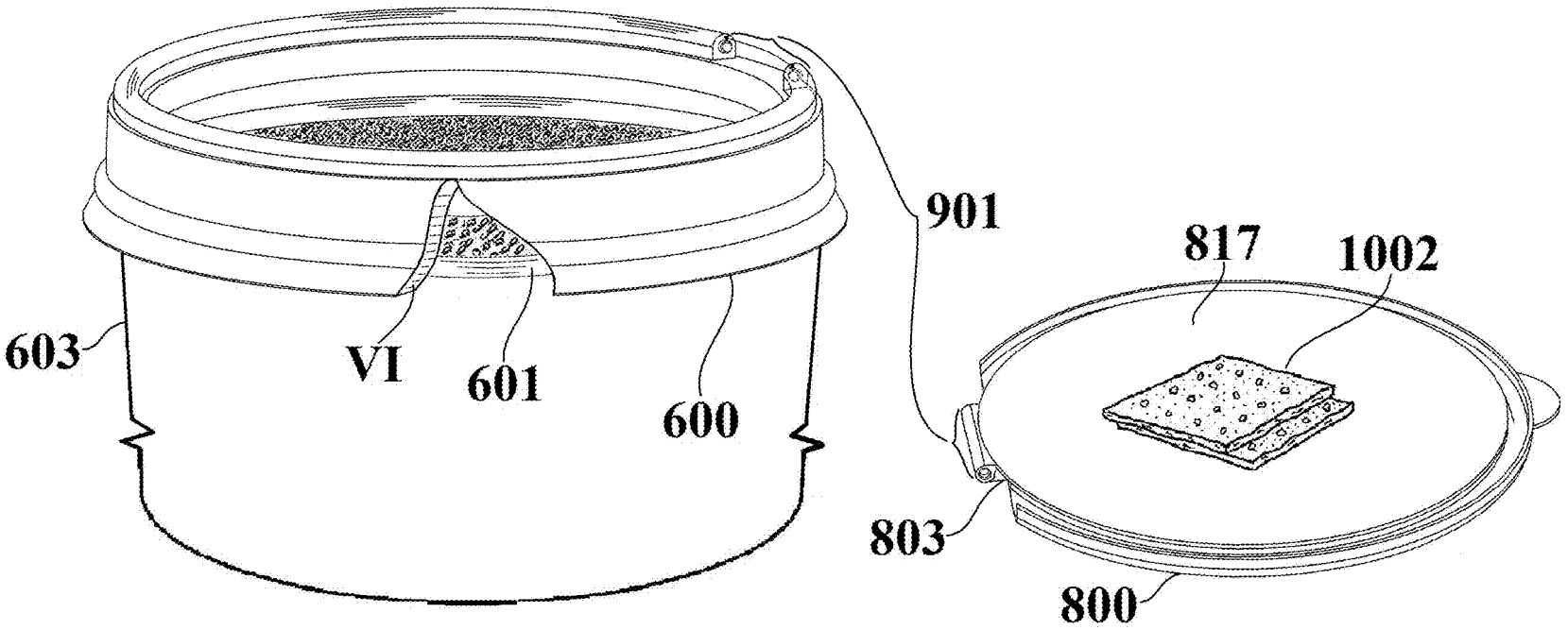
FIG. 39A is a perspective top view of dome lid configuration, mounted to the rolled rim of a food container, compressed for ease of illustration, with an accompanying food, crackers in this example, resting on the underside bottom surface of the adjacent disconnected inverted hatch cover part.

FIG. 39 is a perspective view of flat lid 1000 mounted to rolled rim 601 (see FIG. 25A) of disposable food container 603, compressed for ease of illustration, with hatch cover part 800 in the fully opened position, exposing recessed hatch opening 626 (solid line with double-headed arrows) of flat brim mount part 700. In a preferred embodiment the underside bottom surface 817 of recessed top wall 803 (not shown) of hatch cover part 800, may provide an optional resting surface to accommodate an accompanying food 1002, such as crackers and the like, optionally included with the main food 609 within disposable food container 603. Dome lid 900 offers the same preferred embodiment for optionally accommodating an accompanying food 1002 resting on underside bottom surface 817 of hatch cover part 800 in the fully opened position.

The optional use of underside bottom surface 817 of recessed top wall 803, of fully opened hatch cover part 800, provides a temporary alternative surface, other than a table top, plate, tray, lap or other surface, to optionally rest utensils, condiments, and napkins included with your grab-and-go purchase and/or an accompanying food 1002, for eating separately from the main food 609 within disposable food container 603 or for optional dunking into or adding to the top of the main food 609 within disposable food container 603 through recessed hatch opening 626 (solid line with double-headed arrows). This preferred embodiment offers a potentially more hygienic surface for supporting any adjoining items included with your purchase, wherein the underside bottom surface 817 of recessed top wall 803 of hatch cover part 800 has only been exposed to the food 609 within disposable food container 603 and avoids the need to use an unfamiliar surface or a surface previously used by other diners which may not be sanitary or has not been properly cleaned. Grab-and-go food purchases are often eaten in communal eating areas or any other convenient location on surfaces which are not subject to cleaning. Cleaning staff assigned to communal eating areas cannot keep up with the volume of movement through these areas to satisfactorily clean every eating surface in a timely matter. Often the customer is left to clean the eating surface with napkins included with the meal, and intended for personal use, and not for the purpose of cleaning a surface area to place utensils or any other adjoining items such as drinks, condiment packets, and crackers, for example, which may be included with the grab-and-go meal. Utilizing the underside bottom surface 817 of recessed top wall 803 of hatch cover part 800 as an optional support surface to rest items included with your grab-and-go purchase opens up more optional areas to eat an on-the-go food meal, both standing and sitting, in a more hygienic manner while avoiding wasting the short time available to consume your on-the-go purchase to improperly sanitize an eating surface and in the process waste napkins or wipes, intended for personal use and hygiene during and following consumption of the meal.

As previously described in FIGS. 37, 37A, and 38A to 38D, the combination of the snug interface between cylinder end walls 810*a* and 810*b*, in intimate contact with end walls 618*a* and 618*b*, together with the intimate seating of opposing partially spherical protrusions 620*a* and 620*b*, respectively, enveloped by partially spherical indentation 812*a* and 812*b*, to retain detachable hinge 901 in a fixed substantially horizontal fully opened position, together with the frictional wedging of clamping rib second outside wall 804*b*/locking channel second inside wall 802*b*, against retaining rib 614 first outside wall 615*a*, with outside annular exterior rim 612 supporting a portion of clamping rib arch 805, work together to retain hatch cover part 800 in a stable horizontal position thereby providing a stable, fixed optional platform, underside bottom surface 817 of recessed top wall 803 of hatch cover part 800 to rest accompanying foods 1002, or other products adjoining your on-the-go meal as described under FIG. 39. This variation on this new invention adopted for use with disposable food containers allows grab-and-go food purchasers to optionally experience eating on-the-go when this new two part container lid variation is employed. The optional use of the underside bottom surface 817 of hatch cover part 800 to rest adjoining items included with a grab-and-go meal purchase when the hatch cover part 800 is pivoted to a fully opened position together with the benefit of no longer having to remove the lid from the container to access the food within, reduces and/or eliminates the need of a supporting surface to manage the disposable food container and disconnected lid in order to eat from the disposable food container. The customer can now optionally eat while on-the-go with this variation of this new invention adopted for use with grab-and-go food purchases served in disposable food containers.

FIG. 39A is a perspective top view of dome brim mount part 600 mounted to the rolled rim 601 in cut-away VI of a disposable food container 603, compressed for ease of illustration, with the hatch cover part 800 portion of detachable hinge 901 disconnected from dome brim mount part 600 and resting on a flat surface, such as a table top, with underside bottom surface 817 of recessed top wall 803 (not shown) facing upwards in a horizontal position similar to that in FIG. 39 with an accompanying food 1002, in this example crackers, resting on underside bottom surface 817 of recessed top wall 803. The underside bottom surface 817 of recessed top wall 803 of disconnected hatch cover part 800 provides a suitable sanitary resting surface for any accompanying items included with the food purchase and a safe interface between such items and unclean surfaces. Separating hatch cover part 800 from dome brim mount part 600 is accomplished through a preferred embodiment of this variation on this new invention wherein each half of detachable hinge 901, respectively, on dome brim mount part 600 and flat brim mount part 700 and hatch cover part 800, are gently snap fitted into each other, and, optionally, the moulded halves may be gently disengaged with sufficient force to hatch cover part 800 due to the flexible and smooth surface properties of the thermoplastic as discussed in FIGS. 21F and 21F-1 for dome 400 and flat 500 lid configurations used on beverage containers 203 and initially discussed under FIG. 31A. The disassembling of hatch cover part 800 portion of detachable hinge 901 may be optionally rested on a table or counter top surface with recessed top wall 803 facing downwards and underside bottom surface 817 facing upwards providing an optional, more hygienic surface to rest an accompanying food 1002, such as crackers in this example and, as well, to provide a clean surface to rest a napkin, utensils or condiments and the like.

FIG. 40 is a perspective top view of the dome lid 900 with dome brim mount part 600 mounted to the rolled rim 601 (see cut-away VI) of disposable food container 603, compressed for ease of illustration, with hatch cover part 800 in the fully opened position showing food 609, such as pasta for example, filling disposable food container 603 well above the plane of recessed hatch opening 626 (solid line with double-headed arrows) and above retaining rib arch 616.

In a preferred embodiment of this variation on this new invention, dome brim mount part 600 offers additional height to accommodate filling disposable food container 603 with food 609 above rolled rim 601 and also offers the customer additional vertical height 902 (see FIG. 34A) to add toppings 903, in this example melted cheese on a topped up layer of food 904. Dome 900 and flat 1000 lid configurations accommodate toppings 903 added to food surface plane 627 (see FIG. 34A) in the same way in which beverage dome 400 and flat 500 lid configurations accommodate the addition of a whipped topping 410 to the beverage surface plane 228 (see FIG. 13) optionally served to the customer with the respective hatch cover parts 800 and 100 in a pivoted fully opened position. The additional vertical height 902 (see FIG. 38B) provided by food dome brim mount part 600 and vertical height 411 (see FIG. 11A) provided by beverage dome brim mount part 200, respectively, also allows hatch cover parts 800 and 100 to be pivoted to the fully closed position with minimal disruption to the physical appearance of these respective toppings and not compress food toppings 903 and the peak of whipped toppings 410, respectively, into food 609 or beverage 209 below. This new invention and its variation for use with disposable food containers allows the addition of toppings to the food surface plane 627 or beverage surface plane 228 to enhance the respective food 609 and beverage 209 without the topping being compressed into the respective food in the disposable food container 603 or into the respective beverage in the disposable beverage container 203 while the disposable lid remains firmly clamped to the disposable container. Although the respective toppings added to the food surface plane 627 and beverage surface plane 228 are different, this comparison again supports that dome 900 and flat 1000 lid configurations are variations on respective beverage dome 400 and flat 500 lid configurations and therefore these variations do not represent separate species, but variations within the same species.

FIG. 41A is a perspective top view of a plurality of the dome lids 900 with hatch cover part 800 in the fully closed position shown in a stacking arrangement. Gripping tab 813 front edge 818 does not extend beyond the outside diameter of outside perimeter free edge 605*a* of bottom flange 605, parts of annular skirt 604 (see FIG. 31A), allowing dome brim mount part 600 of dome lid 900 to be easily stacked one on top of the other in a stable, nested arrangement.

A preferred embodiment of this variation on this new invention adopts the grasping of the front edge 818 of gripping tab 813 by index finger 403 and thumb 404, as previously described under FIGS. 8A and 31C, respectively, to disengage the top lid from a stack of lids thereby avoiding using the index finger 403 and thumb 404 of the opposing hand 405 to retain the underlying lids in a stacking arrangement and stopping them from being lifted together with the top lid, thereby avoiding potential unhygienic practices and possible contamination through hand contact with the subsequent underlying lids. Similarly, as described earlier, a digit, or digits of either hand may lift the front edge 818 of gripping tab 813 to remove a lid from a stack of lids, leaving the underlying stack of lids intact.

FIG. 41B is a perspective top view of a plurality of flat lids 1000 with hatch part 800 in the fully closed position shown in a stacking arrangement. A preferred embodiment of flat lid 1000 is that less material may be used in manufacturing resulting in lower costs and more units being stacked and stored in the same space compared with dome lid 900. The advantages describing the use of gripping tab 813 as a more hygienic option to removing the top lid from a stack of lids described under FIG. 41A also applies to stacked flat lids 1000. Gripping tab 813 front edge 818 does not extend beyond the outside diameter of outside perimeter free edge 605*a* of bottom flange 605, thereby allowing flat brim mount part 700 of flat lid 1000 to be easily stacked in a stable, nested arrangement and to be easily retrieved, leaving the remaining stacked lids in their nested configuration.

The present invention, and variations therein, have been described in detail. However, it should be understood that the detailed descriptions and specific examples, while indicating preferred embodiments of this new invention, are given by way of illustration only, since various changes within the spirit and scope of the invention will become apparent to those skilled in the art from this detailed description.

With respect to the above description, it is to be realized that the optimum dimensional relationships for the parts of the invention, to include variations in size, materials, shape, form, function and manner of operation, configuration and use, are deemed readily apparent and obvious to one skilled in the art, and all equivalent relationships to those illustrated in the drawings and described in the specification are intended to be encompassed by the present invention and its variations described herein.

The present invention may be optionally used for both disposable beverage container/lid configurations and disposable food container/lid configurations. When adopted for disposable food container/lid configurations, dome 400 (FIG. 8A) and flat 500 (FIG. 9A) lid configurations have undergone minor changes by simply removing the unnecessary preferred embodiments, ring-shaped crown portion 210 and compressed ring-shaped crown portion 301, respectively, for use with dome 900 (FIG. 24A) and flat 1000 (FIG. 25A) lid configurations placed on disposable food containers 603 while retaining other core preferred embodiments of dome 400 and flat 500 lid configurations including the two part brim mount/hatch cover part configuration connected by a detachable hinge 401 which becomes detachable hinge 901 for dome 900 and flat 1000 lid configurations. The removal of the equivalent ring-shaped crown portion 210 and compressed ring-shaped crown portion 301, respectively, from dome 900 and flat 1000 lids, further increases the already enlarged recessed hatch opening 626. The corresponding increase in the diameter of retaining rib 614 on dome brim mount part 600 and flat brim mount part 700 to fit the larger diameter upper end opening 602 of disposable food container 603 also required a corresponding increase in the diameter of hatch cover part 100 (FIG. 1A) to form equivalent hatch cover part 800 (FIG. 29) to fit the corresponding wider diameter recessed hatch opening 626. Maximizing recessed hatch opening 626 to more efficiently accommodate access to food 609 within disposable food container 603, for such purposes including, but not limited to, using a utensil to retrieve food, adding toppings and condiments, dunking accompanying foods, or cooling hot food to a preferable temperature for consumption. As mentioned herein, dome 900 and flat 1000 lids for disposable food containers 603 are a variation on dome 400 and flat 500 lid configurations for beverage 209 filled disposable containers 203 and, as such, dome 900 and flat 1000 lids do not represent two separate distinct species compared with beverage dome 400 and flat 500 lid configurations, but are variations of the same species.

Therefore, the foregoing is considered as illustrative only of the principles of the present invention. Further, since numerous variations will be readily apparent to those skilled in the art, it is not desired to limit the invention to the exact construction and operation shown and described, and accordingly, all suitable variations and equivalents may be resorted too provided they fall within the scope of this invention.

It is further noted that different preferred embodiments illustrated are not foreign but merely applied in a different manner as defined by this invention. Grab-and-go beverage customers are familiar with a variety of beverage and food containment formats both of a disposable and a reusable configuration for lids and containers such that while those illustrated above may seem complex, the use of ribs and channels for retaining hatch cover part 100 to dome 200 and flat 300 brim mount parts and hatch cover part 800 to dome 600 and flat 700 brim mount parts, in the fully closed position have been adopted and used in different applications and suitably modified accordingly to become preferred embodiments of this new invention. Similarly, the use of ribs and channels for retaining respective dome 200 and flat 300 brim mount parts to the rolled rims 201 of beverage containers 203, and respective dome 600 and flat 700 brim mount parts to the rolled rim 601 of food containers 603, have been adopted and used in different applications and suitably modified accordingly to become preferred embodiments of this new invention. As well, detachable hinge configurations have been used in different applications to connect two components such that they articulate and pivot about a common axis as those encountered for jewel cases and have been similarly adopted for use on this new invention to connect the respective hatch cover parts to the respective brim mount parts.

As to a further discussion of the manner of usage and operation of the present invention, the same should be apparent from the above description. Accordingly, no further discussion relating to the manner of usage and operation will be provided.

This new invention introduces a moulded disposable or reusable container lid comprising a brim mount part with a recessed hatch opening and a realisable hatch cover part sized to fit over this hatch opening, and connected together by a detachable hinge configuration in which the partially spherical indentation 812*a* female hinge part is a separately injection moulded extension of one section and a substantially partially spherical protrusions male hinge part is a separately injection moulded extension of the other section, and the male and female hinge part are in operative engagement with each other such that the hatch cover part pivots between a fully closed and a fully opened position providing access to the hatch opening and the contents within the container without the necessity of removing the brim mount part from the rolled rim of the container to access the contents within the container.

I claim:

1. A two part container lid for accessing a beverage within a container including a brim mount part with a hatch opening in a top portion and a hatch cover part, sized and shaped to fit over said hatch opening, said brim mount part and said hatch cover part are separately constructed and joined by a detachable hinge, said two part container lid further comprising, in combination:

wherein said detachable hinge allows said hatch cover part to be easily detached from, and reattached to, said brim mount part;

an annular skirt circumferentially disposed at a lower portion of said brim mount part and aligned to reversibly attach to a rolled rim of said container;

wherein said annular skirt further comprises a clamping curvature outwardly disposed radially therefrom an upper end of said annular skirt with an interior sealing curvature therein, said interior sealing curvature is radially directed in a reversible sealingly engaged clamped relationship to said rolled rim, thereby retaining said two part container lid attached to said container; and whereby a bottom flange is outwardly disposed at a downward angle from the bottom of said clamping curvature with an outside perimeter free edge disposed therefrom;

a ring-shaped crown portion, integral to an upper end of said annular skirt, forms an elevated raised and planar region;

wherein a first outside wall depends at an upward angle from the upper end of said clamping curvature to a planar top transition surface depending inwardly and terminating at the top of a second outside wall, said second outside wall disposed at a downward angle thus terminating on one side of a trough at a trough base;

a first drinking access port is centrally die-cut through said planar top transition surface of said ring-shaped crown portion along a central line across said top portion of said brim mount part;

a second drinking access port is centrally die cut through said planar top transition surface diametrically opposite said first drinking access port;

a retaining rib is formed around the perimeter of said ring-shaped crown portion therein;

whereby said retaining rib is constructed in the form of an archway with a first outside wall upwardly disposed from said trough base to an arch, thus forming the opposite side of said trough and wherein a second outside wall, equal in height to said first outside wall, is downwardly disposed on the opposite side of said arch terminating therein;

whereby a segment of said retaining rib is symmetrically severed at two opposing positions and removed therefrom, thereby further defining said retaining rib as partially annular, wherein each severed position is closed with an end wall, thus forming a first gap between said closed end walls therein; and wherein a partially spherical protrusion is outwardly disposed therefrom a surface of said end wall, forming a male hinge part of said detachable hinge therein;

an annular interior rim is disposed concentrically around the base of said second outside wall of said retaining rib;

a ring-shaped wall is downwardly disposed from a perimeter edge of said annular interior rim thus forming an anti-splash/spill apron around the perimeter of said hatch opening, said ring-shaped wall necessarily extending into said container terminating at a free edge disposed below said rolled rim of said container thereby breaking a surface of said beverage disposed therein to an upper end of said container;

wherein said anti-splash/spill apron delineates said hatch opening, comprising a first recessed lowered and planar region therein said top portion of said brim mount part, said brim mount part having more than one top portion, one of which delineates said hatch opening, of sufficient diameter thereby capable of providing unobstructed access to said beverage within said container when said hatch cover part is pivoted to a fully opened position;

wherein said ring-shaped wall of said anti-splash/spill apron extending through said surface of said beverage thus partitions an upper portion of said beverage disposed at said upper end of said container, into an interior area within said hatch opening circumscribed by said ring-shaped wall and an exterior area between said ring-shaped wall and an inside wall surface of said container;

a clamping rib, with a locking channel therein, is disposed around a perimeter edge of a top wall of said hatch cover part;

wherein said clamping rib is constructed in the form of an archway with a first outside wall upwardly disposed from a free edge to an arch and a second outside wall, of equal height to said first outside wall, downwardly disposed on the opposite side of said arch terminating contiguous around said perimeter edge of a top wall of said hatch cover part therein;

wherein a segment of said clamping rib is symmetrically severed at two opposing positions and removed therefrom, further defining said clamping rib as partially annular therein, and thus forming an open end on each severed position with a second gap between said open ends and wherein said second gap has a greater arc length than the arc length of said first gap formed between said end walls of said retaining rib; and wherein said top wall forms a second recessed lowered and planar region therein said hatch cover part and disposed in a coplanar relationship with said first recessed lowered and planar region of said hatch opening when said hatch cover part is pivoted to said fully closed position;

a cylindrical housing, equal in length to said first gap between said end walls of said retaining rib of said brim mount part, is comprised of a rectangular base upwardly disposed from said top wall of said hatch cover part with a cylinder of equal length to said rectangular base, upwardly disposed from a top surface of said rectangular base and aligned along the length therein, said cylindrical housing positioned along a central line across said top wall of said hatch cover part positioned within said second gap with said rectangular base partially overlapping said perimeter edge of said top wall;

wherein a partially spherical indentation is centrally recessed on a surface of a cylinder end wall at opposing ends of said cylinder thus forming a female hinge part of said detachable hinge;

wherein said female hinge part is designed to snap fit over said male hinge part thus forming said detachable hinge and joining said hatch cover part to said top portion of said brim mount part; and wherein said female hinge part and said male hinge part are in intimate frictional contact after said snap fit to form said detachable hinge, thereby restricting said hatch cover part from swinging freely between said fully closed and said fully opened positions over said hatch opening;

a gripping tab is joined at one end to said arch of said clamping rib and outwardly disposed therefrom, diametrically opposite said first drinking access port, forming a curvilinear perimeter edge extending beyond said first outside wall of said ring-shaped crown portion;

wherein finger gripping and lifting of said gripping tab necessitates the pivoting of said hatch cover part between said fully closed and said fully opened positions and an intermediate opened position between said fully closed and said fully opened position of which there are a multitude of intermediate positions, of which one intermediate position is selected, thereby retaining said hatch cover part at said fully closed or said fully opened position or said selected intermediate position and wherein said fingers are released from said gripping tab, thus retaining said pivoted hatch cover part at said selected position in a hands free manner.

2. The two part container lid in claim 1, wherein said brim mount part and said hatch cover part are separately constructed from at least one of a resilient material capable of springing back into shape after flexing and bending and with characteristic smooth surface properties therein promoting slidability when like parts are in contact with each other thereby supporting easy detachment and re-attachment to each other.

3. The two part container lid in claim 1, wherein said hatch cover part snap fitted onto said brim mount part thereby bringing said partially spherical protrusions and said partially spherical indentations, each with equal radii, into alignment, whereby said partially spherical indentations enshroud said partially spherical protrusions in a frictional mated relationship forming said detachable hinge;

wherein said detachable hinge forms a pivoting hinge axis parallel to said top portion of said brim mount part, said top portion having a multitude of axes, one of which is parallel, thus capable of pivoting said hatch cover part between said fully closed position and said fully opened position, and said intermediate opened position, of which there are a multitude of said intermediate opened positions between said closed and said fully opened positions, of which one said intermediate opened position is selected; and whereby said detachable hinge provides sufficient holding power capable of rotation while restricting lateral movement and constraining said hatch cover part to said top portion of said brim mount part.

4. The two part container lid in claim 3, wherein said frictional mated relationship between said hatch cover part and said brim mount part is capable of retaining said hatch cover part in said selected intermediate opened position in a hands free manner.

5. The two part container lid in claim 4, wherein said hatch cover part pivoted to one of said multitude of intermediate opened positions therein, thus controls the available space above said hatch opening, and thereby permits control of the rate and degree of steam and heat escaping from said beverage within said container;

whereby said control of said volume of said steam and heat escaping from said hatch opening thereby permits control of the rate and degree of cooling of said beverage, and thus allows for customizing the temperature at which said beverage is consumed; and wherein the rate and degree of cooling of said beverage thus permits control of the addition of a cooling agent, thereby retaining the original flavour and aroma therein said beverage throughout the duration of consumption of said beverage.

6. The two part container lid in claim 3, whereby said hatch cover part is detached from said detachable hinge and oriented with an underside bottom surface facing upwards and said top wall facing downward on top of a surface, of which there are a multitude of surfaces, of which one surface is selected, thus forming a detachable support resting on top of said selected surface;

whereby said underside bottom surface of said detachable support is capable of providing a substantially clean surface upon which an item is rested on said detachable support.

7. The two part container lid in claim 6, wherein said hatch cover part is detached from said brim mount part thus retaining said brim mount part clamped to said rolled rim of said container;

wherein said brim mount part partially covers said upper end opening of said container, whereby said first and said second drinking access ports are both continuously accessible to communicate with said beverage within said container; and whereby said brim mount part provides continuous uncovered access to said hatch opening and said beverage within said container.

8. The two part container lid in claim 1, wherein said gripping tab permits gripping of said hatch cover part between fingers and lifting upwards, thus pivoting said hatch cover part between said fully open and said fully closed positions and said multitude of intermediate opened positions therein, whereby said gripping tab covers said second drinking access port when said hatch cover part is pivoted to said fully closed position;

wherein the covering of said second drinking access port by said gripping tab does not provide an air tight seal, thus enabling air flow to promote the flow of said beverage through said first drinking access port and preventing air from entering the container through the same first drinking access port where said beverage is exiting thereby reducing bubbling and back splash leading to burns through said first drinking access port when drinking through said first drinking access port by allowing steam to escape through said second drinking access port; and whereby said hatch cover part covers said first drinking access port when said gripping tab pivots said hatch cover part to said fully opened position, thus providing drinking access through said second drinking access port and exposing said hatch opening to promote beverage flow through said second drinking access port and the escape of steam through said fully opened hatch opening thus reducing bubbling and back splash through the same second drinking access port where said beverage is exiting therefrom.

9. The two part container lid in claim 8, wherein drinking said beverage from said second drinking access port exposes said hatch opening and is capable of allowing a nose to be positioned over said hatch opening;

wherein said hatch opening is capable of maximizing the release of aroma from said beverage; and whereby a person drinking from said second drinking access port is capable of tasting said beverage and smelling the aroma of said beverage at the same time, thus enhancing consumption of said beverage.

10. The two part container lid in claim 1, wherein said bottom flange and said outside free edge of said annular skirt are positioned over said rolled rim forming a combined pilot guide diameter unit guiding said annular skirt onto said rolled rim with said bottom flange capable of being in an unstressed condition when guiding said annular skirt onto said rolled rim;

whereby a downward finger pressing force exerted on said top portion of said brim mount part flexes said bottom flange outwards guiding and urging said interior sealing curvature in a reversible frictional clamping fitment mating over said rolled rim; and whereby release of said downward finger pressing force returns said bottom flange and said interior sealing curvature to their original unstressed positions, thereby providing a seal between said rolled rim and said annular skirt, designed to non-permanently retain said brim mount part to said rolled rim of said container and thus capable of preventing leaking of said beverage from an interface between said rolled rim and said annular skirt.

11. The two part container lid in claim 1, whereby said hatch cover part pivoted to said fully opened position, is capable of providing the broadest unobstructed access to said beverage within said container through said hatch opening;

wherein said beverage is accessed without necessitating the removal of said two part container lid from said rolled rim of said container; and whereby access to said beverage through said hatch opening is capable of reducing accidents arising when a container lid is unclamped from said container to access said beverage within said container.

12. The two part container lid in claim 1, wherein said beverage within said container is delivered to said container through said hatch opening when said hatch cover part is pivoted to said fully opened position;

whereby said beverage delivered to said container though said hatch opening is capable of eliminating spills arising when a lid is clamped to said container after said container has received said beverage.

13. The two part container lid in claim 1, wherein said partitioning of said interior area within said ring-shaped wall of said anti-splash/spill apron and said exterior area between said ring-shaped wall of said anti-splash/spill apron and said inside wall surface of said container dampens side-to-side sloshing caused by wave-action necessarily caused when handling said container, thus reducing said beverage from splashing upwards through said hatch opening and through said first or said second drinking access ports;

wherein said ring-shaped wall partitions the volume of said beverage delivered when said container is tilted to communicate said beverage to said first or said second drinking access ports, thus controlling the delivery of said beverage and limiting burns by reducing the volume of said beverage arriving all at once to said first or said second drinking access port.

14. The two part container lid in claim 1, wherein a whipped topping is added to said surface of said beverage through said hatch opening when said hatch cover part is pivoted to said fully opened position;

wherein said ring-shaped wall of said anti-splash/spill apron partitions said whipped topping within said interior area inside said ring-shaped wall; and whereby said whipped topping positioned on said surface of said beverage is capable of building a mound of said whipped topping rising upwards in an unobstructed manner from said surface of said beverage through said hatch opening.

15. The two part container lid in claim 1, whereby said hatch cover part, in said fully closed position, seals said hatch opening, reversibly and non-permanently;

whereby said downward finger pressing force exerted on said top wall of said hatch cover part and said arch of said clamping rib when pivoting said hatch cover part to said fully closed position, thus deforms said clamping rib, flexing it outwardly to matingly fit said locking channel therein, thus forming a seated closing abutment over said retaining rib, such that release of said downward finger pressing force permits said clamping rib to spring back to its original, unstressed position, thereby frictionally clamping said hatch cover part over said hatch opening; and wherein said perimeter edge, on an underside of said top wall of said hatch cover part, is in intimate contact with a top surface of said annular interior rim, wherein said annular interior rim provides support to said hatch cover part when said hatch cover part is in said fully closed position over said hatch opening.

16. The two part container lid in claim 1, whereby said trough collects said beverage splashed upwards through said hatch opening or said first or said second drinking access ports when said hatch cover part is in said fully opened or in said intermediate position;

whereby said beverage is returned into said container by flowing over top of a planar transition panel and down said apron then through said hatch opening.

* * * * *